US005265855A

United States Patent [19]

Kimura et al.

[11] Patent Number: 5,265,855

[45] Date of Patent: Nov. 30, 1993

[54] COPIER WITH DOCUMENT SUPPORT MOVING MEANS

[75] Inventors: Yoshiyuki Kimura, Tokyo; Kouji Ishigaki; Fumio Kishi, both of Yokohama, all of Japan

[73] Assignee: Ricoh Company, Ltd., Tokyo, Japan

[21] Appl. No.: 686,351

[22] Filed: Apr. 17, 1991

[30] Foreign Application Priority Data

| | | | |
|---|---|---|---|
| Apr. 17, 1990 | [JP] | Japan | 2-99302 |
| May 8, 1990 | [JP] | Japan | 2-116951 |
| May 3, 1990 | [JP] | Japan | 2-116953 |

[51] Int. Cl.[5] ..... B65H 39/11

[52] U.S. Cl. ..... 270/53; 270/58; 271/293; 271/294

[58] Field of Search ..... 270/52, 53, 58, 37; 271/287, 292, 293, 294

[56] References Cited

U.S. PATENT DOCUMENTS

| | | | |
|---|---|---|---|
| 4,083,550 | 4/1978 | Pal | 270/53 |
| 4,433,837 | 2/1984 | Romanowski | 271/293 |
| 4,925,171 | 5/1990 | Kramer | 270/53 |
| 4,928,941 | 5/1990 | Uto | 270/53 |
| 5,035,412 | 7/1991 | Hiroi et al. | 271/292 X |
| 5,048,820 | 9/1991 | Chung et al. | 271/293 |
| 5,050,860 | 9/1991 | Matsuo et al. | 271/293 |
| 5,087,029 | 2/1992 | Sugishima | 271/294 X |
| 5,088,709 | 2/1992 | Yamamoto | 270/52 |
| 5,090,688 | 2/1992 | Sasaki | 271/293 |
| 5,099,292 | 3/1992 | Hirose | 270/53 |
| 5,125,634 | 6/1992 | Lawrence | 270/52 X |
| 5,131,642 | 7/1992 | Yamamoto et al. | 270/52 X |
| 5,141,215 | 8/1992 | Ishiguro et al. | 271/287 X |

FOREIGN PATENT DOCUMENTS

| | | | |
|---|---|---|---|
| 301596 | 2/1989 | European Pat. Off. | 270/53 |
| 195065 | 11/1982 | Japan | 271/287 |
| 212673 | 9/1988 | Japan | 270/52 |
| 48779 | 2/1989 | Japan | 270/52 |
| 53988 | 3/1989 | Japan | 270/52 |
| 92173 | 4/1989 | Japan | 270/58 |
| 64971 | 5/1989 | Japan | 270/58 |

*Primary Examiner*—Edward K. Look
*Assistant Examiner*—John Ryznic
*Attorney, Agent, or Firm*—Oblon, Spivak, McClelland, Maier & Neustadt

[57] ABSTRACT

A document feeder for feeding a plurality of different kinds of document to image forming equipment automatically, and a sheet finisher for sorting, stapling or otherwise finishing sheets inclusive of the documents. A drive source selectively drives a document support moving member in opposite directions to move document supports from an initial position to a document feed position and further to a stand-by position. This allows a particular document feeding operation to be effected with each of the document supports. Sheets are automatically stapled and then automatically removed from sheet accommodating members. A sheet receiving section collects such stapled and removed sheets.

6 Claims, 146 Drawing Sheets

Fig. 55

| ORDER OF RESERVED JOBS | RESERVED MODE (SET MODE) | | BIN TO USE | BINS TO HOLD SHEETS | ORDER OF JOB EXECUTION |
|---|---|---|---|---|---|
| 1 | 5 SETS TO STAPLE DOCUMENT | STAPLE | 5 | 0 | 1 |
| 2 | 8 SETS TO SORT DOCUMENT | SORT BIN | 8 1 | 9 | 2 |
| 3 | 5 SETS TO STAPLE DOCUMENT | STAPLE | 5 | 0 | 3 |
| 4 | 15 SETS TO SORT DOCUMENT | SHIFT TRAY | 15 | 15 | 5 |
| 5 | 10 SETS TO STAPLE DOCUMENT | SHIFT TRAY | 10 | 0 | 4 |
| 6 | 15 SETS TO SORT DOCUMENT | SORT BIN | 15 +1 | 16 | 8 |
| 7 | 15 SETS TO SORT DOCUMENT | SORT BIN | 15 +1 | 16 | 6 |
| 8 | 20 SETS TO STAPLE DOCUMENT | SHIFT TRAY | 20 | 0 | 9 |
| 9 | 10 SETS TO STAPLE DOCUMENT | STAPLE | 10 | 0 | 7 |
| 10 | 5 SETS TO SORT DOCUMENT | SORT BIN | 5 +1 | 6 | 10 |

Fig. 56

| | | | | | | | | | | | |
|---|---|---|---|---|---|---|---|---|---|---|---|
| FPM 1 L/H | 1 | 2 | 3 | 4 | 4 | 6 | 6 | 7 | 9 | 10 | — |
| FPM 2 L/H | 2 | 3 | 4 | 5 | 6 | 7 | 7 | 9 | 10 | — | — |
| FPM 3 L/H | 3 | 4 | 5 | 6 | 7 | 8 | 9 | 10 | — | — | — |
| FPM 4 L/H | 4 | 5 | 6 | 7 | 8 | 9 | 10 | — | — | — | — |
| FPM 5 L/H | 5 | 6 | 7 | 8 | 9 | 10 | — | — | — | — | — |
| JOB NOS. TO EXECUTE | 1 | 2 | 3 | 5 | 4 | 8 | 6 | 9 | 7 | 10 | — |

| Fig. 57A |
| --- |
| Fig. 57B |
| Fig. 57C |

Fig. 76

DATA FORMAT ((RECEIVED COPY MODE DATA))

| | | | | | | | |
|---|---|---|---|---|---|---|---|
| 0 | 0 | 0 | 0 | :DUMMY | | | |
| 0 | 0 | 0 | 1 | :1ST BIN FEED H.P. | | | |
| 0 | 0 | 1 | 0 | :2ND BIN FEED H.P | | | |
| 0 | 0 | 1 | 1 | :3RD BIN FEED H.P | | | |
| 0 | 1 | 0 | 0 | :4TH BIN FEED H.P | | | |
| 0 | 1 | 0 | 1 | :5TH BIN FEED H.P | | | |
| 0 | 1 | 1 | 0 | DESTINATION DATA :SHIFT TRAY FACE UP | (①' | SWITCH | ②-20 |
| 0 | 1 | 1 | 1 | DESTINATION DATA :SHIFT TRAY FACE DOWN | (① | | ② |
| 1 | 0 | 0 | 0 | DESTINATION DATA :SORT BIN FACE UP | (① | | ① |
| 1 | 0 | 0 | 1 | DESTINATION DATA :SORT BIN FACE DOWN | (①' | | ① |
| 1 | 0 | 1 | 0 | DESTINATION DATA : DF TOP | (③ | | – |
| 1 | 0 | 1 | 1 | | | | |
| 1 | 1 | 0 | 0 | | | | |
| 1 | 1 | 0 | 1 | | | | |
| 1 | 1 | 1 | 0 | | | | |
| 1 | 1 | 1 | 1 | :RESERVE MODE INHIBITED | | | |

Fig. 77

| | |
|---|---|
| 0 0 0 | DUMMY |
| 0 0 1 | DOCUMENT → PROOF TRAY ② |
| 0 1 0 | DOCUMENT → STAPLE TRAY ① |
| 0 1 1 | PAPER → PROOF TRAY ④ |
| 1 0 0 | PAPER → STAPLE TRAY ③ (SORT MODE) |
| 1 0 1 | PAPER → ③ (STACK MODE) |
| 1 1 0 | TO STACK TRAY AFTER STAPLING |
| 1 1 1 | |

Fig. 86

| | MODE 1 | MODE 2 | MODE 3 | |
|---|---|---|---|---|
| DOCUMENT:M ($M \leq 20$) | DOCUMENT TO DOCUMENT STACK TRAY, STAPLE AFTER COPY (ONLY SAME SIZE) | DOCUMENT TO DOCUMENT STACK TRAY, SORT TO EMPTY BIN AFTER COPY | DOCUMENT TO DOCUMENT STACK TRAY, SORT TO SAME BIN AFTER COPY | |
| COPY: n ($n \leq 20$) | STAPLE N SETS EACH HAVING M SHEETS | *1 $\left(\frac{n}{M}\right) \leq 19$ SORT N SETS EACH HAVING M SHEETS | SORT N SETS EACH HAVING M SHEETS STACK M SETS EACH HAVING N SHEETS | |
| | SORT ORIGINAL TO DESIRED BIN EXCEPT FOR COMBINATION OF A3 & A4, A4 & A5, A4 & A5, ETC. | *1 TO MODE 3 WHEN $\left(\frac{M}{n}\right) = 20$ NON-STAPLE MODE MAY BE INHIBITED IN RESERVE MODE (TO ALLOW OTHER JOBS TO BE EXECUTED) | | |

START
S89-1
SET INITIALIZE REQUEST FLAG?
Y
N
RET
S89-2
STAPLE HP ON ?
Y
N
S89-3
SET STAPLE HOME REQUEST FLAG
S89-4
JOGGER READY FLAG SET ?
Y
N
S89-5
SET JOGGER HOME RETURN FLAG
1
S89-14
DOCUMENT INGRESS SENSE 1 & 2 ON ?
Y
N
S89-16
SET DOCUMENT JAM FLAG
S89-15
CLEAR DOCUMENT JAM FLAG
S89-17
RELEASE SENSOR ?
Y
N
S89-19
SET RELEASE JAM FLAG
S89-18
CLEAR RELEASE JAM FLAG

START
S90-1
TIMER 2 COUNTED UP ?
S90-2
JOGGING FLAG SET ?
S90-3
JOGGER HONE RETURN FLAG SET ?
S90-4
DECODE DATA SENT FROM COPIER
RECEIVED MODE DATA 2 OR 4 ?
S90-5
Y
N
1
2
3
4
6
S90-46
MEMORY & JOGGING COUNTER COMPARE EQUAL ?
S90-47
TURN OFF JOGGER MOTOR
S90-48
CLEAR JOGGER FORWARD FLAG
S90-49
CLEAR JOGGER REVERSE FLAG
S90-50
TIMER 2 STARTED ?
S90-51
START TIMER 2
S90-52
SET DISCHARGE OK FLAG
RET

START
S94-1
INITIALIZE REQUEST FLAG SET ?
Y
N
S94-2
SET WHEEL HOME REQUEST FLAG
S94-3
COPY TRANSPORT JAM FLAG SET ?
Y
N
S94-4
DOCUMENT JAM FLAG SET ?
Y
N
S94-5
SWITCHING WHEEL INITIALIZE
RET
S94-6
DECODE DATA SENT FROM COPIER
S94-7
RECEIVED MODE DATA = 0 ?
Y
N
S94-8
RECEIVED MODE DATA ≤ 5 ?
Y
N
RET
S94-9
SET MODE UNDER-WAY FLAG
S94-10
WHEEL ROTATING ?
Y
N

Fig. 95

| NEW POSITION OF WHEEL / CURRENT POSITION DATA OF WHEEL | [a] | [b] | [c] | [d] |
|---|---|---|---|---|
| [a] DRIVE PULSE COUNTER | 0 pls | +180 pls | +45 pls | −90 pls |
| [b] "225" | + 180 pls | 0 pls | −135 pls | +90 pls |
| [c] "0" | − 45 pls | +135 pls | 0 pls | −135 pls |
| [d] "135" | +90 pls | −90 pls | +135 pls | 0 pls |

+ : FORWARD

− : REVERSE

| |
|---|
| Fig. 98A |
| Fig. 98B |

START
S121-1
DISCHARGE TO DOCUMENT STACK TRAY ?
N
Y
RET
S121-2
TURN ON SWITCHING MOTOR TO SET AT HOME POSITION
S121-3
INGRESS SENSOR 1 ON ?
N
Y
S121-4
TURN OFF SWITCHING SOL
S121-5
TIMER 2 STARTED ?
N
Y
1
2
S121-6
TIMER 2 COUNTED UP ?
N
Y
3
S121-15
TIMER 1 STARTED ?
N
Y
S121-16
START TIMER 1
RET
S121-17
TIMER 1 COUNTED UP ?
N
Y
S121-18
STOP & RESET TIMERS 1 & 2
S121-19
SET DISCHARGE JAM FLAG

4
S121-12
SEND FLAG TO COPIER
TO JAM PROCESS ROUTINE
S121-9
INGRESS SENSE 2 ON
S121-13
Y
N
STOP & RESET TIMER 2
S121-14
TURN OFF BOTTOM PLATE SOL., START TIMER 3
RET

1
S121-7
STOP & RESET TIMER 1
START TIMER 2
S121-8
2

3
S121-10
STOP & RESET TIMER 2
SET REVERSE JAM FLAG
S121-11
4

START
S122-1
POSITIONING ROLLER SOL ON ?
Y
N
S122-2
0.3 SEC TIMER COUNTED UP ?
Y
N
S122-3
STOP & RESET 0.3 SEC TIMER
TURN OFF POSITIONING ROLLER SOL
S122-4
RET
S122-5
TIMER 3 ON ?
N
Y
1
1
S122-12
0.2 SEC TIMER ON ?
Y
N
S122-13
0.2 SEC TIMER COUNTED UP ?
Y
N
S122-14
CLEAR STOP & RESET 0.2 SEC TIMER
S122-15
START 0.3 SEC TIMER
S122-16
TURN ON POSITIONING ROLLER SOL
RET

COPIER WITH DOCUMENT SUPPORT MOVING MEANS

BACKGROUND OF THE INVENTION

The present invention relates to a printer, copier, facsimile apparatus, laser printer or similar image forming equipment and, more particularly, to a document feeder for feeding a plurality of kinds of documents to such equipment automatically and a finisher for sorting, stapling or otherwise finishing sheets on which images have been formed.

Image forming equipment of the kind described has to feed and process documents automatically in order to increase production efficiency. Especially, there is an increasing demand for versatile document handling functions, and a document feeder itself is becoming more complicated. Document feeders available today include one which has a single document tray and can feed a plurality of sets of documents to image forming equipment automatically if a special sheet is inserted between adjoining sets of documents. However, inserting such a sheet between each adjoining sets of documents is time- and labor-consuming. Using the extra sheet as a job sheet needs more time and labor and, moreover, prevents documents of different sizes from being positioned with accuracy. Japanese Patent Laid-Open Publication No. 252564/1986 discloses an apparatus which has a plurality of document trays and moves them to a document feeder one at a time by use of a spiral cam. Japanese Patent Laid-Open Publication No. 82249/1988 teaches an arrangement in which a group of document trays are moved to a document feed position by a pinion and rack device and brings documents to a feed position by using the inclination of the trays and stops. The problem with these schemes is that the spiral cam or the pinion and rack device has to be accompanied by complicated means for moving the document trays, resulting in poor productivity and reliability.

Conventional finishers for finishing sheets include a sorter and a stacker each having multiple bins and located downstream of, for example, a fixing unit of a copier with respect to an intended direction of sheet transport. When a sort mode is selected, the sorter stacks processed sheets, or copies, in order of page. In a stack mode operation, the stacker stacks copies page by page. A more advanced finisher has a stapler for stapling each sorted or stacked set of sheets automatically. This type of finisher, or sorter/stapler, may be so constructed as to sort sheets into multiple bins arranged one above another and staple the sheets stacked in each bin by a stapler which is movable relative to the bins. This kind of construction, however, has a problem that when the number of bins loaded with stapled sets of sheets is great, it takes a substantial period of time to bring the stapled sheets out of the such bins, noticeably reducing the efficiency of copying operations or image forming operations. In addition, productivity in the copying or image forming aspect is critically lowered since the next copying procedure cannot be started unless all the sheets ar removed from the bins. Another conventional sorter/stapler has sheet gripping means for gripping a set of sheets sorted into a bin and moving it from the bin to a stapling position where a stapler is located, as disclosed in Japanese Patent Laid-Open Publication No. 158465/1985. While the sheet gripping means is essential in such a sorter/stapler because the bins and the stapler are remote from each other, it makes the whole apparatus complicated and bulky. Further, a set of sheets sorted into a bin may be shifted to a staple tray, stapled on the staple tray, and then dropped into a stacker by gravity, as taught in Japanese Patent Laid-Open Publication No. 41363/1988. However, moving such sorted sets of sheets to the staple tray one by one is undesirable from the productivity standpoint. Moreover, the apparatus is complicated and bulky because the bin section and the staple section are independent of each other.

SUMMARY OF THE INVENTION

It is therefore an object of the present invention to provide a document feeder for image forming equipment which is simple in construction and insures high productivity and reliability.

It is another object of the present invention to provide a sheet finisher for image forming equipment which is highly productive and small size.

In accordance with the present invention, a device for feeding a document to a predetermined position automatically comprises a plurality of document supports, a feeding mechanism for feeding the document, a document support moving member for moving the plurality of document supports sequentially and intermittently, a drive source for driving the document support moving member, a guide arrangement for guiding in a predetermined direction the document supports being moved by the document support moving member, and a switching mechanism for switching a direction in which the document supports are moved along the guide means.

Also, in accordance with the present invention, a device for feeding a document to a predetermined position automatically comprises a plurality of document supports, a feeding mechanism for feeding the document, a document support moving member for moving the plurality of document supports sequentially and intermittently, a drive source for driving the document support moving mechanism, and a moving mechanism for causing the drive source to drive the document support moving member in one direction to thereby move the document supports from an initial position to a predetermined position, then to drive the document support moving member in the other direction to move the document supports to a document feed position, and to drive, after the feeding mechanism has fed documents, the document support moving member in the above-mentioned one direction to move the document supports to a stand-by position.

Further, in accordance with the present invention, a sheet finishing device comprises a plurality of sheet accommodating members arranged one above another for accommodating a plurality of sheets each, a sorting arrangement for sorting sheets to the plurality of sheet accommodating members, a stapler for stapling sheets accommodated in the plurality of sheet accommodating members, and a sheet removing mechanism for removing sheets stapled by the stapler in the plurality of sheet accommodating members.

BRIEF DESCRIPTION OF THE DRAWINGS

The above and other objects, features and advantages of the present invention will become more apparent from the following detailed description taken with the accompanying drawings in which:

FIG. 55 shows a relation between the reservation and execution of jobs in a reserve mode;

FIG. 56 shows how jobs are shifted;

FIG. 66A, 66B and 66C is a flowchart showing a procedure associated with keys;

FIG. 76 shows the format of received copy mode data;

FIG. 77 shows mode data sent from the copier body to the finisher;

FIG. 86 lists specific modes relating to the processing of documents and paper sheets;

FIG. 95 shows a data table associated with a drive pulse counter;

DESCRIPTION OF THE PREFERRED EMBODIMENT

A preferred embodiment of the present invention will be described with reference to the accompanying drawings. The following description will proceed by using the following items and subitems for clarity:

1. General Construction
2. Document Transport
   - 2.1 Multi-Step ADF
   - 2.2 Document Transport Unit
   - 2.3 Document Reverse Section
   - 2.4 Document Stack Section
   - 2.5 Document Stack Tray Section
   - 2.6 Doggy Tail Section
3. Sheet Finish
   - 3.1 Bin
   - 3.2 Staple Mechanism 3.3 Sheet Drop Mechanism
3.4 Jogger Mechanism
3.5 Sheet Deflect Mechanism
4. Control Circuitry
5. General Control Scheme
6. Control over Individual Sections
6.1 General
6.2 Reserve Mode
6.3 Execution of Reserve Mode Job
6.4 Processing by Document Process Key
6.5 Processing by Copy Process Key
7. Different Flows of Document and Paper Based on Mode
8. Finishing after Copy Discharge
8.1 Initialize
8.2 Jogger Drive
8.3 Switching Wheel Initialize
8.4 Switching Wheel Drive
8.5 Sheet Bin Up/Down Check
8.6 Sheet Bin Up/Down Control
8.7 Stapler Shift
8.8 Staple
8.9 Sheet Drop
9. Document Processing Control
9.1 Initialize
9.2 Movement of Document Bin
9.3 Setting of Document Bin at Feed Position
9.4 Feed-In
9.5 Jam Check
9.6 Feed-Out
9.7 Document Stack Section
9.8 Refeed
9.9 Jam Check Timing
9.10 Document Transport Timing
9.11 Flow and Timing of Document

General Flow of Job Execution

1. General Construction

To begin with, the general construction of a copier embodying the present invention will be described.

Figure 1:
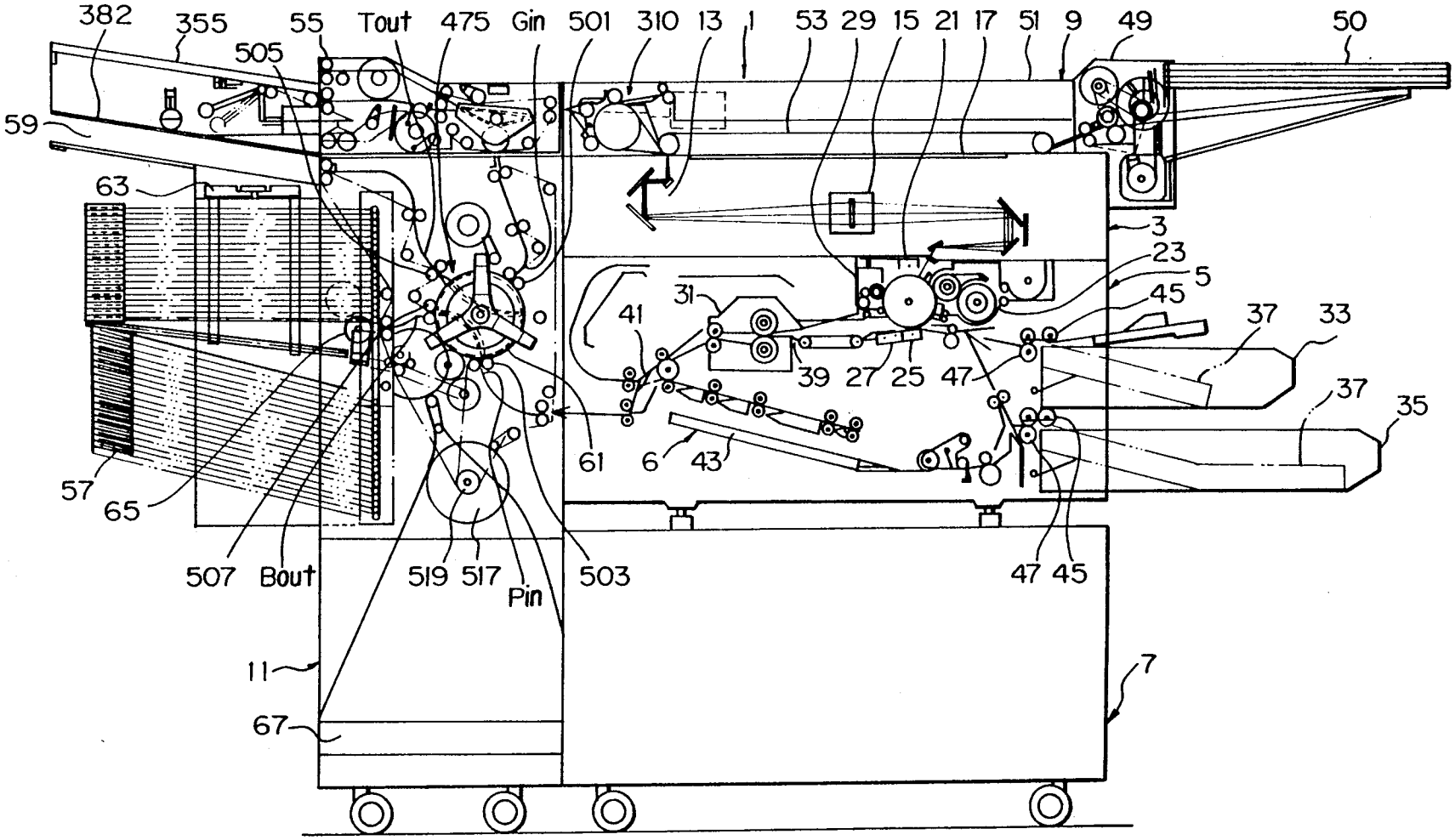
FIG. 1 is a view showing a copier embodying the present invention and belonging to a family of image forming equipment.

Referring to FIG. 1, a copier, generally 1, has an optical section 3, an image forming section 5, a sheet feed section 6, a control section 7, a document transport section 9, and a finish section 11. The optical section is made up of a light source, a group of movable and stationary mirrors 13, and a lens 15 which are conventional. While a document laid on a glass platen 17 is illuminated from behind the glass platen 17, a reflection from the document is routed through the mirror group 13 and lens 15 to be incident to a photoconductive element which will be described. As a result, a latent image is electrostatically formed on the surface of the photoconductive element.

The image forming section 5 forms an image by a conventional electrophotographic procedure and has a photoconductive element in the form of a drum. A main charger 21, a developing unit 23, a transfer charger 25, a separation charger 27, and a cleaning unit 29 are arranged around the drum 19. A fixing unit 31 is located on a transport path included in the sheet feed section 6 which will be described.

The sheet feed section 6 has an upper and a lower sheet tray 33 and 35, and a transport path 39 along which a paper sheet 37 picked up from the tray 33 or 35 is transported to the finish section 11 via the image forming section 5. The transfer charger 25, separation charger 27 and fixing unit 31 are arranged on the transport path 39. A path selector in the form of a pawl 41 and an intermediate tray 43 are positioned downstream of the fixing unit 31 in order to implement two-sided copies. Of course, various transport rollers including pick-up rollers 45 and register roller 47 and rotatable pawls for selecting a particular transport path are arranged along the transport path 39 as usual.

The control section 7 has control circuitry for controlling image forming operations, the transport of the paper sheet 37, the transport of a document, and the finishing of the paper sheet 37 and document, as will be described specifically later. Such control is effected automatically by being manually set by the operator or on the basis of reserve modes set beforehand.

The document transport section 9 has a multi-step document feed section or multi-step ADF (Automatic Document Feeder) 49, and a document reversing section 52. The multi-step ADF 49 is made up of a multi-step unit 50 having bins 201, and a document transport section or unit 51. A Geneva wheel which will be described causes each of the five bins 201 of the multi-step unit 50 to move to a document inlet, so that documents stacked on the individual bins 201 may be fed into the document transport unit 51 one after another. In the document transport unit 51, a belt 53 transports the document fed from any one of the bins to the glass platen 17 and, after imagewise exposure, further transports it to a document discharge section 55 or the finish section 11. The document discharge section 55 reverses the document and then drives it back to the glass platen 17 for reproducing the other side. In this sense, the multi-step ADF 49 is operable as an automatic recycling document feeder (ARDF).

The finish section or finisher 11 has twenty bins 57 which are arranged one above another for accommodating sheets. In the embodiment, the term "sheets" refer to both of documents and paper sheets for forming images thereon. A discharge tray or proof tray 59 accommodates sheets which are not distributed to the bins 57. A switch section 61 switches the transport of paper sheets coming in through the transport path 39 of the paper feed section 6 or documents coming in through the document discharge section of the document transport section 9 to the bins 57 or to the proof tray 59. A jogger 63 positions paper sheets stacked on the individual bins 57. A stapler 65 staples each set of sheets positioned by the jogger 63. The bundles of sheets so stapled by the stapler 65 are released (dropped) from the individual bins 57 to be stacked on a stack tray 67. With such a construction, the finisher 11 is operable in a sorter/stapler fashion.

The various sections constituting the copier 1 will be described in detail hereinafter. Since the image forming section 5 and paper feed section 6 are conventional, the following description will concentrate on the structures for feeding and discharging sheets and the control over the feed and discharge of sheets.

2. Document Transport

Since the copying procedure begins with a step of loading documents, a mechanism for processing documents to be copied will be described first.

2.1 Multi-Step ADF

Figure 2:
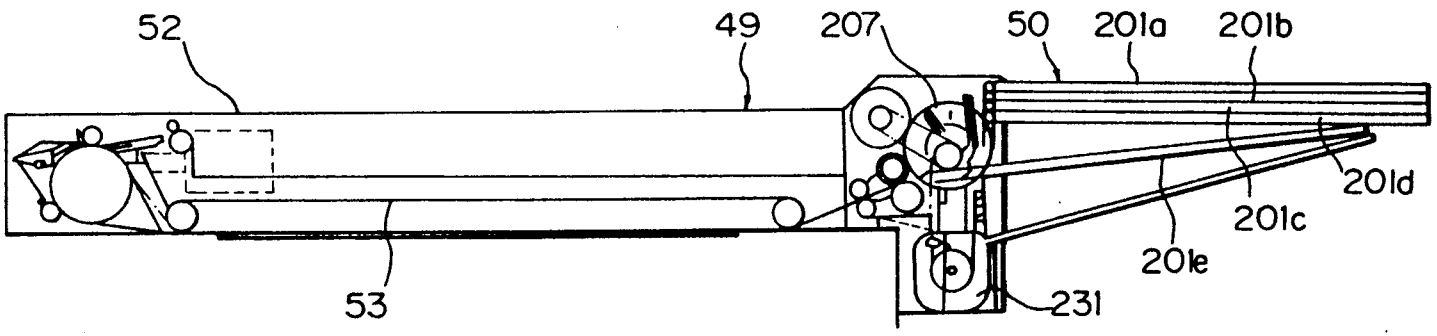
FIG. 2 is fragmentary enlarged view of a document transport line included in the embodiment.
Figure 3:
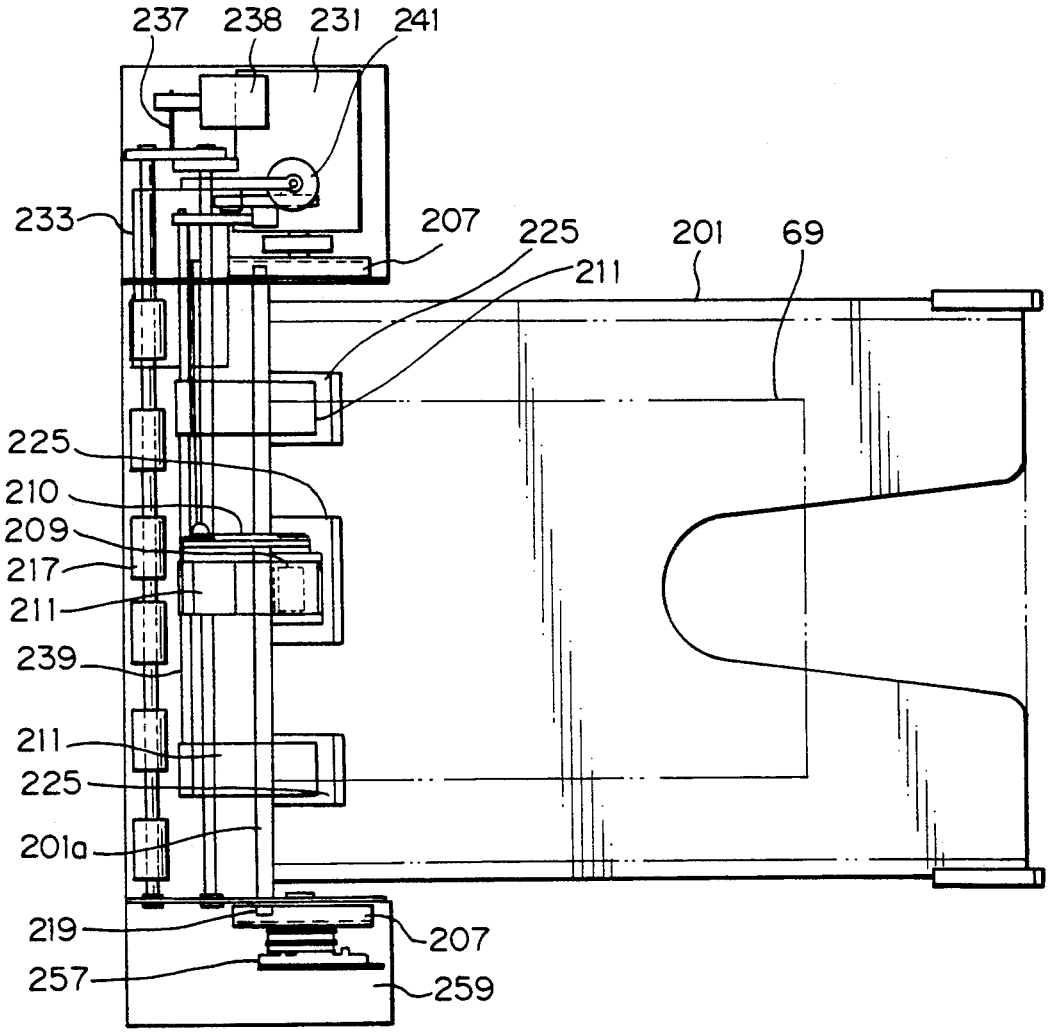
FIG. 3 is a fragmentary plan view of a multi-step unit included in the embodiment.
Figure 4A:
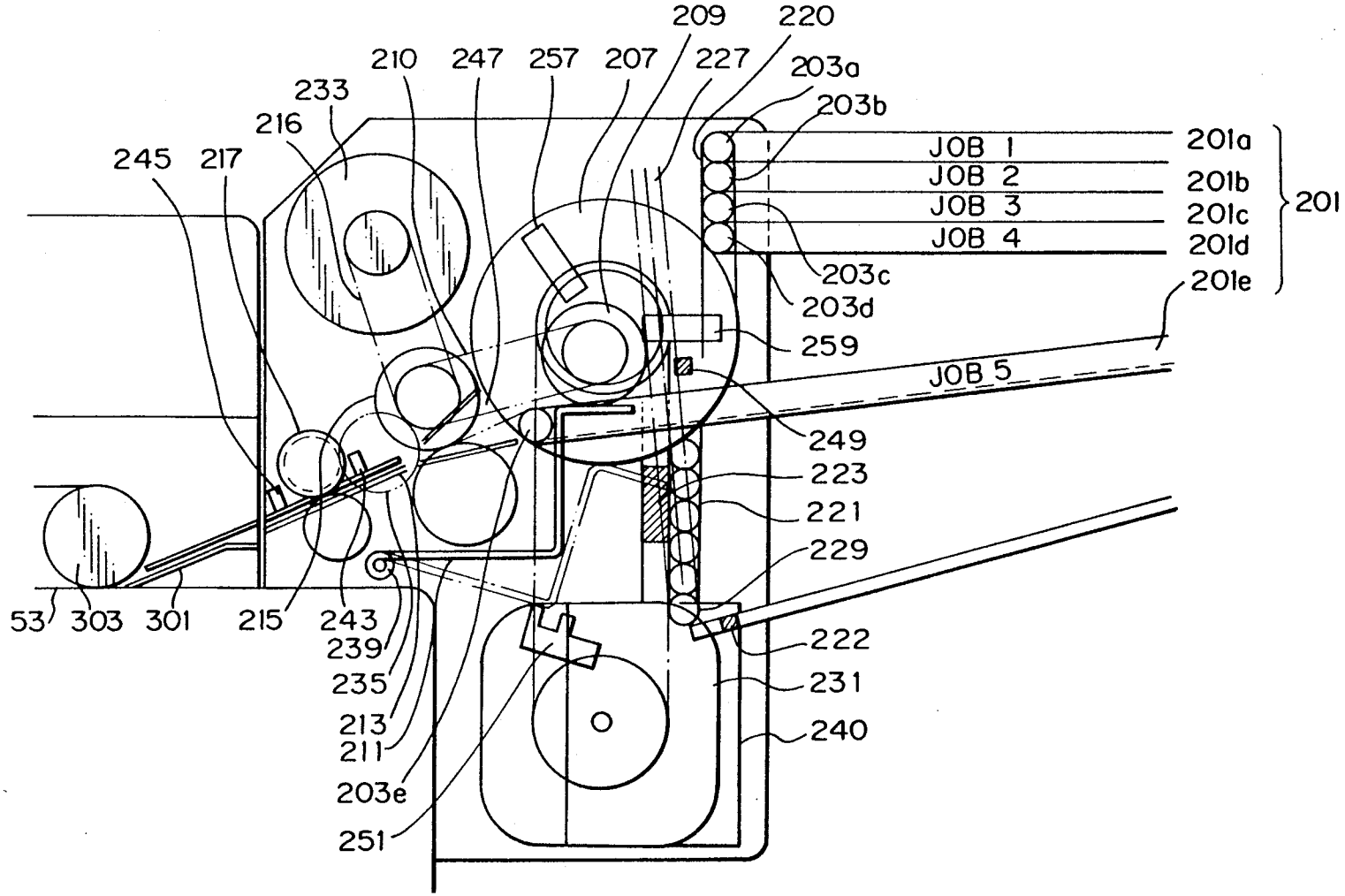
FIGS. 4A to 4C are views outlining the construction and operation of the multi-step unit.
Figure 124:
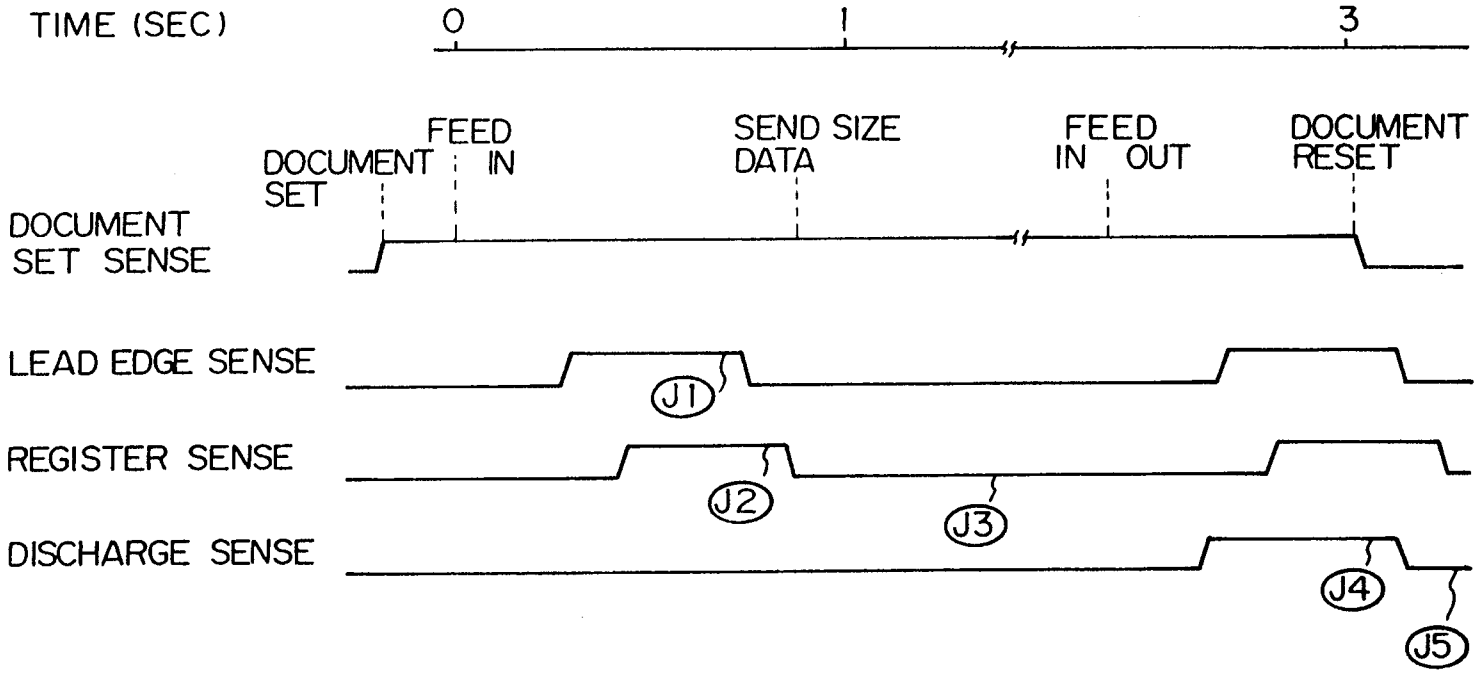
FIG. 124 is a timing chart indicative of a jam check timing in a one-side mode.

Referring to FIG. 2 the document transport section or multi-step ADF 9 has a multi-step unit 50 constituted by five bins implemented as independent units 201*a*, 201*b*, 201*c*, 201*d* and 201*e* (or 201 collectively), and a document transport unit 51 shown in detail in FIG. 124. As shown in FIGS. 3 and 4A, the bins 201*a*, 201*b*, 201*c*, 201*d* and 201*e* have respectively stops 203*a*, 203*b*, 203*c*, 203*d* and 203*e* (or 203 collectively) at the front edges thereof with respect to an intended direction of document transport. A Geneva wheel 207 is engageable with any one of the stops 203 to move the bin 201 having the stop 203 to a document feed position. A bottom plate 211 raises documents 69 stacked on such a bin 201 toward a pick-up roller 209 at the time of document feed. A separation roller 215 and a pull-out roller or register roller 217 are arranged along a transport path 213. The pull-out roller 217 defines the timing for driving the leading edge of the document 69.

The bins 201 are movable with their stops 203 engaged with and guided by an upper and a lower guide path 220 and 221 which extend substantially vertically while partly facing the locus of rotation of a recess 219 formed in the Geneva wheel 207. A pawl 223 is located along the lower guide path 221 and adjacent to the center of the Geneva wheel 207 for releasing each of the bins 201 from the Geneva wheel 207 and guiding it to the lower guide path 221. The bins 201 are each formed with holes 225 adjacent to the stop 203 thereof, so that the bottom plate 211 may raise the documents 69 stacked on the bin 201. A push member 229 is positioned at the lower end of the lower guide path 221 and constantly biased by a tension spring 227 to in turn bias the stops 203 received in the path 221 upward. The Geneva wheel 207 is reversibly rotated by a wheel motor 231 which is implemented as a stepping motor.

The pick-up roller 209 and the separation roller 215 are driven by a transport motor 233 via belts 210 and 216, respectively. The output torque of the transport motor 233 is also transmitted by a gear 235 to a register clutch 237 which controls the drive of the pull-out roller 217. The register clutch 237 is driven by a register solenoid 238. A bin select solenoid 240 is located below the lower guide path 221 for driving the pawl 223.

A reversible, bottom plate drive motor 241 is drivably connected to an arm 239 which moves the bottom plate 211 in an angular motion. Sensors 243 and 245 responsive to the leading edge and the register of the document 69, respectively, are located one after another along the transport path 213. Another sensor 249 is located in a position adjacent to the upper guide path 220 and where it will face the upper surface of the bin 201 when the latter is inserted into a paper inlet 247, so that it may determine whether or not the bin 201 has been set. A home position sensor 251 is disposed below the bottom plate 211 for determining whether or not the bottom plate 211 has retracted to a home position thereof away from the holes 255 of the bin 201. Sensors 257 and 259 are located to face the Geneva wheel 207 to sense Geneva wheel 207 when the latter is brought to a stand-by home position and a feed home position, respectively. Such an arrangement is bodily enclosed by side walls 261 which support the bins 201 through the guide paths 220 and 221.

As shown in FIG. 4A, the five bins 201*a* through 201*e* and a dummy bin (corresponding to the push member 229) are initially located below the Geneva wheel 207 and constantly biased upward by the tension spring 227 via the push member 229. In this condition, the first or uppermost bin 201*a* is held in pressing contact with the circumferential edge of the Geneva wheel 207. The pawl 223 is maintained in a lowered position, as illustrated.

Figure 4B:
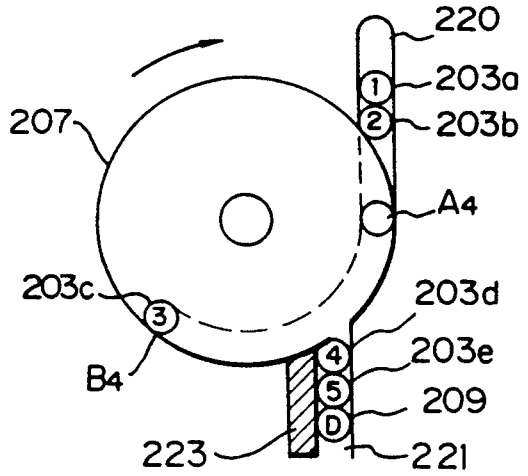

How the bins 201 are moved up and down and fed to the document feed position will be described with reference to FIGS. 4A and 4B. As the wheel motor 231 is rotated counterclockwise as viewed in FIG. 4A, it rotates the Geneva wheel 207 counterclockwise. When the Geneva wheel 207 reaches a position where it faces the stop 203*a* of the bin 201*a*, the stop 203*a* is thrusted into the notch 219 by the force of the spring 227. Then, the Geneva wheel 207 in rotation lifts the bin 201*a* along the locus of rotation thereof. As soon as the bin 201*a* reaches the feed home position sensor 259, the sensor 259 senses it. The resultant output of the sensor 259 deenergizes the wheel motor 231 (position $A_4$, FIG. 4B, representative of the motion of the third bin 201*c*) and then reverses it. As a result, the Geneva wheel 207 is rotated clockwise to move the bin 201*a* forward to the document feed position by holding the stop 203*a* of the bin 201*a*. The stop 203*a* is successfully brought to the document feed position without slipping out of the notch 219 because, at the time when the stop 203*a* faces the lower guide path 221, the stop 203*b* of the second bin 201*b* waits at, or closes, the open end of the guide path 221 under the action of the tension spring 227.

As the bin 201*a* is moved toward the document feed position as stated above, the sensor 249 senses the document set position, i.e., document feed position and stops the rotation of the wheel motor 231 (position $B_4$, FIG. 4B, representative of the motion of the third bin 201*c*). Then, the motor 241 is rotated to raise the bottom plate 21 until the documents 69 abut against the pick-up roller 209. In this condition, a job associated with the first bin 201*a* is executed.

Figure 4C:
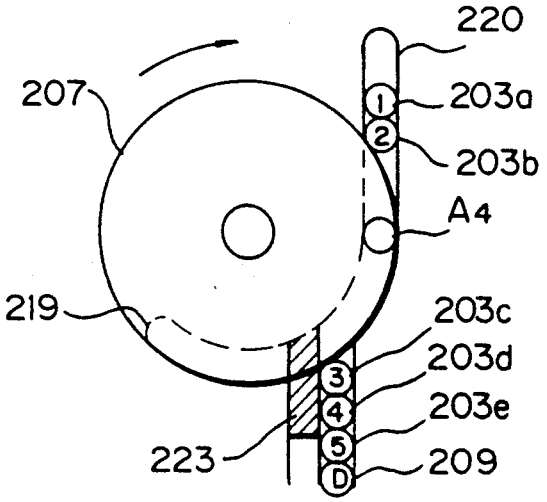

Subsequently, the next bin is selected on the basis of modes entered beforehand. The first bin 201*a*, therefore, has to be retracted from the document feed position. For this purpose, the wheel motor 231 is rotated counterclockwise from the document feed position ($B_4$). Specifically, the wheel motor 231 and, therefore, the Geneva wheel 231 is rotated counterclockwise to move the stop 203*a* of the bin 201*a* in the same direction. When the stop 203*a* reaches the position $A_1$, it is released from the notch 219 of the Geneva wheel 207 and transferred to the upper guide 220. As the Geneva wheel 231 continues to rotate counterclockwise, the notch 219 is brought to a position where it faces the stop 203*b* of the next bin 201*b* located at the upper end of the lower guide path 220. The stop 203*b*, therefore, enters the notch 219 with the result that the bin 201*b* is moved to the document feed position by the above procedure or to the upper guide path 220, as will be described. To return the bin 201 from the upper guide path 220 to the lower guide path 221, the wheel motor 231 and, therefore, the Geneva wheel 207 is rotated clockwise. As the notch 219 of the Geneva wheel 207 faces the opening of the upper guide path 220, the stop 203 of the bin 201 is dropped into the notch 219 by gravity. At this instant, the pawl 223 having been retracted from the locus of the Geneva wheel 207 is raised by drive means, not shown, to protrude into the locus of the wheel 207, as shown in FIG. 4C. As a result, the stop 203 moving downward in engagement with the notch 219 abuts against the pawl 223 when it faces the open end of the lower guide path 221. Then, the stop 203 is forced into the lower guide path 221 against the action of the tension spring 227 while being urged against the pawl 223. As soon as the stop 203 is released from the notch 219, the circumferential edge of the Geneva wheel 207 abuts against the stop 203 to prevent the stop 203 from slipping out of the guide path 221, as shown in FIG. 4C.

Figure 5:
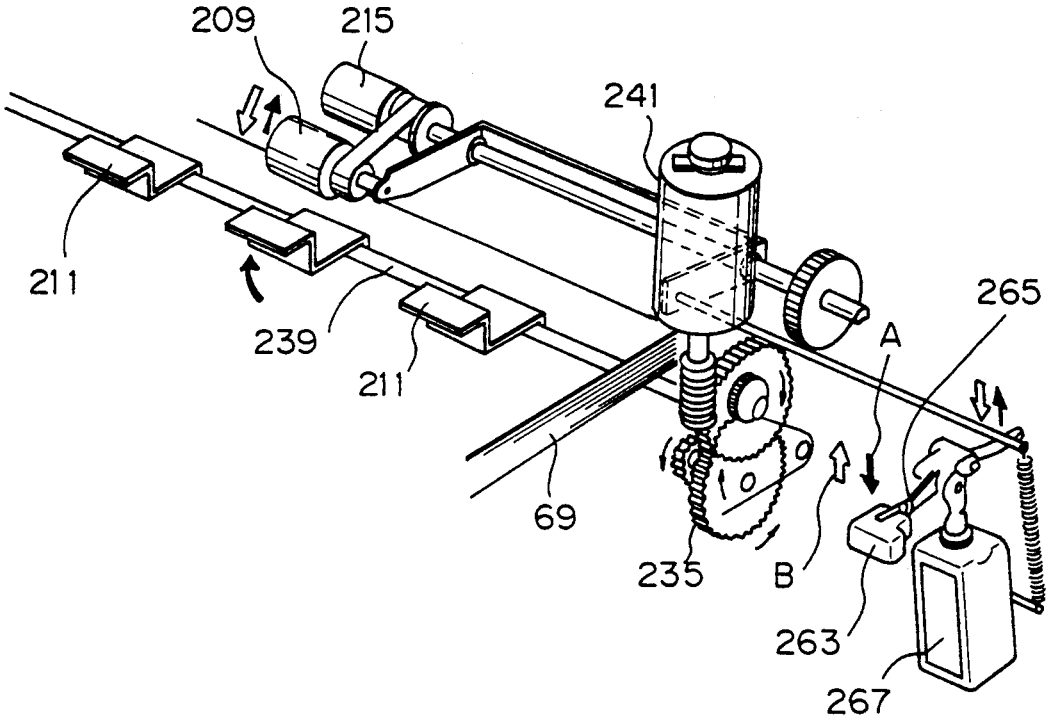
FIG. 5 shows a mechanism for raising the bottom plate of a document bin included in the embodiment.

FIG. 5 shows a mechanism for raising the bottom plate 211. As shown, the bottom plate 211 is made up of three parts and mounted on the arm 229. As the motor 241 is rotated, it causes the bottom plate 211 to rise to press the documents 69 stacked on the bin 201 against the pick-up roller 209. specifically, when the bin 201 is set in the paper feed position, the motor 24 starts rotating one rotation while raising the bottom plate 211. The documents 69 are raised by the bottom plate 211 until they abut against the pick-up roller 209, whereby the pick-up roller 209 is slightly raised. Then, an intercepting piece 265 is moved away from a sensor 263, as indicated by an arrow in the figure. The resultant output of the sensor 263 deenergizes the motor 241 and thereby stops the upward movement of the documents 69. As the stack of documents on the bin 201 decreases in height due to the repetitive copying operation, the intercepting piece 265 again rises little by little in a direction indicated by an arrow B. When the intercepting piece 265 interferes with the sensor 263, the motor 241 is again turned on to raise the documents 69.

The rotation speed of the motor 241 is reduced to about one-tenth by two gears. This is to increase the torque of the motor 241 by the gears and to enhance the accuracy of the sensor 263 by raising the documents 69 slowly. A worm gear is mounted on the output shaft of the motor 241 to prevent a force from acting on a sector gear 235 in the reverse direction due to the weight of the documents 69.

Figure 6:
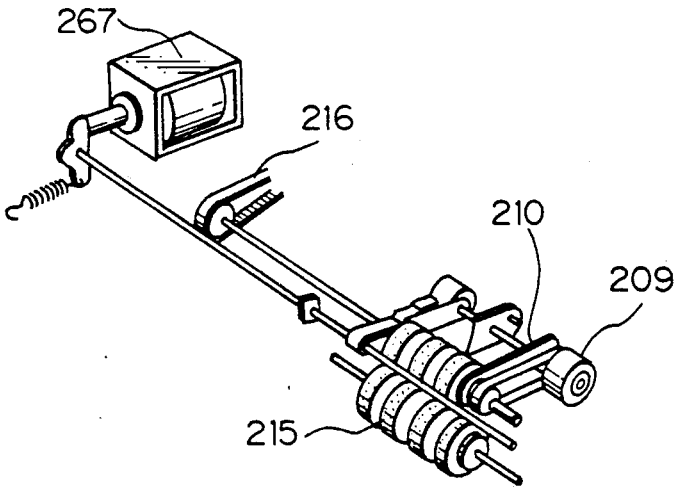
FIG. 6 indicates a relation between a pick-up roller and a separation roller included in the embodiment.
Figure 7:
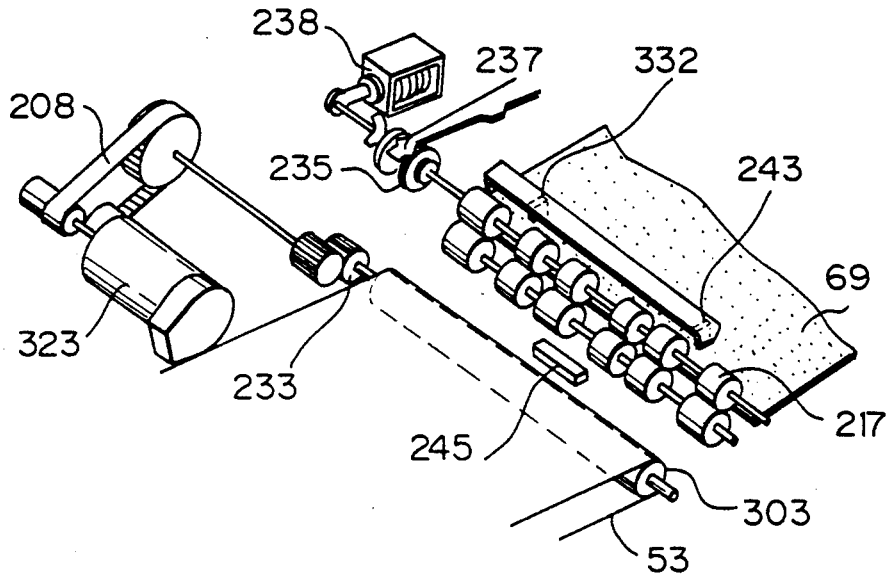
FIG. 7 outlines an arrangement around a pull-out roller included in the embodiment.
Figure 8:
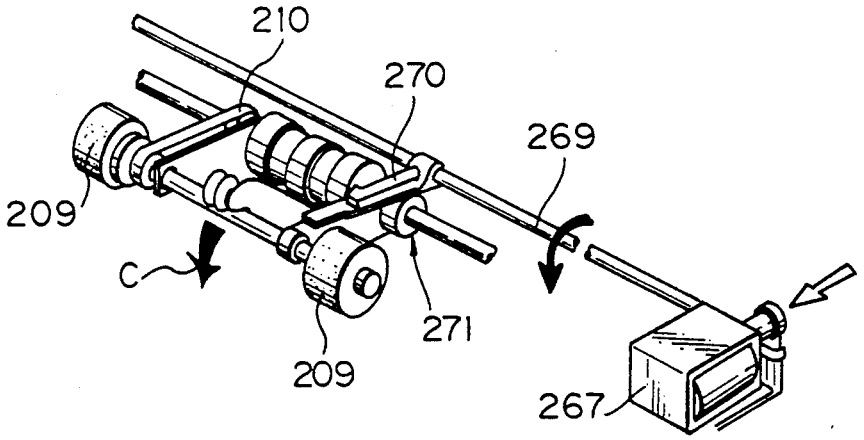
FIG. 8 outlines an arrangement around the pick-up roller.

Referring to FIGS. 6, 7 and 8, a pick-up solenoid 267 is energized when a print key 663 provided on the copier 1 is pressed after the insertion of documents 69. Then, the pick-up solenoid 267 pulls its plunger and thereby rotates a shaft 269 and an assembly 271 of an actuating lever 270 mounted on the shaft 269 in a direction indicated by an arrow C. As a result, the pick-up roller 209 is lowered to contact the documents 69. Thereafter, the transport motor 233 is energized to rotate the separation roller 215 via a separation roller drive belt 216 and to rotate the pick-up roller 209 via a pick-up roller drive belt 210. The pick-up roller 209 and separation roller 215 cooperate to feed the documents 69 one by one.

Since the register solenoid 238 is energized at the same time as the transport motor 233, the rotation of the transport motor 233 is transmitted to a register clutch 237 and then to a gear 235. As a result, the pull-out roller 217 is rotated to drive the document 69 toward the document transport unit 51. The register clutch 237 is implemented as a spring clutch. When the document 69 is fed into the document transport unit 51 to turn off the register sensor 245, the register solenoid 238 is also turned off and the register clutch 237 is uncoupled by a stop. Consequently, the pull-out roller 217 is also brought to a stop to interrupt the feed of the document 69.

In an ADF mode operation, the pick-up solenoid 267 is deenergized when the sensor 243 senses the leading edge of the document 69. On the other hand, in a semi-automatic or SADF mode operation, the pick-up solenoid 267 is turned off when the register sensor 245 turns on.

Figure 9A:
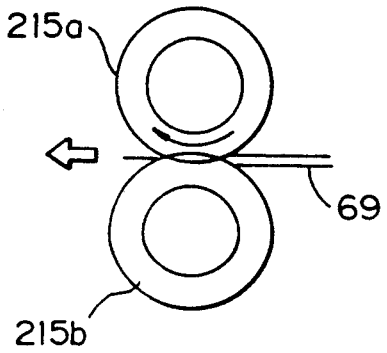
FIGS. 9A and 9B show a condition in which the separation roller is used.
Figure 9B:
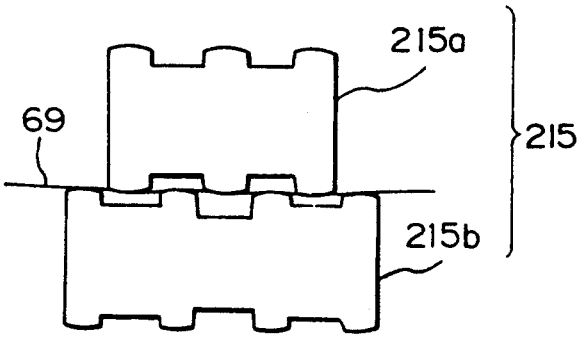

As shown in FIGS. 9A and 9B, the separation roller 215 serves to separate one of the documents 69 from the others and is made up of an upper and a roller separation roller **215*a* and 215*b*. These rollers 215*a* and 215*b* each has circumferential projections and recesses, and they are positioned such that their projections and recesses mate with each other. In this configuration, the rollers 215*a* and 215*b* separate one document 69** from the others by friction.

Figure 10:
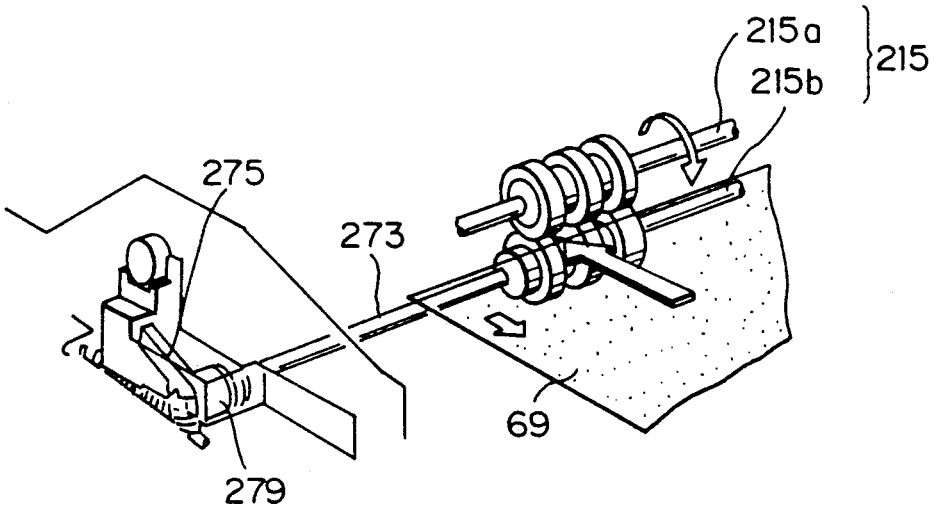
FIGS. 10 through 12 each shows the operation of the separating roller.
Figure 11:
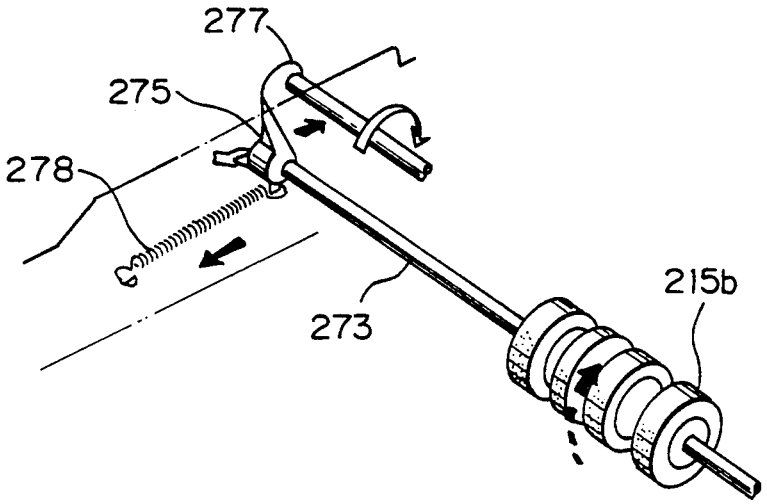

The separation rollers 215 are provided with unique implementations for sure transport. As shown in FIG. 10, when the paper sheet 69 faces the rollers 215, the rollers 215 are rotated in the feed direction by an amount corresponding to the rotation of an actuating lever 275 which is mounted on one end of a shaft 273 that supports the lower roller **215*b* thereon. While the transport motor 233 is in the energized state, the lower roller 215*b* is rotated in the reverse direction little by little to free the rollers 215 from wear and to prevent two or more documents 69 from being fed together. When the transport motor 233 is energized, the rotation of the motor 233 is transmitted to the upper roller 215*a* via a gear 277. As also shown in FIGS. 10 and 11, the gear 277 has a boss in the form of an eccentric cam. The operating lever 275 is constantly urged against the eccentric cam of the gear 277 by a spring 278. Hence, as the eccentric cam rotates, it causes the actuating lever 275 to rotate with the contour thereof. A one-way clutch 279 is press-fitted in the actuating lever 275 to cause the lower roller 215*b* to rotate when the actuating lever 275** moves upward.

Figure 12:
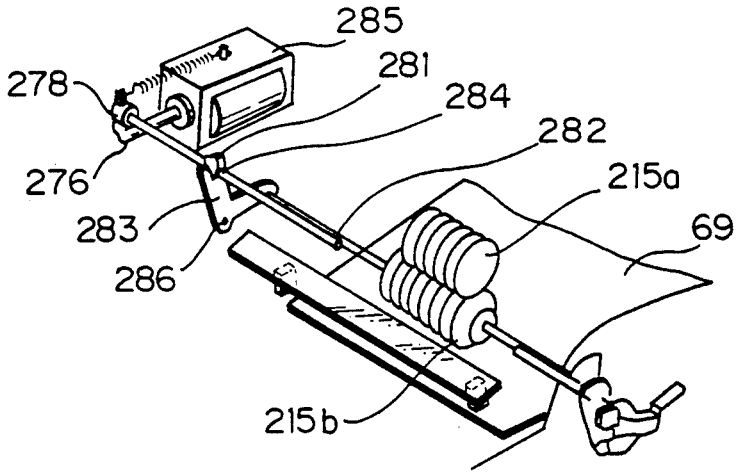

Every time a copy is produced, the separation rollers 215 are moved away from each other to be prevented from being smeared by documents which are written in pencil, for example. Specifically, as shown in FIG. 12, a shaft 282 carrying an eccentric cam 281 therewith is associated with the upper roller **215*a*. The eccentric cam 281 is received in a recess 284 formed in an adjusting plate 283. The other end of the adjusting plate 283 is engaged with the shaft of the lower roller 215*b*. Another eccentric cam 278 is mounted on one end of the shaft 282 and driven by a lever 276 which is operatively connected to the plunger of a solenoid 285. When the solenoid 285 is energized, its plunger pulls the lever 276 to thereby rotate the eccentric cam 278. As a result, the shaft 282 and, therefore, eccentric cam 281 is rotated. The eccentric cam 281 in turn causes the adjusting plate 283 to rotate about the shaft 286. Consequently, the lower roller 215*b* is moved downward away from the upper roller 215*a***.

Figure 13:
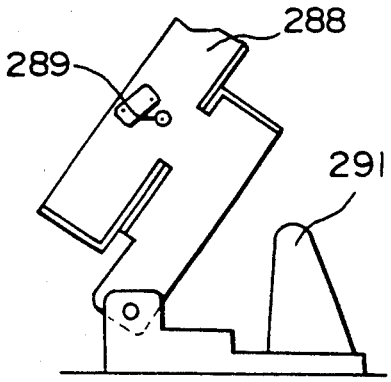
FIGS. 13 through 16 show a mechanism for opening and closing a cover plate included in the embodiment.
Figure 14:
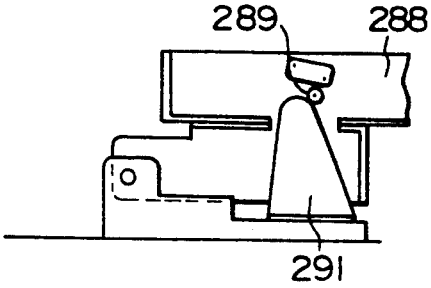
Figure 15:
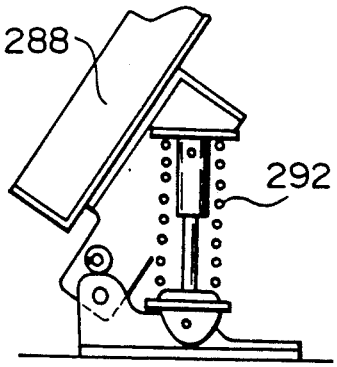
Figure 16:
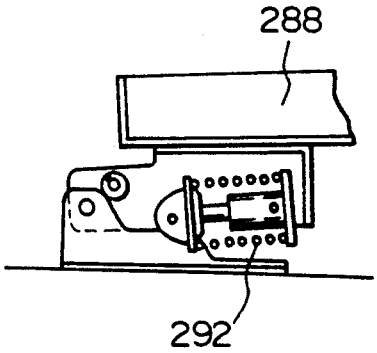

FIGS. 13 to 16 show an arrangement for sensing the lifted or open position and the closed position of the document transport unit 51, i.e., a cover plate 288. As shown in FIG. 13, the document transport unit 51 has a sensor 289 which turns on when the cover plate 288 is set. The sensor 289 is implemented by a microswitch. When the cover plate 288 is lowered toward a base 290, an arm 291 extending out from the base 290 pushes the movable end of the microswitch 28 with the tip thereof, as shown in FIG. 14. As a result, the microswitch 289 is turned on to determine that the cover plate 288 has been set. In this embodiment, a spring 292 is substituted for a conventional brake shoe. Specifically, when the cover plate 288 is not set, the spring 292 is expanded, as shown in FIG. 15. When the cover plate 288 is lowered, the spring 292 is compressed to regulate the lowering speed of the cover plate 288, as shown in FIG. 16.

2.2 Document Transport Unit

Figure 17:
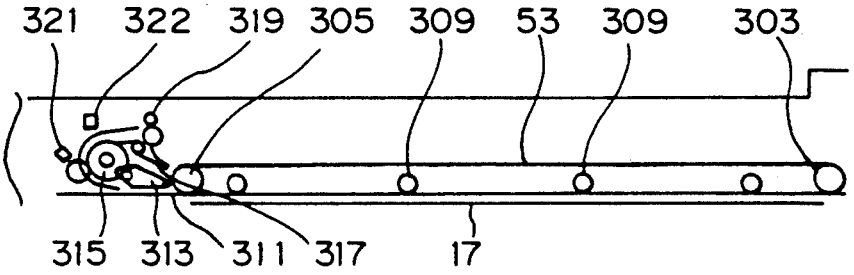
FIG. 17 shows a document transport unit included in the embodiment.

As shown in FIG. 17, the document transport unit 51 has a transport path 301 which is contiguous with the transport path 213 of the multi-step unit 50. The transport belt 53 is passed over a drive roller 303 and a driven roller 305. A plurality of press rollers 309 are interposed between the upper and lower runs of the belt 53 to urge the belt 53 against the glass platen 17. When the document 69 is driven out from the belt 53 to a transport path 311, a pawl 313 returns the document 69 toward the glass platen 17 by turning it over. The reference numerals 315, 317 and 319 designate respectively a turn roller, a turn gate 317, and a discharge roller 319 located at the inlet side of the turn gate 317. Sensors 321 and 322 are responsive to the document 69 which is discharged from the transport belt 53.

Figure 18:
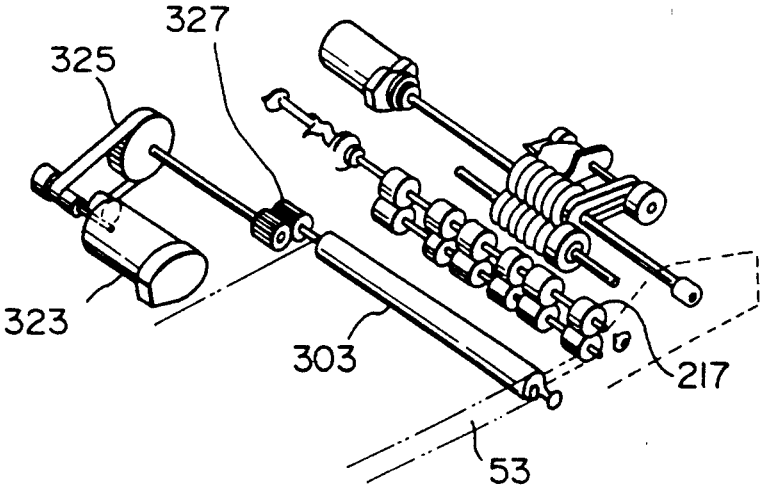
FIG. 18 shows an arrangement on the document inlet side of the document transport unit.
Figure 19:
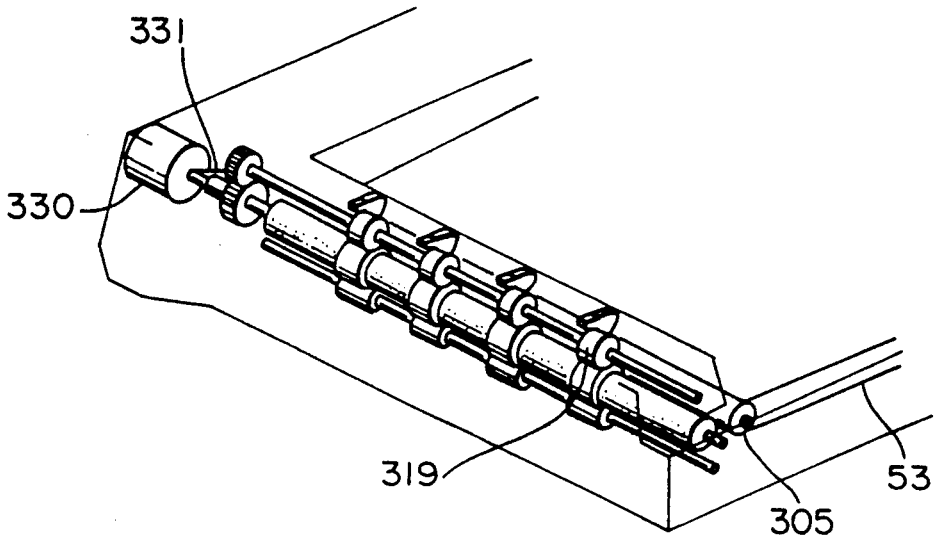
FIG. 19 shows an arrangement on the document outlet side of the document transport unit.

As shown in FIG. 18, the drive roller 303 is driven by a document transport motor 323 via a timing belt 325 and a gear train 327 to rotate the transport belt 53. After the transport belt 53 has brought the document 69 to the glass platen 17, the motor 323 is deenergized to stop the document 69 at a predetermined position on the glass platen 17. Then, the document 69 on the glass platen is illuminated. Thereafter, the motor 323 is again energized by a signal fed from the copier body to thereby move the document away from the stop position. At the same time, a discharge motor 330, FIG. 19, is energized to rotate a discharge roller 319 via an intermediate gear 331 with the result that the document 69 is discharged.

Figure 20:
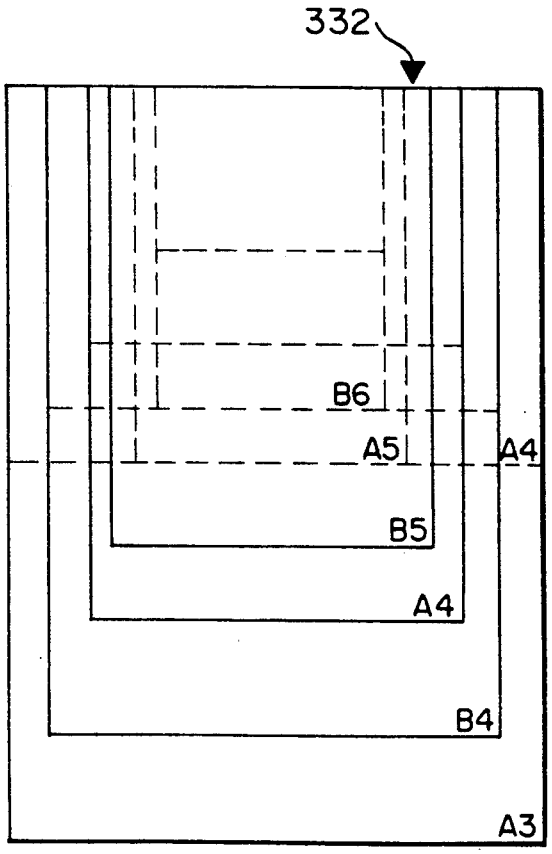
FIG. 20 indicates how the document size is sensed.

The motors stated above are ON/OFF controlled on the basis of a sensed document size. As shown in FIG. 20, the register sensor 245 and a size sensor 332 determine respectively the length and the size of a document. The length of a document is determined in terms of the interval between pulses which appear on the turn-on and turn-off of the register sensor 245. Such data are sent to the copier body as size data in the case of paper-specified magnification change and automatic paper select modes.

2.3 Document Reverse Section

Figure 128:
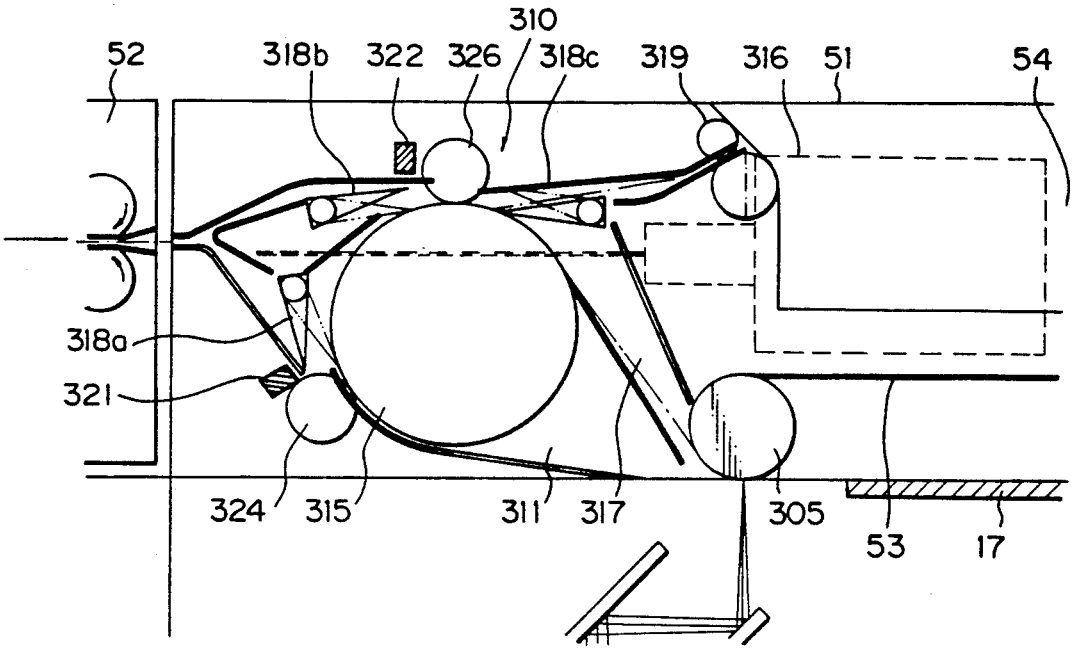
FIG. 128 shows essential part of the document transport unit.

FIG. 128 shows the document reverse section 310 of the document transport unit 51 in detail. The document reverse section 310 is capable of performing four different operations with the document 69 having been transferred from the transport section 54, as will be described with reference to FIGS. 129A to 129D.

Figure 129A:
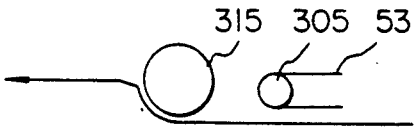
FIGS. 129A through 129D each shows a particular flow of documents.

FIG. 129A shows a mode for driving the document 69 from the document transport section 54 to the document stack section 52. In this mode, a reverse solenoid 316 is deenergized to maintain pawls 318*a*, 318*b* and 318*c* in positions indicated by dash-and-dots lines in FIG. 128. The turn roller 315 is rotated forward to move the document 69 coming out of the transport section 54 to the document stack section 52 via a discharge sensor 321. When the discharge sensor 321 senses the leading edge of the document 69, the turn roller 315 and belt 53 are brought to a stop.

Figure 129B:
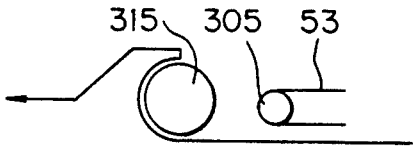

FIG. 129B shows a mode for turning over the document 69 coming out of the transport section 54 and then driving it toward the document stack section 52. In this mode, the reverse solenoid 316 is energized to position the pawls 318*a*, 318*b* and 318*c* as indicated by solid lines in FIG. 128. The turn roller 315 and, therefore, the discharge roller 319 held in mesh with the roller 315 via a gear is rotated forward. As a result, the document 69 is driven toward the discharge roller 319 via the transport path 311 and discharge sensors 321 and 322. When the discharge sensor 322 senses the trailing edge of the document 69, the reverse solenoid 316 is turned off and the rotation of the turn roller 315 is stopped. Thereafter, the turn roller 315 is reversed to steer the document 69 to the document tack section 52 via the discharge sensor 322. As soon as the discharge sensor 322 senses the trailing edge of the document 69, the turn roller 315 is brought to a stop.

Figure 129C:
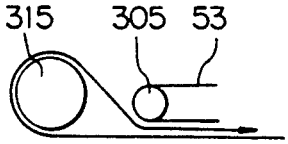

FIG. 129C shows a mode for turning over the document 69 coming out of the transport section 54 and then return it to the transport section 54. In this mode, the reverse solenoid 316 is energized while the turn roller 315 and transport belt 53 are moved forward. The document 69 is therefore moved toward the discharge sensor 322 across the discharge sensor 321. When the discharge sensor 322 senses the leading edge of the document 69, the reverse solenoid 316 is deenergized with the result that the document 69 is driven toward the turn gate 317. At this time, the transport belt 53 has already been reversed and, therefore, returns the document 69 to the glass platen 17.

Figure 129D:
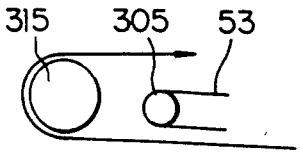

Further, FIG. 129D shows a mode for discharging the document 69 onto a cover which is disposed above the document transport section 54. In this mode, the reverse solenoid 316 is energized and the turn roller 315 and discharge roller 319 are rotated in the forward direction. Hence, the document 69 is driven out by the discharge roller 319 across the sensors 321 and 322. When the sensor 322 senses the trailing edge of the document 69, the turn roller 315 and transport belt 53 are brought to a stop on the lapse of a predetermined period of time. The control over such operations is demonstrated in FIG. 127 specifically.

(2.4 Document Stack Section)

Figure 21:
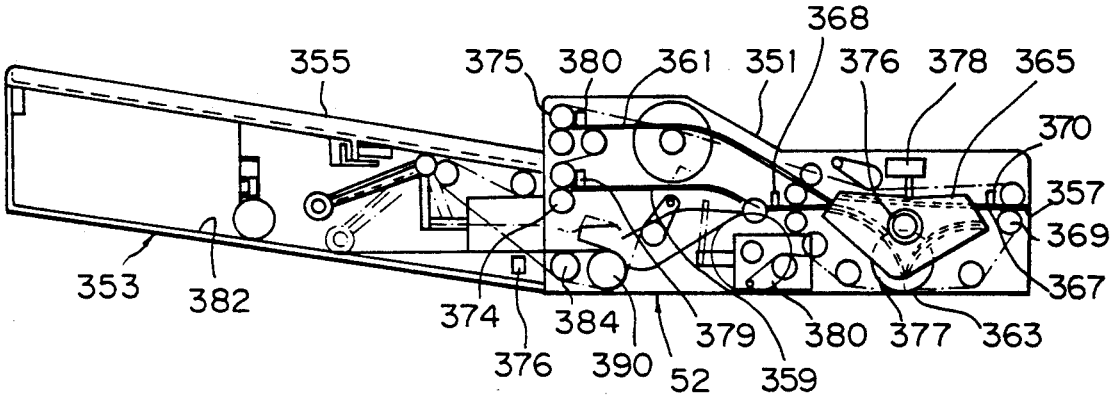
FIG. 21 shows the internal construction of a document reverse unit included in the embodiment.

As shown in FIG. 21, the document stack section or unit 52 has a document transfer section 351 contiguous with the document transport unit 51, a document stack tray 353, and a doggy tail section 355.

The document stack unit 52 has three different transport paths thereinside. Specifically, a transport path 359 extends from a document inlet 357 which is contiguous with the end of the transport path of the document transport unit 51 to the stack tray section 353. A transport path 361 extends from the document inlet 357 to the doggy tail section 355. A transport path 363 extends from the document inlet 357 to the finisher 11 which will be described. A selector 365 is movable to select one of the three transport paths 359, 361 and 363, as needed. The document 69 coming in through the document inlet 357 is transported along a transport path 367 into the document stack unit 52. A pair of transport rollers 369 are located on the transport path 367 to drive the document 69. A first ingress sensor (ingress sense 1) 370 is responsive to the entry of the document 69 in the transport path 367. A second ingress sensor (ingress sense 2) is located on the transport path 359 to sense the entry of the document 69 from the stack tray 353. Transport rollers 371, 372 and 373 are located on the transport paths 359 and 361. Discharge rollers 374 and 375 are respectively disposed at the outlets contiguous with the stack tray section 353 and doggy tail section 355.

Figure 22:
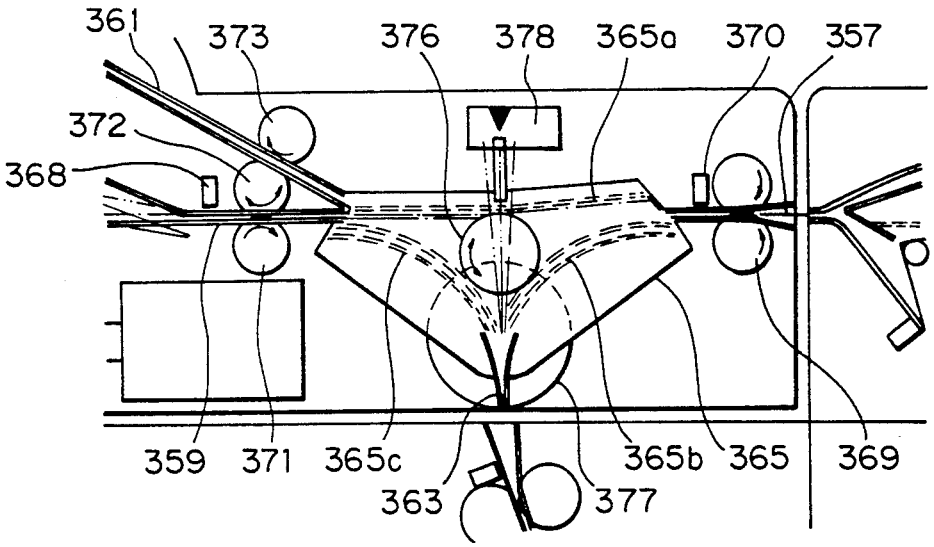
FIGS. 22, 23 and 24 demonstrate the operation of a mechanism for switching the document reverse unit.
Figure 23:
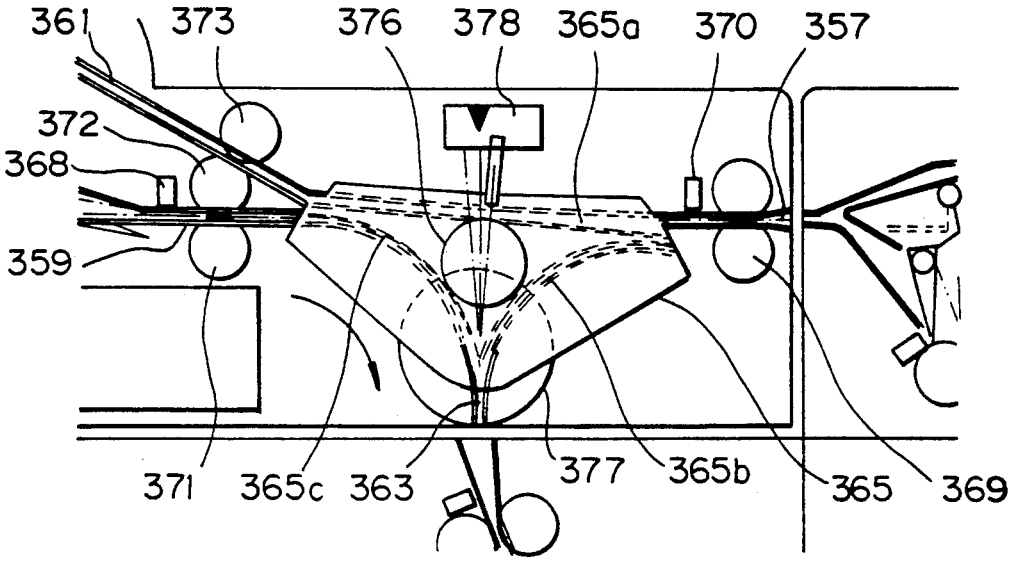
Figure 24:
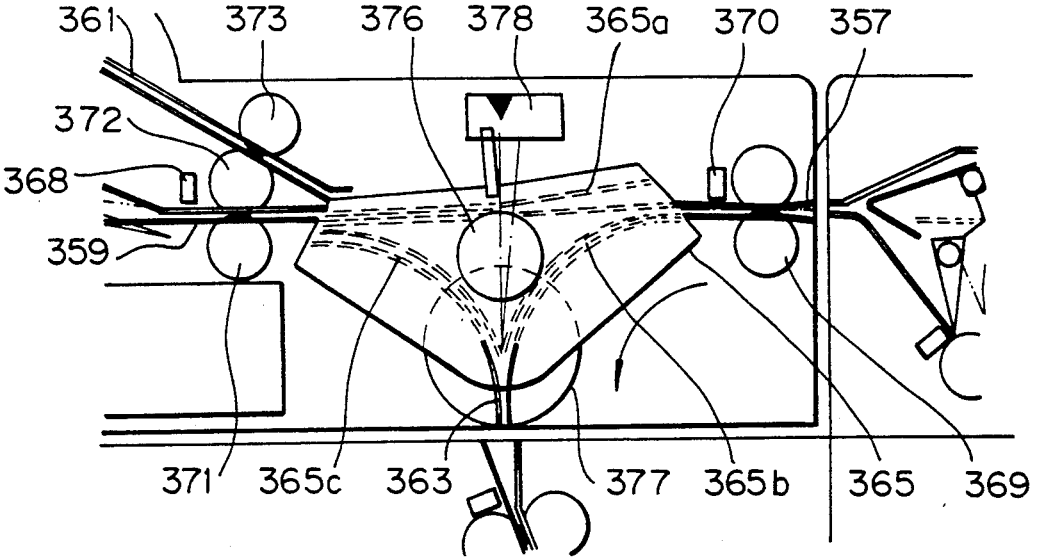

The selector 365 has a generally pentagonal shape in a side elevation and has a first to a third passage 365*a*, 365*b* and 365*c* thereinside. The passage 365*a* communications the transport path 367 to the transport path 361 (FIG. 23) or to the transport path 359 (FIG. 22). The passage 365*b* communicates the transport path 367 to the transport path 363 (FIG. 24). The passage 365 communicates the transport path 359 to the transport path 363 (FIG. 23). A transport roller 376 is accommodated in the selector 365 and shared by the three passages 365*a* to 365*c*. Driven by a stepping motor 377, the selector 365 is rotatable to select any one of such three routes. A home position sensor 378 is disposed above the selector 365 to sense the arrival of the selector 365 at the home position thereof.

Document sensors 379 and 380 are positioned at the ends of the transport paths 359 and 361, respectively.

2.5 Document Stack Tray Section

Figure 25:
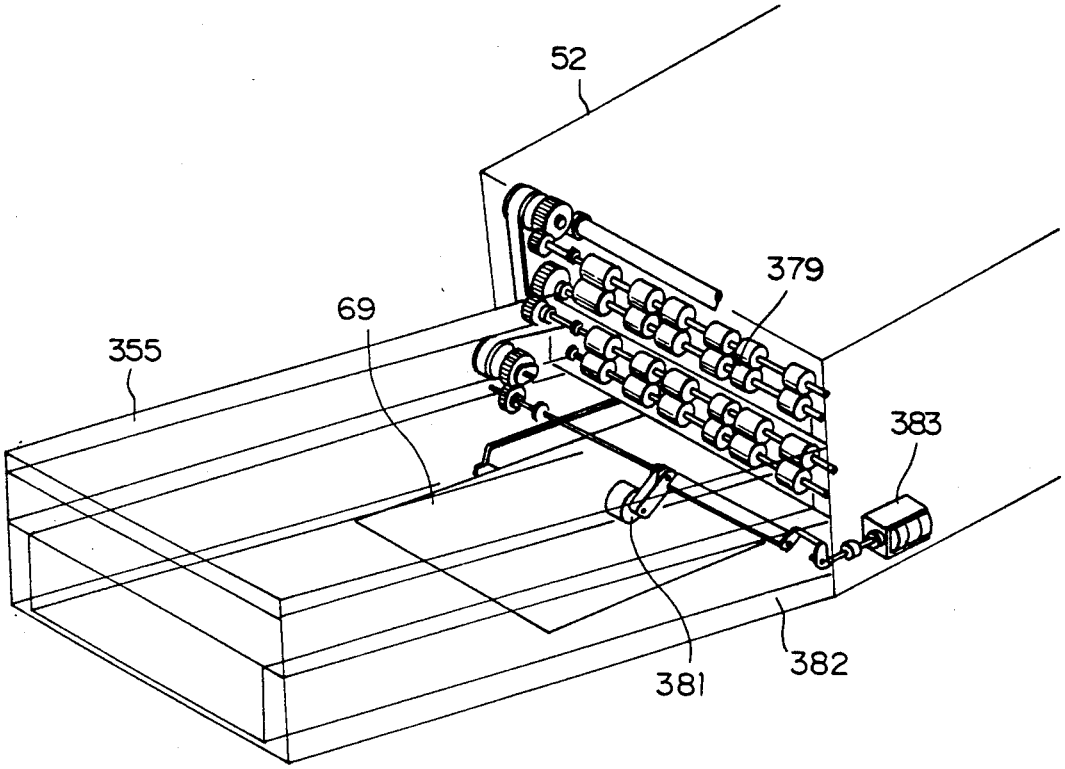
FIG. 25 is a perspective view of a document stack tray section included in the embodiment.

As shown in FIG. 25, the document stack tray section 353 has a positioning roller 381 and a solenoid 383 for driving the positioning roller 381. The document 69 driven out of the transport path 359 onto the stack tray 382 by the roller 374 is urged backward by the positioning roller 381 until the leading edge therof arrives at a predetermined position. Specifically, the solenoid 383 is not energized until the trailing edge of the document 69 moves away from the sensor 379, maintaining the positioning roller 381 in a raised position, as shown in FIG. 21. As soon as the document 69 is fully laid on the stack tray 382, the solenoid 383 is energized to lower the positioning roller 381. Then, the positioning roller 381 is rotated in contact with the document 69 to move the document 69 backward toward a pick-up roller 384. Immediately after the document 69 has reached the pick-up roller 384, the solenoid 383 is deenergized to raise the positioning roller 381 away from the stack tray 382. In this position, the positioning roller 381 awaits the next document 69.

Figure 26:
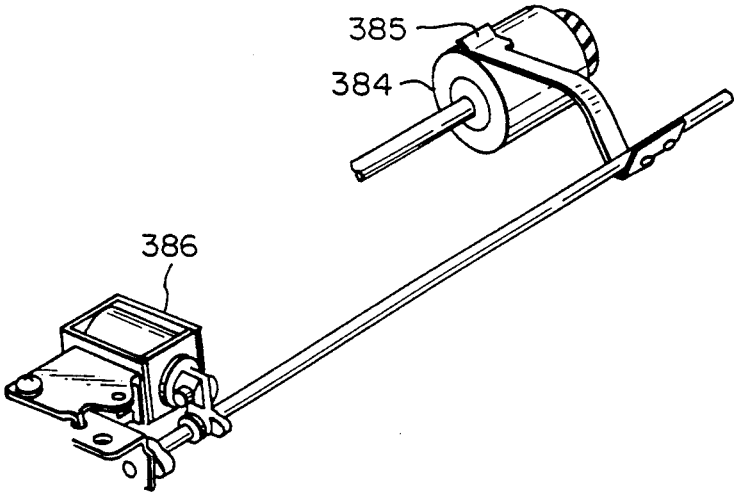
FIG. 26 is a fragmentary view showing a document pick-up mechanism included in the embodiment.

As shown in FIG. 26, the mechanism for picking up the document 69 has the pick-up roller 384, a device, not shown, for driving the roller 384, a lever 385 for urging the document 69 against the roller 384, and a solenoid 386 for actuating the lever 385. Assume that a given number of documents 69 have been stacked on the stack tray 382 with their leading edges positioned as stated above. A document feed signal from the copier body energizes the solenoid 386 which in turn causes the lever 385 to urge the documents 69 against the pick-up roller 384. Then, a spring clutch, not shown, is coupled to rotate the pick-up roller 384 with the result that the lowermost document on the stack tray 382 is fed out.

Figure 27:
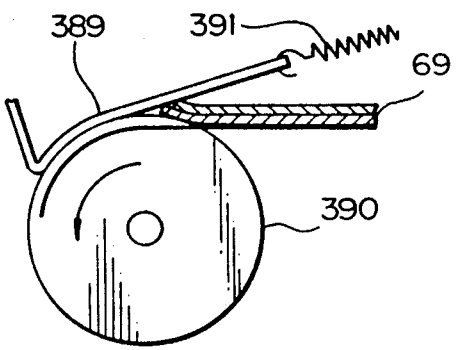
FIG. 27 shows a mechanism for separating one document from the others included in the embodiment.

As shown in FIG. 27, the embodiment uses a belt 389 and a roller 390 for separating the lowermost document from the others. The belt 389 is held in contact with the roller 390 and held under tension by a spring 391. In this configuration, the lowermost document 69 is separated from the others by friction and conveyed in the direction of rotation of the roller 390.

2.6 Doggy Tail Section

Figure 29:
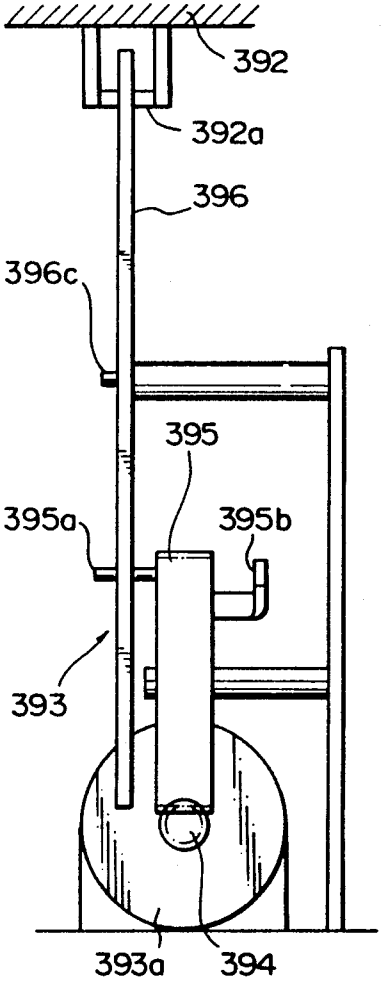
FIG. 29 is a fragmentary side elevation showing the shift tray drive mechanism.
Figure 28:
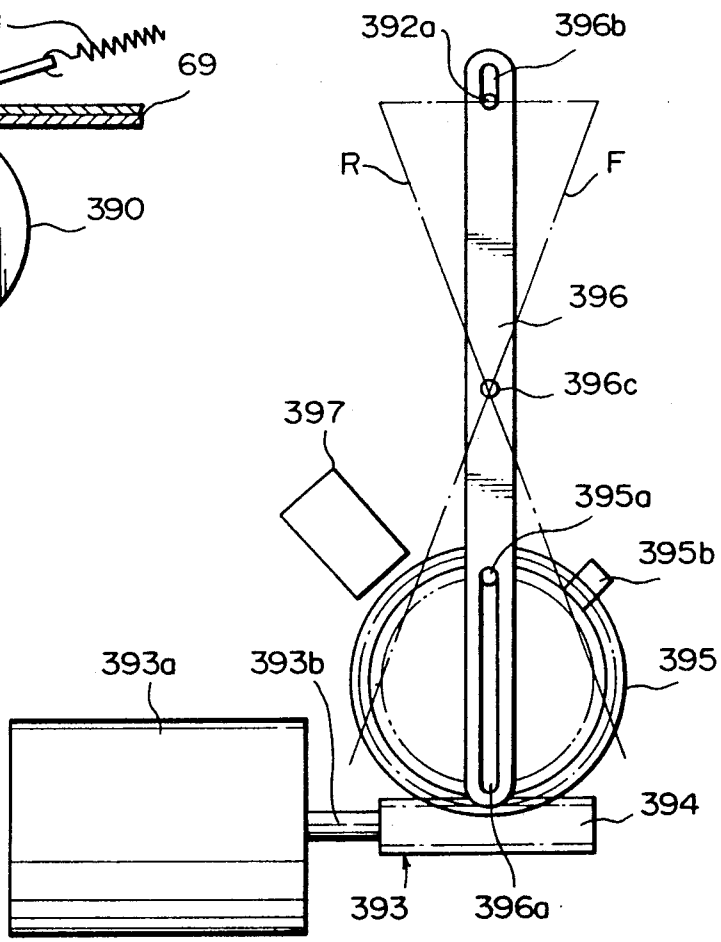
FIG. 28 is a fragmentary front view of a shift tray drive mechanism included in the embodiment.

As shown in FIGS. 28 and 29, the doggy tail section 355 has a shift tray 392 and a drive mechanism 393. The drive mechanism 393 has a motor 393*a*, a worm 394 affixed to the output shaft of the motor 393*a*, a worm wheel 395 held in mesh with the worm 394, a projection 395*a* extending from one end of the worm wheel 395 in parallel with the axis of rotation of the latter, and a link 396 rotatable about a support shaft 396*c* and having an elongate slot 396*a* in which the projection 395*a* is received. A pin 392*a* is studded on the shift tray 392 and received in another slot 396*b* formed through the link 396 at the opposite side to the slot 396*a*. An intercepting plate 395*b* extends sideways from the other end of the worm wheel 395 to sense the home position of the shift tray 392, i.e., the home position of the worm wheel 395. A home position sensor 397 is located in a position corresponding to the intercepting plate 395*b* and where it can sense the home position of the shaft tray 392.

When the motor 393*a* is energized, the worm 394 mounted on the output shaft 393*b* the motor 393*a* is rotated to in turn rotate the worm wheel 395. Then, the intercepting plate 395*a* intercepts the optical path of the home position sensor 397. At this instant, the link 396 has an inclination F and has moved the shift tray 392 forward, i.e., toward the document transfer section 351. After the document 69 has been fed out, the motor 393*a* is rotated by a predetermined number of pulses to in turn rotate the worm wheel 395 180 degrees. As a result, the link 396 is brought to an inclination R to move the shift tray 392 rearward. In this manner, the shift tray 392 is slidable over a stroke of 30 millimeters in this embodiment due to the inclinations F and R. The intercepting plate 395*a* may be provided on the other end of the worm 394, if desired.

3. Sheet Finish

The paper sheet 37 undergone a copying operation at the image forming section 5 is transported to the finisher 11 to be finished in a desired mode entered by the operator. The document 69 will also be transported to the finisher 11, depending on the entered mode. The term "finishing" refers to sorting the documents 69 having been copied, stapling, etc. In the illustrative embodiment, a sorter/stapler having movable bins is used and handles both of the paper sheets 37 and documents 69, as follows.

3.1 Bin

Figure 30:
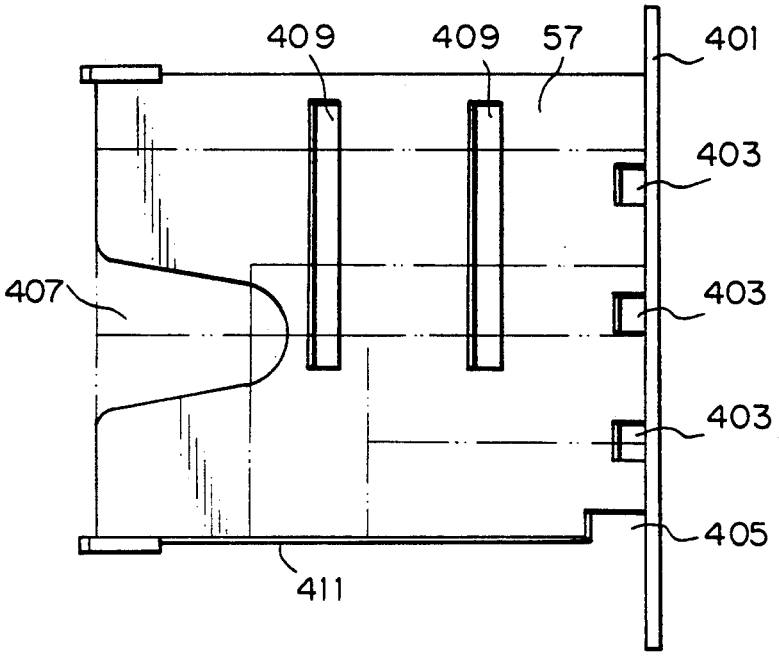
FIG. 30 is a plan view of a sheet bin included in the embodiment.
Figure 34:
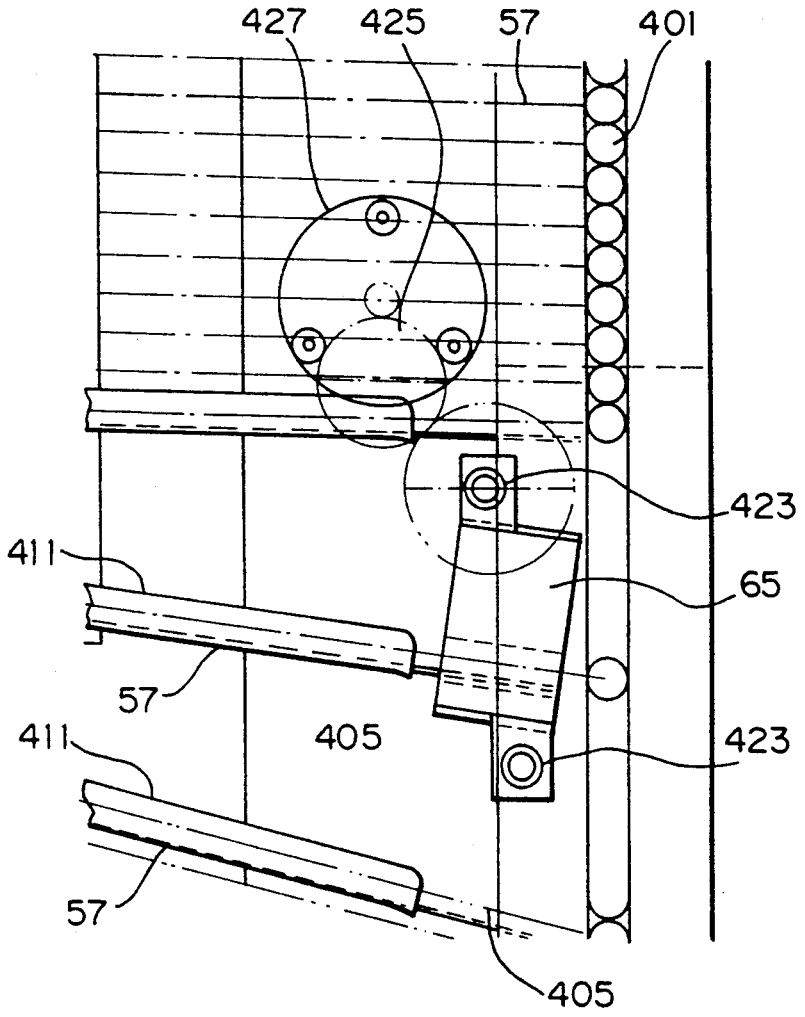
FIG. 34 is a side elevation of the stapling section as seen from the sheet discharge side.

As shown in FIG. 30, the bins 57 each is connected to a drive shaft 401 along the axis of the latter. The bin 57 has three holes 403 adjacent to the drive shaft 401 for receiving first drop rollers 431 which will be described, and a notch 405 formed at one edge in the vicinity of the drive shaft 401. A notch 407 is formed through the other end of the bin 57 to allow the operator to remove sheets by hand. Further, a pair of elongate slots 409 are formed through the intermediate portion of the bin 57 in order to receive joggers which will be described. As also shown in FIG. 34, the edge of the bin 57 which is shown at the bottom of FIG. 30 is configured as an upright wall 411, so that sheets may be positioned by the wall 411 when abutted thereagainst. In FIG. 30, dash-and-dots lines indicate the contours of sheets so positioned by the upright wall 411.

Figure 31:
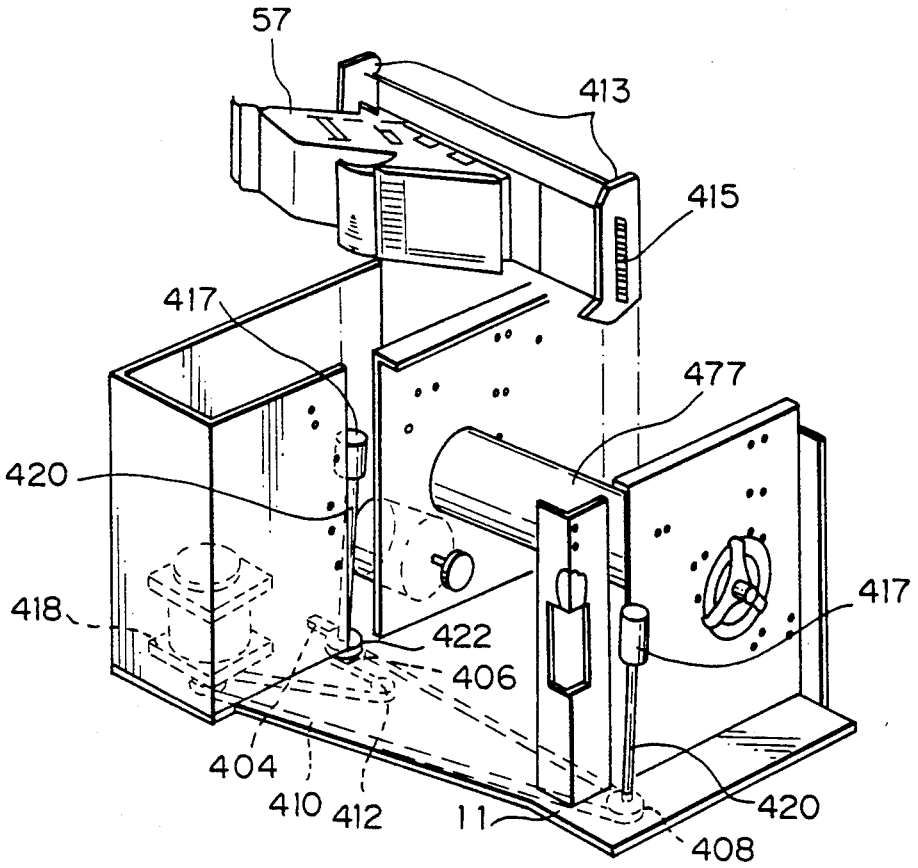
FIG. 31 is a perspective view showing a sheet bin section.

The illustrative embodiment has twenty bins 57, as stated earlier. As shown in FIG. 31, a bin holder 413 has guide channels 415. The drive shafts 401 of the bins 57 other than the drive shaft 401 of the lowermost bin 57 are received in the guide channels 415 and moved up and down by a helical wheel 417 shown in FIG. 32.

Specifically, as shown in FIG. 31, a pair of helical wheels 417 are driven by a bin motor 418. The helical wheels 417 are each mounted on the upper end of a shaft 420. A rotation sensing plate and a pulley 406 are mounted on the lower end of one of the two shafts 420, while a pulley 408 is mounted on the lower end of the other shaft 420. A belt 410 is passed over the pulleys 406 and 408 and a pulley mounted on the output shaft of the motor 418. To insure the accurate torque transmission from the motor 418, a pulley 412 is constantly pressed against the belt 410 to adjust the tension of the belt 410.

Part of the rotation sensing plate 422 in the circumferential direction is notched. A bin sensor 404 implemented by a photointerrupter senses light which is propagated through the notch of the plate 422. The bin sensor 404 generates a pulse every time it senses a predetermined number of rotations, e.g., one rotation of the plate 422. The number of such pulses, therefore, represents the number of rotations of the helical wheels 417. In addition, the number of pulses having been counted from the initial position is representative of the position of a bin 57 of interest relative to the others.

Figure 32:
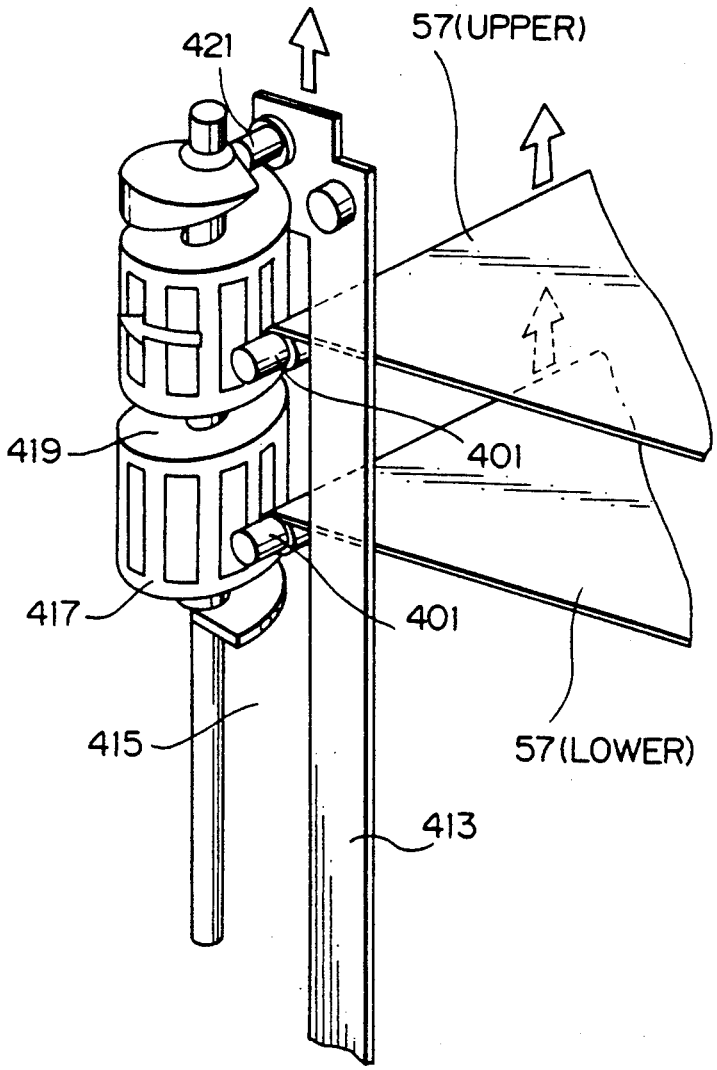
FIG. 32 is a fragmentary perspective view showing a helical wheel and sheet bins included in the embodiment.

A helical groove 419 extends over each helical wheel 417 by three turns. As the helical wheels 417 rotate, two of the bin drive shafts 401 which adjoin in the vertical direction are caught in the helical grooves 419 and raised thereby. At the same time, the bin holder drive shafts 421 extending from the top of the bin holder 413 are also raised. As soon as the shaft 401 of the upper bin 57 (UPPER, FIG. 32) dropped from the notch and being raised meets the shafts 421, the helical wheel 417 is brought to a stop. At this instant, the lower bin 57 is held in a halt at a position labled LOWER in FIG. 32. The position labeled UPPER in FIG. 32 is the stand-by position for stapling, as will be described.

3.2 Staple Mechanism

Figure 33:
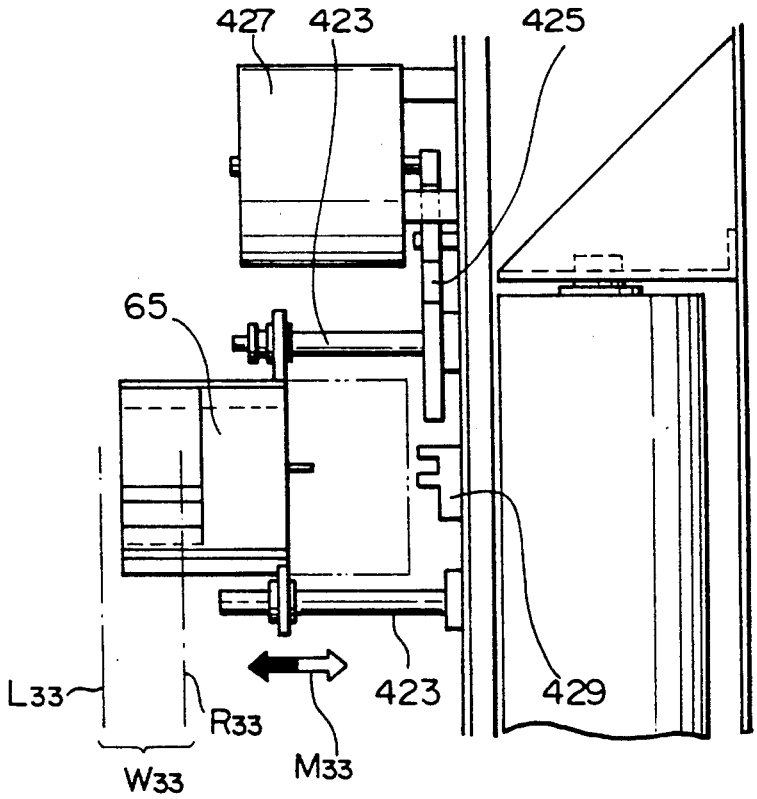
FIG. 33 is a front view of a stapling section included in the embodiment, as seen from the sheet discharge side.

Referring to FIGS. 33 and 34, the stapler 65 is supported by a pair of lead screws 423 in such a manner as to be movable toward and away from one side of the bin 57, as indicated by an arrow $M_{33}$. A stapler motor 427 is drivably connected to the lead screws 423 via a gear train 425. In FIG. 33, the distance $W_{33}$ between dash-and-dot lines $L_{33}$ and $R_{33}$ shown at the left-hand side and the right-hand side, respectively, is representative of the width of the notch 405 for stapling, FIG. 30. The stapler 65 is retracted from the notch 405 by the motor 427 except when it is in a stapling operation. The retracted position, or home position, of the stapler 65 is sensed by a home position sensor 429 which is mounted on a side panel which supports the motor 427 and gear train 425.

Figure 41:
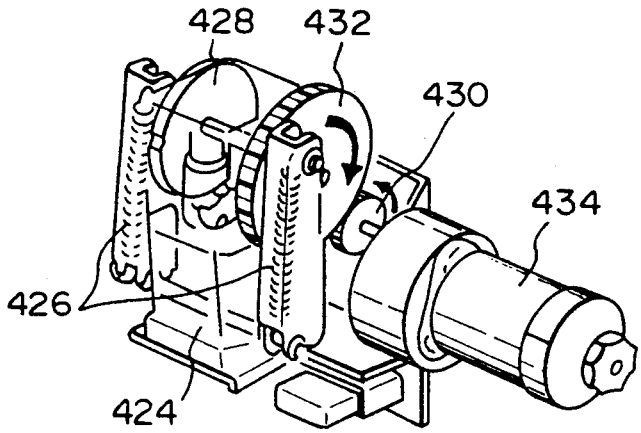
FIG. 41 is a perspective view of a stapler body included in the stapling section.
Figure 42:
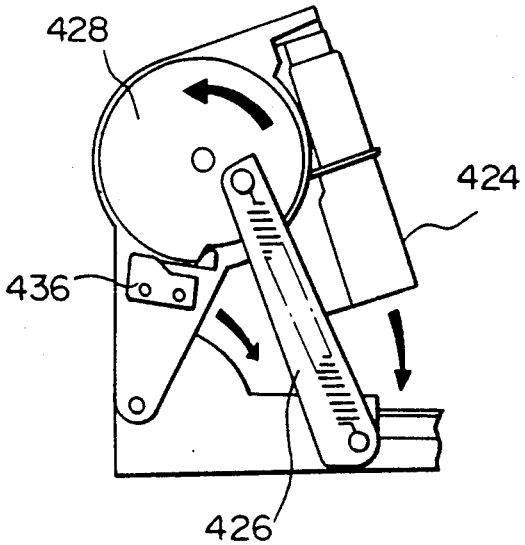
FIG. 42 is a side elevation of the stapler body.
Figure 43:
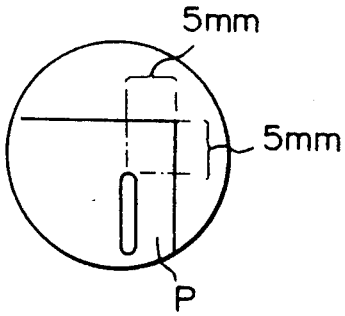
FIG. 43 shows a staple position.

As shown in FIG. 41, the stapler 65 has a hammer 424, a link 426, a drive gear 430, a driven gear 432, and a motor 434. The motor 434 drives the drive gear 430 which in turn drives the driven gear 432 meshing with the drive gear 430. The driven gear 432 rotates a cam 428. The hammer 424 is driven by the link 426 which is actuated by the cam 428. When sheets are set in the staple position, the hammer 424 starts rotating. As the hammer 424 completes one rotation, it presses a stapler home position sensor 436 and thereby stops the rotation of the cam 428, as shown in FIG. 42. In this condition, the stapler 65 staples the paper sheets. Here, the sheets are stapled such that the upper end of a staple is located at a distance of 5 mm as measured from the upper edge and the side edge of the sheets.

3.3 Sheet Drop Mechanism

Figure 35:
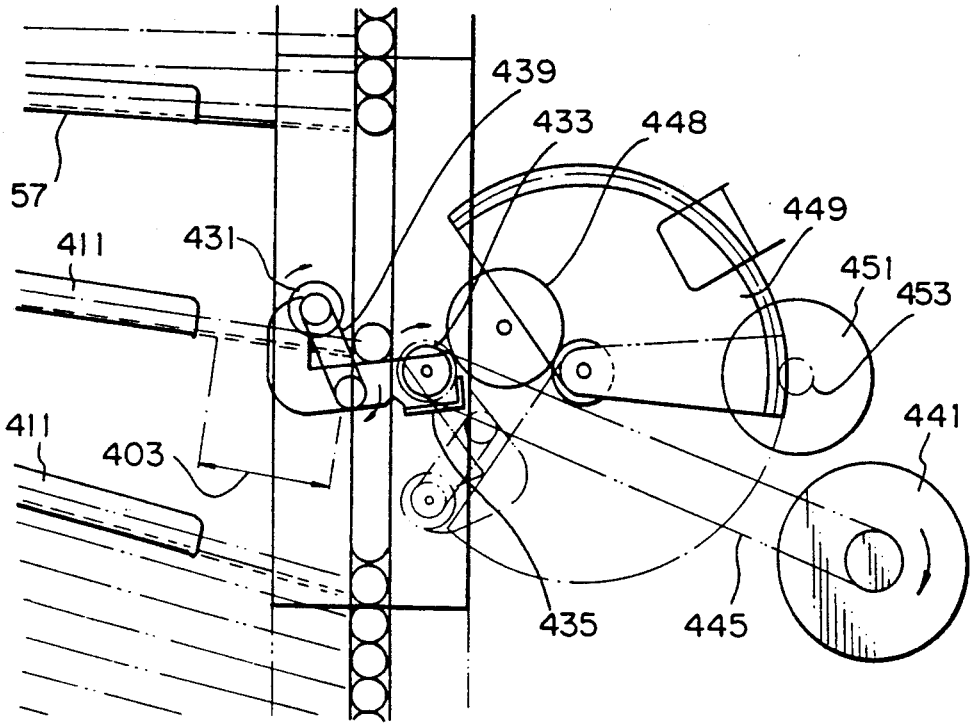
FIG. 35 is a fragmentary front view of a sheet dropping mechanism included in the embodiment.
Figure 36:
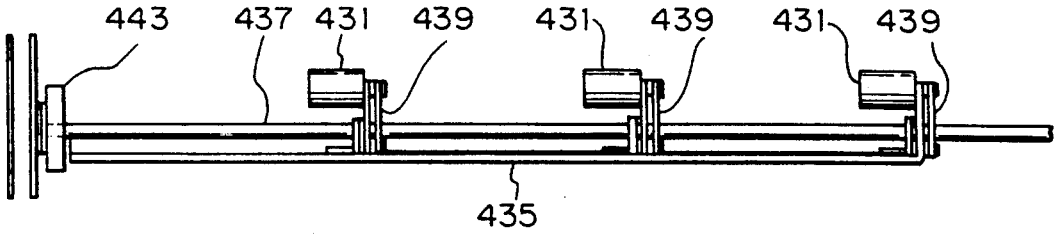
FIG. 36 is a fragmentary front view of a drop roller.
Figure 37:
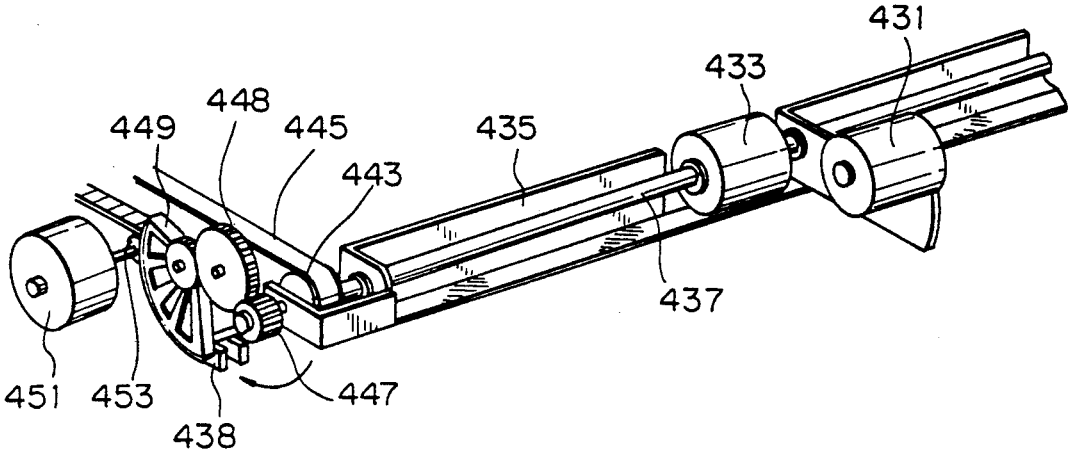
FIG. 37 is a perspective view showing the drop roller and a mechanism for driving it.

In the finisher 11, the stack tray 67 is located such that stacks of sheets sequentially stapled by the stapler 65 are let fall and stacked on the tray 67, as stated earlier. FIGS. 35 through 37 show a mechanism for so dropping the stapled sheet stacks onto the stack tray 67. As shown, the mechanism has three first drop rollers 431 and three second drop rollers 433. The first drop rollers 431 are rotatably mounted on an elevatable arm 435 while the second drop rollers 433 are mounted coaxially on a drive shaft 437. Endless rubber members 439 are each passed over one of the first drop roller 431 and associated one of the second drop rollers 433, whereby the rotation of the drive shaft 437 is transmitted to the first roller 431 via the second roller 433.

Figure 131:
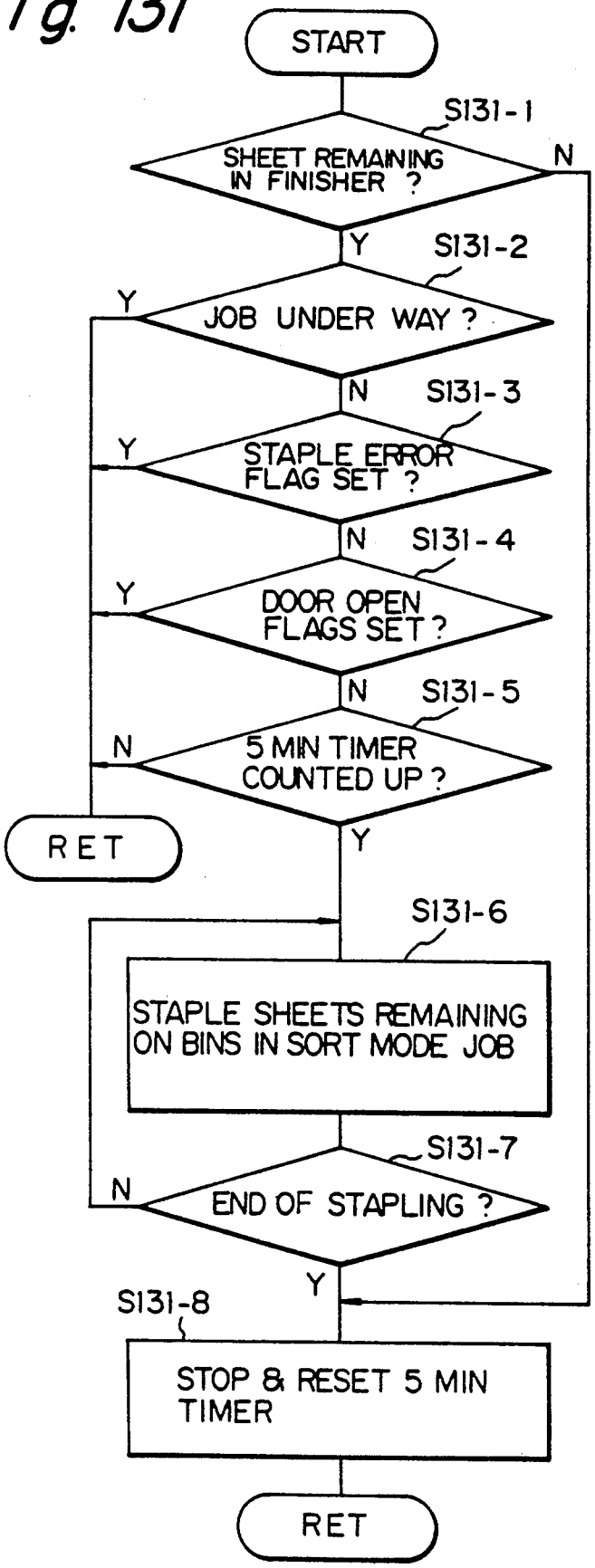
Figure 132A:
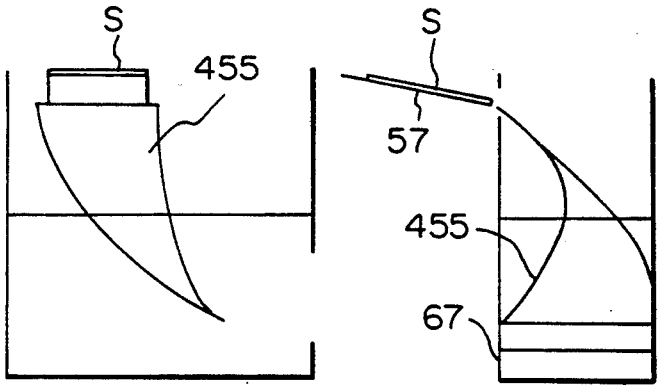
FIGS. 132A through 132F show stapled sheets being dropped toward a stack tray.
Figure 132B:
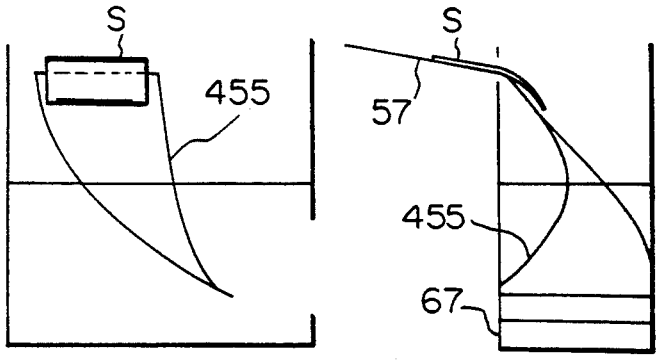
Figure 132C:
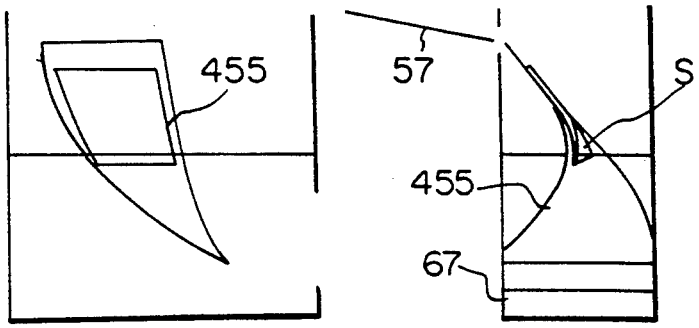
Figure 132D:
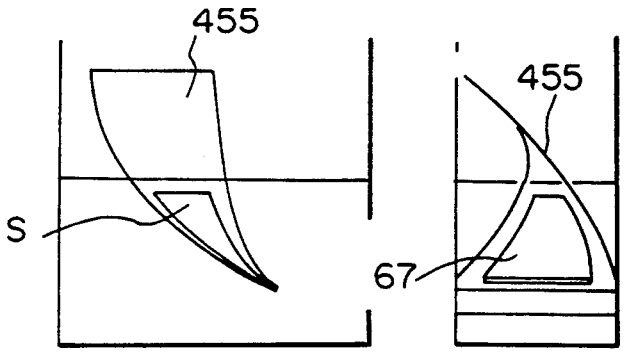
Figure 132E:
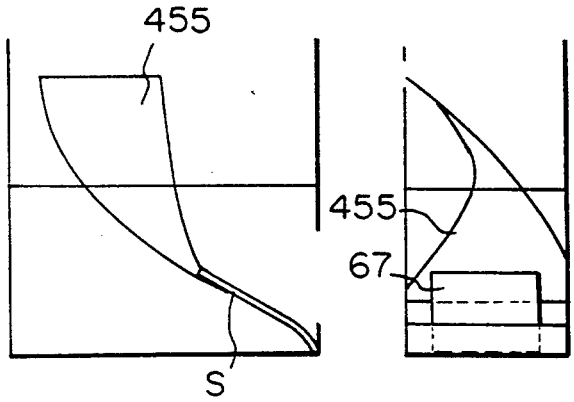
Figure 132F:
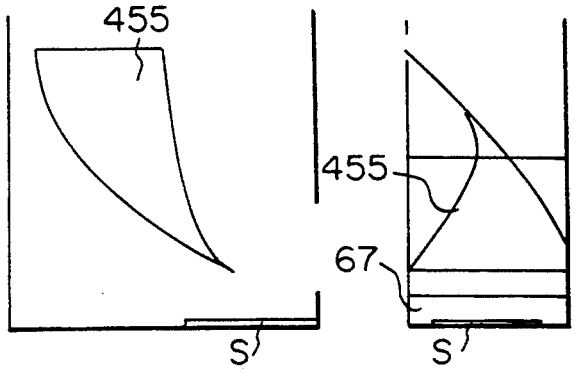

The elevatable arm 435 is movably coupled over the drive shaft 437 and is movable independently of and about the drive shaft 437, as will be described. A belt 445 is passed over the output shaft of a motor 441 and a pulley 443 which is mounted on one end of the drive shaft 437. A gear 447 is mounted on one end of the elevatable arm 435. A sector gear 449 is held in mesh with the gear 447 with the intermediary of a gear 448. The sector gear 449 is meshed with a drive gear 453 which is mounted on the output shaft of a motor 451. In the illustrative embodiment, the sector gear 449 and, therefore, the elevatable arm 435 is rotatable over an angular range of 120 degrees. In this configuration, as the elevatable arm 435 rotates 120 degrees from a position indicated by a dash-and-dots line in FIG. 35 while the drop rollers 431 and 433 rotating about their own axes, the drop rollers 431 protrude from the holes 403 of the bin 57. As a result, the stapled sheet stack S is released from a stop, not shown, and then drops from the bin 57 onto the stack tray 67. Such a procedure is shown in a flowchart in FIG. 131.

As shown in FIGS. 132A to 132F, the stack tray 67 has an inclined surface 455 which repositions the sheet stack S dropped from the bin 57 such that the sheet stack S will have been turned 90 degrees when it reaches the front end of the equipment. In the figures, front views as seen from the sheet discharge side and front views as seen from the front end of the copier are shown at the left-hand side and the right-hand side, respectively.

3.4 Jogger Mechanism

Figure 38:
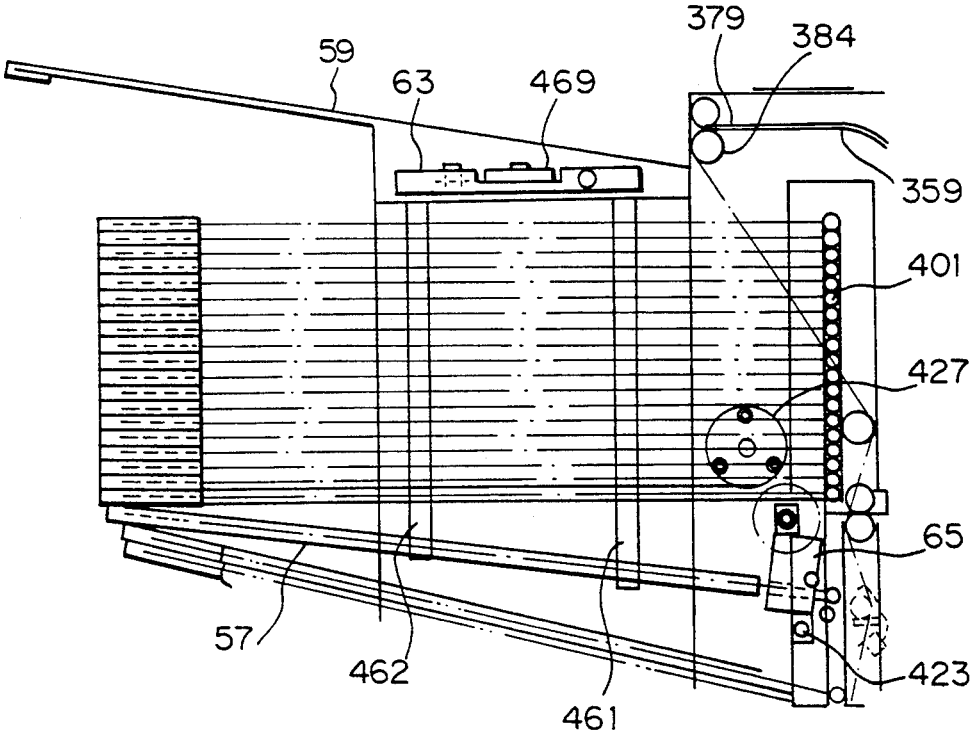
FIG. 38 is a fragmentary perspective view of a jogger mechanism included in the embodiment.
Figure 39:
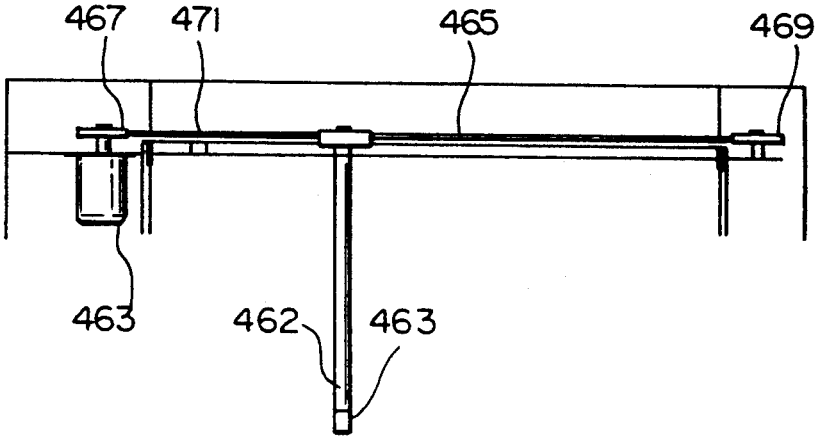
FIG. 39 shows a mechanism for driving the jogger mechanism.

To staple and stack the sheets S as stated above, it is necessary to arrange the sheets S neatly. FIGS. 38 and 39 show a jogger mechanism which plays such a role. As shown, the jogger mechanism has a front and a rear jogger rod 461 and 462 extending throughout the slots 409 of the bins 57, and a motor 463 for driving the jogger rods 461 and 462 via a belt 465. Driven by the motor 463, the jogger rods 461 and 462 each is movable in and along the associated slots 409 of the bins.

Figure 40:
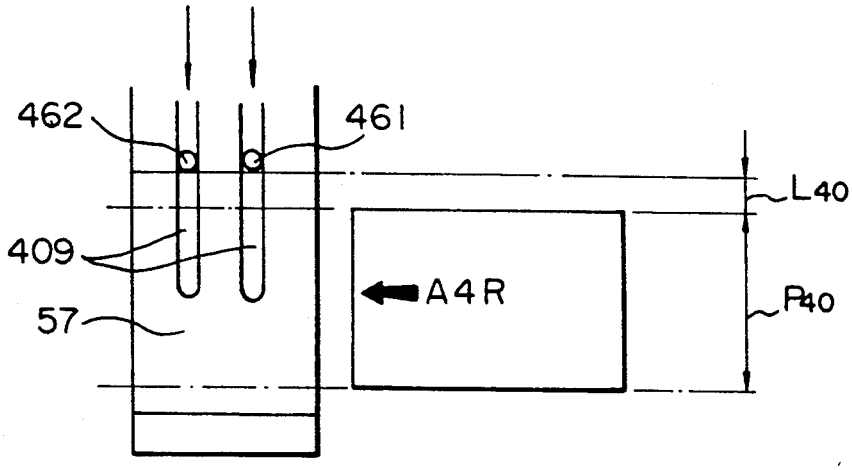
FIG. 40 indicates a relation between jogger rods included in the jogger mechanism and a sheet.

A drive pulley 467 is mounted on the output shaft of the jogger motor 463 which is implemented as a stepping motor. A belt 465 is passed over the drive pulley 467 and a driven pulley 469 which is located to face the drive pulley 467 with the intermediary of the slots 409. When the main switch of the copier is turned on, the jogger rods 461 and 462 are located at a home position which is sensed by a home position sensor 471. On the turn-on of a start key, the jogger rods 461 and 462 are moved to a position matching cassette size data or document size data. Specifically, as shown in FIG. 40, this position is short of a paper size $P_{40}$ by $L_{40}$ (=15 mm). In such a position, the jogger rods 461 and 462 wait for the entry of a sheet in the bin 57. As soon as a sheet is fully driven out onto the bin 57, the jogger rods 461 and 462 are moved to the paper size to position the sheet. The jogger rods 461 and 362 perform such an action every time a sheet enters the bin 57.

3.5 Sheet Deflect Mechanism

A sheet deflecting device 475 is located in the switching section 61 and between a plurality of transport rollers. The device 475 has a switching wheel 477 which is rotatable to selectively communicate a plurality of incoming paths and a plurality of outgoing paths. As shown in FIG. 1, in the illustrative embodiment, a document inlet path $G_{in}$ and a paper sheet inlet path $P_{in}$ are the incoming paths, while a tray-oriented path $T_{out}$ and a bin-oriented path $B_{out}$ are the outgoing paths.

Then, four different combinations are available, as follows:

| | Incoming | | Outgoing |
|---|---|---|---|
| [1] | $G_{in}$ | → | $B_{out}$ |
| [2] | $G_{in}$ | → | $T_{out}$ |

-continued

| | Incoming | | Outgoing |
|---|---|---|---|
| [3] | $P_{in}$ | → | $B_{out}$ |
| [4] | $P_{in}$ | → | $T_{out}$ |

How the above-mentioned combinations are changed over will be described later with reference to FIGS. 96A to 96D. Data representative of the angular movements (pulses) of the switching wheel 477 are shown in FIG. 95.

Figure 44:
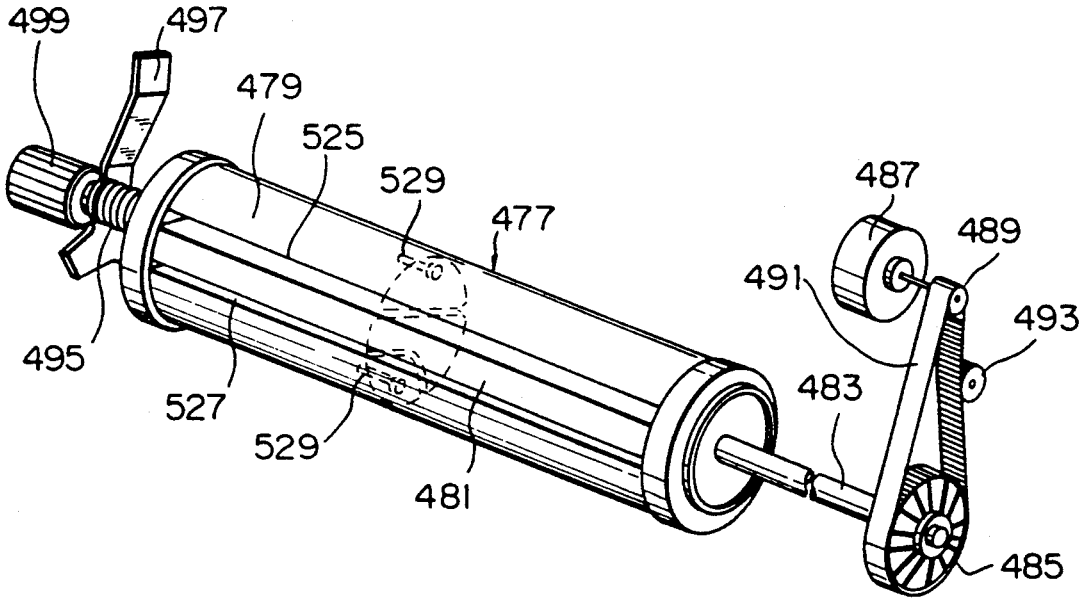
FIG. 44 is a perspective view showing a switching wheel and a mechanism for driving it included in the embodiment.

As shown in FIG. 44, the switching wheel 477 is made up of two parts, i.e., a front wheel 479 and a rear wheel 481 which are respectively located at the front side and the rear side as seen from the front of the copier 1. A shaft 483 extends throughout and along the axis of the switching wheel 477. A pulley 485 is mounted on one end or rear end of the shaft 483. A belt 491 is passed over the pulley 485 and a pulley 489 which is mounted on the output shaft of a motor 487. A tensioner in the form of a pulley 493 is held in contact with the belt 491 to adjust the tension of the belt 491. A plate 497 is affixed to the other end or front end of the shaft 483 by a knob 499 with the intermediary of a spring 495. The knob 499 is threaded into the shaft 483.

Figure 45:
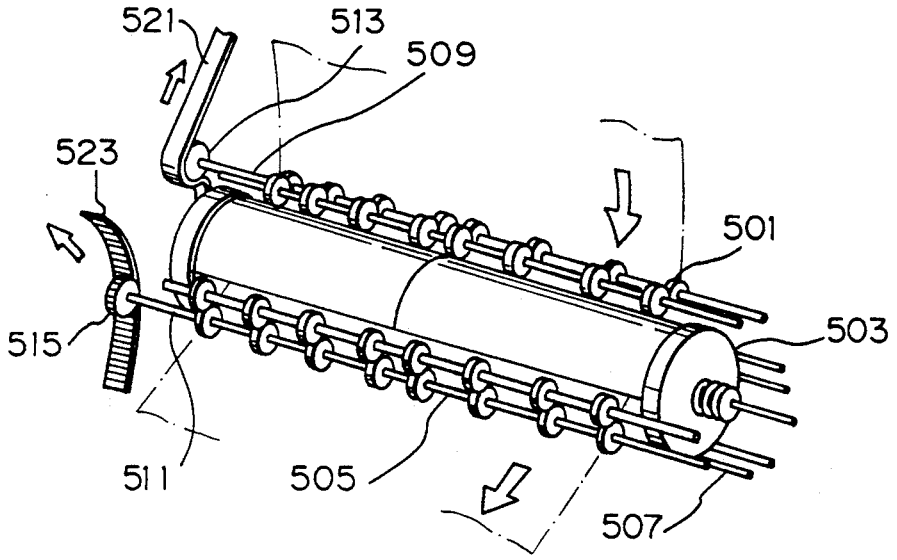
FIG. 45 is a perspective view showing the switching wheel and transport rollers arranged theraround.

As shown in FIGS. 1 and 45, two pairs of transport rollers 501 and 503 and two pairs of discharge rollers 505 and 507 are arranged around the switching wheel 477 to face the open ends of guide passages 525 and 527 which are defined in the wheel 477, as will be described. These roller pairs each corresponds to respective one of the previously mentioned document inlet path $G_{in}$, paper inlet path $P_{in}$, tray-oriented transport path $T_{out}$, and bin-oriented transport path $B_{out}$. The roller pairs 501, 503, 505 and 507 are driven by a motor 517 via belts 521 and 523 which are passed over pulleys 513 and 515 and a pulley 591. The pulleys 513 and 515 are respectively mounted on shafts 509 and 511, while the pulley 519 is mounted on the output shaft of the motor 517. In this construction, a sheet coming in through the path $G_{in}$ or $P_{in}$ is steered toward the path $T_{out}$ or $B_{out}$.

Figure 46:
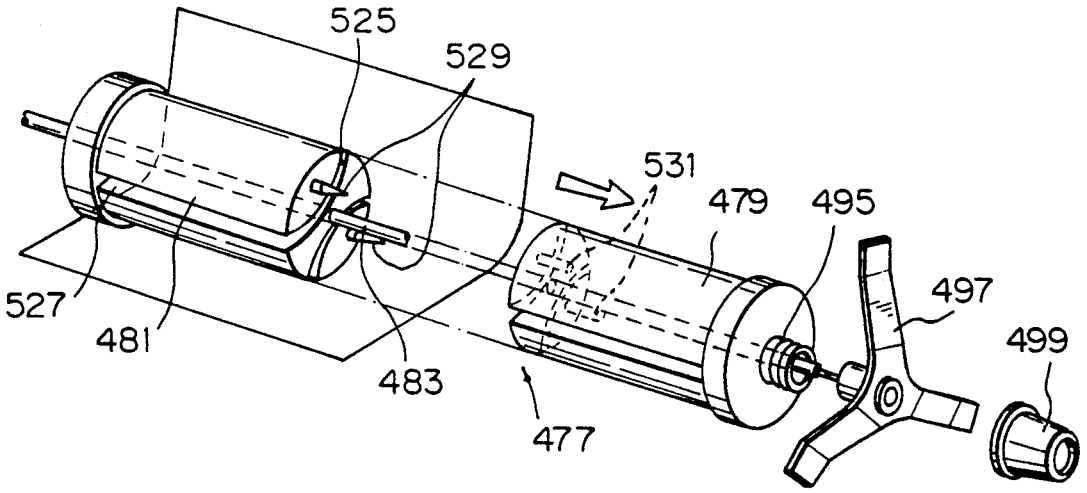
FIG. 46 is a perspective view showing a front and a rear switching wheel separated from each other.

As shown in FIGS. 44 and 46, the switching wheel 477 has two guide passages 525 and 527 thereinside. The guide passages 525 and 527 implement any one of the previously mentioned four different combinations [1] to [4]. The two wheel parts 479 and 481 constituting the switching wheel 477 are positioned relative to each other and synchronized to each other during rotation by bores 531 formed in one part 479 and pins studded on the other part 481. Such a configuration facilitates the removal of a jamming sheet. Specifically, when a sheet jams the guide path 525 or 527, the operator may remove the knob 499 and then the switching wheel 479 from the shaft 483.

Figure 133:
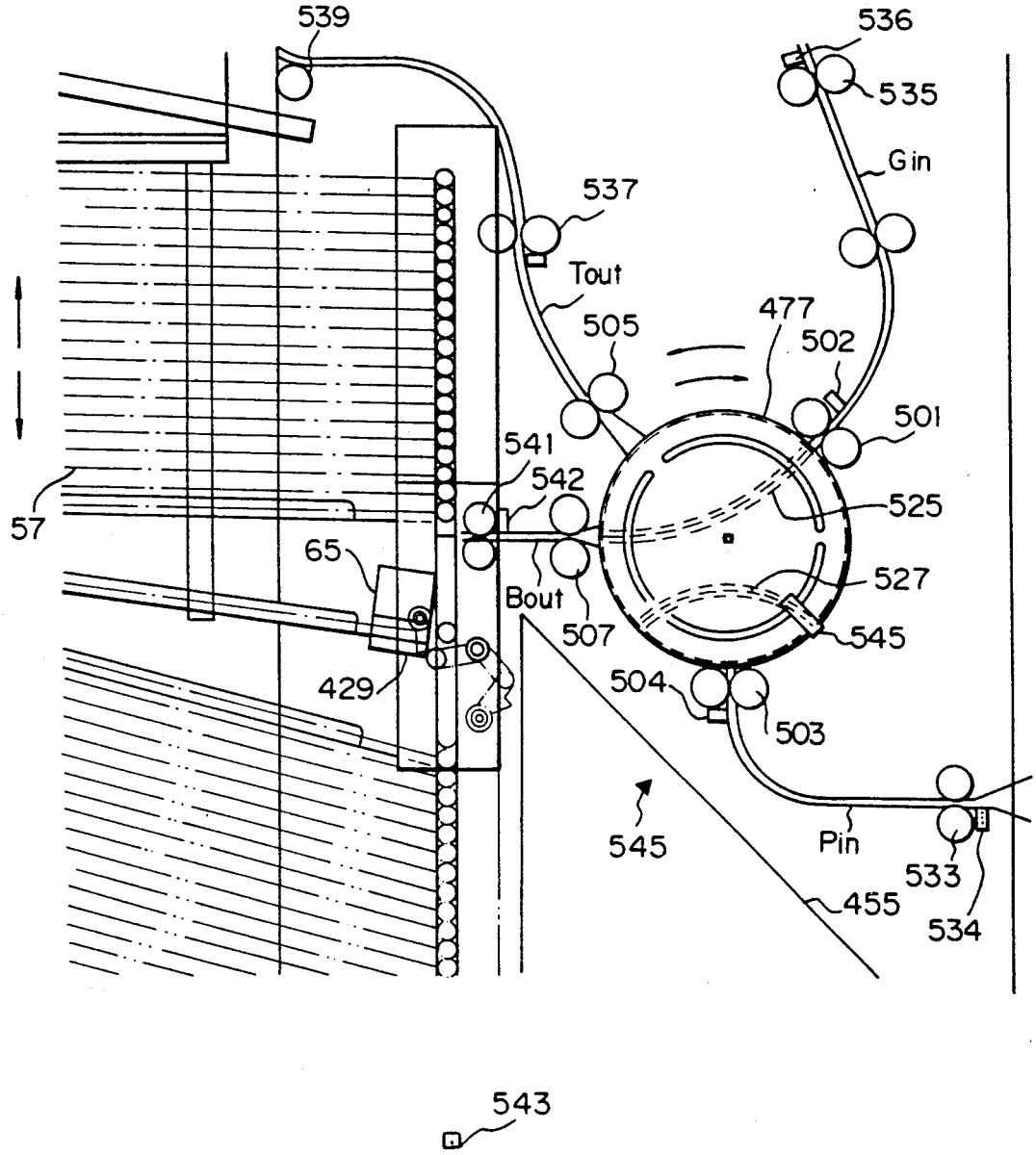
FIG. 133 shows sensors arranged around the switching wheel.

FIG. 133 shows various sensors arranged around the switching wheel 477 and is representative of a particular mode in which documents are driven out onto the bins 57. As shown, sensors 534 and 504 are respectively located immediately before a transport roller pair 533 arranged on the paper inlet path $P_{in}$, and immediately before the transport roller pair 503. Likewise, sensors 536 and 502 are respectively associated with a transport roller pair 535 and the transport roller pair 501 arranged on the document inlet path $G_1$. Sensors 538 and 540 are respectively associated with transport roller pairs 537 and 539 arranged on the tray-oriented transport path $T_{out}$. Further, a sensor 540 is associated with a transport roller pair 541 arranged on the bin-oriented transport path $B_{out}$. A bin home position is located at the home position of the supported portions of the bins 57. Regarding the stapler, a stapler home position sensor (position 429), a staple end sensor (position 429), and a stapler rotation sensor (position 429) are positioned are arranged. Also shown in FIG. 133 are the jogger home position sensor and a switching wheel home position sensor 545.

The switching wheel 477 is driven by the motor 487, as state previously. Hence, by counting pulses on the basis of data representative of the current position of the wheel 477, it is possible to select newly entered one of the guide paths 525 and 527.

4. Control Circuitry

Figure 47A:
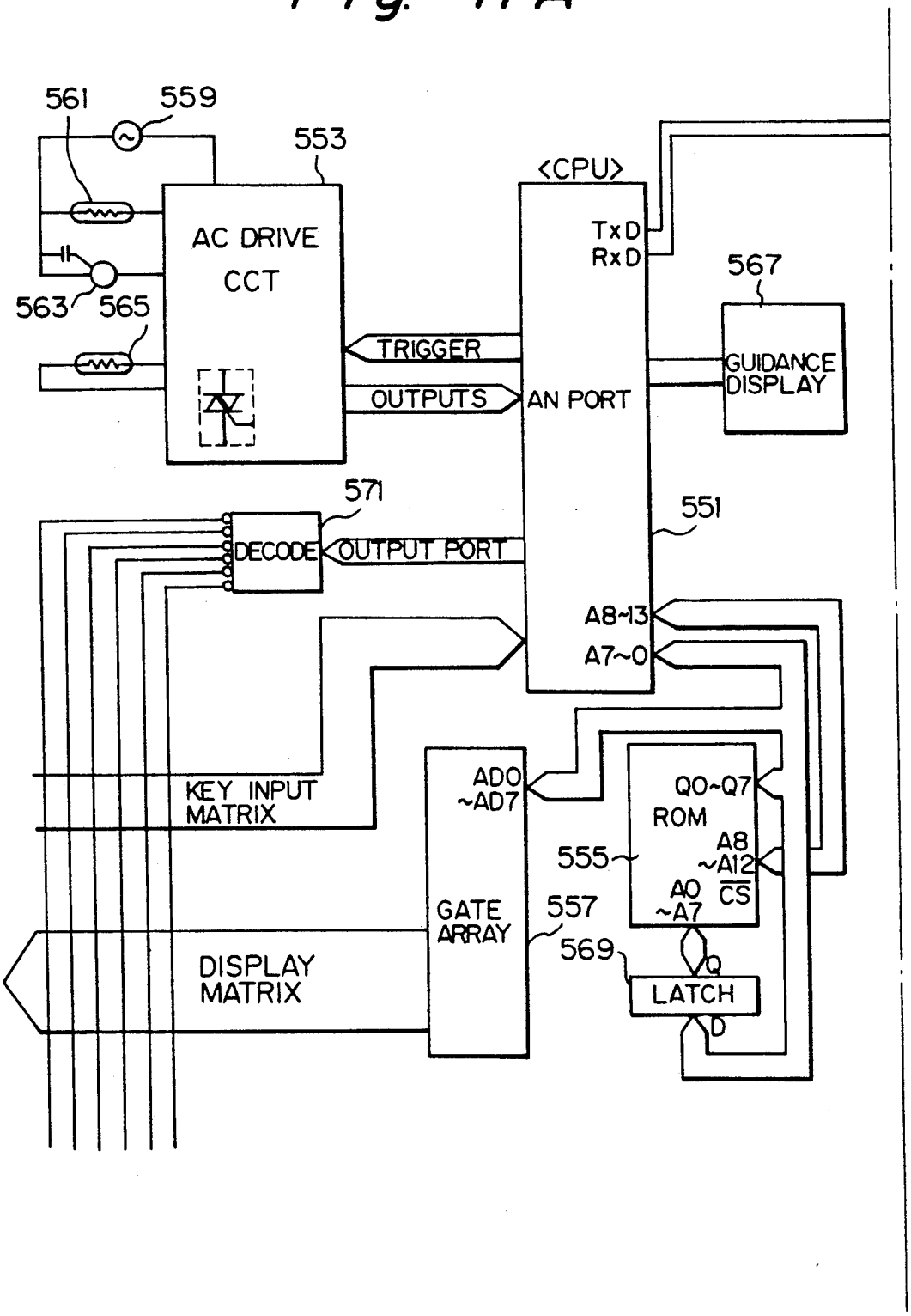
FIGS. 47A through 47C are block diagrams schematically showing a control system incorporated in the body of the copier.
Figure 47B:
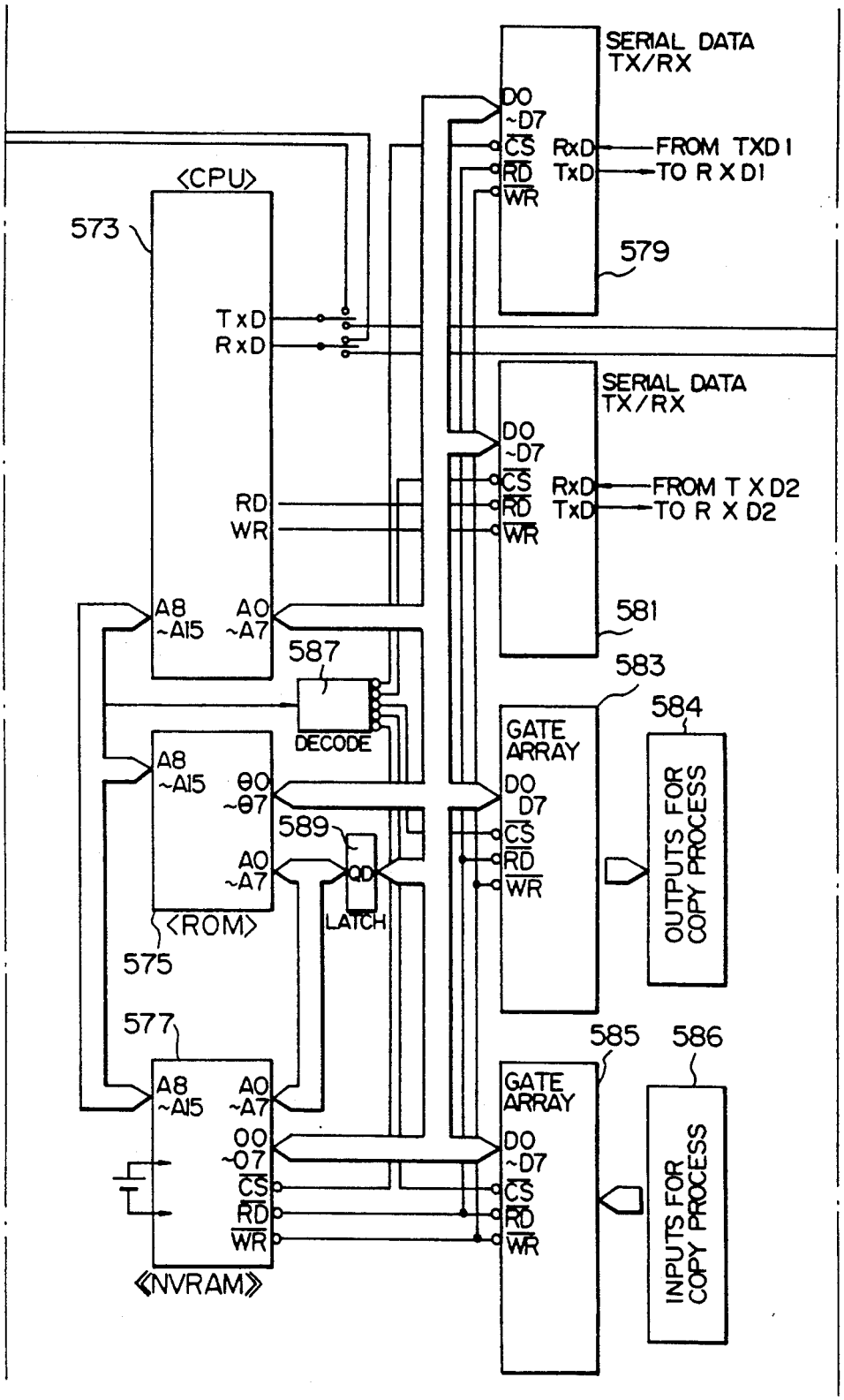
Figure 47C:
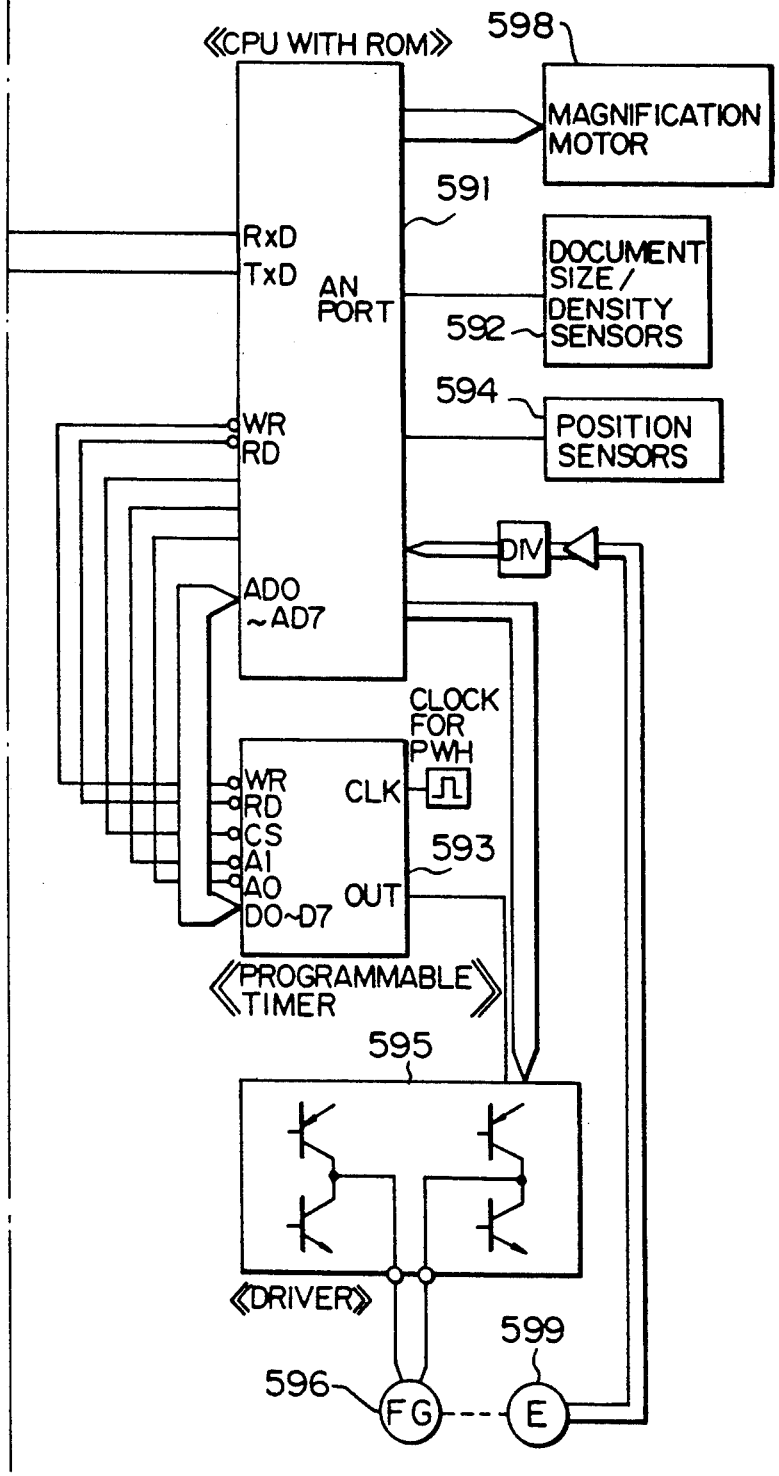

Referring to FIGS. 47A to 47C, control circuitry built in the copier body is shown and generally made up of an operating section AC control line, a copying process control line and an optics control line.

The operating section AC control line has a central control (hereinafter referred to as a CPU) 551, an AC drive circuit 553, a ROM 555, and a gate array 557. The AC drive circuit 553 controls a fixing heater 551 and a motor 563 which are directly powered by an AC power source, and a lamp 565. The AC drive circuit 553 is connected to AN ports included in the CPU 551. The CPU 551 is connected directly to a guidance display 557, to a ROM 557 via a latch 569, and to a gate array 557 and a decoder 571 connected to a display matrix so as to control them in response to the outputs of a key matrix.

The copy process control line has a CPU 573, a ROM 575, a non-volatile RAM 577, two serial data transmission/reception devices 579 and 581, and two gate arrays 583 and 585. These components are connected together by a bus and controlled by the CPU 573. The reference numerals 587 and 589 designate a decoder and a latch, respectively.

The serial data transmission/reception devices 579 and 581 each interchanges data with a CPU included in a document feeding device which will be described. The gate arrays 583 and 585 are respectively associated with various outputs 584 and various inputs 586 for the copying process.

The optics control line has a CPU 591 having a ROM thereinside, a programmable timer 593, and a driver 595 for driving a servo motor 596. The programmable timer 593 and driver 595 each is connected to the CPU 591 by a bus. An encoder 599 has the output thereof connected to the CPU 591 and senses the rotation of the servo motor 596. The CPU 591 performs various kinds of control over a stepping motor 598 and other components belonging to the optics control line in response to the outputs of a document size sensor, a document density sensor 592, and various position sensor 594. The CPU 551 of the operating section AC control line and the CPU 591 of the optics control line are connected to the CPU 573 of the copy process control line at TxD and RxD terminals thereof.

Figure 48A:
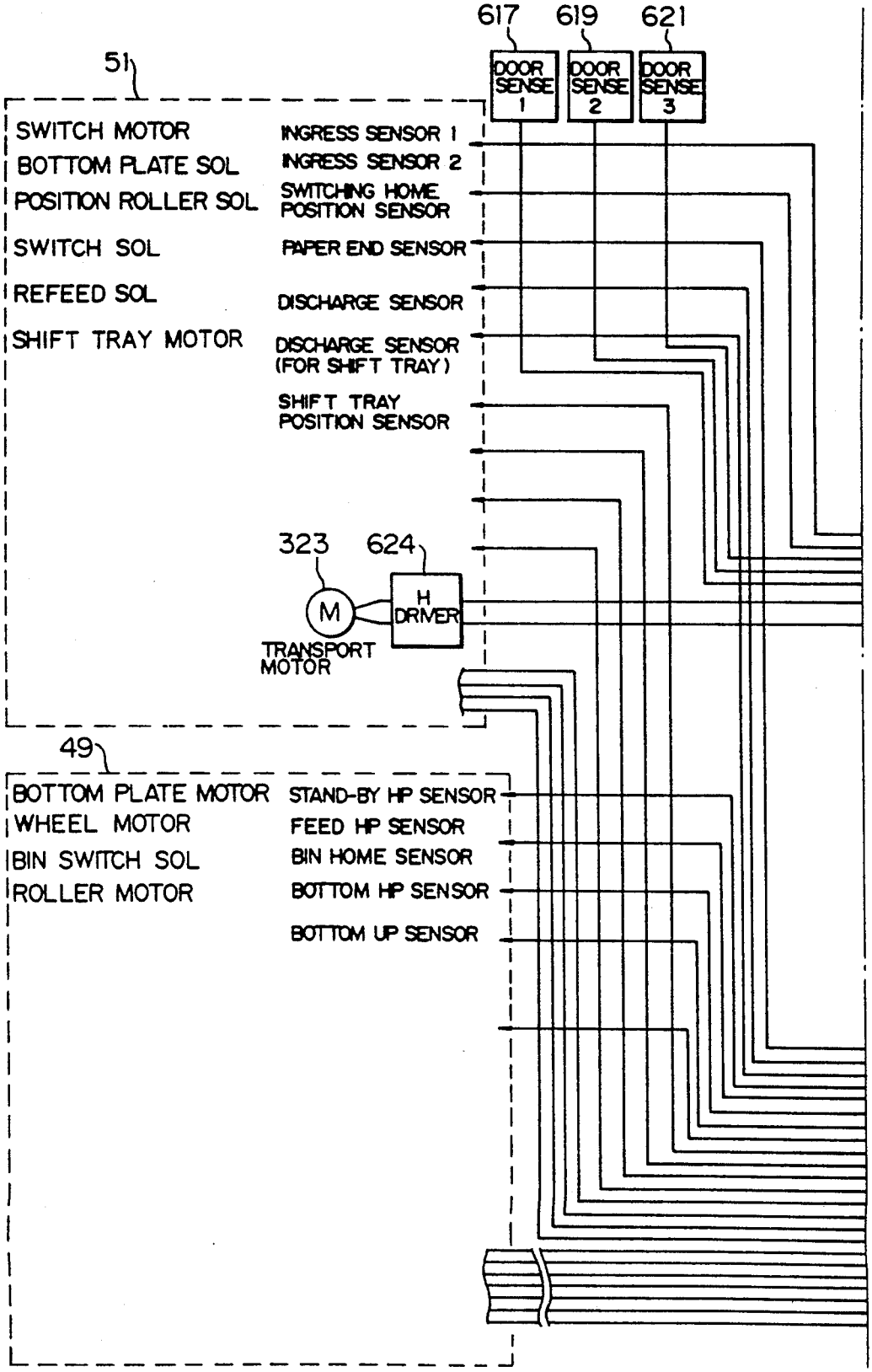
FIGS. 48A and 48B are schematic block diagrams showing a document transport and fed control system incorporated in the document transport unit.
Figure 48B:
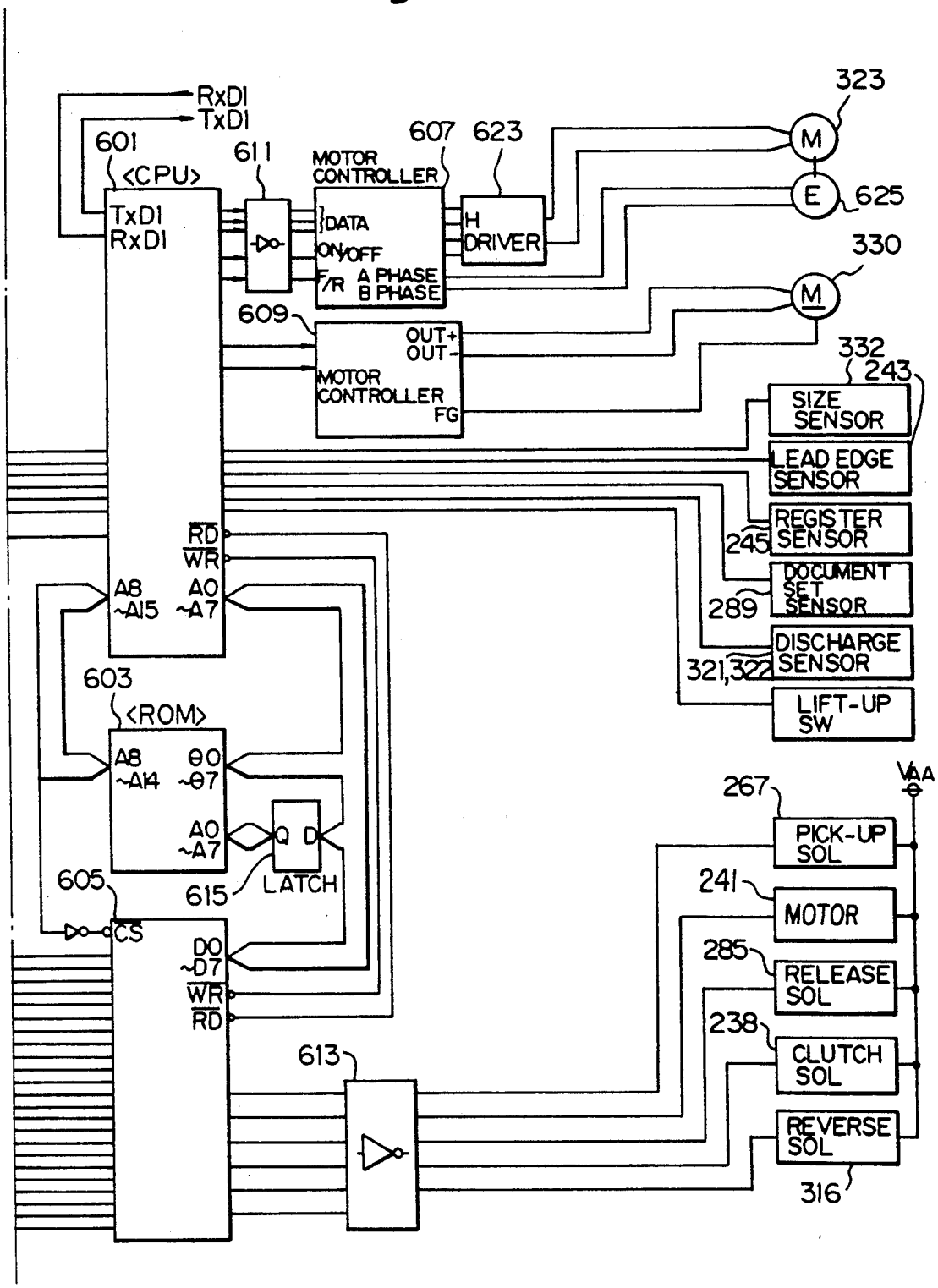

FIGS. 48A and 48B schematically show a document feed control line associated with the document transport unit 11. As shown, the document feed control line has a CPU 601, a ROM 603, a gate array 605, two motor controllers 607 and 609, drivers 611 and 613, and a latch 615. The document discharge section 55, i.e., various control devices included in the document stack unit are connected to the CPU 601. Specifically, a first through a third door sensor 617, 619 and 621 and a driver 611 are connected to the CPU 601. A belt drive motor, i.e., a driver (H type driver) 623 for driving the document feed motor 323 is connected to the CPU 601 via a motor controller 607. An encoder 625 responsive to the rotation of the motor 323 is connected to the motor controller 607. The document discharge motor 330 is connected to the CPU 601 via the motor controller 609. Further connected to the CPU 601 are the size sensor 332, leading edge sensor 243, discharge sensors 321 and 322, and lift-up switch 289. The pick-up solenoid 267, release solenoid 285, register solenoid 238, reverse solenoid 316 and bottom plate elevation motor 241 are connected to the gate array 605 via the driver 613.

Figure 49:
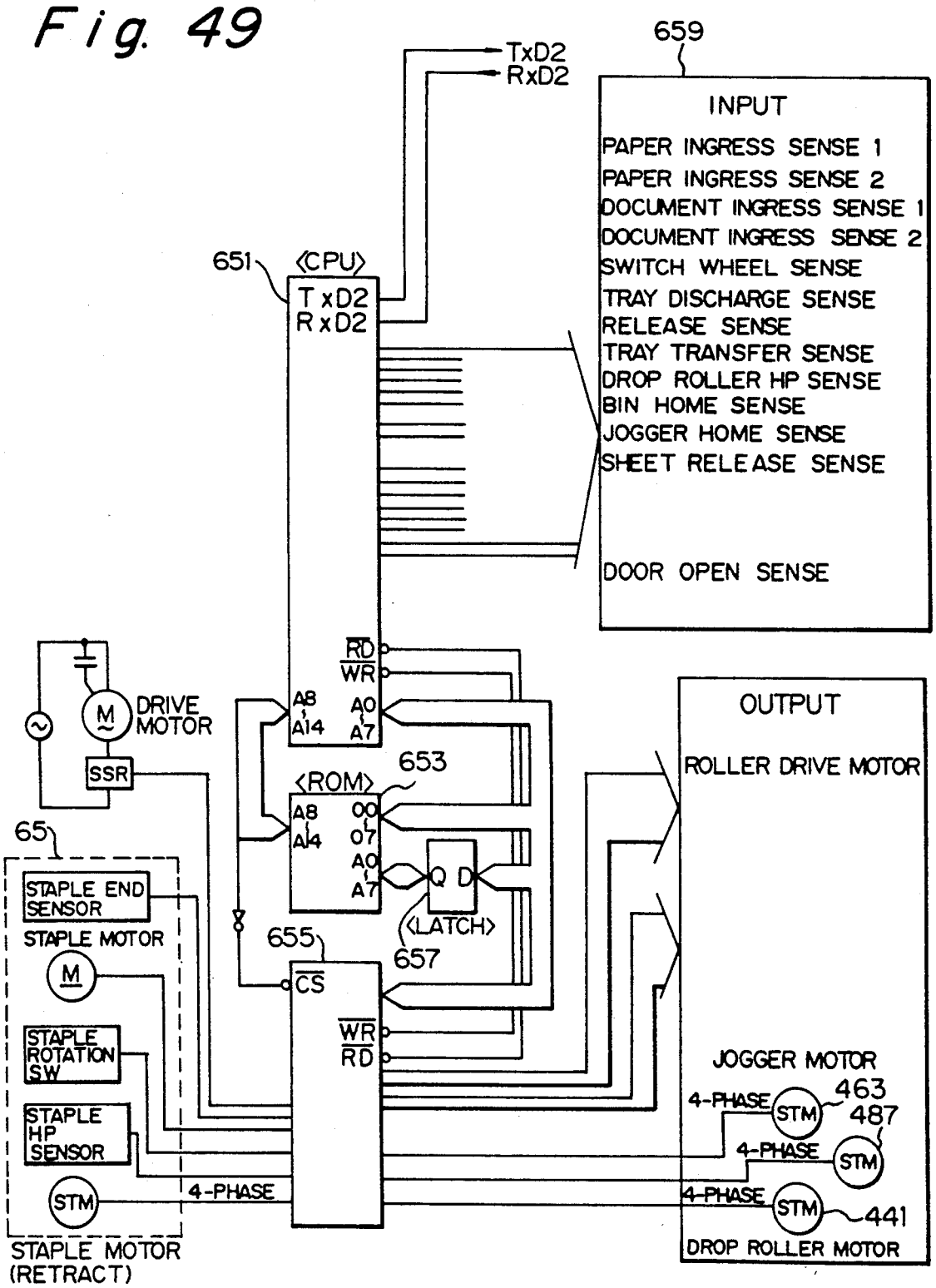
FIG. 49 is a block diagram schematically showing a control system incorporated in a finisher included in the embodiment.

FIG. 49 shows control circuitry for controlling the finisher 11. As shown, the control circuitry has a CPU 651, a ROM 653, a gate array 655, and a latch 657. The CPU 651 receives the outputs 659 of various control devices associated with the finisher 11 and thereby performs various kinds of control which will be described. The CPU 651 is connected to the drive motor 434, jogger motor 463, switching wheel motor 487, drop roller drive motor 441, and various control devices associated with the stapler 6 via the gate array 655.

The CPU 601 of the document feed unit control line is connected to the serial data transmission/reception device 579 of the copy process control line at TxD1 and RxD1 terminals thereof. The CPU 651 of the finisher control line is connected to the serial data transmission/reception device 581 of the copy process control line at TxD2 and RxD2 terminals thereof. In this configuration, the CPU 573 of the copy process control line and the CPUs 551, 591, 601 and 651 of the individual sections are communicable with each other.

5. General Control Scheme

Figure 134A:
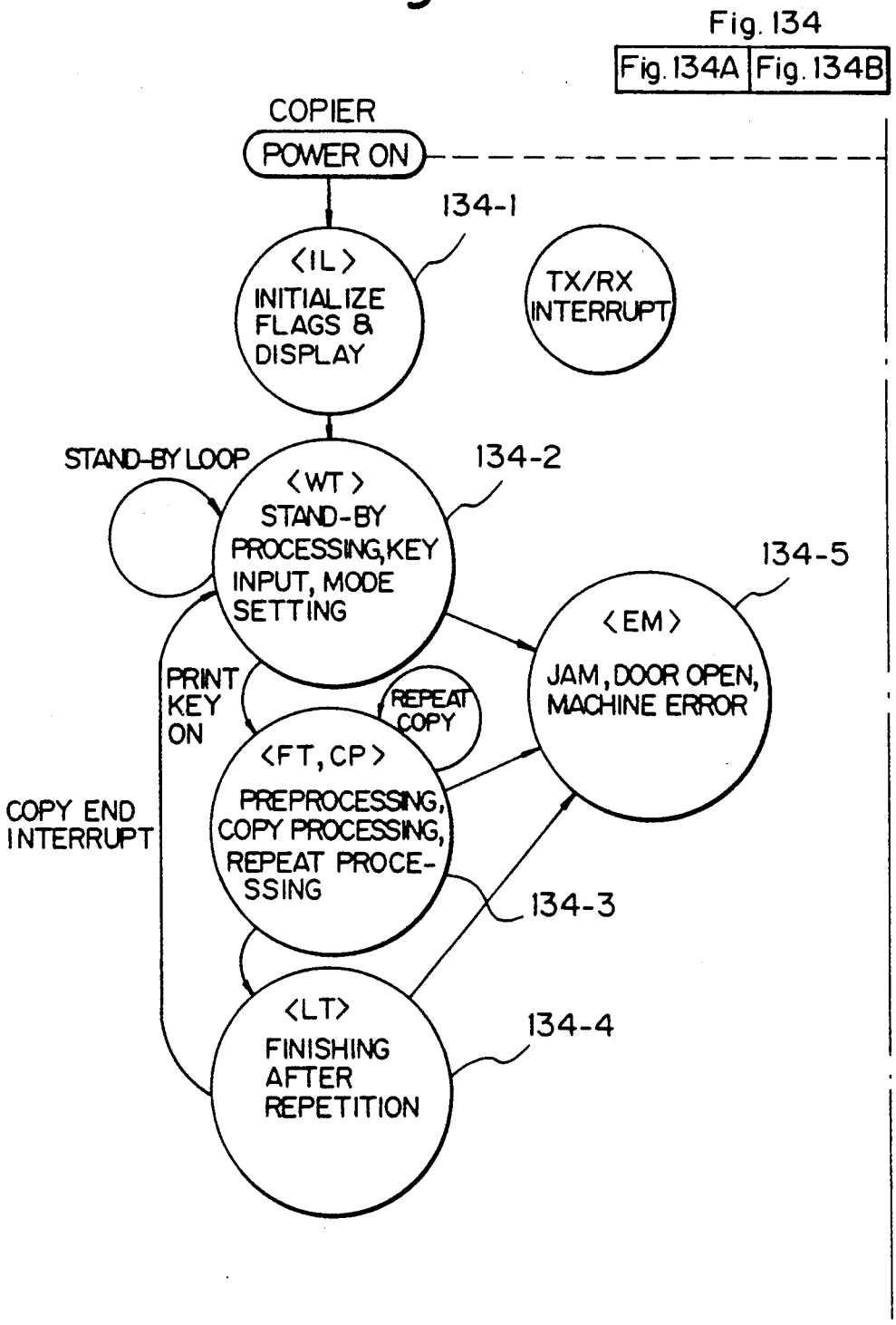
FIGS. 134A and 134B is a view schematically showing the general control inclusive of the communication between the copier and the multi-step ADF and finisher.
Figure 134B:
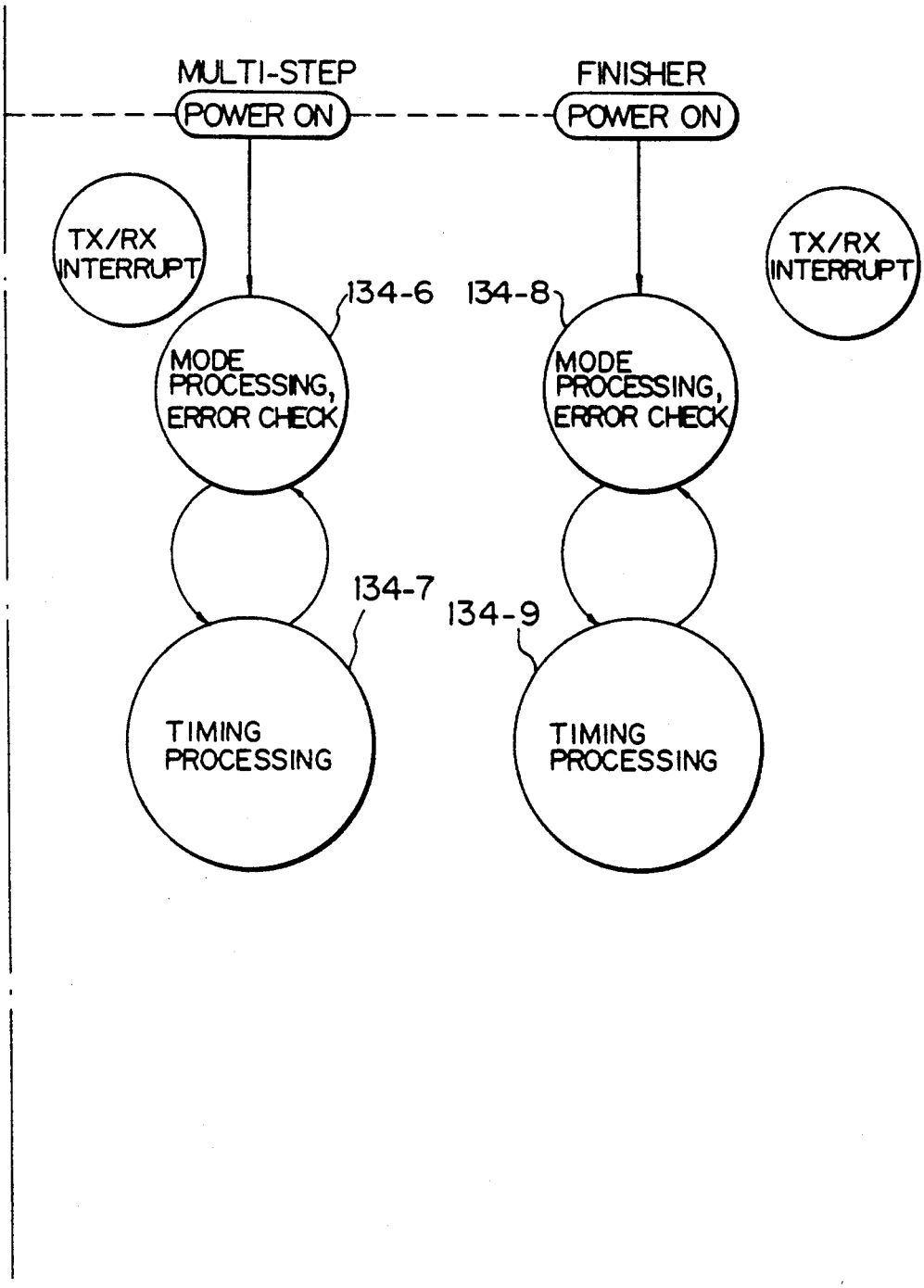

Referring to FIG. 134, how the individual sections each being constructed as described above are interconnected and controlled will be described. As shown, on the turn-on of the power source, the multi-step ADF 49 and finisher 11 each executes various kinds of checking or processing. Specifically, the copier body 1 executes initialization 134-1 first and then sequentially executes stand-by processing 134-2, preprocessing and copy processing 134-3, and postprocessing 134-4. An error mode 134-5 represented by error checking is included in each of such processing to cope with various kinds of errors. The initialization 134-1 refers mainly to display initialization and flag initialization. The stand-by processing 134-2 includes key input processing and mode set processing. The preprocessing and copy processing 134-3 includes repeat processing. Further, the postprocessing 134-4 refers to processing which follows the repeat processing. The operation will be transferred from the postprocessing to the stand-by processing 134-2 on the completion or the termination of copying or to the error mode 134-5 on the occurrence of an error.

In the multi-step ADF 49 and the finisher 11, mode processing, error checking 134-6 and 134-8, and timing processing 134-7 and 134-9 are executed repetitively.

6. Control Over Individual Sections

The operations of the individual sections and those of the entire copier system constituted by the individual sections will be described with reference to flowcharts.

6.1 General

The copier 1 has the multi-step ADF 49 at the document feed side thereof and, therefore, can execute a plurality of different jobs in sequence. Specifically, in a reverse mode, a plurality of jobs (five jobs in the embodiment) at maximum may be entered and stored. The copier 1 is capable of selecting a particular copying sequence which increases the productivity and executing processing according to the jobs. Of course, the copier 1 allows a normal or ordinary copy mode to be selected, as desired. The reserve mode or the copy mode is selected on the basis of non-volatile RAM data or by use of a dip switch provided on a printed circuit board.

The reserve mode and normal mode each includes processing to be executed during copying operation, processing which follows the discharge of a copy, and document processing. In both of the reserve mode and the normal mode, the processing during copying operation executes a copying operation matching entered modes. In the processing which follows the discharge of a copy, sorting, stapling or similar finishing operation is performed. It is to be noted that the lowermost bin of the finisher 11 will be the first bin in the sort mode while the uppermost bin will be the first bin in the staple mode. In the document processing, documents are sequentially discharged to the shift tray 392 or the sort bins 57, for example, according to the desired mode.

6.2 Reserve Mode

In the reserve mode, a plurality of jobs are entered beforehand, and various timings such as the start timing are determined and executed by the copier 1. The method of executing the jobs and other methods are the same as with ordinary copying operations.

Preconditions for the reserve mode to be set are as follows:

(1) peripheral or optional units are designated; and (2) the reserve mode is selected.

Whether or not the precondition (1) is satisfied is represented by whether or not the optional units are connected on-line by serial communication. If the precondition (1) has been satisfied, either the reserve mode or the normal mode can be selected, as desired. Hence, the operator selects the reserve mode or the normal mode by rewriting the data stored in the non-volatile RAM 577 or by use of the dip switch.

Figure 53:
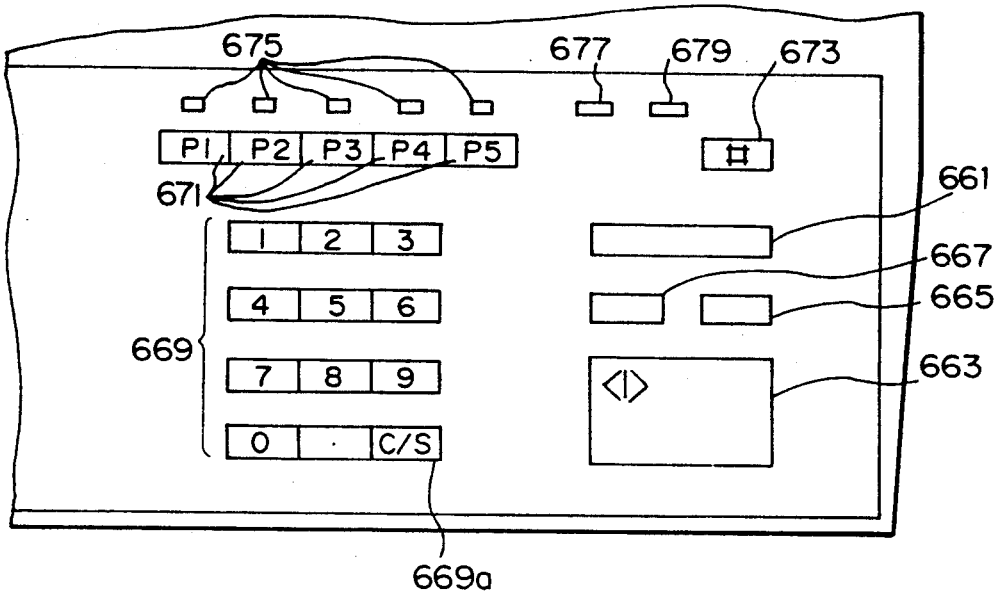
FIG. 53 is a fragmentary plan view of an operating section having various keys thereon.

A procedure for selecting the reserve mode will be outlined hereinafter. Various keys provided on the operating section and which will be mentioned are shown in FIG. 53.

(1) Input (a) A reserve mode key 661 is turned on. Then, a reserve (accept) LED 677 flashes or glows. (While the LED 667 is flashing or glowing, the program retracts from the reserve mode.)

(b) After the entry of a three-figure numerical value (code), one of reserve select keys P1, P2, P3, P4 and P5, or 671 collectively, is turned on. In the event of erroneous input, a mode clear key 665 is held in a valid state. If the numerical value entered does not have three figures, the program retracts from the reserve mode. (If the keys P1 to P5 have already been turned on, the mode is cleared and then changed.)

(c) If the three-figure code is acceptable, one of LEDs LEDP1, LEDP2, LEDP3, LEDP4 and LEDP5 associated with the keys P1 to P5 flashes. The reserve LED 677 is turned on.

(d) After the entry of the reserve mode, an enter key 673 is turned on.

(e) If the enter key 673 has been turned on, an LED 675 associated with the operated key 671 glows. The reserve LED 677 is turned off.

(2) Mode Clear and Change (a) The reverse mode key 661 is turned on.

(b) After the entry of a three-figure numerical value, any one of the reserve mode keys P1 through P5 is turned on. In the event of the entry of an incorrect numerical value, the mode clear key 665 is held in a valid state.

(c) If the entered numerical value is not correct, a reserve error LED 675 is turned on, and the program retracts from the reserve mode.

(d) If the entered numerical value is acceptable, associated one of the keys P1 through P5 flashes. Then, the entered mode is set up while the reserve LED 677 is turned on.

(3) Mode Clear (a) The mode clear key 665 and enter key 673 are turned on at the same time (0.5 seconds).

(b) The associated LED 675 and reserve LED 877 are turned off.

(4) Mode Correct (a) A mode to be substituted for the entered mode is inputted on a particular key, and then the enter key 673 is turned on. On the completion of the job, one of the LEDs P1 through P5 associated with the job is turned off. While the job is under way, a stop key is held in a valid state. Reservation is acceptable.

Figure 50:
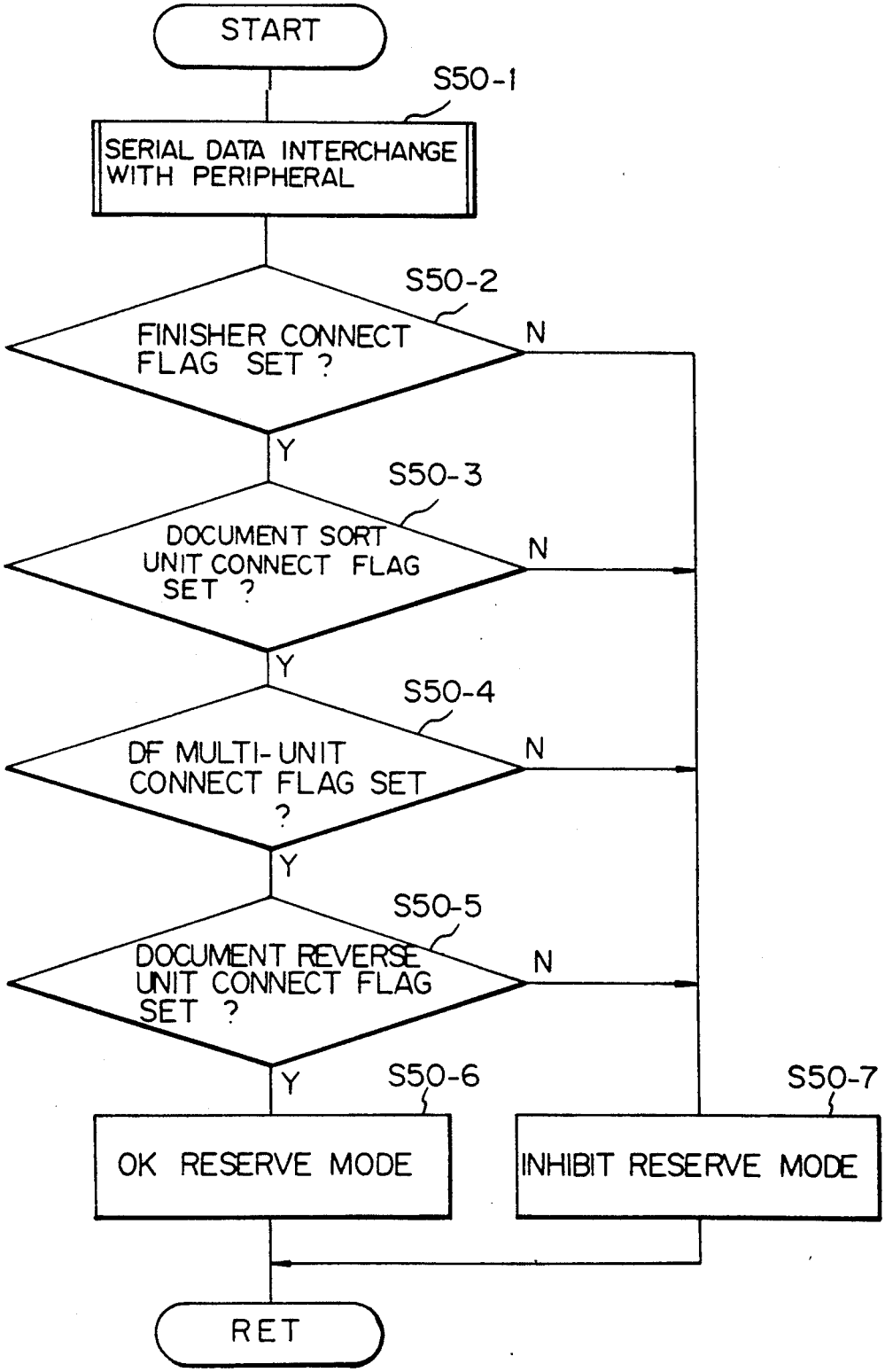
FIGS. 50 and 51 are flowcharts each showing a specific reserve mode setting procedure.

The above procedures will be described specifically with reference to FIGS. 50 and 51. As shown in FIG. 50, a subroutine for establishing serial transmission and reception paths with the peripheral units is executed (step S50-1). Then, whether or not the finisher 11 is connected (S50-2), whether or not the document stack unit 52 is connected (S50-3), whether or not the multi-step unit 50 is connected (S50-4), and whether or not the document reverse unit 52 is connected (S50-5) ar determined. If all such units are connected, the program allows the reserve mode to be set up (S50-6) and then returns. If any one of the peripheral units is not connected as determined in the steps S50-2 through S50-5, the program inhibits the reserve mode from being set (S50-7) and then returns. This is followed by a sequence of steps shown in FIG. 51.

Figure 51:
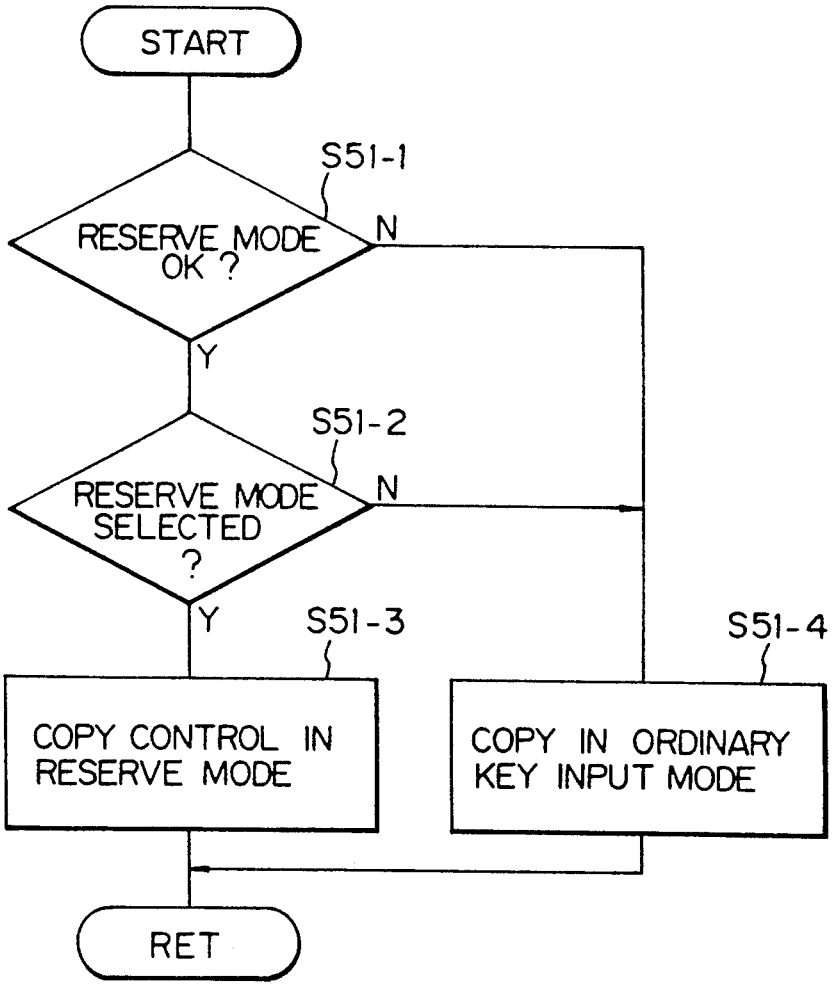

In FIG. 51, if the reserve mode has been allowed as determined in a step S51-1, the reserve mode is selected (S51-2). If the reserve mode has been selected, copy control is executed as the reserve mode (S51-3). If the reserve mode has not been allowed as determined in the step S51-1 or if the reserve mode has not been selected as determined in the step S51-2, a step S51-4 is executed to perform a copying operation in response to ordinary key inputs.

Figures 1, 52A:
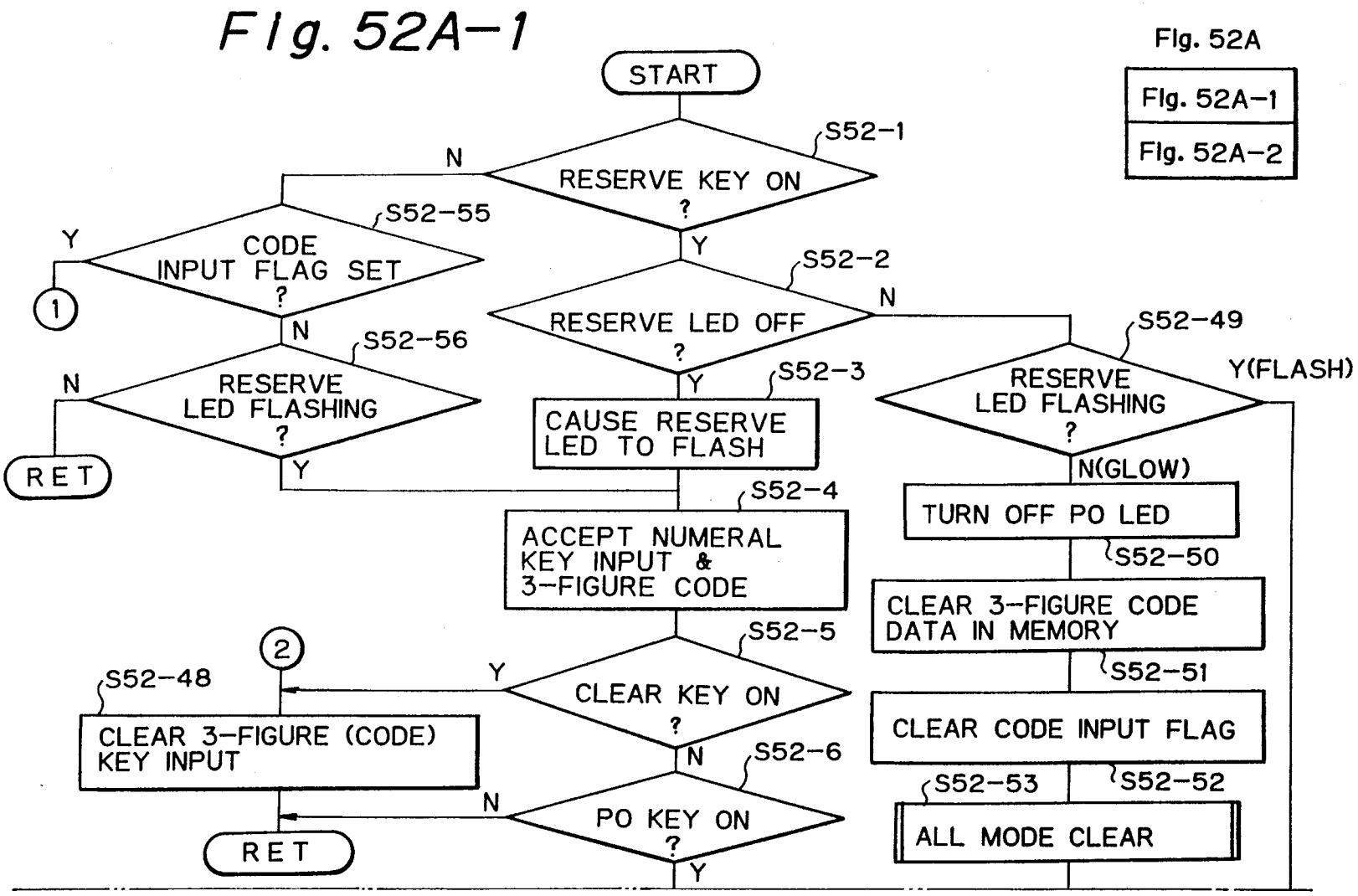
FIGS. 52A through 52D are flowcharts demonstrating a specific procedure for entering, changing and clearing a reserve mode job.
Figures 2, 52A:
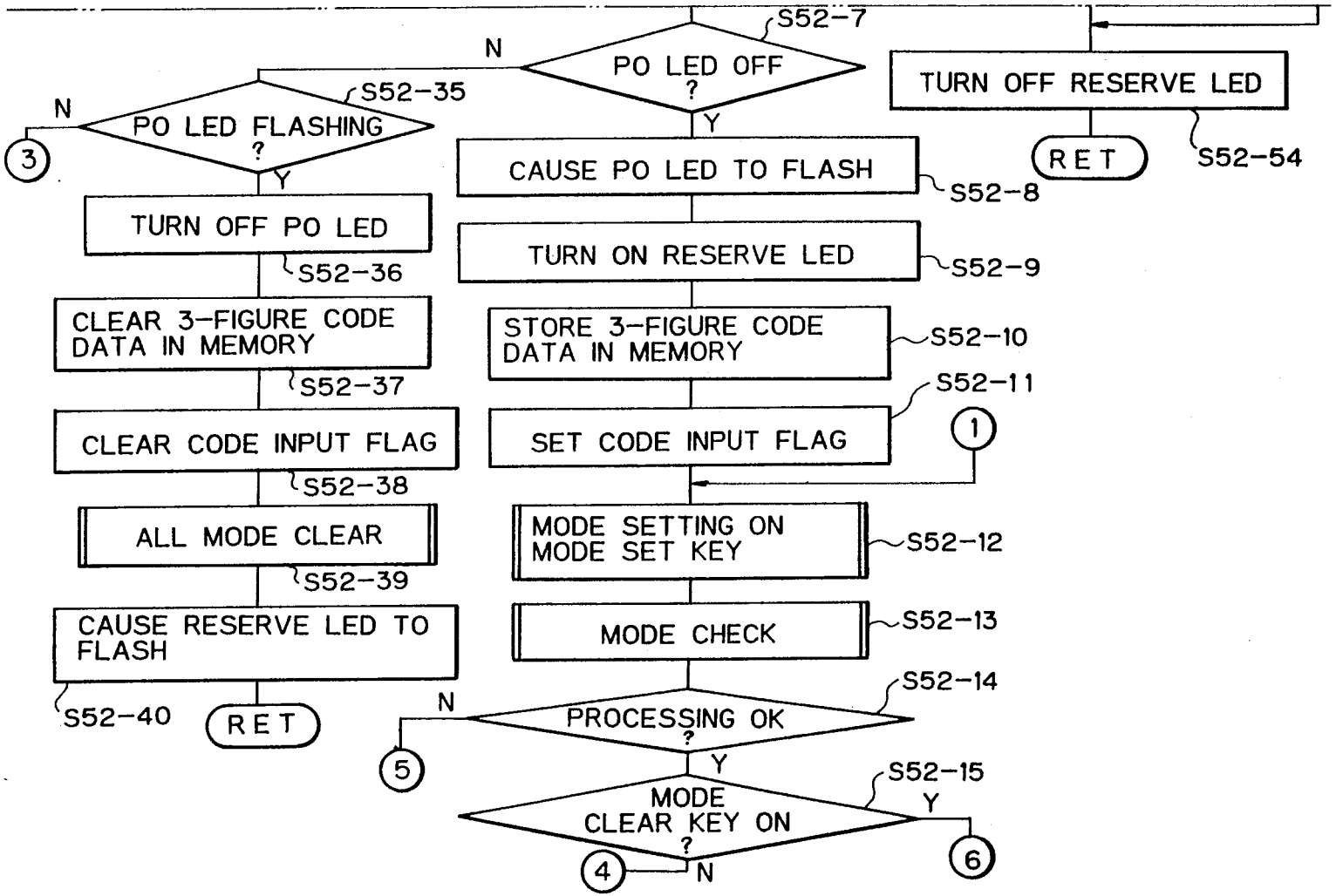
Figure 52B:
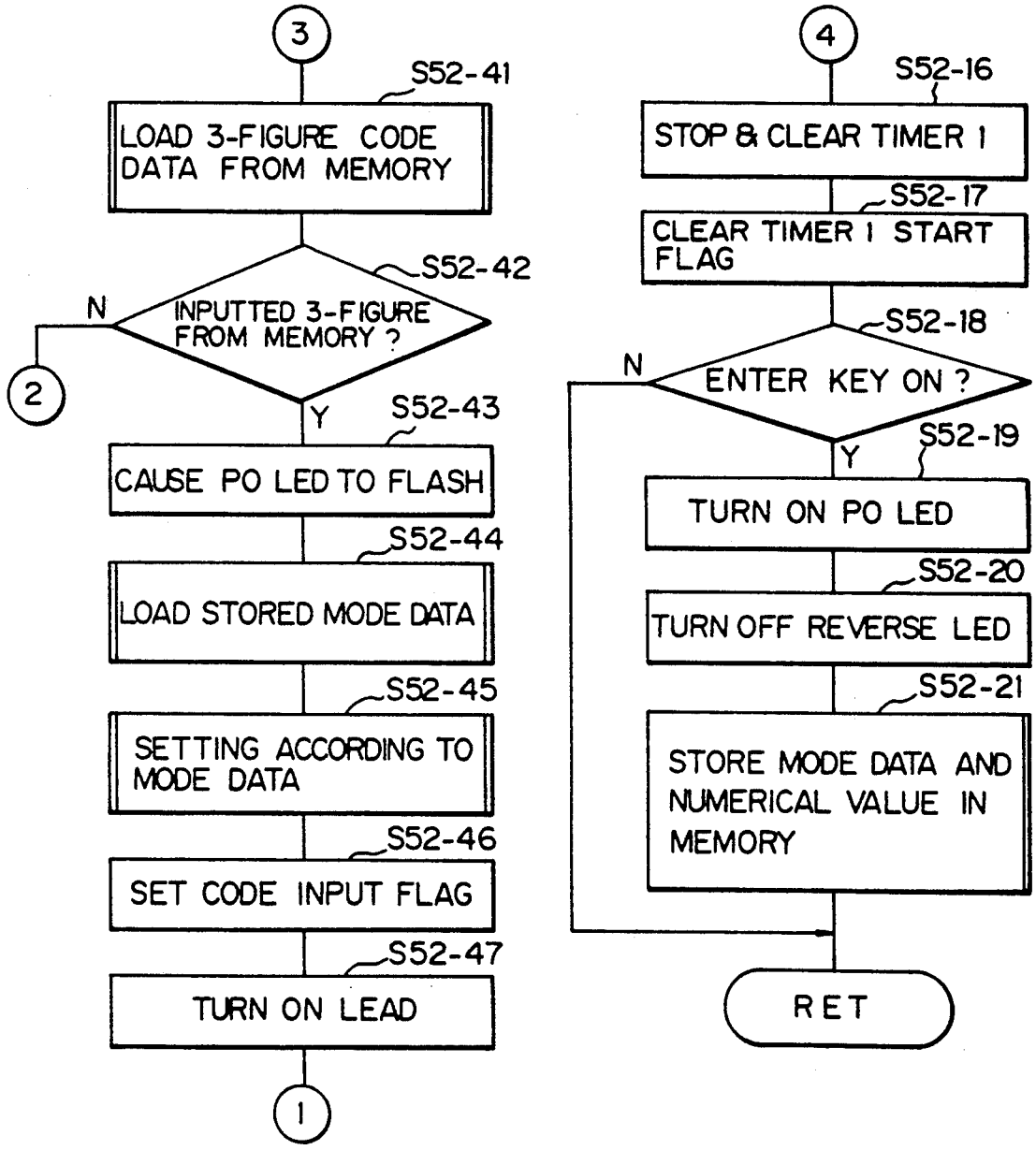
Figure 52C:
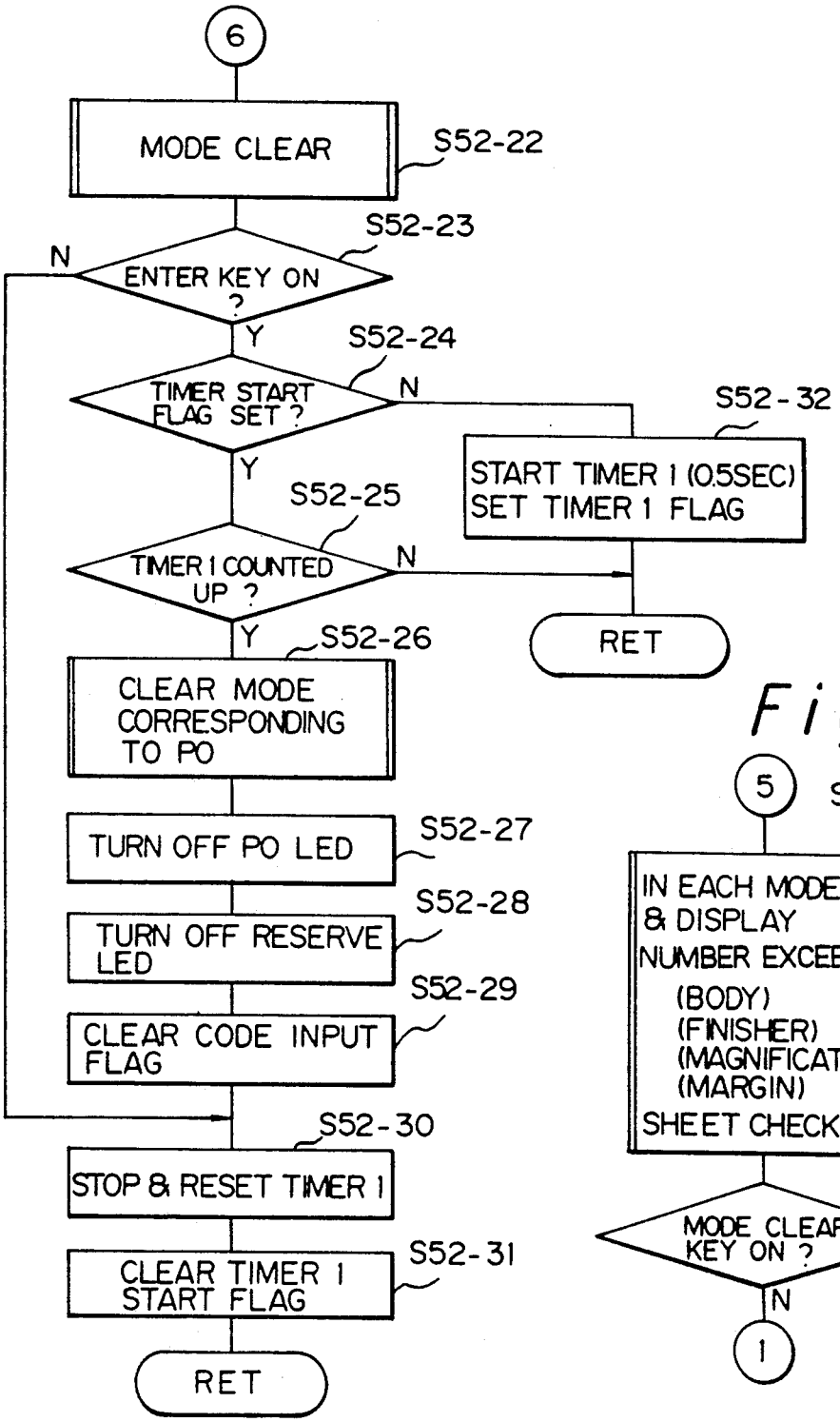
Figure 52D:
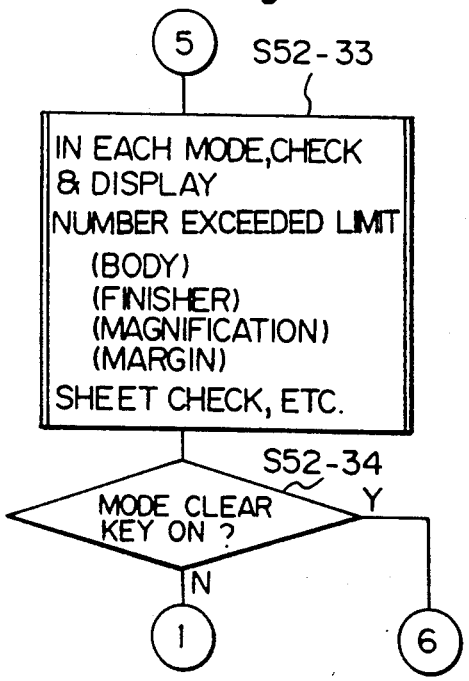

When the reserve mode is selected as determined in the step S51-2, the reserve mode job cannot be entered, changed or cleared unless a three-figure numerical value (code) is inputted. This is to prevent the other operators from clearing or changing the entered job. Such a procedure will be described specifically with reference to FIGS. 52A through 52C.

In this procedure, whether or not the reserve mode key 661 has been turned on is determined. As shown in FIG. 53, the reserve mode key 661 is located above a print key 663. A mode clear key 665 and an interrupt key 667 are interposed between the reserve mode key 661 and the print key 663. Numeral keys and a clear/-stop key 669 are located at the left of the print key 663. The reserve select keys 671 each being assigned to a particular reserve mode are arranged above the keys 669. An enter key 673 is positioned at the right of the keys 671. The LEDs 675 are arranged above the keys 671. The reserve LED 677 and a reserve error LED 679 are located at the right of the LEDs 675.

Figure 54:
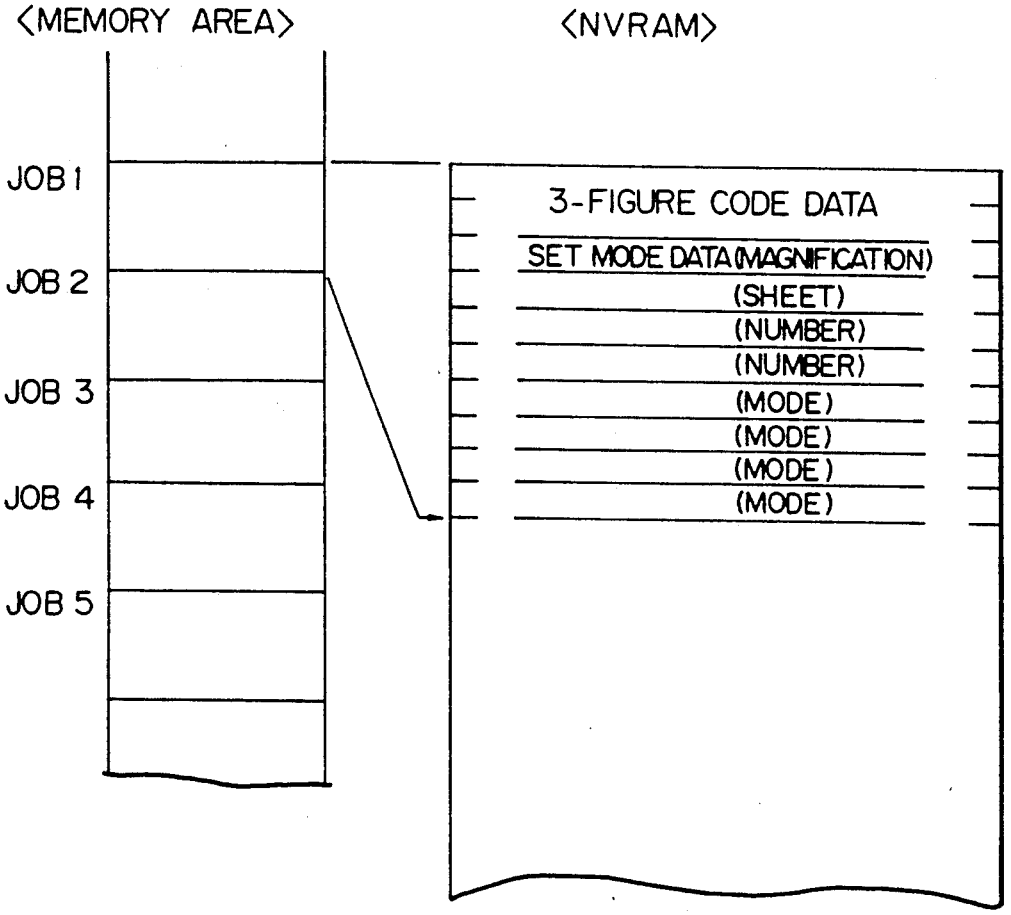
FIG. 54 shows the content of jobs and a memory map representative of a nonvolatile RAM storing them.

When the reserve mode key 661 has been turned on as determined in a step S52-1, whether or not the reserve LED 677 has been turned off is determined (S52-2). If the answer of the step S52-2 is YES, the reserve LED 677 is turned on (S52-3). Then, a particular three-figure code is entered on the numeral keys 669 (S52-4). Thereafter, if the mode clear key **669*a* has not been turned on (NO, S52-5), whether or not any one of the reserve select keys P1 to P5, or 671 collectively, has been turned on is determined (S52-6). If any one of the keys P1 through P5 has been turned on, whether or not the LED 675 associated with such a key has been turned off is determined (S52-7). If the LED 675 of interest has been turned off, it is caused to flash (step S52-8), and the reserve LED 677 is turned on (S52-9). Subsequently, the three-figure code data is written to a memory (S52-10), and then a code input flag is set (S52-11). This is follows by a subroutine shown in a step S52-12 which urges the operator to set a mode on the reserve mode key 661. Then, the program checks the mode by a subroutine shown in a step S52-13. On completing this processing (YES, S52-14), the program determines whether or not the mode clear key 556 has been turned on and, if the answer is negative (NO, S52-15), it stops and clears a timer 1 (S52-16) and clears a timer 1 start flag (S52-17). Thereafter, whether or not the enter key 673 has been turned on is determined (S52-18). If the answer of the step S52-18 is YES, one of the LEDs 675 associated with the reserve select key 671 of interest is turned on (S52-19), the reserve LED 677 is turned off (S52-20), the mode data and numerical value are written to the memory (S59-21) and then the program returns. FIG. 54 is a memory map showing such code data written to the memory. If the enter key 673 has been turned off as determined in the step S52-18**, the program returns.

If the mode clear key 665 has been turned on as determined in the step S52-15, a step S52-22, i.e., mode clear processing is executed, and then whether or not the enter key 673 has been turned on is determined (S52-23). If the answer of the step S52-23 is YES, whether or not the timer start flag has been set is determined (S52-24). If the answer is positive, whether or not the timer 1 has counted up is determined (S52-25). If the answer of the step S52-25 is YES, the mode selected on the key 671 is cleared (S52-26), the associated LED 675 is turned off (S52-27), the reserve LED 677 is turned off (S52-28), and then a code input flag is cleared (S52-29). Thereafter, the timer 1 is stopped and cleared (S52-30), the timer 1 start flag is cleared (S52-31), and then the program returns. If the enter key 673 has been turned off as determined in the step S52-23, the step S52-30 and successive steps are executed.

If the timer start flag has not been set (NO, S52-24), a 0.5 second timer 1 is started, the timer 1 start flag is set (S52-32), and the program returns. If the timer 1 has not counted up as determined in the step S52-25, the program returns immediately.

If the answer of the step S52-14 is NO, meaning that the mode checking has not been completed, a step S52-33 is executed to see if the entered numerical value associated with each mode is too great, to check paper sheets, and to display the result of checking. If the mode clear key 665 has been turned on (YES, S52-34), the step S52-22 and succesive steps are executed. If the mode clear key 665 is still in the OFF state (NO, S52-

34), the step S52-12 and successive steps are executed. If the LED 675 associated with the reserve select key 671 of interest has been turned on (YES, S52-7), whether or not it is flashing is determined (S52-35). If it is flashing, it is turned off (S52-36), and the three-figure code data stored in the memory is cleared. Subsequently, the code input flag is cleared (S52-38) to clear all of the modes (S52-39), the reserve LED 677 is caused to flash (S52-40), and then the program returns.

If the LED 675 is not flashing as determined in the step S52-35, the three-figure code data is loaded from the memory (S52-41) and compared with the the three-figure code entered to see if they are identical (S52-42). If the answer of the step S52-42 is YES, the reserve select key 671 and associated LED 675 are caused to flash (S52-43), the mode data stored in the memory is loaded (S52-44), and modes are set on the basis of the mode data (S52-45). Then, the code input flag is set (S52-46), and the LED 675 of interest is turned on (S52-47). This is followed by the step S52-12 and successive steps. If the answer of the step S52-42 is NO, a step S52-48 and successive steps which will be described are executed. Before the step S52-48, the reserve error LED 679 and other display elements may be turned on for a predetermined period of time.

If the mode clear key 665 has been turned on as determined in the step S52-5, the three-figure code is cleared (S52-48) and the program returns. If the reserve select key 671 of interest is in an OFF state as determined in the step S52-6, the program returns immediately.

If the reserve LED 677 has been turned on as determined in the step S52-2, whether or not the reserve LED 677 is flashing is determined (S52-49). If the reserve LED 677 is in an ON state but not flashing, the LED 675 of interest is turned off (S52-50), the three-figure code data stored in the memory are cleared (S52-51), and then the code input flag is cleared (S52-52). Subsequently, a subroutine (S52-53) for clearing all of the reserved modes is executed, the reserve LED 677 is turned off, and the operation returns. If the reserve LED 677 is flashing as determined in the step S52-49, it is turned off (S52-54) and the program returns.

Assume that the reserve mode key 661 is in an OFF state as determined in the first step S52-1 of the flowcharts. Then, whether or not the code input flag is set is determined (S52-55). If the answer of the step S52-55 is YES, the step S52-12 and successive steps are executed; if otherwise, whether or not the reserve LED 677 is flashing is determined (S52-56). If the reserve LED 677 is flashing, the step S52-4 and successive steps are executed; if otherwise, the program returns.

After the reserved job has been set as described above, the operator puts documents on any of the bins 201, 202, 203, 204 and 205 corresponding to the job numbers selected, i.e., the reserve select keys P1, P2, P3, P4 and P5. Thereupon, the jobs to be executed are selected according to the reserved modes and then executed.

6.3 Execution of Reserve Mode Job

When the copier is waiting in a reserve mode, the sequence in which five reserve modes (jobs) should be executed is determined on the basis of the following factors.

If all of the modes are staple modes, the jobs are executed in order of entry.

In the case of a non-stable mode, it is executed only if the next job can be executed with the idle bins of the finisher 11, i.e., the bins which will not be used in the non-staple mode.

In the illustrative embodiment, in the non-staple mode, sheets are left on the bins 57 of the finisher 11 for five minutes after the end of the job. This will allow the operator to remove the sheets from the bins. However, when sheets are left on the bins 57 more than five minutes, they are automatically stapled to avoid a delay in starting on the next job. The stapled sheets are sequentially driven out to the stack tray 67 to empty the bins 57. Hence, the processing time of all of the jobs depends on how effectively the five seconds is used.

FIG. 55 tabulates a relation between jobs reserved in the reserve mode and the execution thereof, i.e., the order in which reserved jobs are accepted, reserved modes, the numbers of bins to be used, the numbers of bins on which sheets are to be left, and the order in which the reserved jobs are executed. As shown, the following modes are available:

1

(a) stapling five sets of copies
(b) stapling documents also
(c) using five bins
(d) leaving sheets on no bin

2

(a) sorting eight sets of copies
(b) documents to sort bins
(c) using 8+1 bins
(d) sheets remaining on nine bins

3

(a) stapling five sets of copies
(b) stapling documents also
(c) using five bins
(d) leaving sheets on no bin

4

(a) sorting fifteen sets of copies
(b) documents to shift tray
(c) using fifteen bins
(d) leaving sheets on fifteen bins

5

(a) stapling ten sets of copies
(b) documents to shift tray
(c) using ten bins
(d) leaving sheets on no bin

6

(a) sorting fifteen sets of copies
(b) documents to sort bin
(c) using 5+1 bins
(d) leaving sheets on sixteen bins

7

(a) sorting fifteen sets of copies
(b) documents to sort bin
(c) using 15+1 bins
(d) leaving sheets on 16 bins

8

(a) stapling twenty sets of copies
(b) documents to shift tray
(c) using twenty bins
(d) leaving sheets on no bin

9

(a) stapling ten sets of copies
(b) stapling documents
(c) using ten bins
(d) leaving sheets on no bin

10

(a) sorting five sets of copies
(b) documents to sort bin
(c) using 5+1 bins
(d) leaving sheets on six bins Assuming that the reserved jobs are executed in order of entry, the job 5) will be completed in job 1) time+job 2) time+job time of five minutes timer (waiting time in non-staple mode)+job 4) time+five minutes timer+-job 5) time. Nevertheless, since the five minutes timer starts at the end of a job, executing the jobs in the order of 1), 2), 3), 5) and 4), i.e., executing the non-staple mode last is successful in completing the jobs five minutes earlier, i.e., in job 1) time+job 2) time+5 minutes timer+job 3) time+job 5) time+job 4) time. The job 6) and successive jobs are executed in the same manner. The resultant sequence in which the jobs are executed is shown in the rightmost column of FIG. 55. The jobs completed are sequentially shifted, as shown in FIG. 56.

Figures 57, 57A:
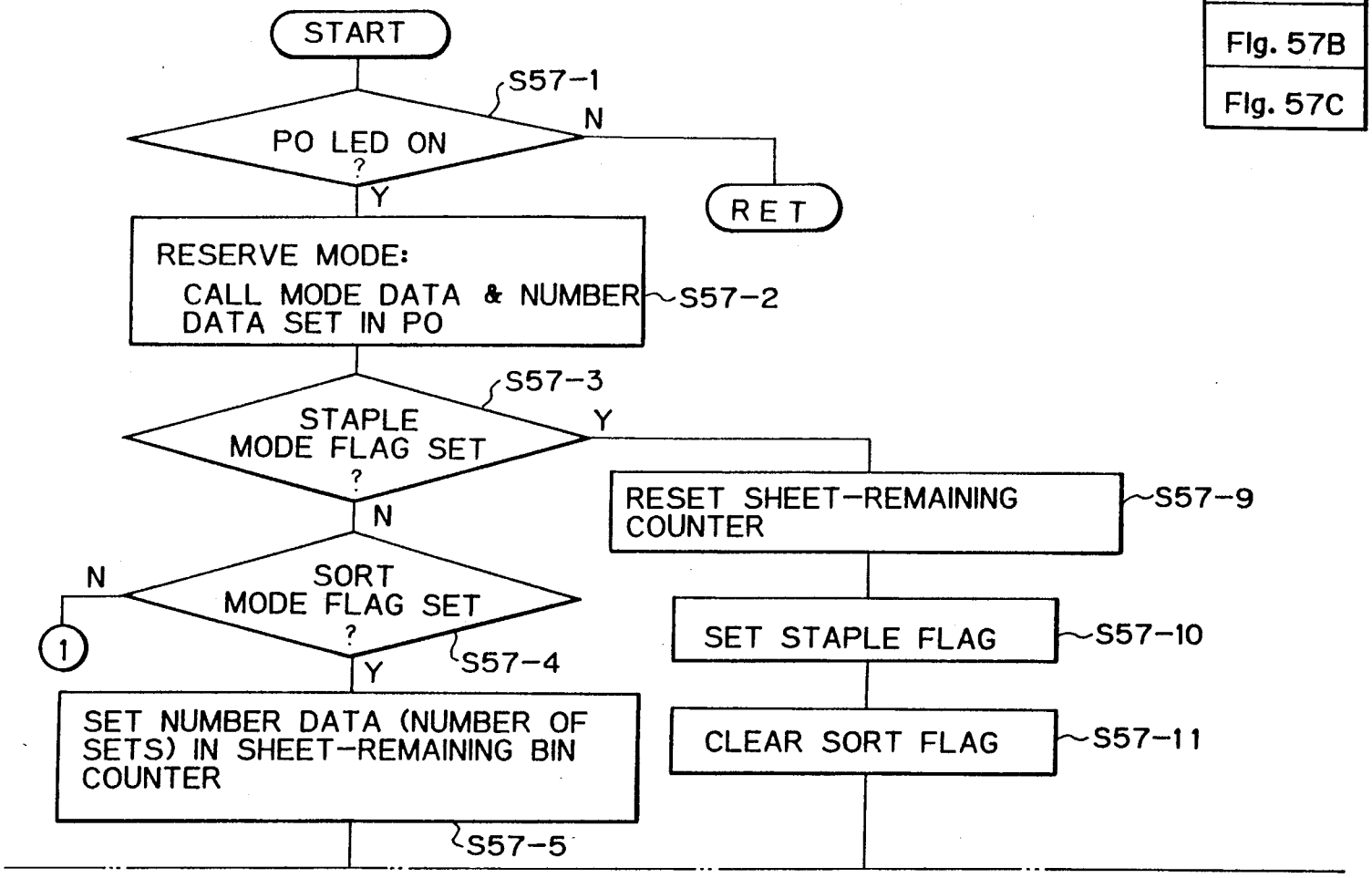
FIGS. 57A, 57B and 57C is a flowchart showing a procedure for determining the order in which jobs should be executed in the reserve mode.
Figure 57B:
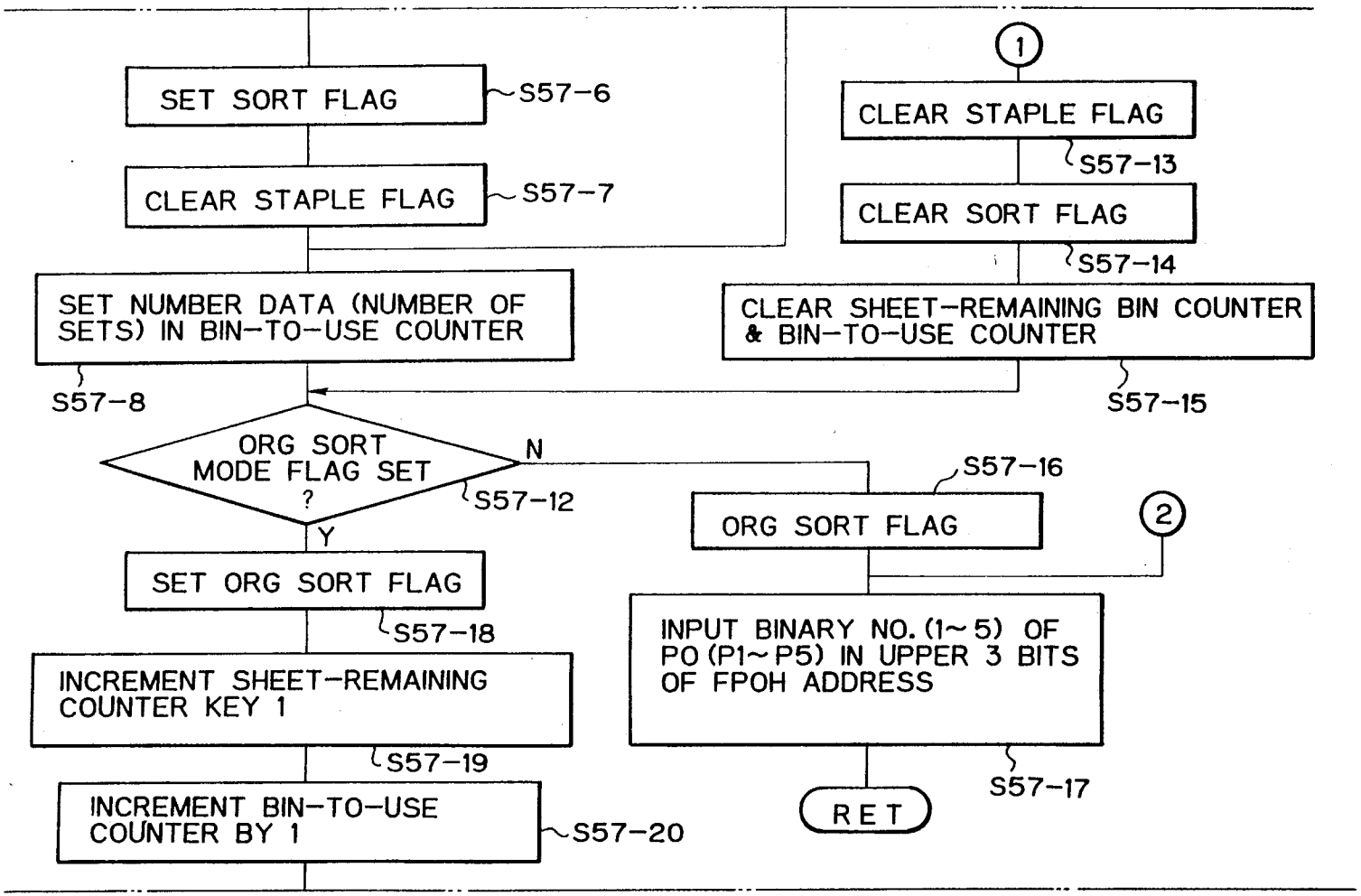
Figure 57C:
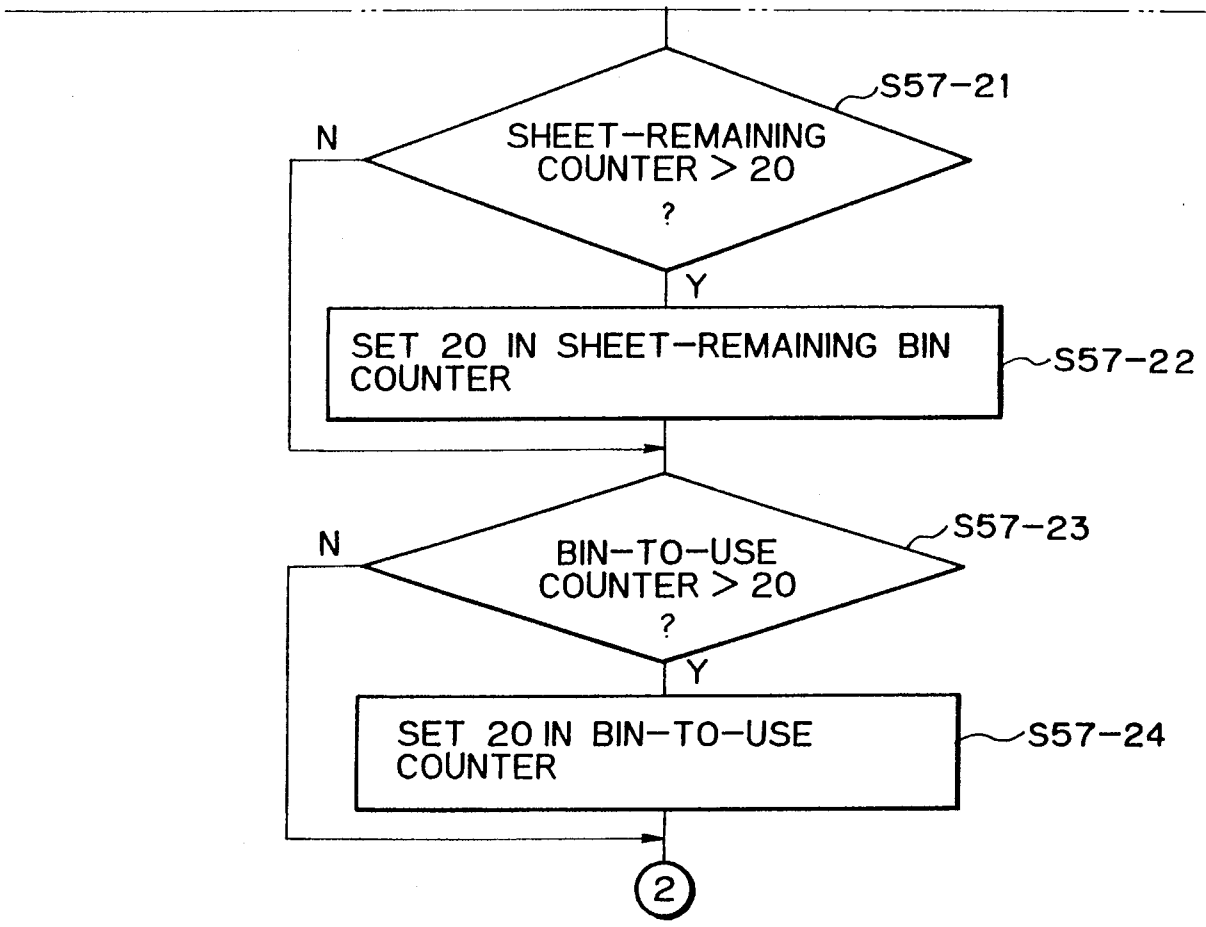

How such reserved jobs are executed will be described specifically with reference to flowcharts. FIG. 57 shows a procedure for determining the order in which the jobs should be executed in the reserve mode. In a step S57-1, whether or not any one of the reserve select keys P1 through P5 has been turned on is determined. If the answer of the step S57-1 is YES, mode data and numerical data set on the reserve select key P of interest are called. Whether or not a staple mode has been selected is determined by referencing a staple mode flag (S57-3). If the answer of the step S57-3 is NO, whether or not a sort mode has been selected is determined by referencing a sort mode flag (S57-4). If the answer of the step S57-4 is YES, numerical data representative of the number of sets of copies is set in a paper-remaining bin counter (S57-5), and then a sort flag is set (S57-6). Subsequently, the staple flag is cleared (S57-7) while numerical data representative of the number of sets of copies is set in a bin-to-use counter. If a staple mode has been set up as determined in the step S57-3, the sheet-remaining bin counter is reset (S57-9), the staple flag is set (S57-10), the sort flag is cleared (S57-11), and then a step S57-8 is executed.

After the step S57-8, whether or not the mode should distribute sheets to the bins 57 is determined by referencing an ORG (original) sort mode flag (S57-12). If the sort mode flag has not been set as determined in the step S57-4, the staple flag (S57-13) and sort mode flag (S57-14) are cleared, the sheet-remaining bin counter and bin-to-use counter are reset (S57-15), and then whether or not the sort mode flag has been set is determined (S57-12).

If the answer of the step S57-12 is NO, the ORG sort flag is cleared (S57-16), the number assigned to the reserve select key P of interest is entered in upper three bits of an FPOH address (PO: P1, P2, P3, P4 or P5) (S57-17), and then the program returns.

If the sort mode flag has been set as determined in the step S57-12, the ORG sort flag is set (S57-18), the sheet-remaining bin counter is incremented by 1 (S57-19), and then the bin-to-use counter is also incremented by 1 (S57-20). Then, whether or not the sheet-remaining bin counter has exceeded 20 is determined (S57-21) and, if the answer is positive, 20 is set therein (S57-22). Subsequently, whether or not the bin-to-use counter has exceeded 20 is determined (S57-23) and, if the answer is positive, 20 is set therein. If the sheet-remaining bin counter or the bin-to-use counter is smaller than 20 as determined in the step S57-21 or the step S57-23, the program executes the step S57-17 skipping the immediately following step and then returns.

The upper three bits of an FPOH address mentioned above in relation to the step S57-17 are illustrated below.

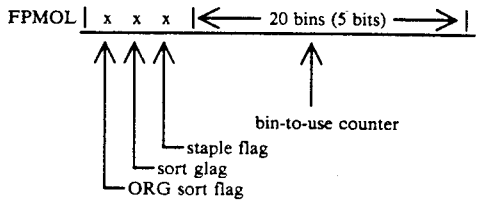

and

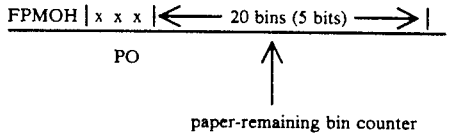

The steps S57-2 and S57-17 and the above-mentioned PO each is representative of the state of the reserve mode selected on the reserve select key 671 (P1, P2, P3, P4 or P5).

Figure 58:
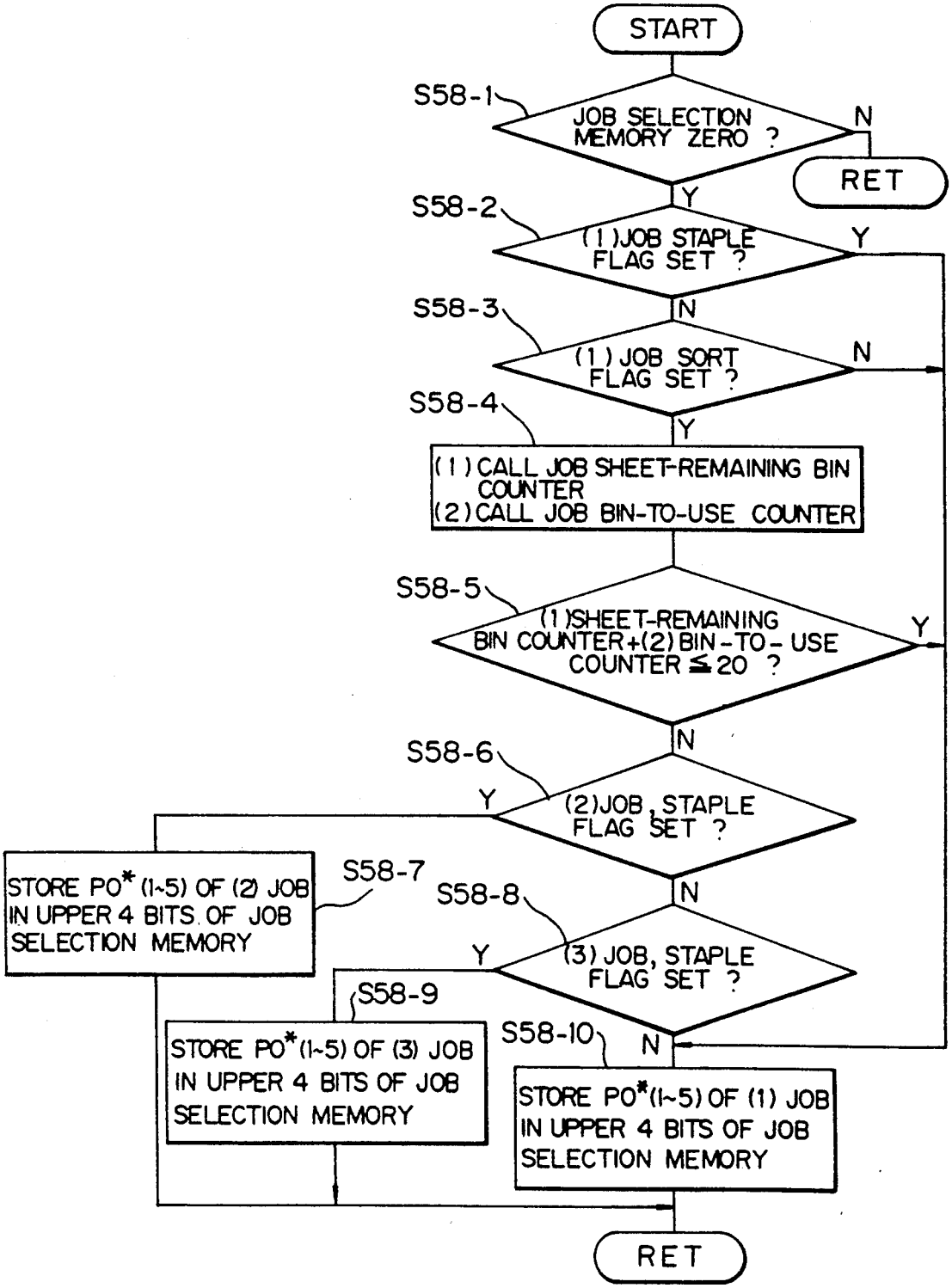
FIG. 58 is a flowchart showing a job selecting procedure.

As shown in FIG. 58, a job selection procedure begins with a step of determining the state of a job selection memory. Specifically, whether or not the state of a job selection memory is zero is determined (S58-1). If the answer of the step S58-1 is NO, the program returns. If it is YES, whether or not the staple flag of FPM1L has been set is determined (S58-2) and, if the answer is YES, the numerical value representative of the number (P1-P5) of the job to be executed first is written to the upper four bits of the job selection memory. The staple flag is sent from the CPU 573 of the copier 1 and is indicative of stapling when it is (logical) ONE. If the answer of the step S58-2 is NO, whether or not the sort flag of FPM1L has been set is determined (S58-3). If the answer of the step S58-3 is NO, a step S58-10 is executed; if it is YES, the sheet-remaining bin counter of FPM1H and the bin-to-use counter of FPM1L are called (S58-4). Then, whether or not the sum of the counters of FPM1H and FPM1L is smaller than 20 is determined (S58-5). If the answer of the S58-5 is YES, the step S58-10 is executed; if otherwise, whether or not the staple flag of FPM2L of the second job has been set is determined (S58-6). If the answer of the step S58-6 is YES, meaning that stapling should be effected, a numerical value representative of the number (P1-P5) assigned to the second job is written to the upper four bits of the job selection memory. Thereupon, the program returns.

If the answer of the step S58-6 is NO, whether or not the staple flag of FPM3L of the third job has been set is determined and if, it has been set, a numerical value representative of the number assigned to the third job is written to the job selection memory, and the program returns. If otherwise, the program returns after executing the step S58-10.

6.4 Processing by Document Process Key

Figure 59:
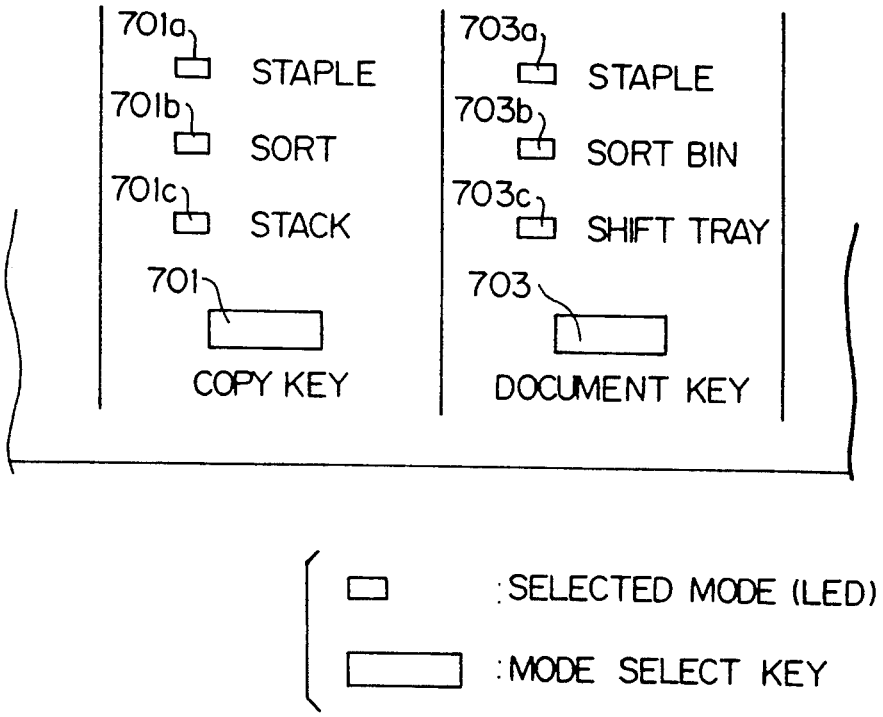
FIG. 59 shows a specific arrangement of mode select keys and a specific display condition.
Figures 1, 60A, 60B:
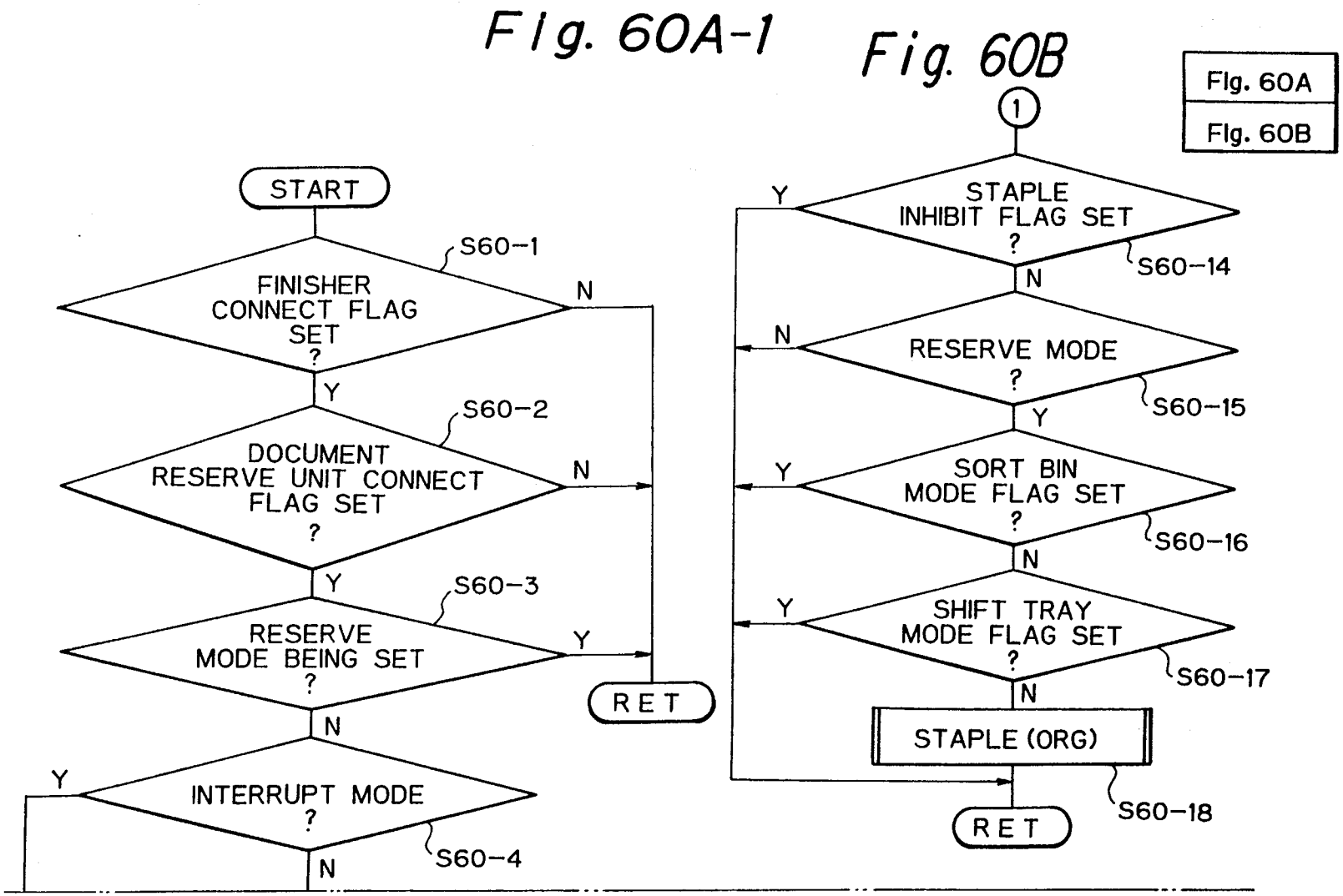
FIGS. 60A–60C are flowcharts demonstrating a procedure effected in a document process mode.
Figures 2, 60A, 60C:
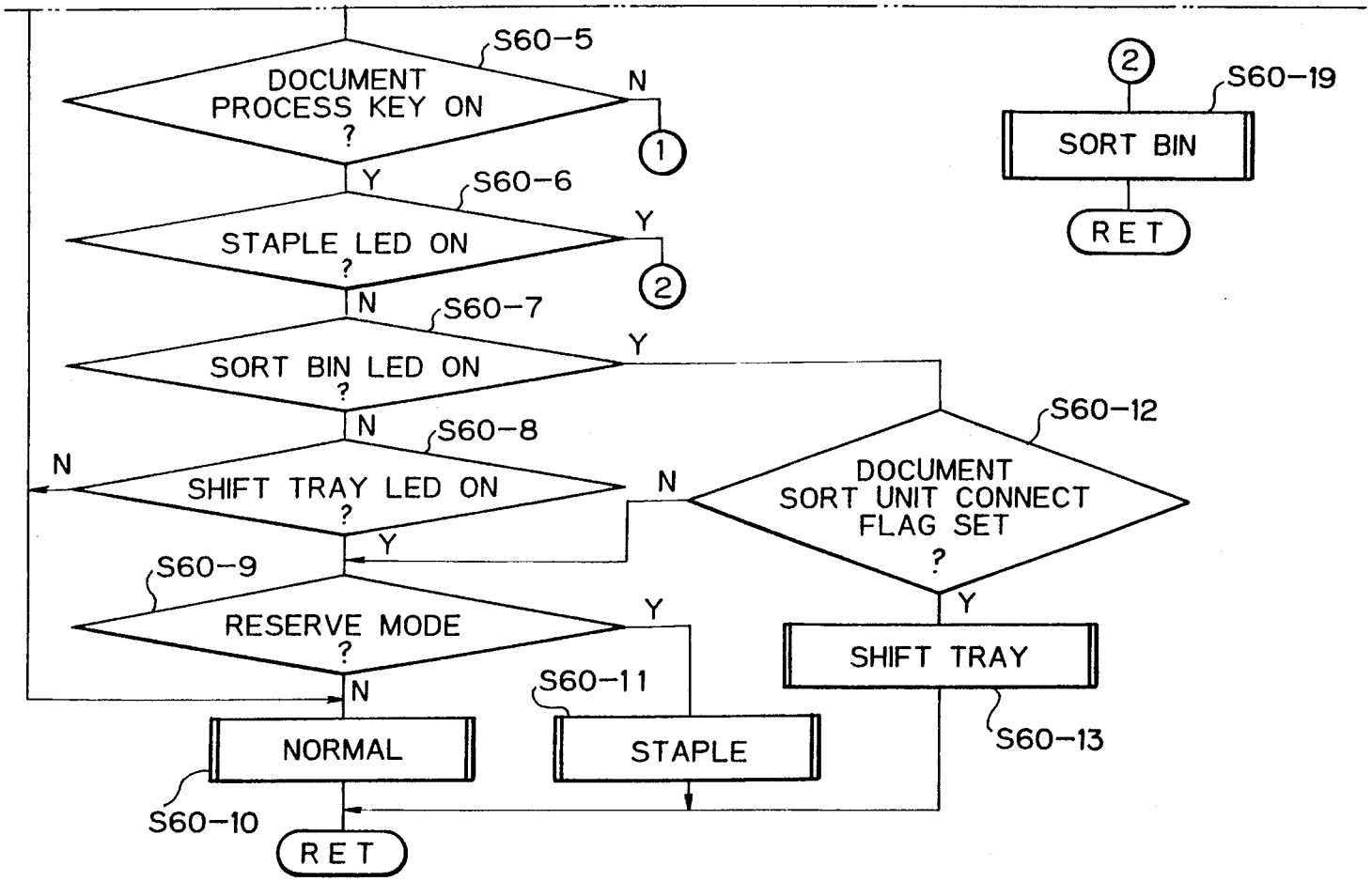

FIG. 59 shows a specific arrangement of mode select keys and indicators which display modes selected on the keys. Specifically, a staple mode LED 701*a*, a sort mode LED 701*b* and a stack mode LED 701*c* are disposed above a copy process key 701, while a staple mode LED 703*a*, a sort mode LED 703*b* and a shift tray mode LED 703*c* are disposed above a document process key 703. In any of the modes selected on the document process key 703, a procedure shown in FIG. 60 is executed. First, the CPU 573 checks a finisher connect flag and a document reverse unit connect flag to see if the finisher and document reverse unit are connected to the copier 1 (S60-1 and S60-2). If any one of such flags is not set, i.e., if the finisher or the document reverse unit is not connected, the program returns. If they are connected, the CPU 573 determines whether or not reserve modes have been fully set (S60-3). If the reservation of modes is under way, the program returns. If all the reserve modes have been set, the CPU 573 determines whether or not an interrupt mode has occurred (S60-4). If the answer of the step S60-4 is NO, the CPU 573 determines whether or not the document process key 703 has been turned on (S60-5). If the answer of the step S60-5 is YES, the CPU 573 determines whether or not the staple mode LED 703*a* has been turned on (S60-6). If the answer of the step S60-5 is NO, the CPU 573 determines whether or not a staple inhibit flag is set (S60-14). If the answer is YES, meaning that stapling is inhibited, the program simply returns; if otherwise, whether or not the reserve mode has been selected is determined (S60-15). If the answer of the step S60-15 is NO, the program returns; if otherwise, whether or not the sort bin mode has been selected is determined (S60-16). If the answer of the step S60-16 is YES, the program returns; if otherwise, whether or not the shift tray mode has been selected is determined (S60-17). If the answer of the step S60-17 is YES, the program returns; if otherwise, CPU 573 executes a staple (ORG) mode subroutine which will be described with reference to FIG. 62 (S60-18) and then returns.

Figure 61:
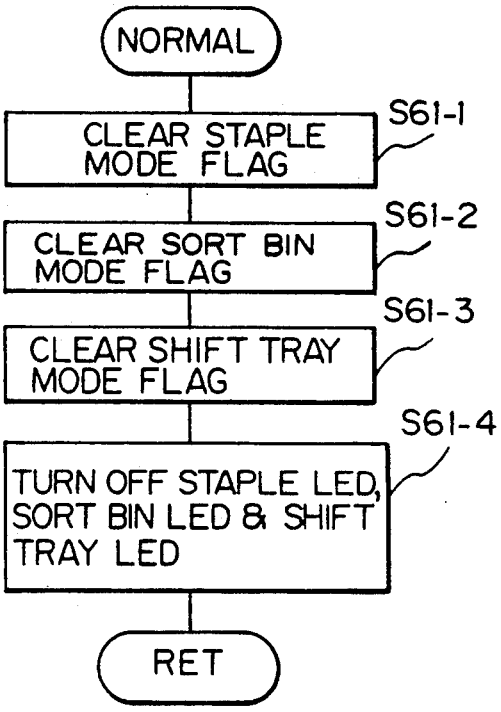
FIG. 61 is a flowchart demonstrating a procedure effected in a normal mode relating to documents.
Figure 62:
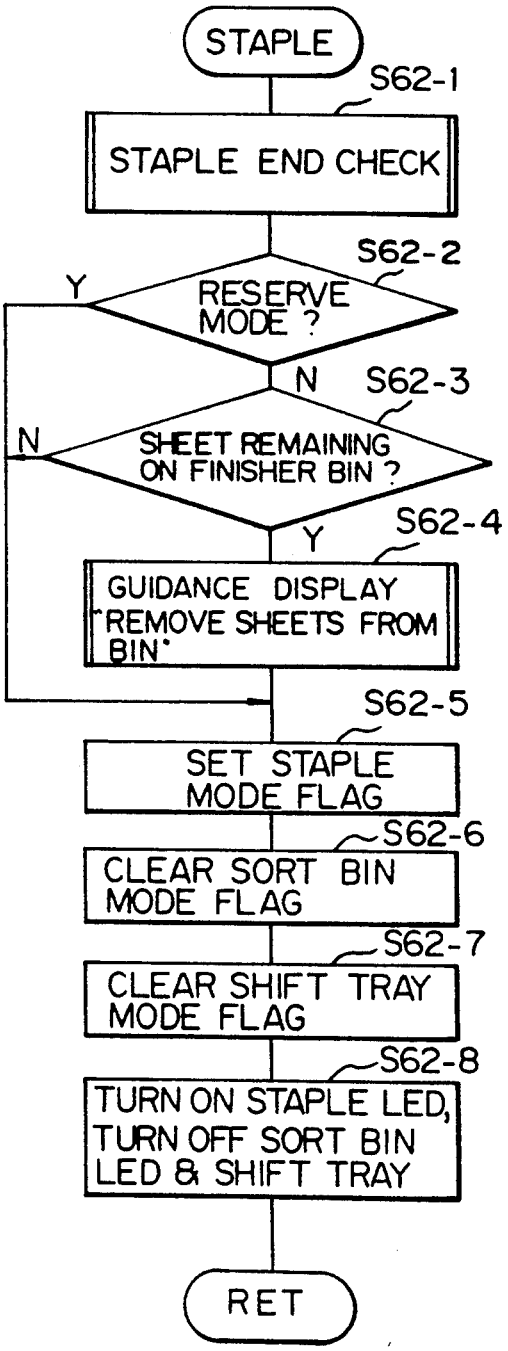
FIG. 62 is a flowchart showing a staple mode relating to documents.
Figure 63:
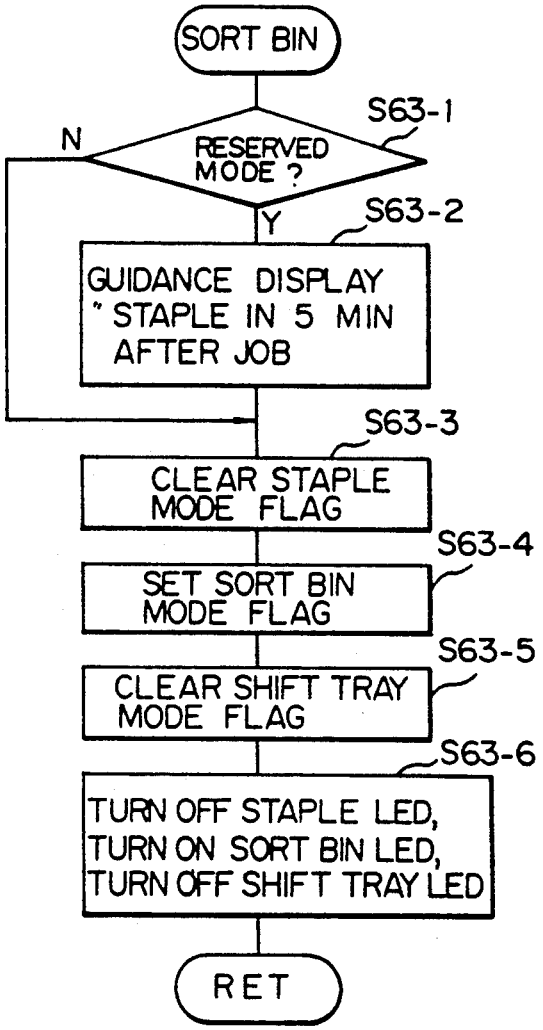
FIG. 63 is a flowchart showing a sort bin mode procedure effective with documents.

If the staple mode LED 703*a* is in an ON state as determined in the step S60-6, the CPU 673 executes a sort bin mode subroutine shown in FIG. 63 (S60-19). If the staple mode LED 703*a* is not in an ON state, whether or not the sort bin mode LED 703*b* is in an ON state is determined (S60-7). If the answer of the step S60-7 is NO, whether or not the shift tray mode LED 703*c* is in an ON state is determined (S60-8). If the answer of the step S60-8 is YES, whether or not the reserve mode has been selected is determined (S60-9). If the answer of the step S60-9 is NO, a normal mode subroutine shown in FIG. 61 is executed (S60-10). Thereafter, the program returns after discharging documents. If the answer of the step S60-9 is YES, the staple mode subroutine shown in FIG. 62 is executed (S60-11) to staple documents. Thereafter, the program returns.

If the sort bin mode LED 703*b* has been turned on as determined in the step S60-7, whether or not the document stack unit 52 is connected is determined (S60-12). If the answer is NO, the CPU 573 executes the step S60-9 and successive steps skipping the step S60-8. If the document stack unit 52 is connected, the CPU 573 executes the shift tray mode subroutine shown in FIG. 64 (S60-13) and then returns.

If the answer of the step S60-4 is YES or if the answer of the step S60-8 is NO, the CPU 573 executes a normal mode subroutine (S60-10) an then returns.

As shown in FIG. 61, the normal mode subroutine is such that the staple mode flag, sort bin mode flag and shift tray mode flag are cleared (S61-1, S61-2 and S61-3), the LEDs 703*a*, 703*b* and 703*c* are turned off, and then the program returns.

Figure 65:
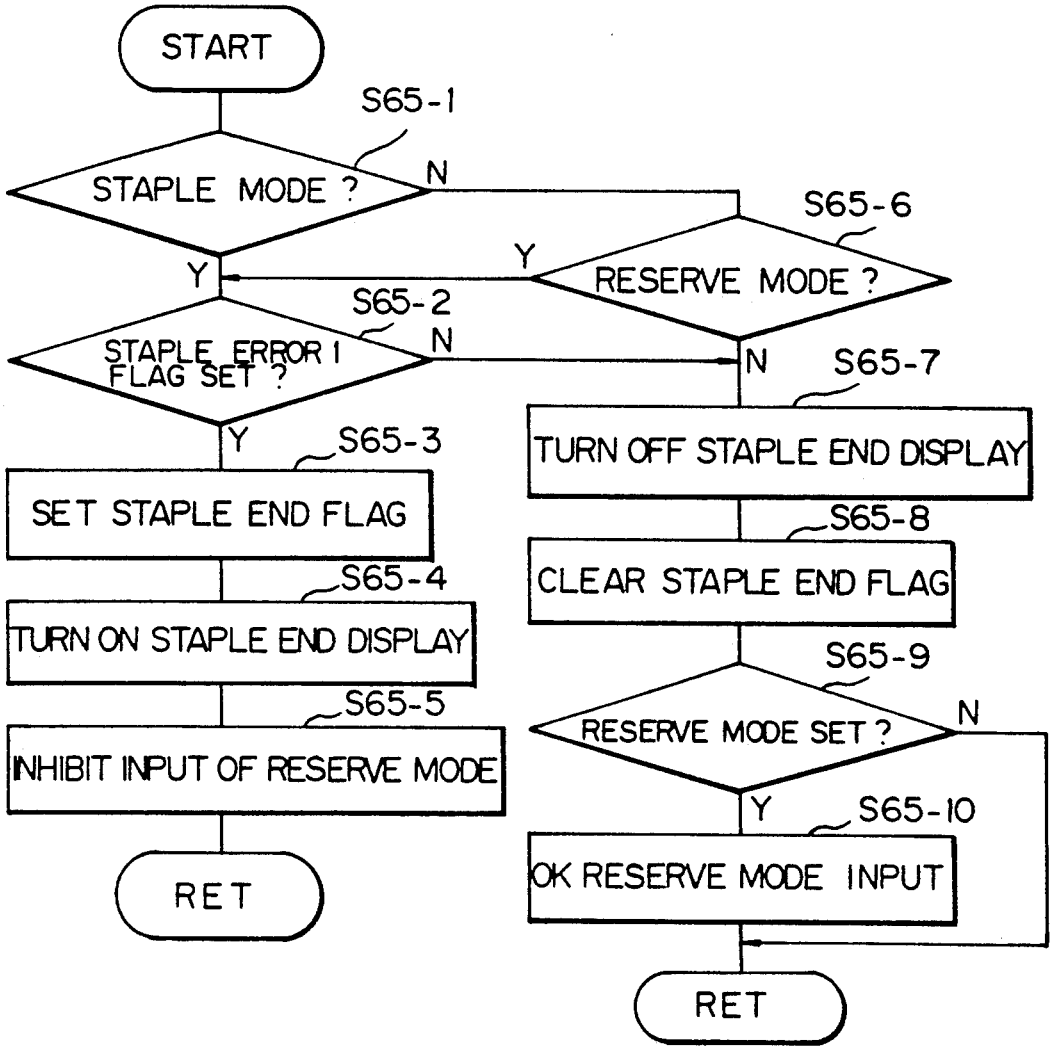
FIG. 65 is a flowchart showing a staple end check procedure relating to documents.

As shown in FIG. 62, the staple mode subroutine (S60-11 and S60-18) begins with a staple end check subroutine (S62-1) which is shown in FIG. 65. Then, whether or not the reserve mode has been selected is determined (S62-2). If the answer of the step S62-2 is NO, whether or not sheets are left on any of the finisher bins (bins 57) is determined (S62-3). If the answer is YES, a message such as "REMOVE SHEETS FROM BINS" is displayed (S62-4), and then the stable mode flag is set to set up a staple mode (S62-5). Thereafter, the sort bin mode flag and shift tray mode flag are cleared (S62-6 and S62-7), the staple mode LED 703*a* is turned on, the sort bin mode LED 703*b* and shift tray mode LED 703*c* are turned off (S62-8), and then the program returns.

If the reserve mode has been set as determined in the step S62-2 or if no sheets are left on the bins 57 as determined in the step S62-3, the program skips the steps up to the step S62-5 and executes the subsequent steps.

As shown in FIG. 63, the sort bin mode subroutine mentioned in relation to the step S60-19 begins with a step S63-1 of determining whether or not the reserve mode has been set. If the answer of this step is YES, a message such as "STAPLE IN 5 MIN AFTER JOB" is displayed (S63-2), and then the staple mode flag is cleared (S63-3) to clear the staple mode. Subsequently, the sort bin mode flag is set (S63-4) to set up a sort bin mode while the shift tray mode flag is cleared (S63-5) to clear the shift mode. Thereupon, the staple mode LED 703*a* and shift tray mode LED 703*c* are turned off while the sort bin mode LED 703*b* is turned on (S63-6), and the program returns.

If the answer of the step S63-1 is NO, meaning that the reserve mode has not been selected, the program executes the step S63-3 and successive steps without displaying the message in the step S63-2.

Figure 64:
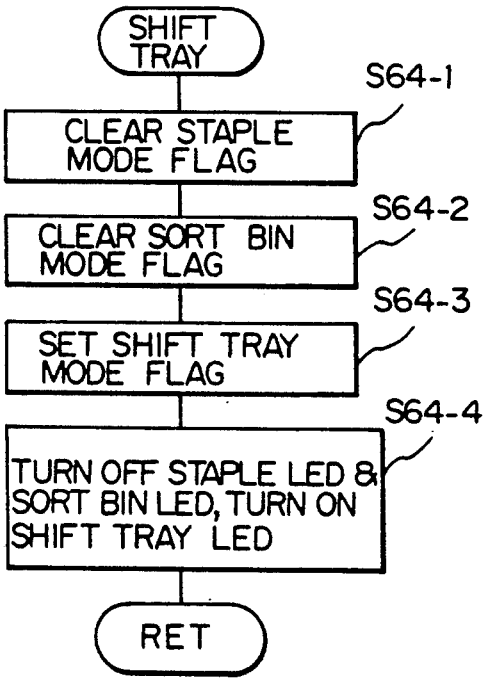
FIG. 64 is a flowchart showing a shift tray mode operation effected with documents.

As shown in FIG. 64, the shift tray mode subroutine is such that the staple mode flag and sort bin mode flag are cleared (S64-1 and S64-2), the shift tray mode flag is set (S64-3) to set up a shift mode, the shift tray mode LED 703*c* is turned on while the staple mode LED 703*a* and sort bin mode LED 703*b* are turned off to show that a shift tray mode has been set up (S64-5), and then the program returns.

Further, as shown in FIG. 65, the staple end check subroutine begins with a step S65-1 of determining whether or not a staple mode is selected. If the answer is YES, whether or not the stapler has run out of staples (S65-2) is determined with reference to a staple error 1 flag. If the staple error 1 flag is set, meaning that the stapler has run out of staples, a staple end flag is set (S65-3), the entry of reserve mode is inhibited (S65-5), and the program returns.

If the answer of the step S65-1 is NO, whether or not the reserve mode has been selected is determined (S65-6) and, if the answer is NO, a staple end display is turned off (S65-7), and then the staple end flag is cleared (S65-8). This is followed by a step S65-9 of determining whether or not the reserve mode has been set. If he answer of step is YES, the entry of reserve mode data is allowed (S65-10), and then the program returns. If the answer if the step S65-9 is NO, the program simply returns.

If the staple error 1 flag is not set as determined in the step S65-2, meaning that the stapler has not run out of staples, the step S65-7 and successive steps are executed. If the answer of the step S65-6 is YES, the step S65-2 and successive are executed.

6.5 Processing by Copy Process Key

Figure 66A:
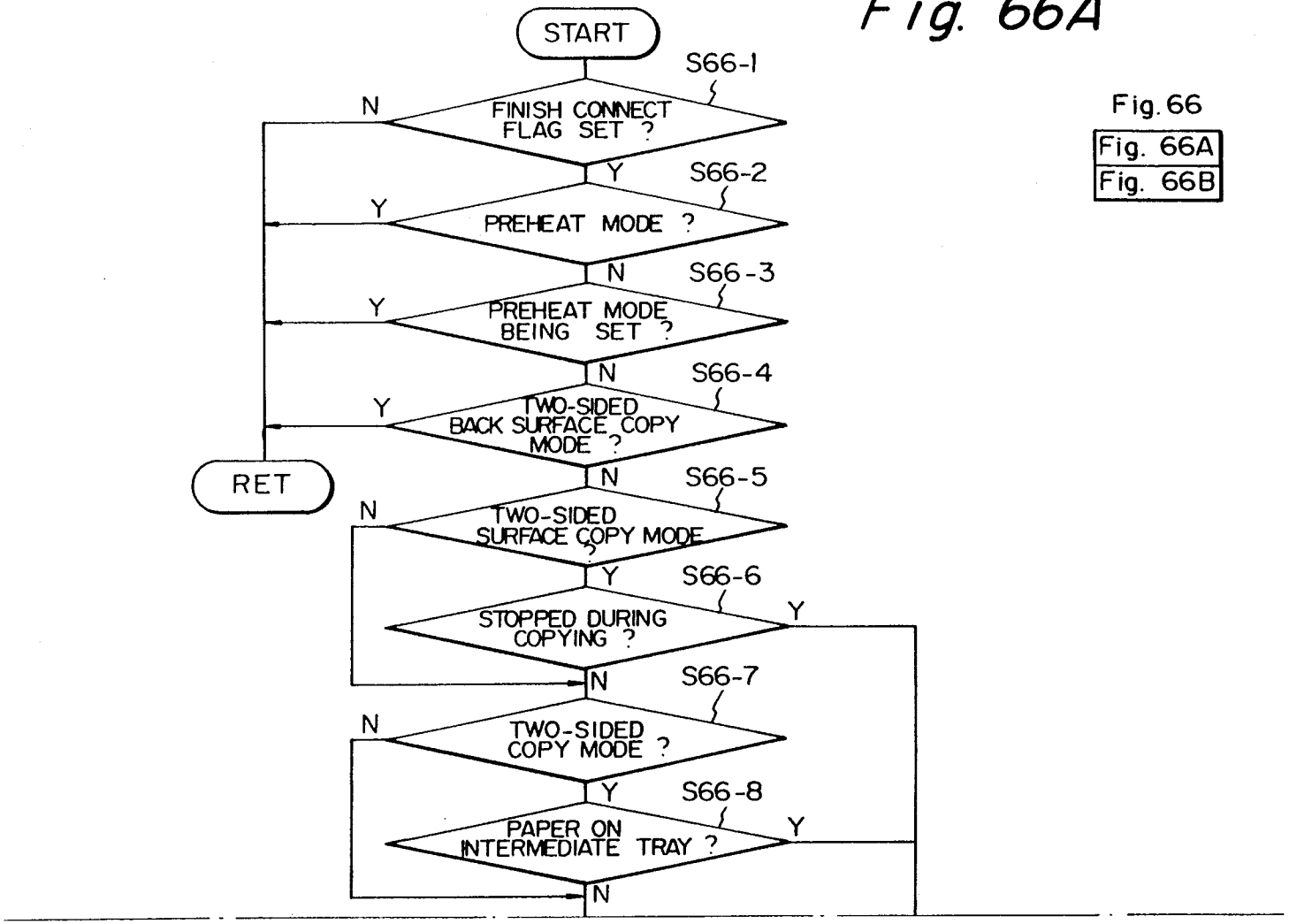
Figure 66B:
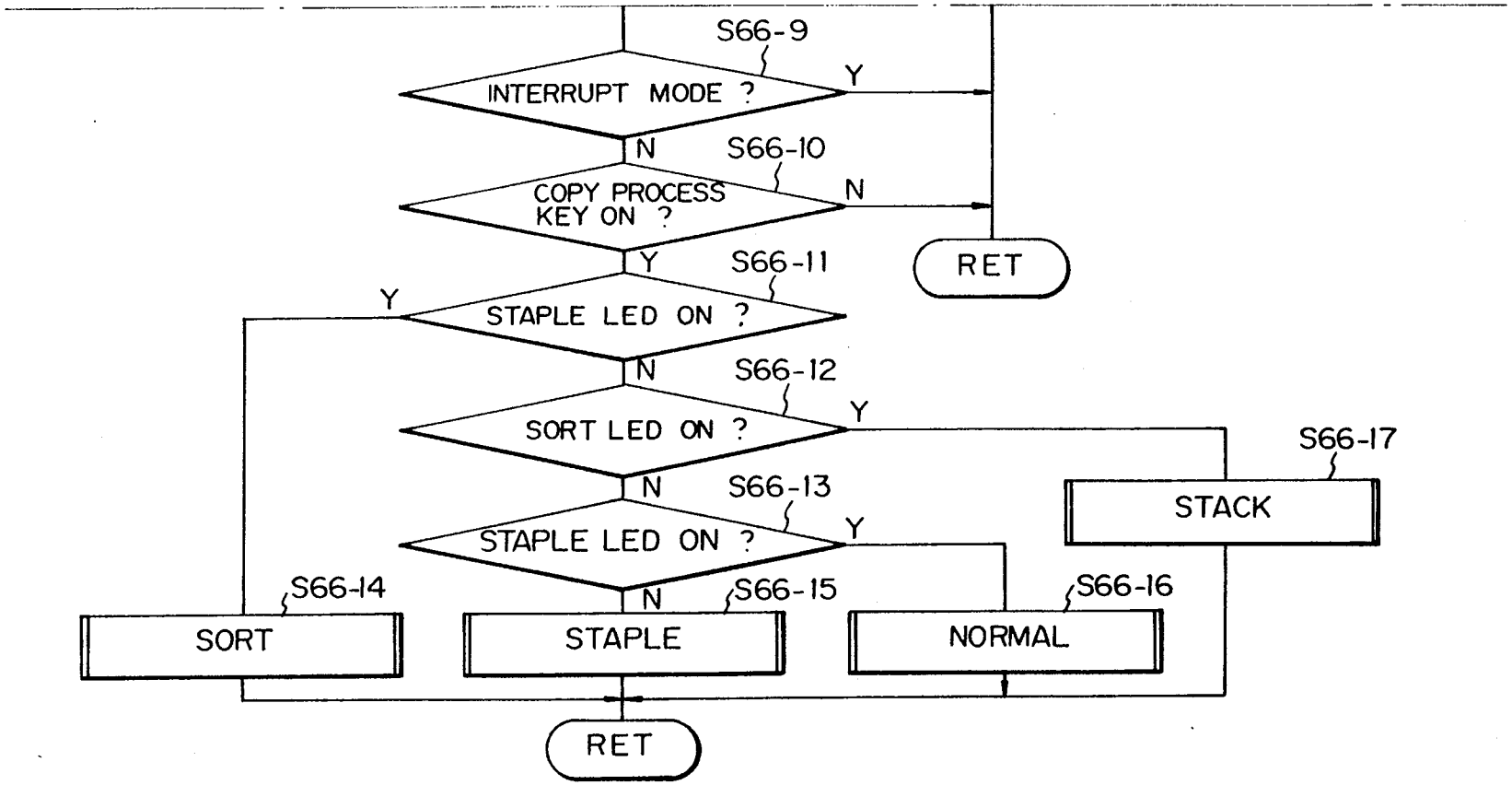

In the modes which may be selected on the copy process key, a specific procedure shown in FIG. 66 is executed. As shown, whether or not a finisher flag is set is determined (S66-1). If the answer is YES, whether or not a preheat mode operation is under way (S66-2); if otherwise, the program returns. If a preheat mode operation is under way as determined in the step S66-2, the program returns; if otherwise, whether or not a preheat mode is being set is determined (S66-3). If the answer of the step S66-3 is YES, the program returns; if otherwise, whether or not a second side or rear copy mode operation is under way is determined (S66-4). If the answer of the step S66-4 is YES, the program returns; if otherwise, whether or not a first side or front copy mode operation is under way is determined (S66-5). If the answer of the step S66-5 is YES, whether or not a stop state has been set up during the course of copying is determined (S66-6). If the answer of the step S66-6 is YES, the program returns; if otherwise, meaning that a copying operation is continuing, whether or not a two-sided copy mode is set is determined (S66-7). If the answer of the step S66-5 is NO, the program advances to the step S66-7 skipping the step S66-6.

If the answer of the step S66-7 is YES, whether or not paper sheets exist on the intermediate tray 43 is determined (S66-8). If the answer of the step S66-8 is YES, the program returns; if otherwise, whether or not an interrupt mode is set is determined (S66-9). If the answer of the step S66-7 is NO, the program advances to the step S66-9 skipping the step S66-8. If the answer of the step S66-9 is YES, the program returns; if otherwise, whether or not the copy process key 701 has been turned on is determined. If the key 701 is in an OFF state, the program returns; if otherwise, whether or not the staple mode LED 701*a* has been turned on is determined (S66-11). If the answer of the step S66-11 is YES, the program executes a sort mode subroutine which will be described with reference to FIG. 69 (S66-14) and then returns. If the answer of the step S66-11 is NO, whether or not the sort mode LED 701*b* is in an ON state is determined (S66-12). If the answer of the step S66-12 is YES, the program executes a stack mode subroutine which will be described with reference to FIG. 70 (S66-17) and then returns. If the answer of the step S66-12 is NO, whether the stack mode LED 701*c* is in an ON state is determined (S66-13). If the answer of the step S66-13 is YES, the program executes a normal mode subroutine which will be described with reference to FIG. 68 (S66-16) and then returns. If the answer of the step S66-13 is NO, the program executes a staple mode subroutine which will be described with reference to FIG. 67 (S66-15) and then returns.

Figure 68:
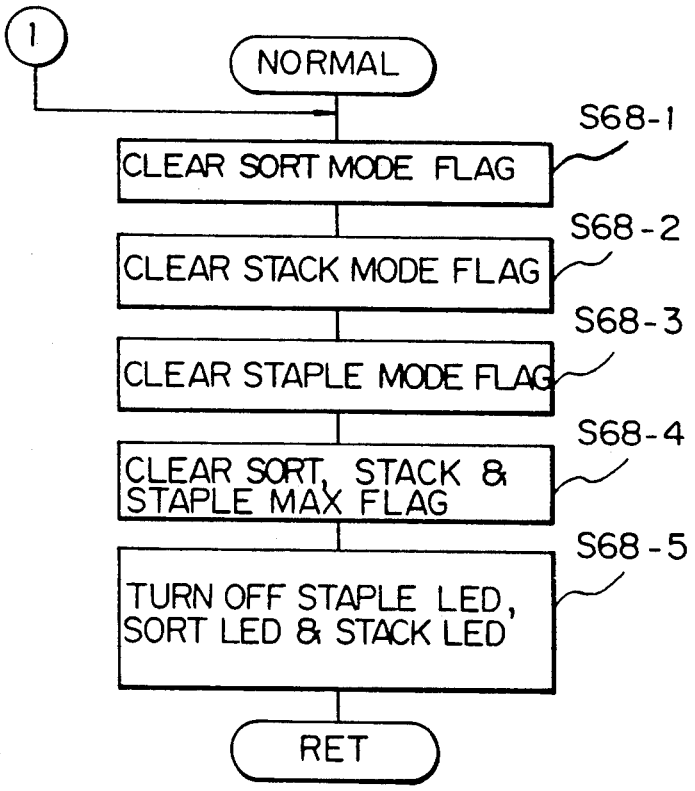
FIG. 68 is a flowchart showing a normal mode effected with copies.

As FIG. 68 indicates, the normal mode subroutine mentioned in relation to the step S66-16 begins with steps S68-1, S68-2 and S68-3 of clearing the sort mode flag, stack mode flag, and staple mode flag. Then, a sort MAX flag, stack MAX flag and staple MAX flag are cleared (S68-4). Thereupon, to show that such modes are not set, the staple mode LED 701*a*, sort mode LD 701*b* and stack mode LED 701*c* are turned off (S68-5).

Figure 69:
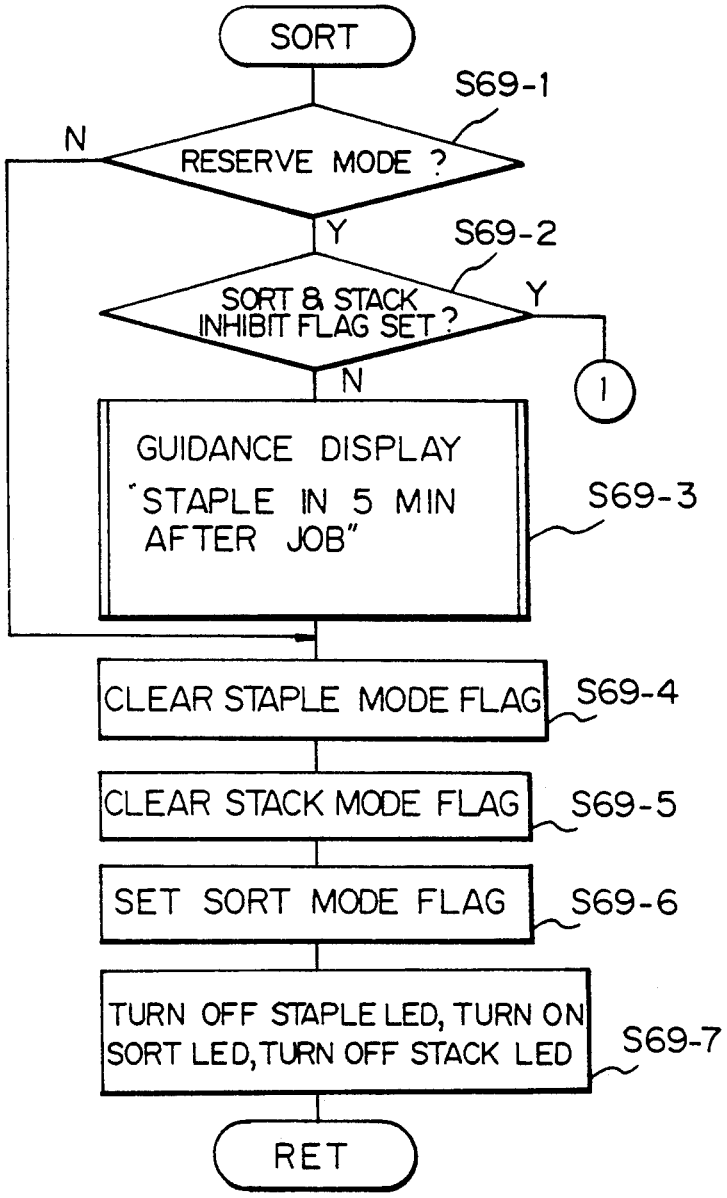
FIG. 69 is a flowchart showing a sort mode effected with copies.

As shown in FIG. 69, the sort mode subroutine begins with a step S69-1 of determining whether or not the reserve mode is selected. If the answer is YES, whether or not a sort inhibit flag and a stack inhibit flag are set is determined (S69-2). If the answer of the step S69-2 is YES, meaning that a sort mode is not selected, the operation is transferred to the processing shown in FIG. 68. If the answer of the step S69-2 is NO, a message such as "STAPLE IN 5 MIN AFTER JOB" is displayed (S69-3). Thereafter, the staple mode flag and stack mode flag are cleared (S69-4 and S69-5) while the sort mode flag is set (S69-6). Then, the staple LED 701*a* and stack mode LED 701*c* are turned off while the sort mode LED 701*b* is turned on (S69-7).

If the answer of the step S69-1 is NO, the program advances to the step S69-4 and successive steps.

Figure 67:
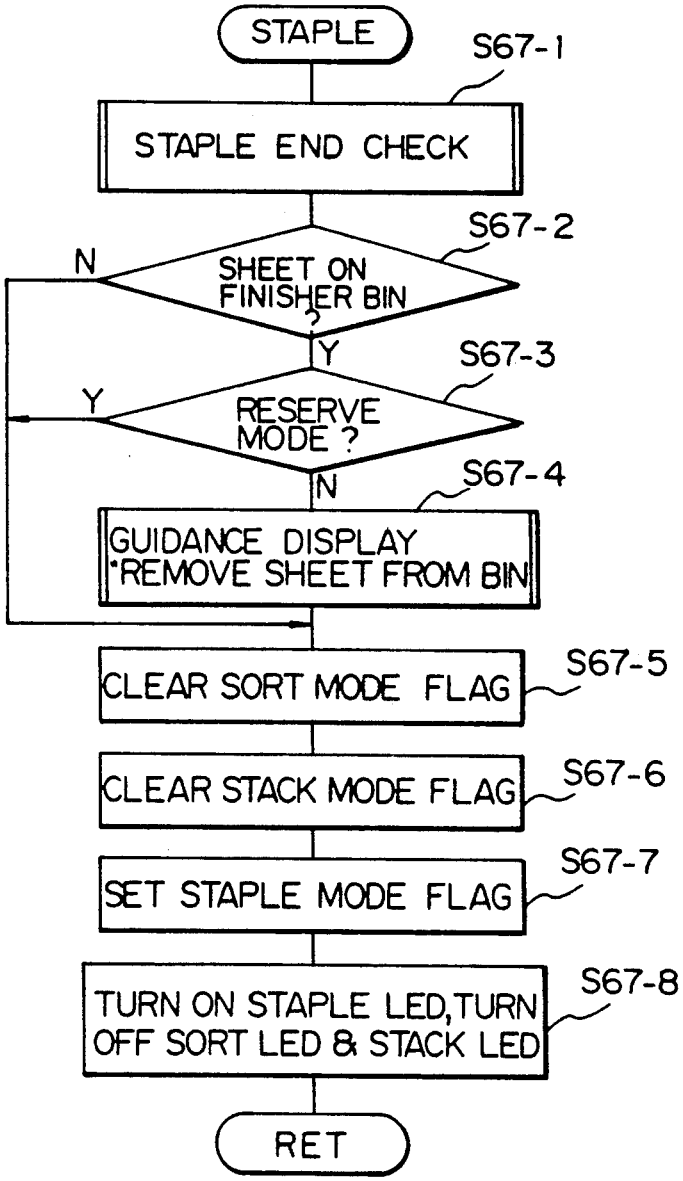
FIG. 67 is a flowchart showing a staple mode effected with copies.

As shown in FIG. 67, in the staple mode subroutine, the staple end check subroutine shown in FIG. 65 is executed (S67-1), and then whether or not paper sheets are left on the bins 57 are determined (S67-2). If the answer of the step S67-2 is YES, whether or not the reserve mode is selected is determined (S67-3). If the answer of the step S67-3 is NO, a message such as "REMOVE PAPER FROM BINS" is displayed and the sort mode flag is cleared (S67-5). If the answer of the step S67-2 is NO or if the answer of the step S67-3 is YES, the program directly advances to the step S67-5. In a step S67-6, the stack mode flag is cleared. In a step S67-7, the staple mode flag is set. Finally, the program returns after turning on only the staple mode LED 701.

Figure 70:
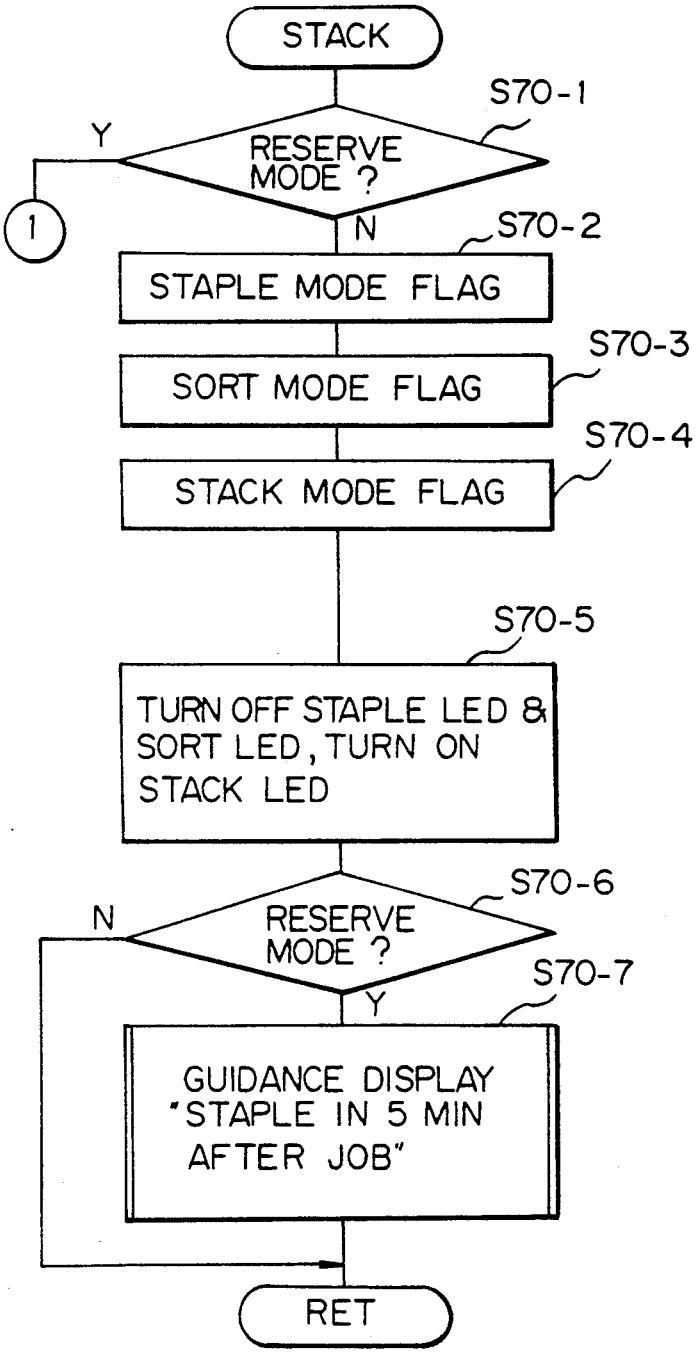
FIG. 70 is a flowchart showing a stack mode effected with copies.

As shown in FIG. 70, the stack mode subroutine begins with a step S70-1 of determining whether or not the reserve mode has been selected. If the answer of the step S70-1 is YES, the step S68-1 and successive steps shown in FIG. 68 are executed; if otherwise, the staple mode flag and sort mode flag are cleared (S70-2 and S70-3) while the stack mode mode is set (S70-4). Only the stack mode LED 701*c* is turned on (S70-5). Then, whether or not the reserve mode is set is determined again (S70-6). If the answer of the step S70-6 is YES, the program displays a message such as "STAPLE IN 5 MIN AFTER JOB" (S70-7) and then returns. If the answer of the step S70-6 is NO, the program returns immediately.

Regarding the processing described above, consideration has to be given to the number of sets of copies entered on the numeral keys since only twenty bins 57 are available with the illustrative embodiment.

Figure 71:
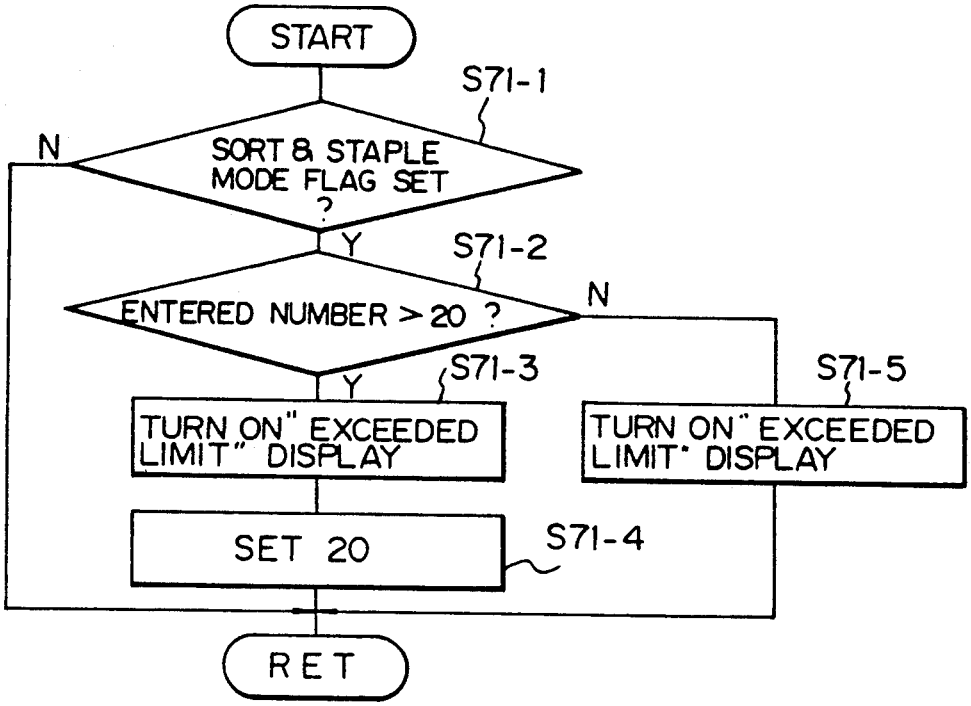
FIG. 71 is a flowchart showing a copy number check procedure executed in a staple mode.

A reference will be made to FIGS. 71 and 72 for describing a procedure for checking the number of sets of copies. FIG. 71 shows processing to be executed in a staple mode. In a sort mode and a staple mode, the processing shown in FIG. 71 cannot handle more than twenty sets of copies. First, whether or not the sort mode flag and staple mode flag are set is determined (S71-1) and, if the answer is NO, the program returns. If the answer of the step S71-1 is YES, whether or not the number of sets of copies entered on the numeral keys is greater than twenty is determined (S71-2). If the answer of the step S71-2 is YES, a message such as "EXCEEDED LIMIT" is displayed (S71-3). Then, the program sets 20 in place of the entered number (S71-4) and then returns. If the answer of the step S71-2 is NO, the program turns off the display "EXCEEDED LIMIT" and then returns.

Figure 72:
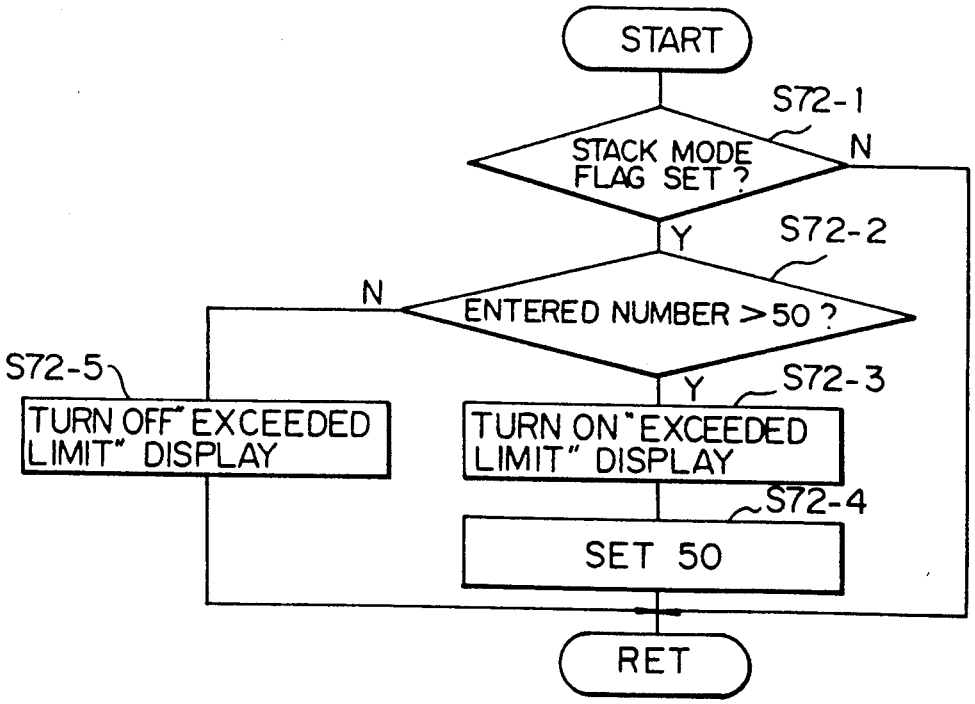
FIG. 72 is a flowchart showing a copy number check procedure executed in a stack mode.

As shown in FIG. 72, in the stack mode, whether or not the stack mode flag is set is determined (S72-1) and, if the answer is NO, the program returns. If the answer of the step S72-1 is YES, whether or not the number entered is greater than fifty is determined (S72-2). If the answer of the step S72-2 is YES, a display "EXCEEDED LIMIT" is turned on (S72-4) and the number is replaced with fifty (S72-4). If the answer of the step S72-2 is NO, the program turns off the display "EXCEEDED LIMIT" and then returns. It is to be noted that the number "fifty" is indicative of the number of paper sheets which can be stacked.

Figure 73:
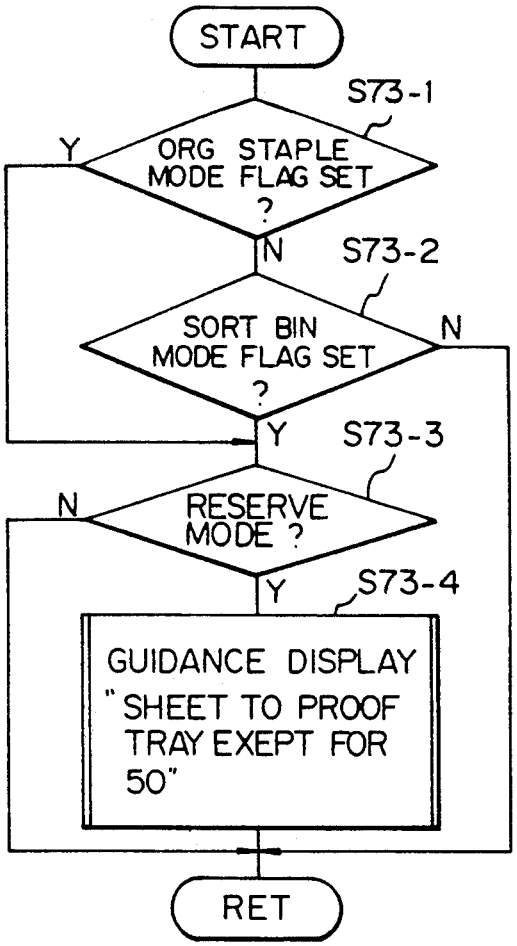
FIG. 73 is a flowchart showing a procedure for alerting the operator to the maximum number of documents allowable in the reserve mode.

In the reserve mode, it is necessary to alert the operator to the maximum number of documents since the number of documents which can be stacked is limited as stated above. In the light of this, in the reserve mode, processing shown in FIG. 73 is executed. Specifically, the processing of FIG. 73 begins with a step S73-1 of determining whether or not the ORG (original) staple mode flag is set (S73-1) and, if the answer is NO, whether or not the sort bin mode flag is set is determined (S73-2). If the answer of the step S73-2 is NO, the program returns; if otherwise, whether or not the reserve mode is set is determined (S73-3). If the answer of the step S73-3 is YES, a message such as "DISCHARGE DOCUMENTS TO PROOF TRAY EXCEPT 50" is displayed for guidance (S73-4). If the answer of the step S73-3 is NO, the program returns immediately.

If the answer of the step S73-1 is YES, the program executes the step S73-3 and successive steps skipping the step S73-2.

Figure 74:
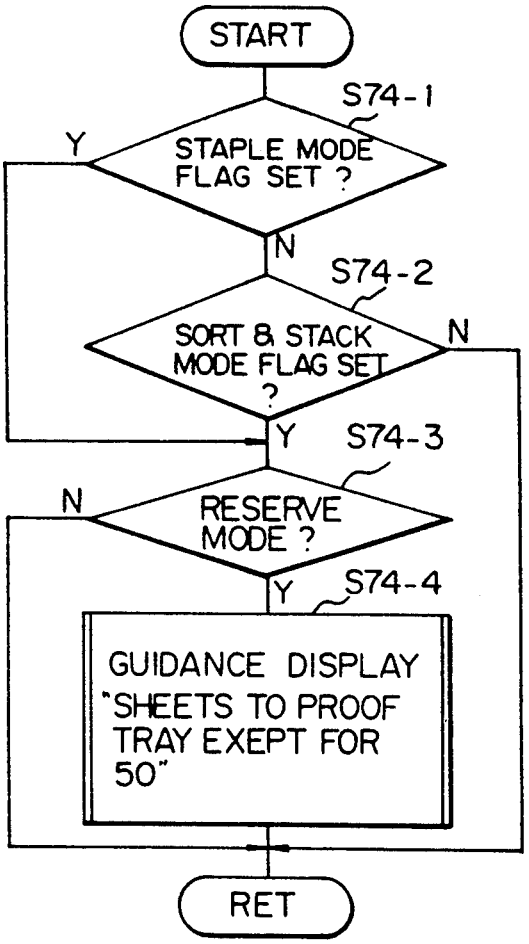
FIG. 74 is a flowchart showing a procedure for alerting the operator to the maximum number of copies allowable in the reserve mode.

It is necessary even with a copy staple mode to alert the operator to the maximum number of copies, i.e., fifty copies when it comes to the reserve mode. Therefore, as shown in FIG. 74, whether or not the staple mode flag is set is determined (S74-1) and, if not, whether or not the sort mode flag and stack mode flag are set is determined (S74-2). If the answer of the step S74-2 is NO, the program returns immediately; if otherwise, whether or not the reserve mode is selected is determined (S74-3). If the answer of the step S74-3 is YES, a message such as "DISCHARGE SHEETS TO PROOF TRAY EXCEPT 50" is displayed for guidance (S74-4); if otherwise, the program returns.

If the answer of the step S74-1 is YES, the program executes the step S74-3 and successive steps skipping the step S74-2.

7. Different Flows of Document and Paper Based on Modes

Figure 75:
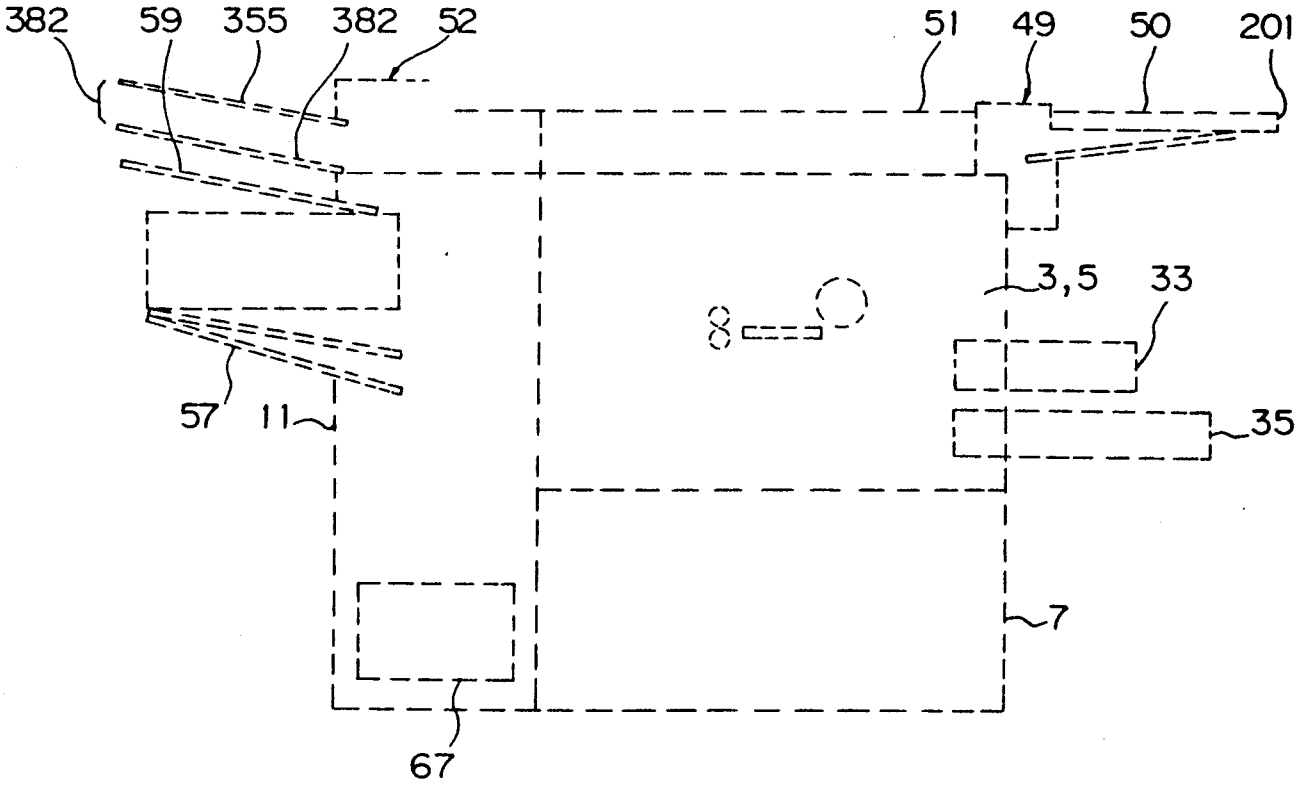
FIG. 75 shows the general construction of a copier.

Referring to FIG. 75, the copier 1 of FIG. 1 is shown schematically and handles documents and paper sheets, or sheets collectively, with the document transport section 9 including the multi-step ADF 49 and document discharge unit 52, document stack tray 382, doggy tail 382, proof tray 59, bins 57, stack tray 67, and paper trays 33 and 35. Since the copier body has a conventional construction, the following description will concentrate on the modes and flows of documents 69 and paper sheets 37.

FIG. 76 shows a specific format of a command which is fed from the CPU 573 of the copier body to the document feeding device 12 and representative of a copy mode. As shown, the command has four bits and is transmitted from the CPU 573 of the copier body to the CPU 601 of the document transport unit 51 via the serial data transmission/reception device 579.

FIG. 77 shows a specific format of a 3-bit command which is transmitted from the CPU 573 of the copier body to the CPU 651 of the finisher 11 via the serial data transmission/reception device 581. Patterns in which the documents 69 may be transported will be described in (9.11 Flow and Timing of Document) later with reference to FIGS. 126A and 126B.

Figure 78:
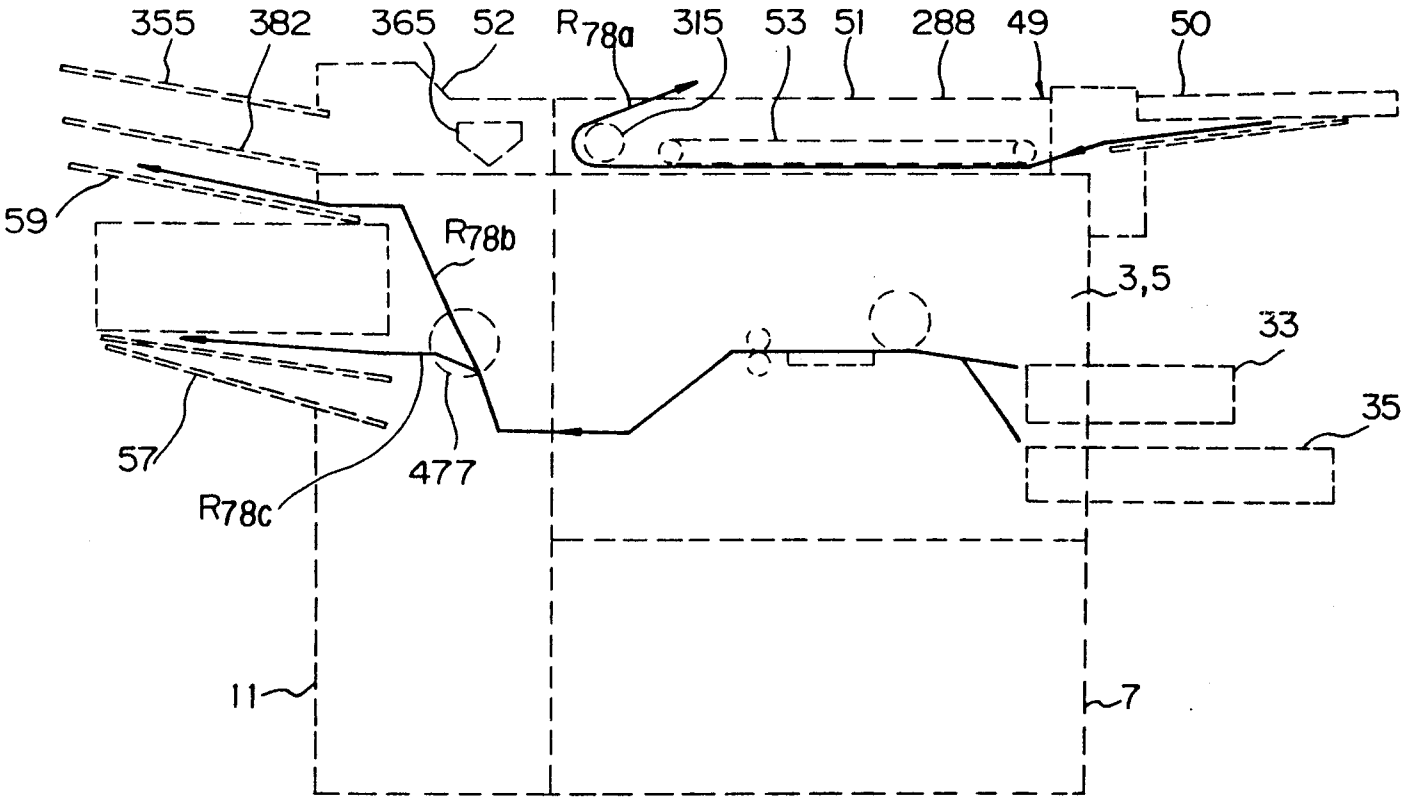
FIGS. 78 through 85 each shows the flow of documents and paper sheets in a particular received mode.

(1) FIG. 78 shows a particular condition in which the command or copy mode data sent from the copier to the document feeding device is "1011" while the command or copy mode data sent from the copier to the finisher is "000" for the documents 69 and "011" through "101" for the paper sheets 37.

The documents 69 are fed from the multi-step unit 50 and then directly discharged onto the tray 285 provided on the cover plate 288 (route labeled $R_{78a}$). The paper sheets 37 are discharged onto the proof tray 59 ("011"; $R_{78b}$).

The documents 69 fed from the multi-step unit 50 are directly discharged onto the tray 285 ($R_{78a}$). The paper sheets 37 are routed to the bins 57 in the sort mode ("100"; $R_{78c}$). In the sort mode, the lowermost bin 57 is the first bin.

The documents 69 fed from the multi-step unit 60 are routed to the tray 285 ($R_{78a}$). The paper sheets 37 are distributed to the bins 57 in the stack mode ("101"; $R_{78c}$).

Figure 79:
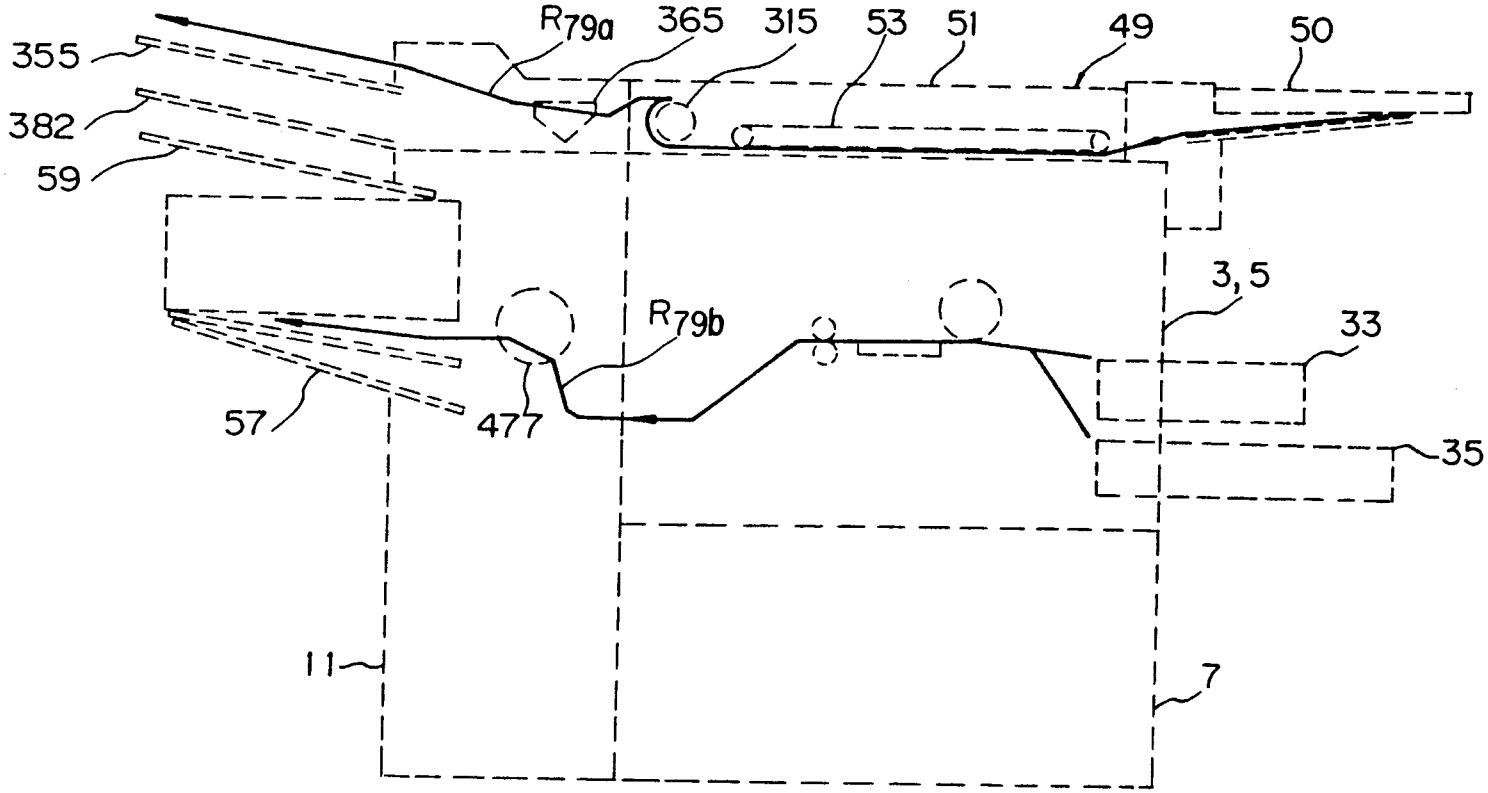

(2) FIG. 79 shows another particular case wherein the command sent from the copier body to the document transport unit 51 is "1100" while the command sent from the copier body 1 to the finisher 11 is "000" for the documents 69 and "100" or "101" for the paper sheets 37. In this condition, the documents 69 are fed from the multi-step unit 50, turned over, and then routed to the doggy tail (shift tray) 355 ($R_{79a}$). The paper sheets 37 are driven out onto the proof tray ("011"; $R_{78b}$).

The documents 69 fed from the multi-step unit 50 are turned over and then discharged to the doggy tail (shift tray) 355. The paper sheets 37 are routed to the proof tray 59 ("011"; $R_{78b}$).

The documents 69 fed from the multi-step unit 50 are turned over and then discharged to the doggy tail (shift tray) 355 ($R_{79a}$). The paper sheets 37 are routed to the bins 57 in the sort mode or the staple mode ("100" or "101"; $R_{79b}$).

Figure 80:
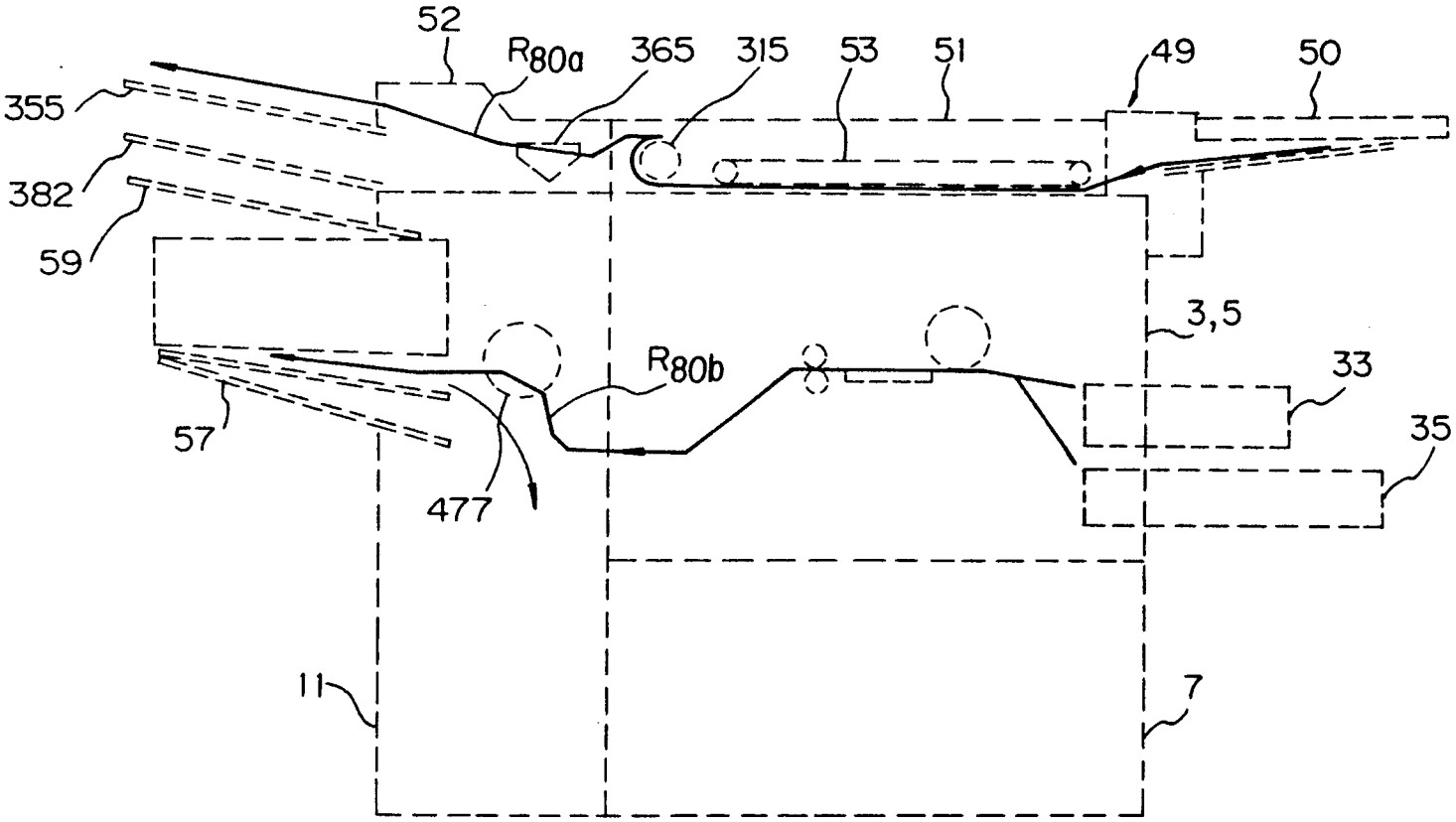

(3) FIG. 80 shows another particular case wherein the command sent from the copier body 1 to the document transport unit 51 is "1100" while the command sent from the copier body 1 to the finisher 11 is "000" for the documents 69 and "100, 110" for the paper sheets 37. Specifically, the documents 69 are fed from the multi-step unit 50, turned over, and then discharged to the doggy tail (shift tray) 355 ($R_{80a}$). The paper sheets 37 are distributed to the bins 57 in the sort mode ("100"), stapled, and then discharged to the stack tray 67 ("110"; $R_{80b}$).

Figure 81:
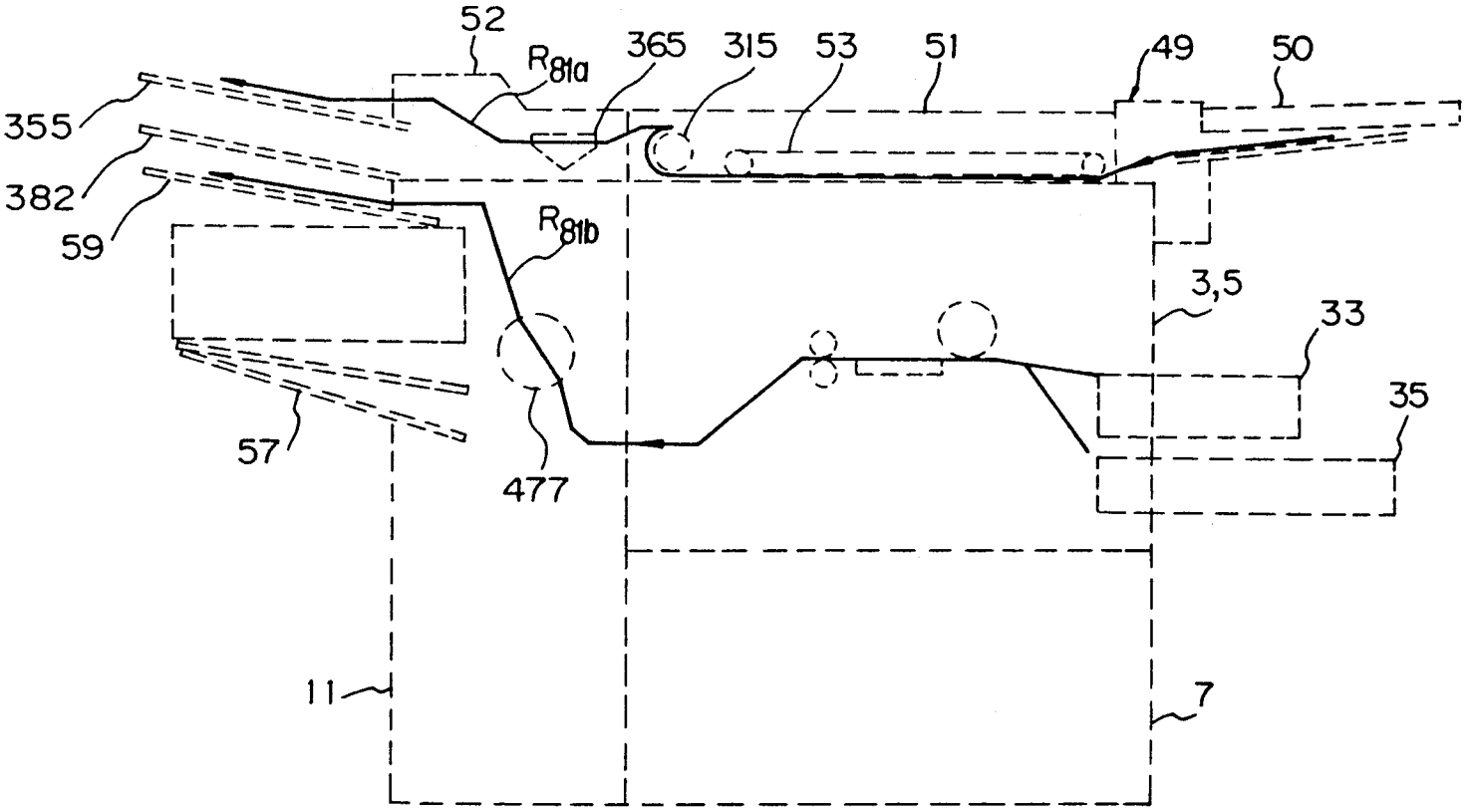

(4) FIG. 81 shows another particular condition wherein the command sent from the copier body 1 to the document transport unit 51 is "1100" while the command sent from the copier 1 to the finisher 11 is "000" for the documents 69 and "011" for the paper sheets 37. In this condition, the documents 69 are fed from multi-step unit 50, turned over, and then discharged to the doggy tail (shift tray) 355 ($R_{81a}$). The paper sheets 37 are routed to the proof tray 59 ("100").

Figure 82:
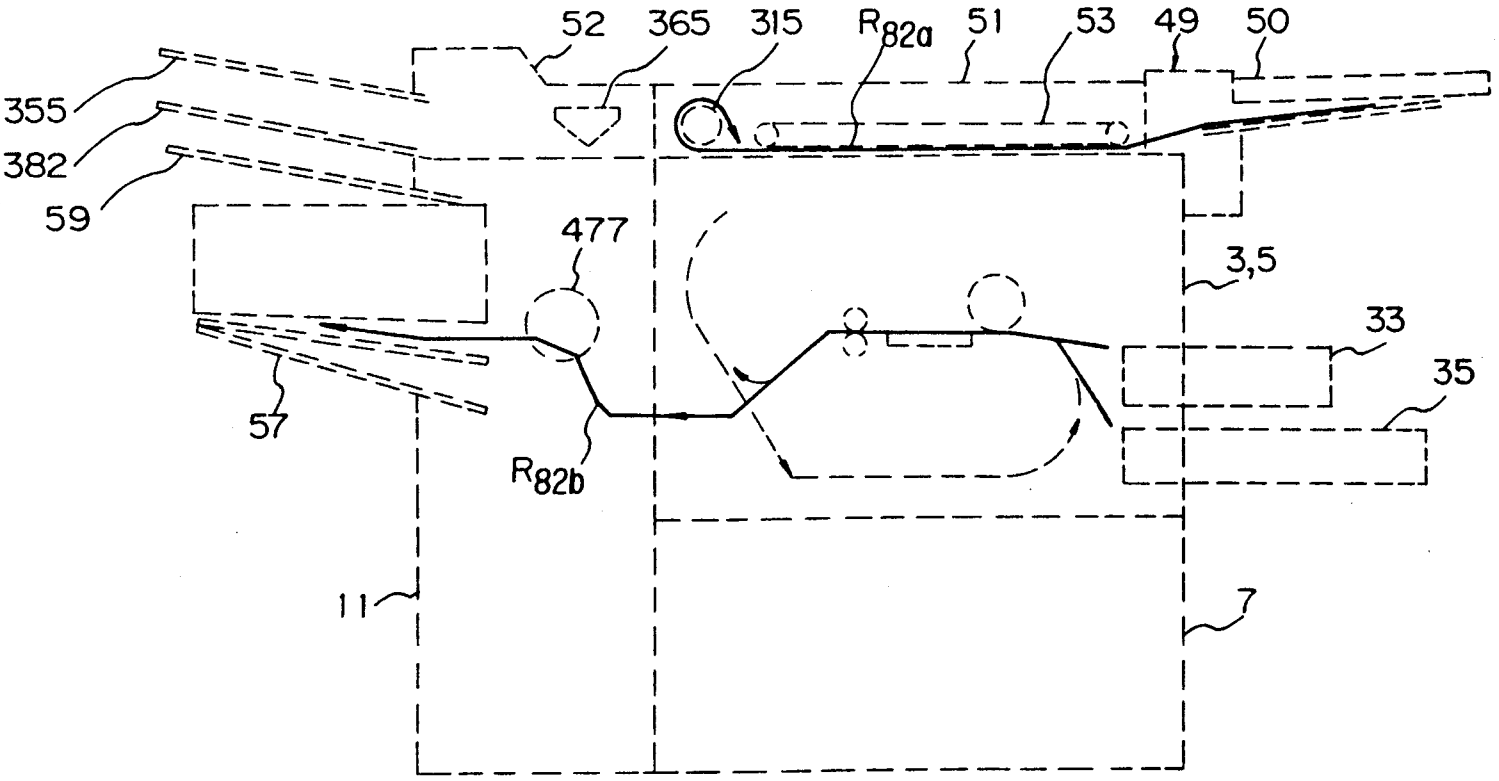

(5) FIG. 82 shows another particular condition wherein the command fed from the copier 1 to the document transport unit 50 is dummy data "000" (to copy the rear surfaces) while the command fed from the copier 1 to the finisher 11 is "000" for the documents 69 and "100, 101" for the paper sheets 37. Specifically, the documents 69 are fed from the multi-step unit 50 in the reverse mode and then have both sides thereof copied, the rear surface being first. At the time when the front surfaces of the documents 69 are copied, new data is received and, therefore, the documents 69 are routed to a particular destination matching the received data ($R_{82a}$). The paper sheets 37 are once stacked on the intermediate tray 43, turned over, subjected to the copying process again, and then distributed to the bins 57 in the sort mode or the stack mode ("100, 101", $R_{82b}$).

Figure 83:
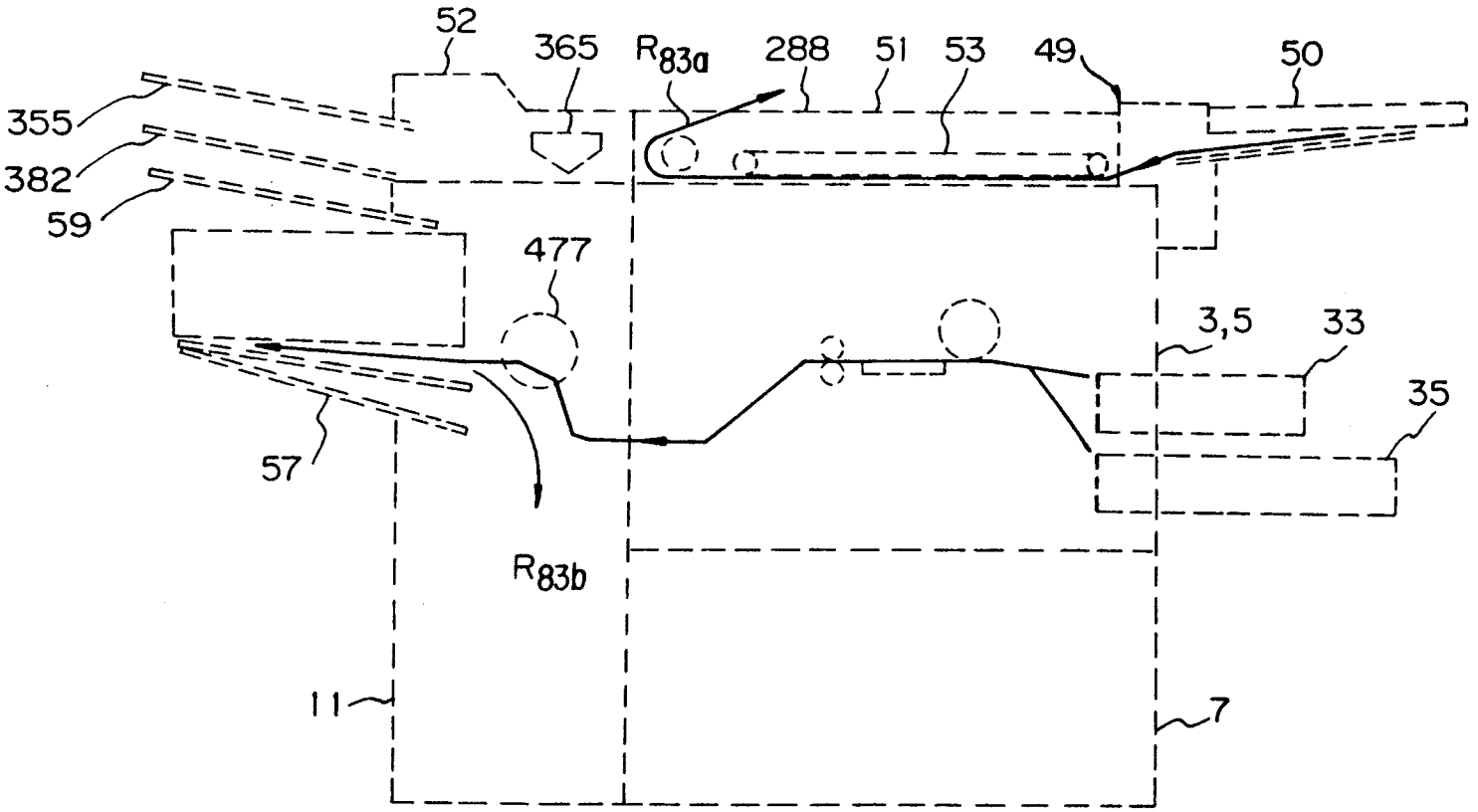

(6) FIG. 83 shows another particular condition wherein the command sent from the copier 1 to the document transport unit 51 is "1011" while the command sent from the copier 1 to the finisher 11 is "000" for the documents 69 and "100, 110" for the paper sheets 37. In this condition, the documents 69 are fed from the multi-step unit 50 and directly discharged onto the tray 285 provided on the cover plate 288 ($R_{83a}$). The paper sheets 37 are routed to the bins 57 in the sort mode ("100"), stapled, and then routed to the stack tray 67 ("110"; $R_{83b}$).

Figure 84:
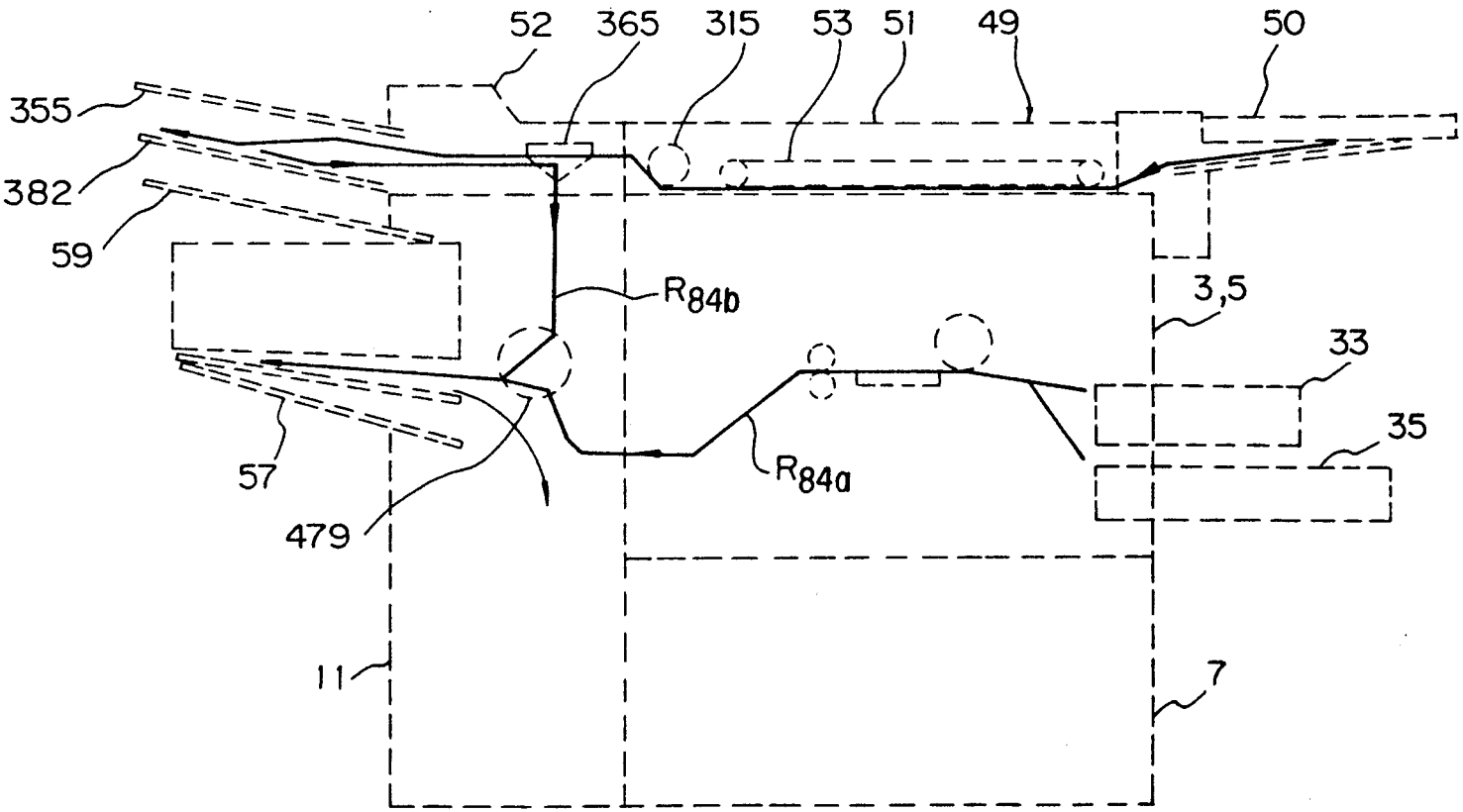

(7) FIG. 84 shows another particular condition wherein the command sent from the copier 1 to the document transport unit 51 is "1101" while the command sent from the copier 1 to the finisher 11 is "010" for the documents 69 and "100, 110" for the paper sheets 37. Specifically, the documents 69 are fed from the multi-step 50, once stacked on the document stack tray 382, transferred to the bins 57, stapled, and then discharged to the stack tray 67 ("1101"; $R_{84a}$). The paper sheets 37 are distributed to the bins 57 in the sort mode ("100"), stapled, and then discharged to the stack tray 67 ("110"; $R_{84b}$).

Figure 85:
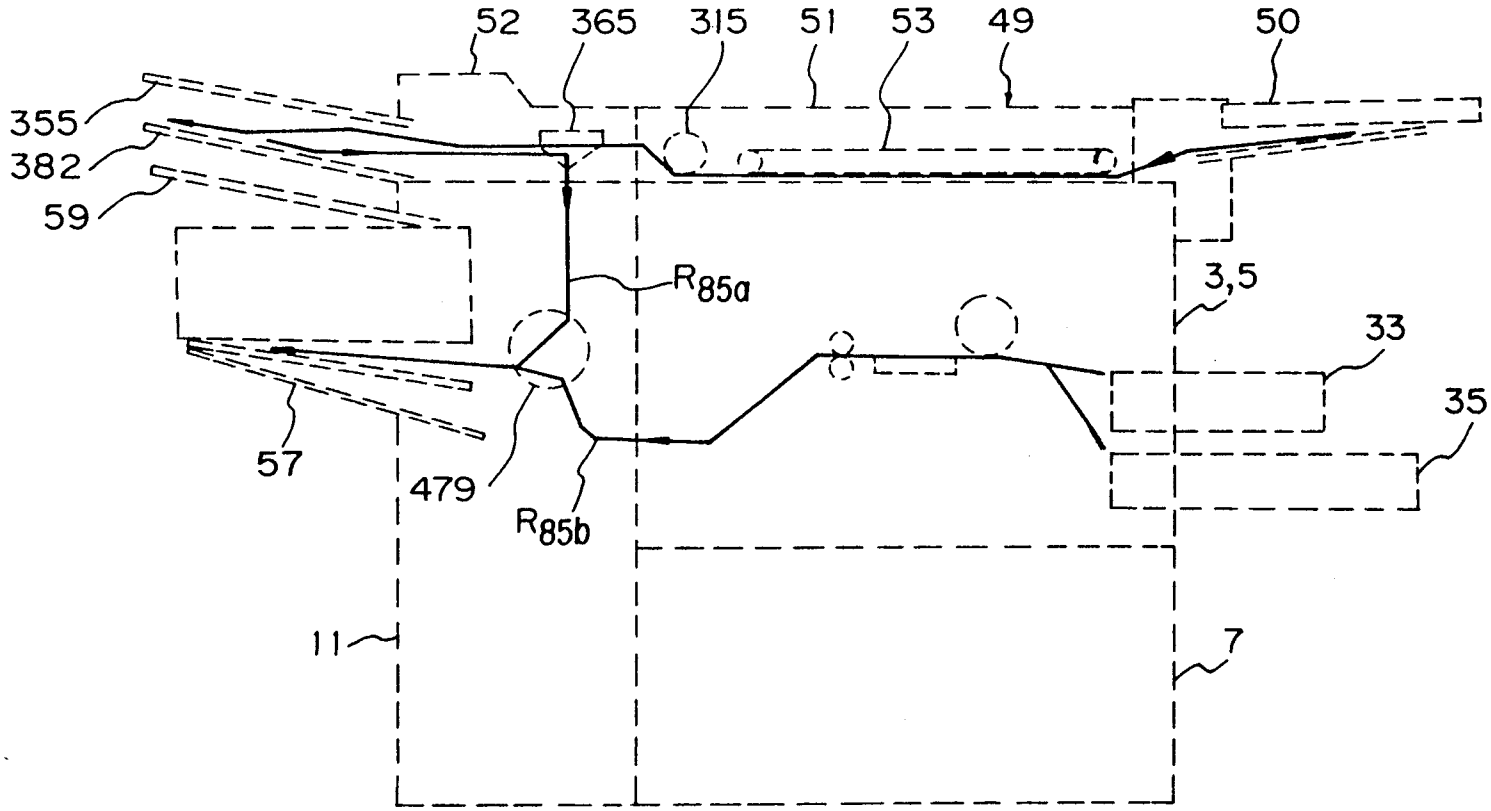

(8) FIG. 85 shows another particular condition wherein the command sent from the copier 1 to the document transport unit 51 is "1101" while the command sent from the copier 1 to the finisher 11 is "010" for the documents 69 and "100" or "101" for the paper sheets 37. In this condition, the documents 69 are fed from the multi-step unit 50, stacked on the document stack tray 382, and then routed to the bins 57 ("1101"; $R_{85a}$). The paper sheets 37 are routed to the bins 57 in the sort mode ("100") or to the bins 57 in the stack mode ("101"; $R_{85b}$).

FIG. 86 shows a specific mode relating to the processing of documents 69 and paper sheets 37.

8. Processing After Copy Discharge

Figure 87A:
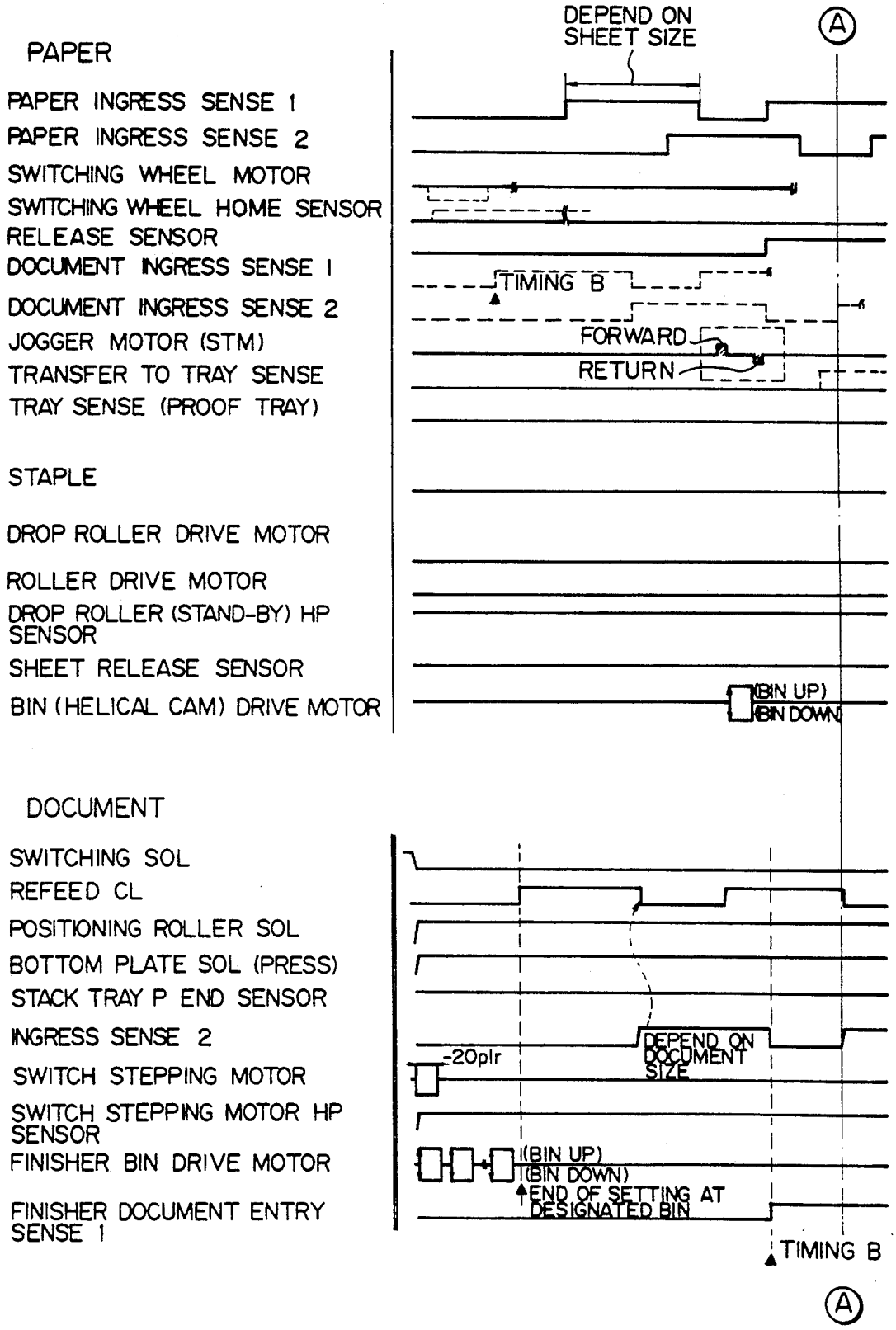
FIGS. 87A through 87C are timing charts demonstrating a procedure which follows the discharge of a paper sheet which has undergone a copying process.
Figure 87B:
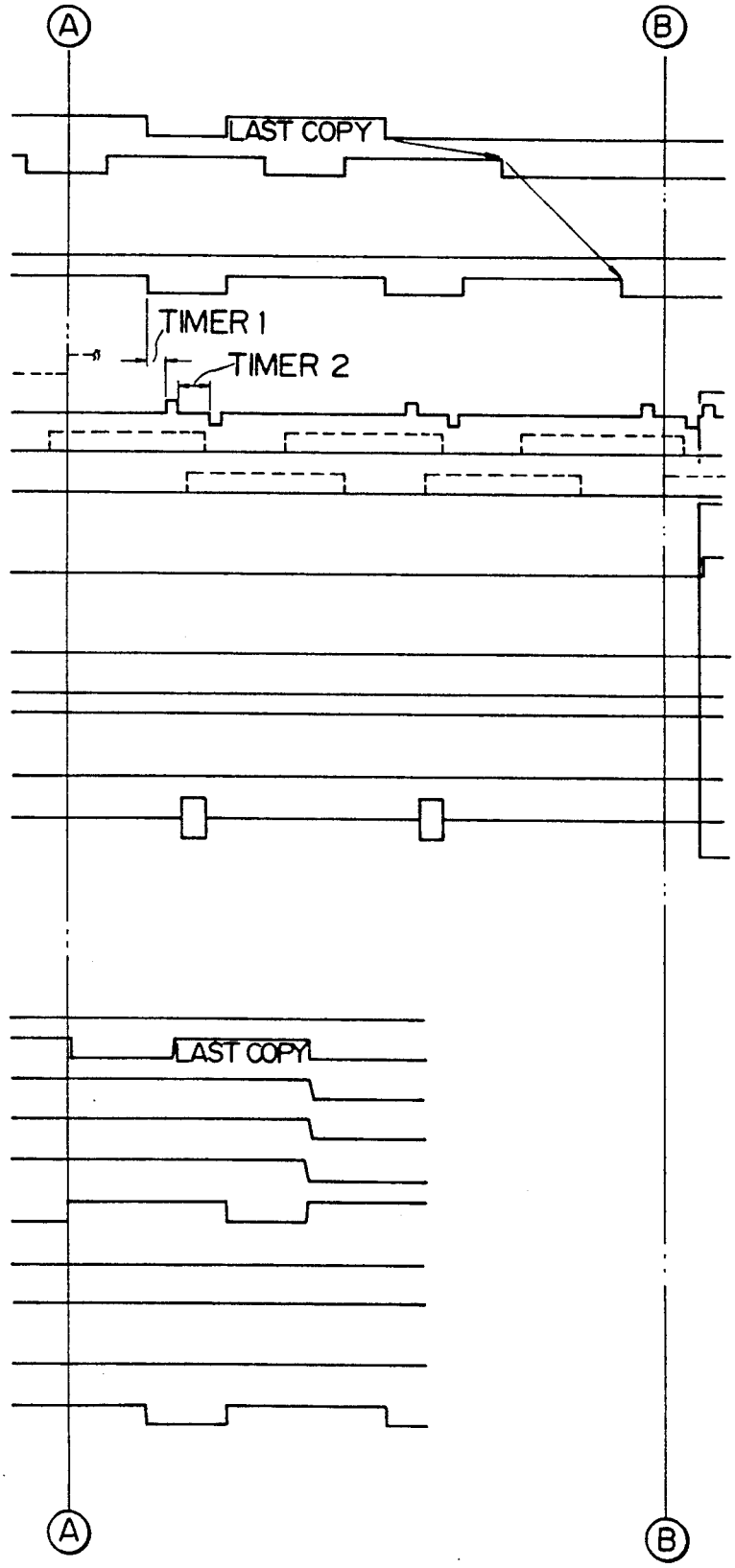
Figure 87C:
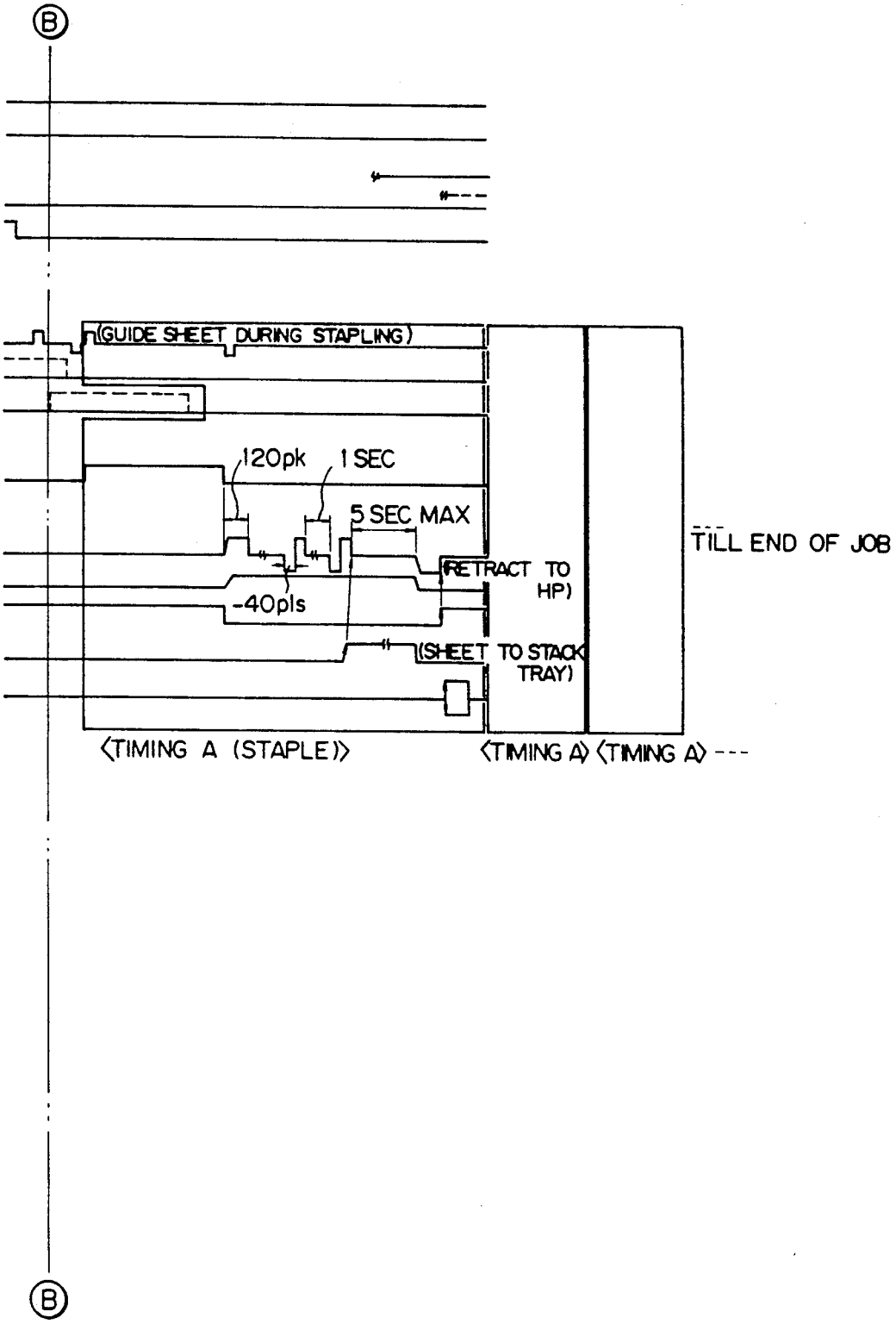

Control over the processing which follows the discharge of the paper sheets, or copies, 37 will be described. This processing is demonstrated in timing charts shown in FIGS. 87A to 87C.

8.1 Initialize

Figure 88:
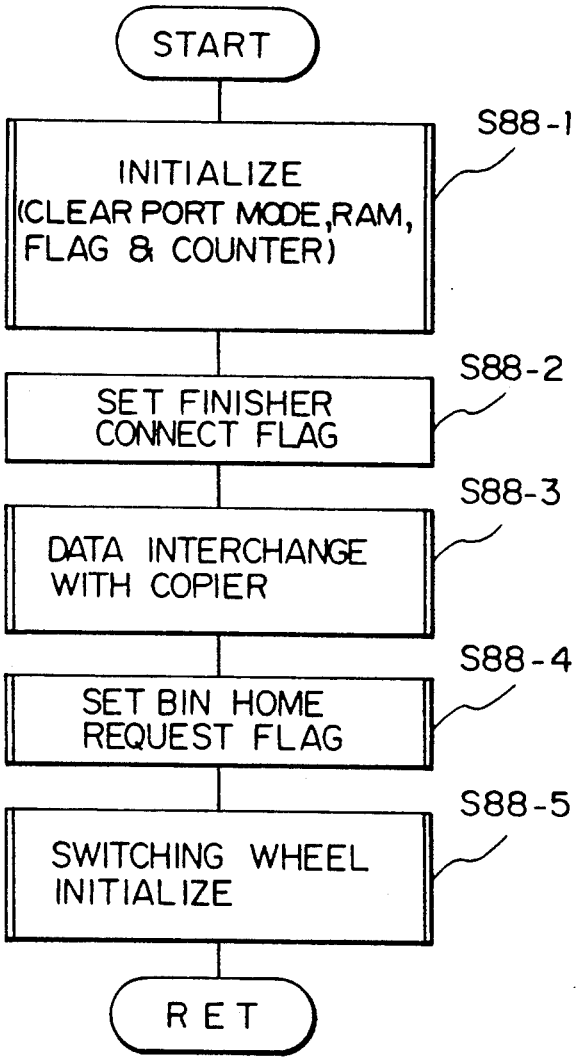
FIGS. 88, 89A, 89B and 89C are flowcharts each showing an initializing operation included in a finishing procedure.

Referring to FIG. 88, a general procedure for initialization is shown. This procedure begins with a step S88-1 of executing an initialize subroutine. Specifically, the port mode, RAM, flags and counters are cleared. Then, a finisher connect flag is set (S88-2), and data interchange with the copier 1 is effected (S88-3). Thereafter, a bin home request flag is set (S88-4), the switching wheel 477 is initialized (S88-5), and then the program returns. The bin home request flag indicates the return of the bins 57 to the home position and is ONE when the return to the home position is under way.

Figures 1, 2, 3, 89A, 89C:
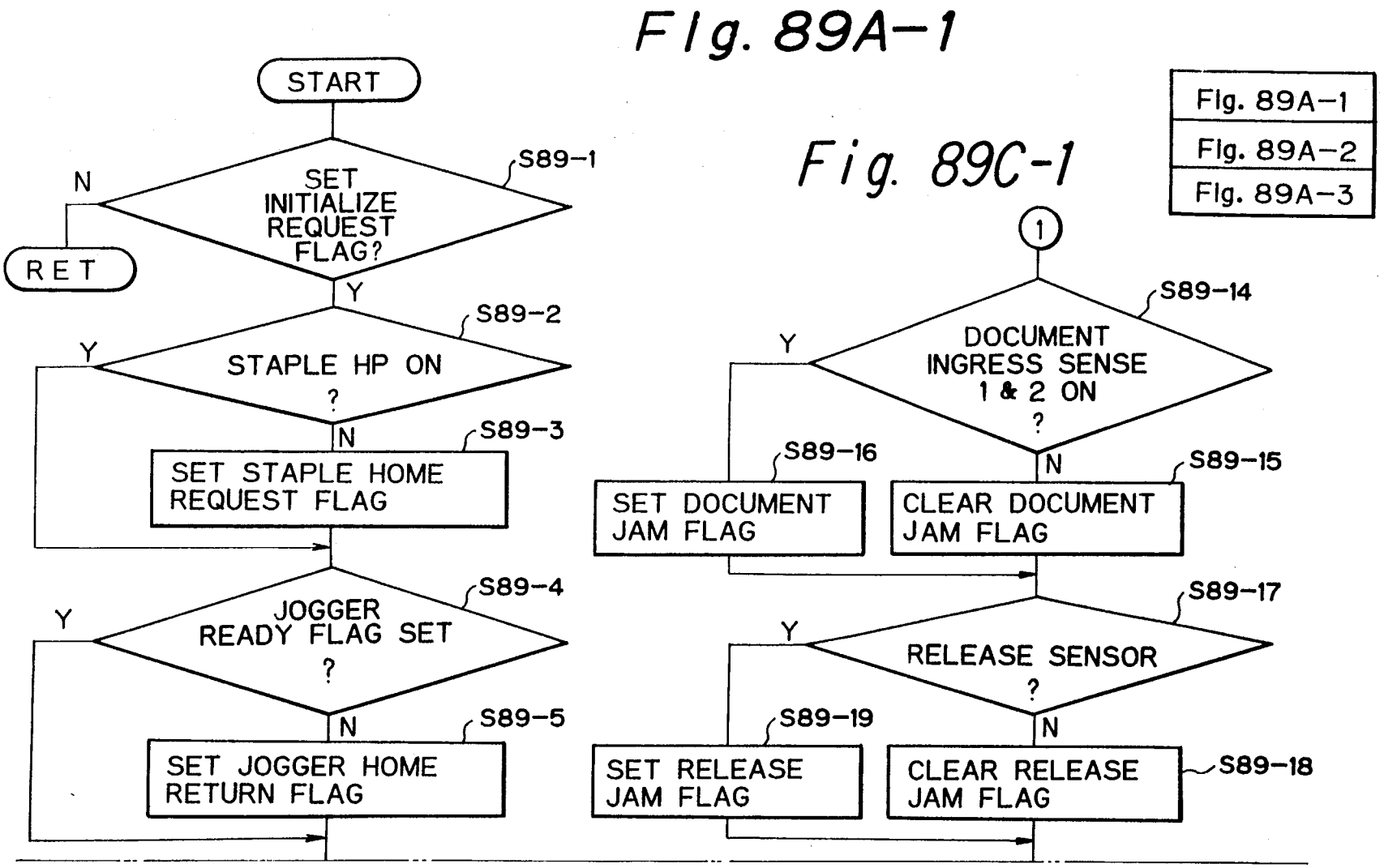
Figures 2, 89A, 89C:
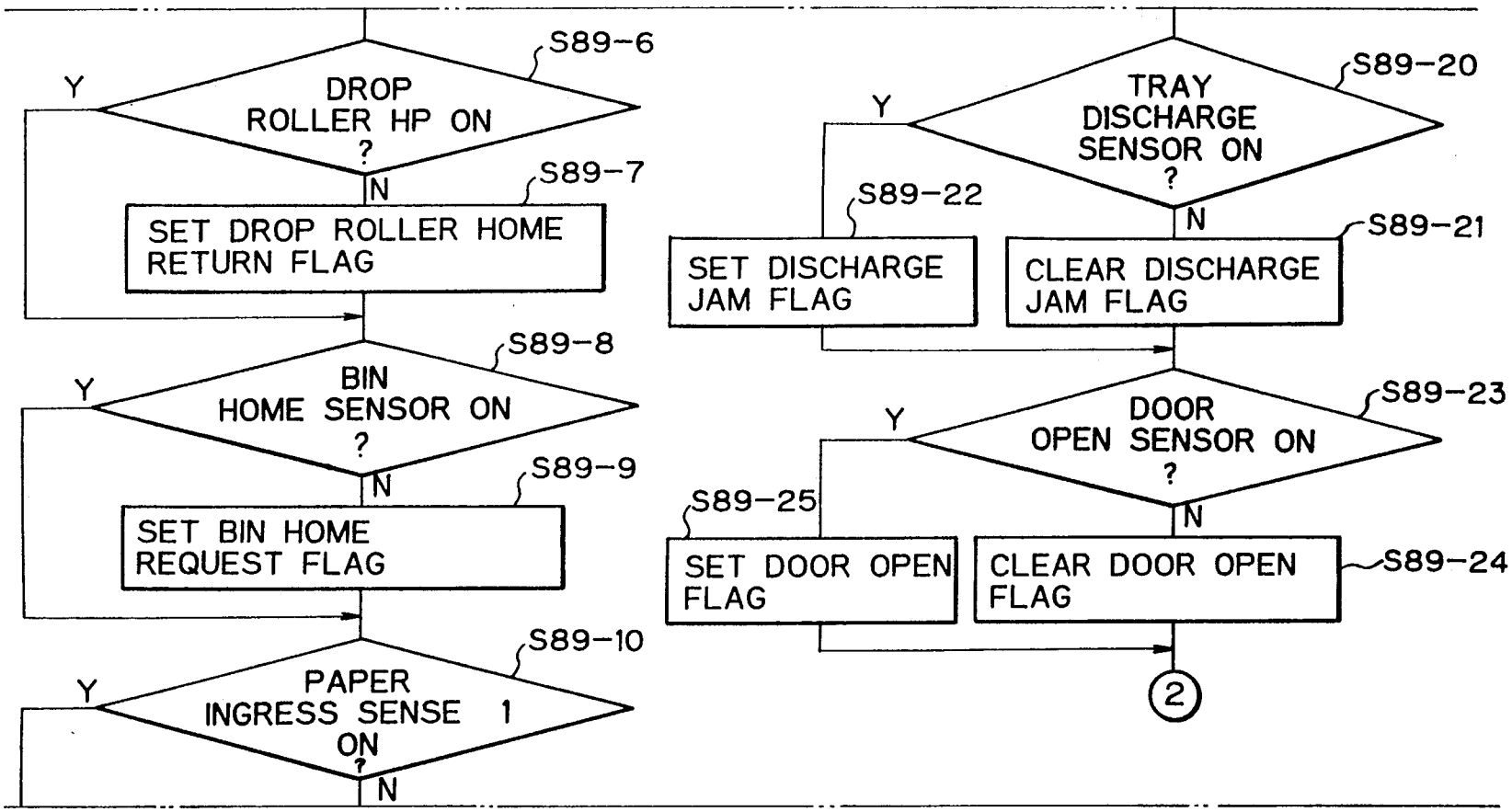
Figures 3, 89A:
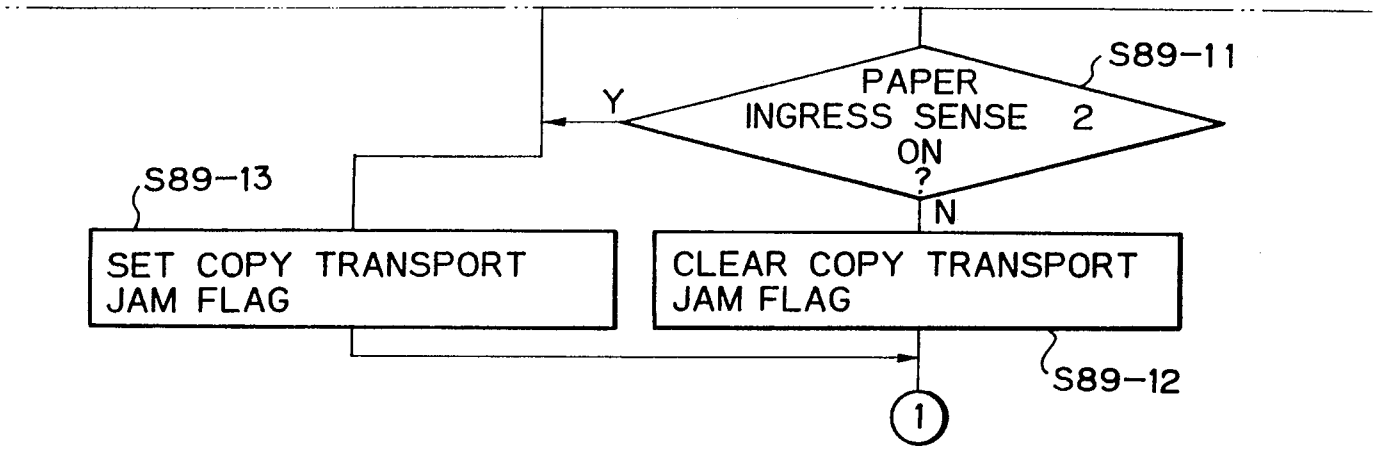
Figure 89B:
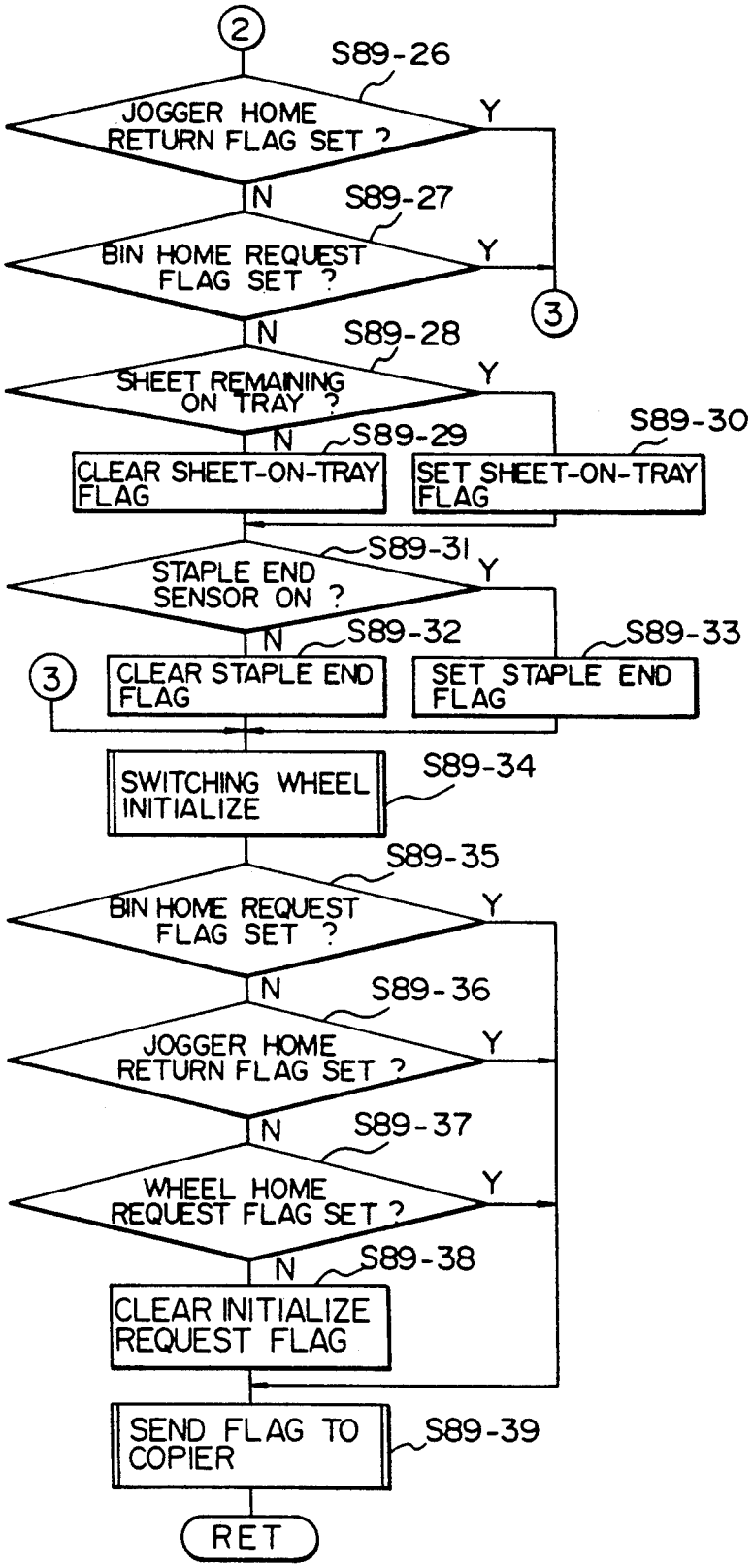

FIGS. 89A and 89B show the initialization more specifically. As shown, whether or not an initialize request flag is set is determined (S89-1) and, if it is not set, the program returns. If this flag is set, whether or not a stapler home position sensor is in an ON state is determined (S89-2). The initialize request flag is sent from the copier 1 to the finisher 11 to set the associated flag of the finisher 11. After checking the jogger 63, bins 57, drop rollers 432 and 433, initial jam and so on, the finisher 11 resets the flag and sends it to the copier body.

If the stapler home position sensor 429 is not in an ON state as determined in the step S89-2, a stapler home request flag is set (S89-3); if it is in an ON state, whether or not a jogger ready flag is set is determined (S89-4). The jogger ready flag shows whether or not the jogger 63 is located in a particular jogging position, and it is set when the movement of the jogger 63 ends. If the answer of the step S89-4 is NO, a jogger home return flag is set (S89-5); if otherwise, whether or not a drop roller home position sensor is in an ON state is determined (S89-6). The jogger home return flag indicates the return of the jogger 63 to the home position and is ON when the return to the home position is under way.

If the answer of the step S89-6 is NO, a drop roller home return flag for returning the drop rollers to the home position is set (S89-7); if otherwise, whether or not the bin home sensor 542 is in an ON state is determined (S89-8). If the answer of the step S89-8, a bin home request flag is set (S89-9); if otherwise, whether or not the output of a first paper ingress sensor (paper ingress sense 1) 535 indicates the entry of the paper sheet 37 is determined (S89-10). If the answer of the step S89-10 is NO, whether or not the output of a second paper ingress sensor (paper ingress sense 2) indicates the entry of the paper sheet 37 is determined (S89-11). If the answer of the step S89-11 is YES, a copy jam flag is set (S89-13) to inform the CPU 573 of a paper jam; if otherwise, the copy jam flag is cleared (S89-12) to inform the CPU 573 of the fact that a paper jam has not occurred. The copy jam flag is associated with a paper jam detected by the first sensor 534 or the second sensor 504 and is ONE when a paper jam has occurred or ZERO when it has not occurred.

Subsequently, whether or not the outputs of the first and second document ingress sensors (document ingress sense 1 and 2) 536 and 502 indicate that a document is present is determined (S89-14). If the answer of the step S89-14 is NO, a document jam flag is cleared (S89-15); if otherwise, the document jam flag is set (S89-16). Then, whether or not the output of a release sensor indicates the presence of a document is determined (S89-17). The document jam flag is ONE when a jam has occurred or ZERO when it has not occurred. If the answer of the step S89-17 is NO, a release jam flag is cleared to indicate that a jam has not occurred (S89-18); if otherwise, the release jam flag is set (S89-19). Thereafter, whether or not the output of the tray discharge sensor 538 indicates the presence of a sheet is determined (S89-20). If the answer of the step S89-20 is NO, a discharge jam flag is reset to indicate that a jam has not occurred (S89-21); if otherwise, the discharge jam flag is set (S89-22). Then, whether or not a door open sensor is in an ON state is determined (S89-23).

If the answer of the step S89-23 is NO, a door open flag is cleared to show that the door of the finisher 11 is closed (normal) (S89-24); if otherwise, the door open flag is set (S89-25). Whether or not the jogger home return flag is set is determined (S89-26). If the answer of the step S89-26 is NO, whether or not the bin home request flag is set is determined (S89-27). If the answer of the step S89-27 is NO, whether or not sheets are left on the tray is determined (S89-28). If no paper sheets are left on the tray, a paper-on-tray flag is cleared (S89-29); if otherwise, the paper-on-tray flag is set (S89-30). Subsequently, whether or not the staple end sensor is in an ON state is determined (S89-31).

If the staple end sensor is in an OFF state as determined in the step S89-31, the staple end flag is cleared (S89-32); if otherwise, the staple end flag is set (S89-33). This is followed by a switching wheel initialize subroutine (S89-34). If the answer of the step S89-26 is YES or if the answer of the step S89-27 is YES, the program directly advances to the step S89-34. After the step S89-34, a step S89-35 is executed to see if the bin home request flag is set. If the bin home request flag is set, a flag is sent to the CPU 573 of the copier 1 (S89-39); if otherwise, whether or not the jogger home return flag is set is determined (S89-36). If the answer of this step S89-36 is YES, a flag is sent to the CPU 573 of the copier 1 (S89-39); if otherwise, whether or not a wheel home request flag is set is determined (S89-37). The wheel home request flag is adapted to set the switching wheel 477 at a home position relating to the control. If the answer of the step S89-37 is YES, a flag is sent to the CPU 573 of the copier 1 (S89-39); if otherwise, the initial request flag is cleared (S89-38). Thereafter, the program returns after sending a flag to the CPU 573 (S89-39).

8.2 Jogger Drive Processing

Figures 1, 2, 3, 90A, 90F:
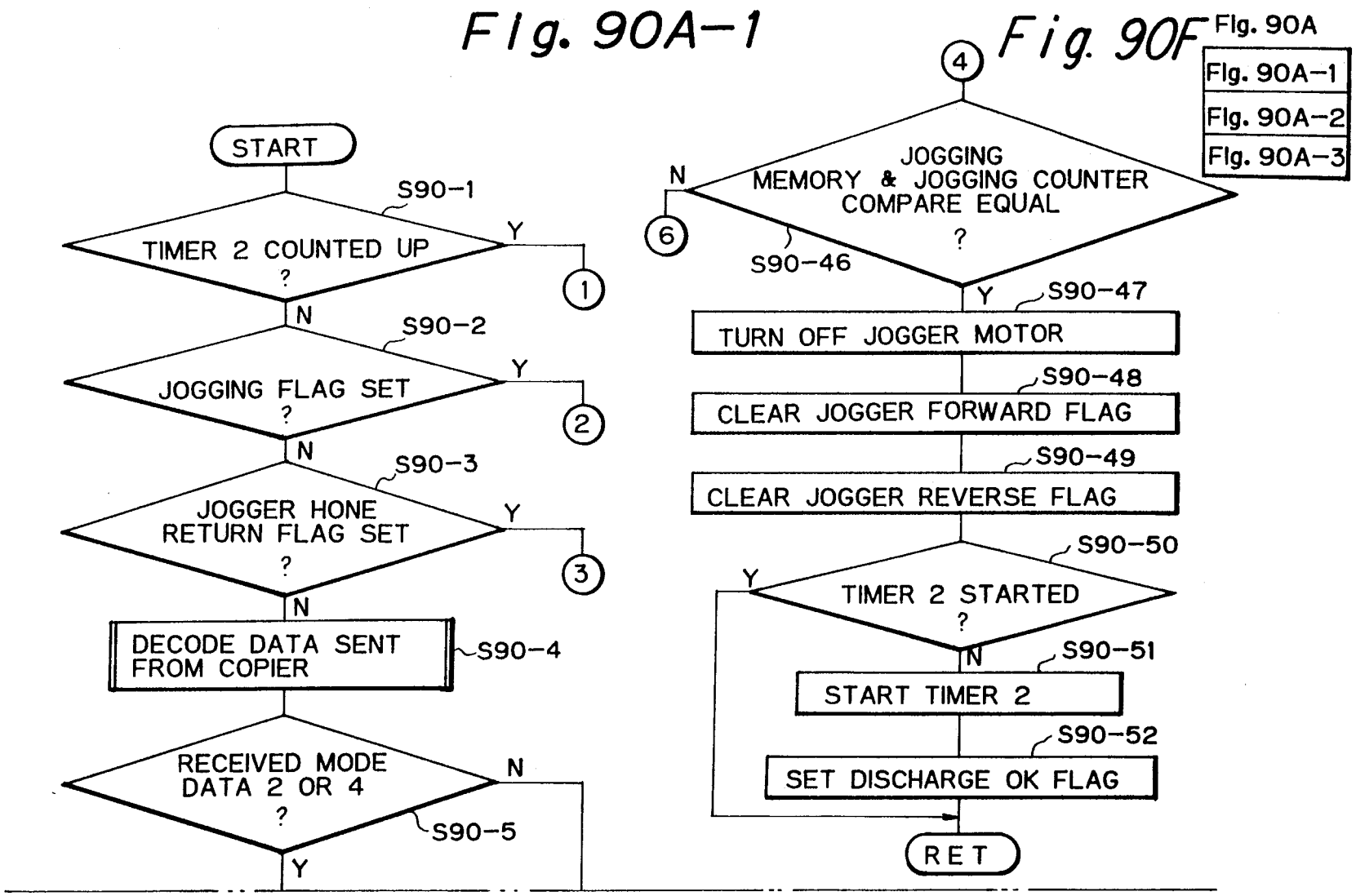
FIGS. 90A through 90F are flowcharts showing a jogger drive procedure.
Figures 2, 90A:
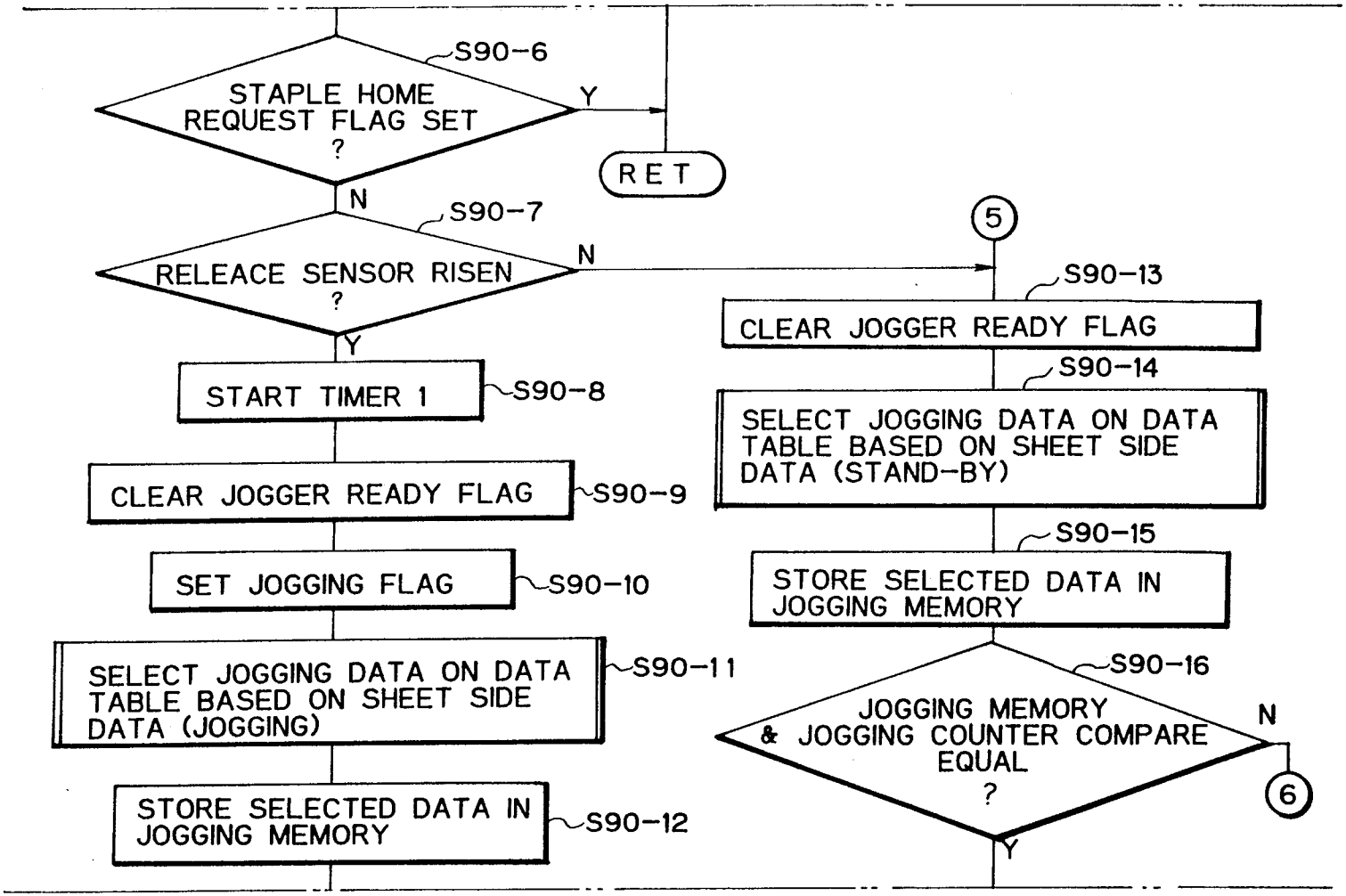
Figures 3, 90A:
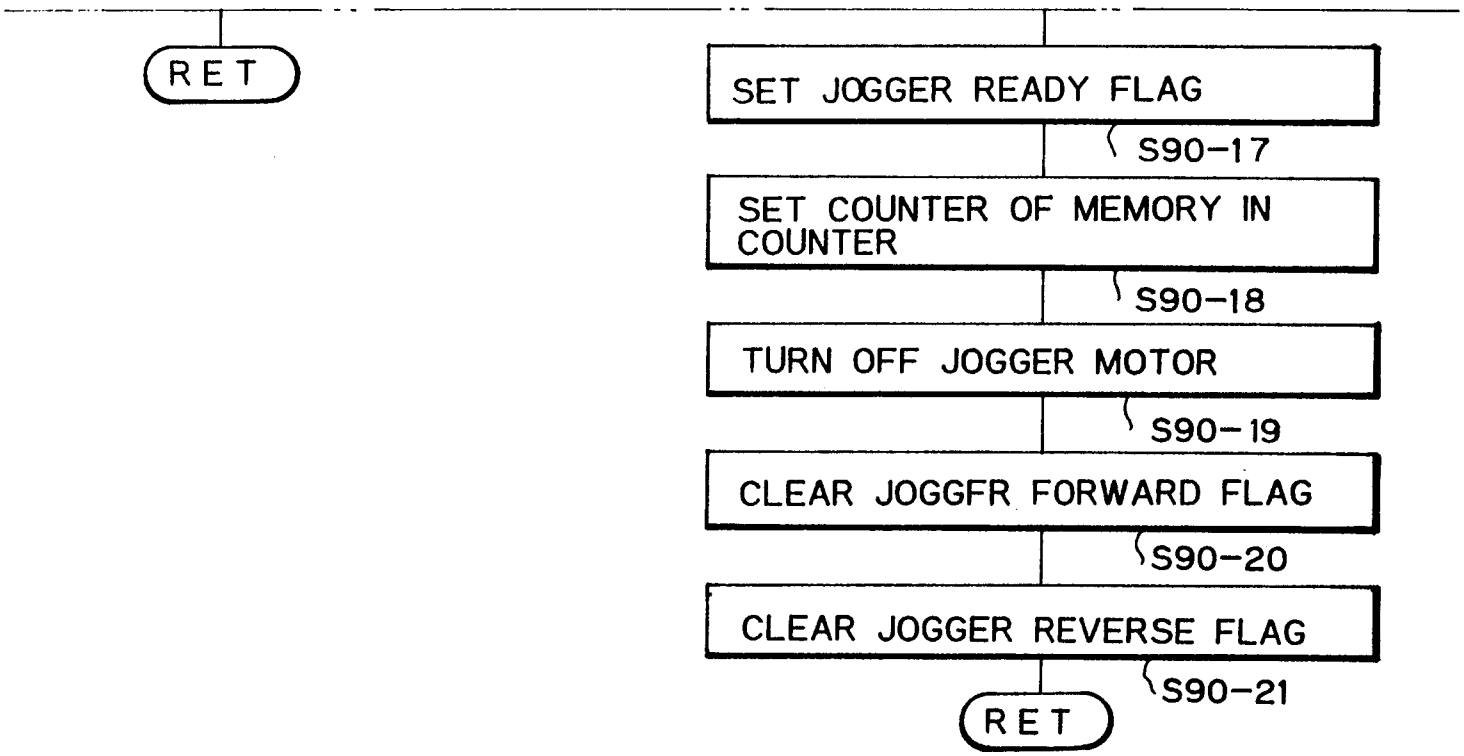
Figure 90B:
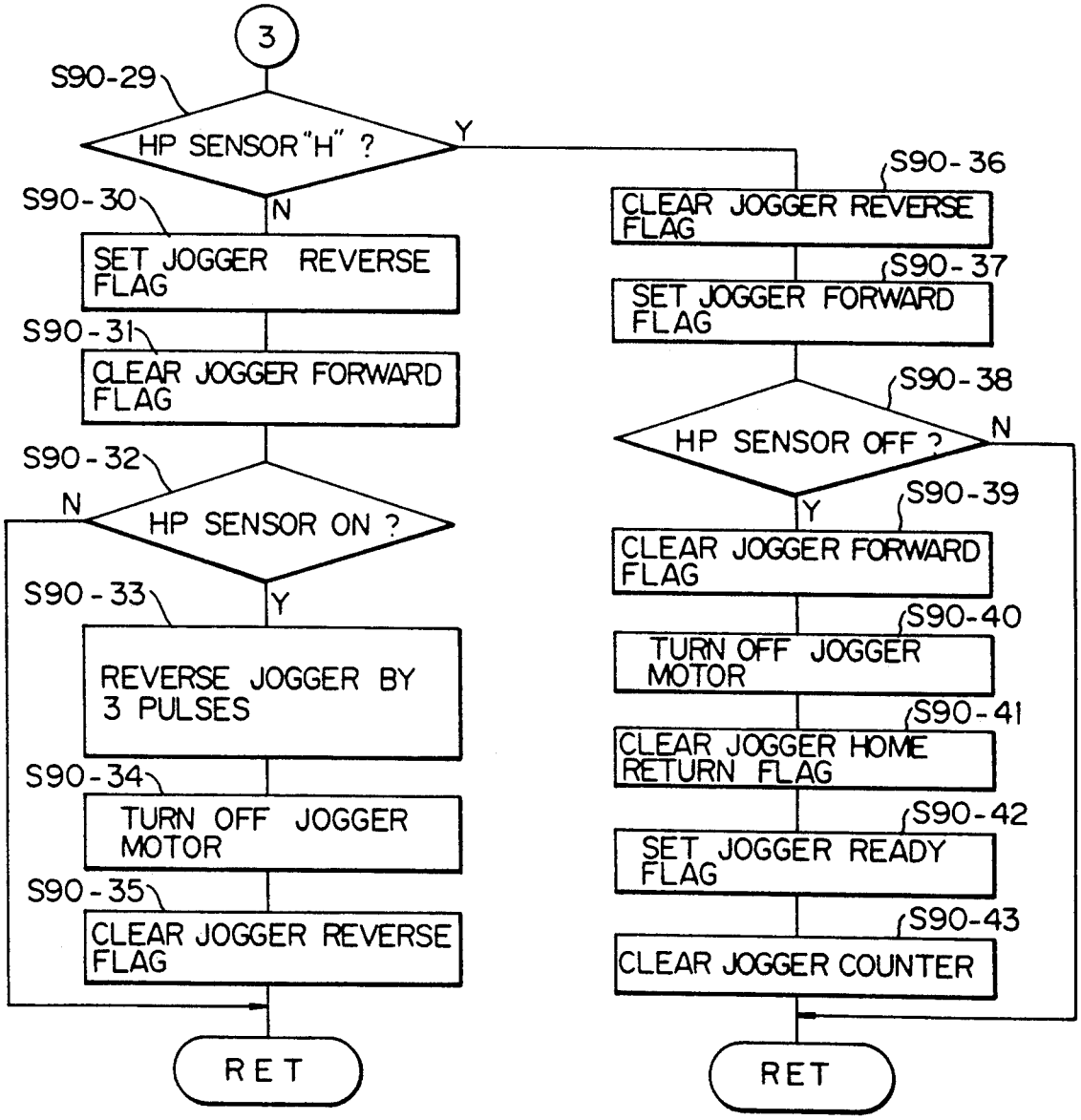
Figure 90C:
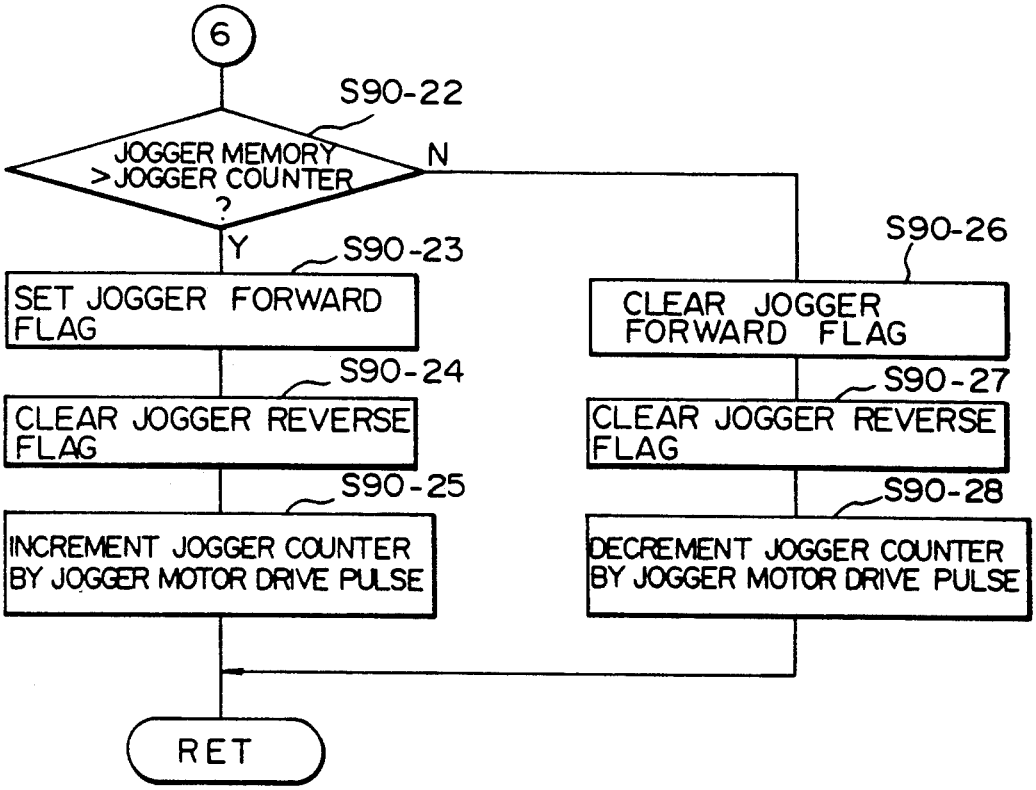
Figure 90D:
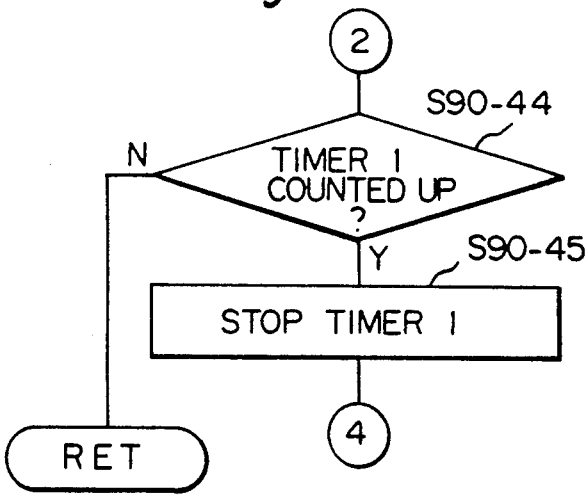
Figure 90E:
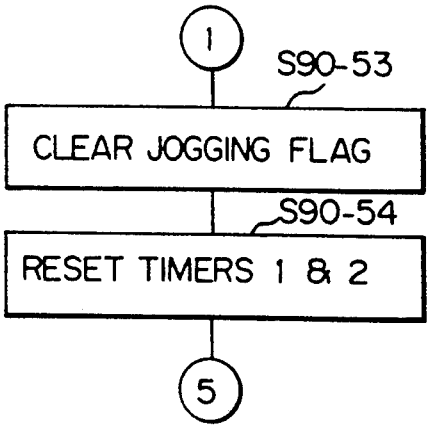

Referring to FIGS. 90A to 90C, a specific procedure for driving the jogger is shown. First, whether or not a timer 2 has counted up is determined (S90-1). If the answer of the step S90-1 is NO, whether or not a jog flag is set is determined (S90-2). If the jog flag is not set, meaning that the jogger fence 472 is not in a jogging motion, whether or not the jogger home return flag is set is determined (S90-3). If the answer of the step S90-3 is NO, data sent from the CPU 573 of the copier 1 is decoded (S90-4) to see if the mode data is 2 or 4 (S90-5). Here, the mode data 2 and 4 correspond respectively to the codes "001" and "011" shown in FIG. 77 and are indicative of a mode for routing the documents 69 to the proof tray 37 and a mode for routing the paper sheets 37 thereto.

If the mode data is not 2 or 4 as determined in the step S90-5, the program returns; if otherwise, whether or not the stapler home request flag is set is determined (S90-6). If the answer of the step S90-6 is YES, the program returns; if otherwise, whether or not the release sensor 542 is in an OFF state is determined (S90-7). If the answer of the step S90-7 is YES, the timer 1 is started (S90-8), the jogger ready flag is cleared (S90-9), and the jog flag is set (S90-10). Then, jogging data matching sheet size data is selected out of a data table (S90-11) and then stored in a jogging memory (S90-12), and then the program returns. It is to be noted that the step S90-11 indicates that a sheet positioning operation is under way. The jogging memory indicates a position to which the jogger fence 472 should be moved on the assumption that the jogger home position is "0". The content of the jogging memory and a jogging counter are combined to control the movement of the jogger fence 472.

If the answer of the step S90-7 is NO, the jogger ready flag is cleared (S90-13), and jogging data matching sheet size data is selected out of the data table (S90-14). In the meantime, the jogger is retracted from the sheets. The jogging data selected in the step S90-14 is written to the jogging memory. Whether or not the data stored in the jogging memory and the count of the jogging counter indicative of the position of the jogger fence 472 are equal is determined (S90-16). If they compare equal, the jogger ready flag is set (S90-17), and the content of the jogging memory is substituted for the content of the jogging counter (S90-18). Thereafter, the jogger motor 463 is turned off (S90-19), a jogger forward flag is cleared (S90-20), a jogger reverse flag is cleared also (S90-21), and then the program returns. The jogger forward flag is indicative of a movement of the jogger 63 in a direction fo positioning sheets, while the jogger reverse flag is indicative of a movement of the jogger 63 in the other direction.

If the result of decision in the step S90-16 is NO, the contents of the jogging memory and jogging counter are compared again (S90-22). If the content of the jogging memory is greater than that of the jogging counter, the jogger forward flag is set (S90-23), the jogger reverse flag is cleared (S90-24), the jogging counter is incremented by jogger motor drive pulses (S90-25), and then the program returns.

Conversely, if the content of the jogging counter is greater than that of the jogging memory, the jogger forward flag is cleared (S90-26), the jogger reverse flag is set (S90-27), the jogging counter is decremented by jogger motor drive pulses (S90-28), and then the program returns.

Figure 92:
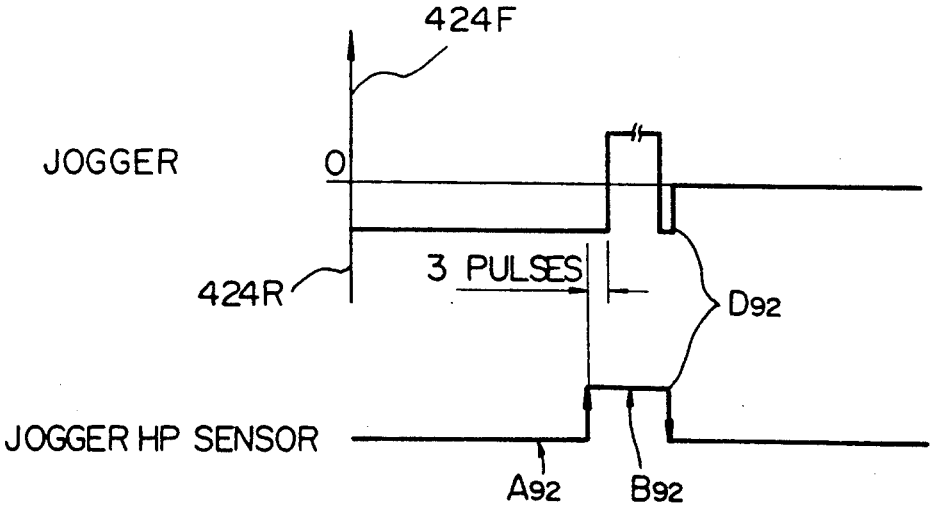
FIG. 92 is a timing chart indicative of the timing for the jogger home position sensor to sense the jogger home position.

If the answer of the previously stated step S90-3 is YES, whether or not the home position sensor 471 is in a high level or "H" is determined (S90-29). If the answer of the step S90-29 is NO, the jogger reverse flag is set (S90-30), the jogger reverse flag is cleared (S90-31), and then whether or not the output of the home position sensor 471 has risen is determined (S90-32). If the answer of the step S90-32 is NO, the program returns; if otherwise, the jogger 63 is shifted by a distance corresponding to three pulses in the reverse direction (S90-23; FIG. 92), the jogger motor 463 is deenergized (S90-33), the jogger reverse flag is cleared (S90-35), and then the program returns.

If the home position sensor 471 is in a high level as determined in the step S90-29, the jogger reverse flag is cleared (S90-36), the jogger forward flag is set (S90-37), and then whether or not the output of the home position sensor 471 has fallen is determined (S90-38). If the answer of the step S90-38 is NO, the program returns; if otherwise, the jogger forward flag is cleared (S90-39), and the jogger motor 463 is deenergized (S90-40). Thereafter, the jogger home return flag is cleared (S90-41), the jogger ready flag is set (S90-42), the jogging counter is reset (S90-43), and then the program returns.

If the jog flag is set as determined in the step S90-2, whether or not the timer 1 has counted up is determined (S90-44). If the answer of the step S90-44 is NO, the program returns; if otherwise, the timer 1 is stopped (S90-45). Then, whether or not the contents of the jogging memory and jogging counter are equal is determined (S90-46) and, if not equal, the previously stated step S90-22 and successive steps are executed. If the answer of the step S90-46 is YES, the jogger motor 463 is deenergized (S90-47), the jogger forward flag and jogger reverse flag are cleared (S90-48 and S90-49), and then whether or not the timer 2 has started is determined (S90-50). If the answer of the step S90-50 is YES, the program returns; if otherwise, the timer 2 is started (S90-51), a discharge OK flag is set (S90-52), and then the program returns.

Finally, if the timer 2 has started as determined in the step S90-1, the jogging flag is cleared (S90-53), the timers 1 and 2 are cleared (S90-54), and then the step 90-13 and successive steps are executed.

Figure 91:
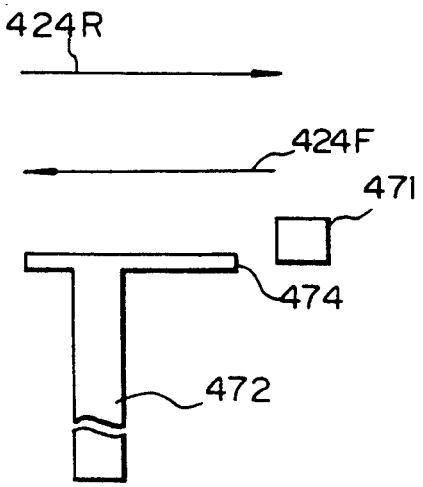
FIG. 91 shows how a jogger home position sensor senses a jogger home position.

Whether or not the output of the jogger home position sensor 471 has risen or fallen is determined in the step S90-32 or S90-38 for the following reasons. As shown in FIG. 91, a feeler 424 extends out from the jogger fence 472 and is movable toward and away from the jogger home position sensor or photointerrupter 471, i.e., in a reverse direction (arrow 424R) and a forward direction (arrow 424R). As FIG. 92 indicates, the home position of the jogger is defined by the negative-going edge ($D_{92}$) of the home position sensor 471. This is successful in defining the home position by the negative-going edge of the sensor output without fail with no regard to the current position, i.e., $A_{92}$ or $B_{92}$, despite that the sensor characteristic differs from the positive-going edge to the negative going edge.

8.3 Switching Wheel Initialize

Hereinafter will be described the control over the switching wheel 477.

Figures 93, 93A, 93B:
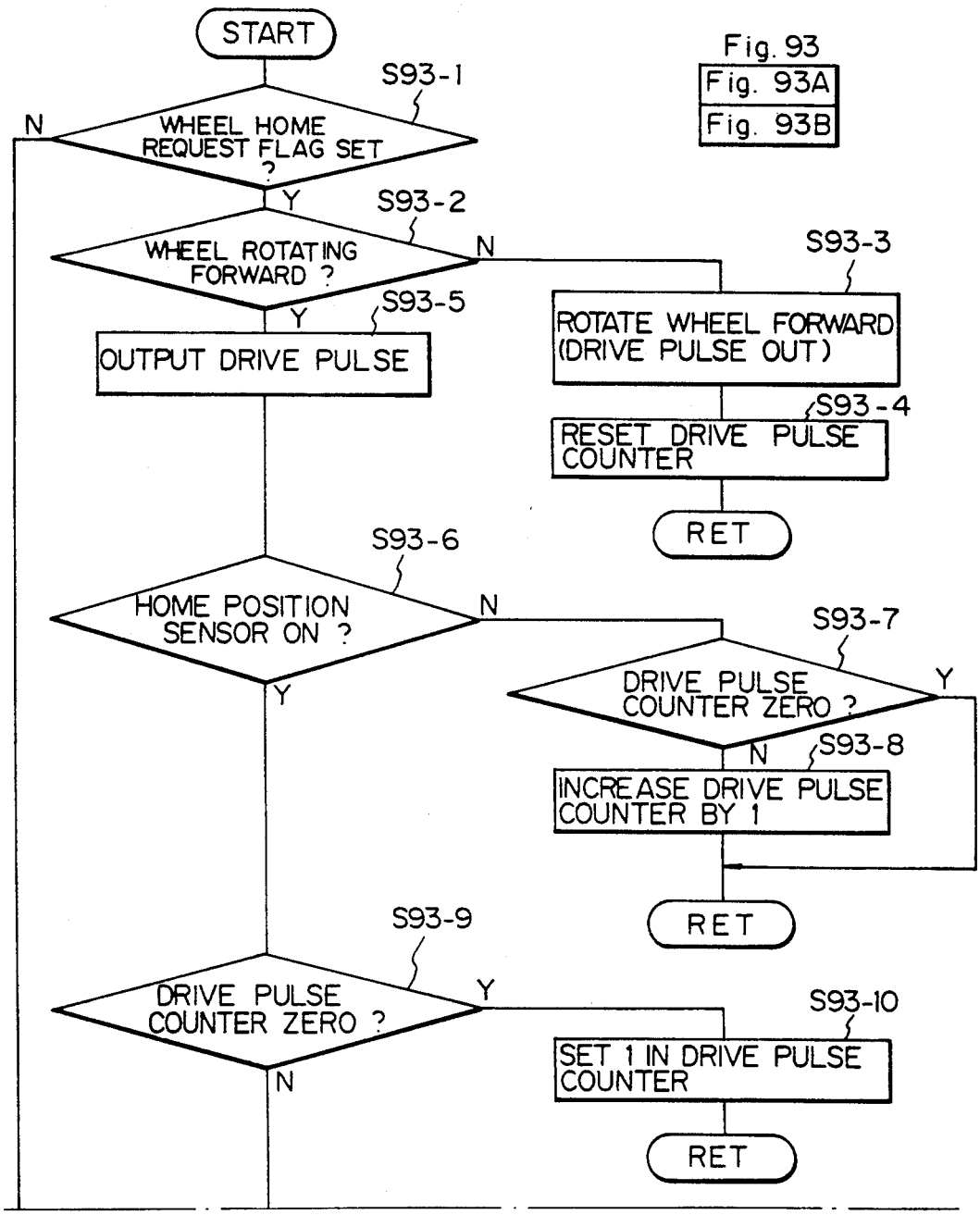
FIGS. 93A and 93B is a flowchart showing a procedure for initializing the switching wheel.
Figure 93B:
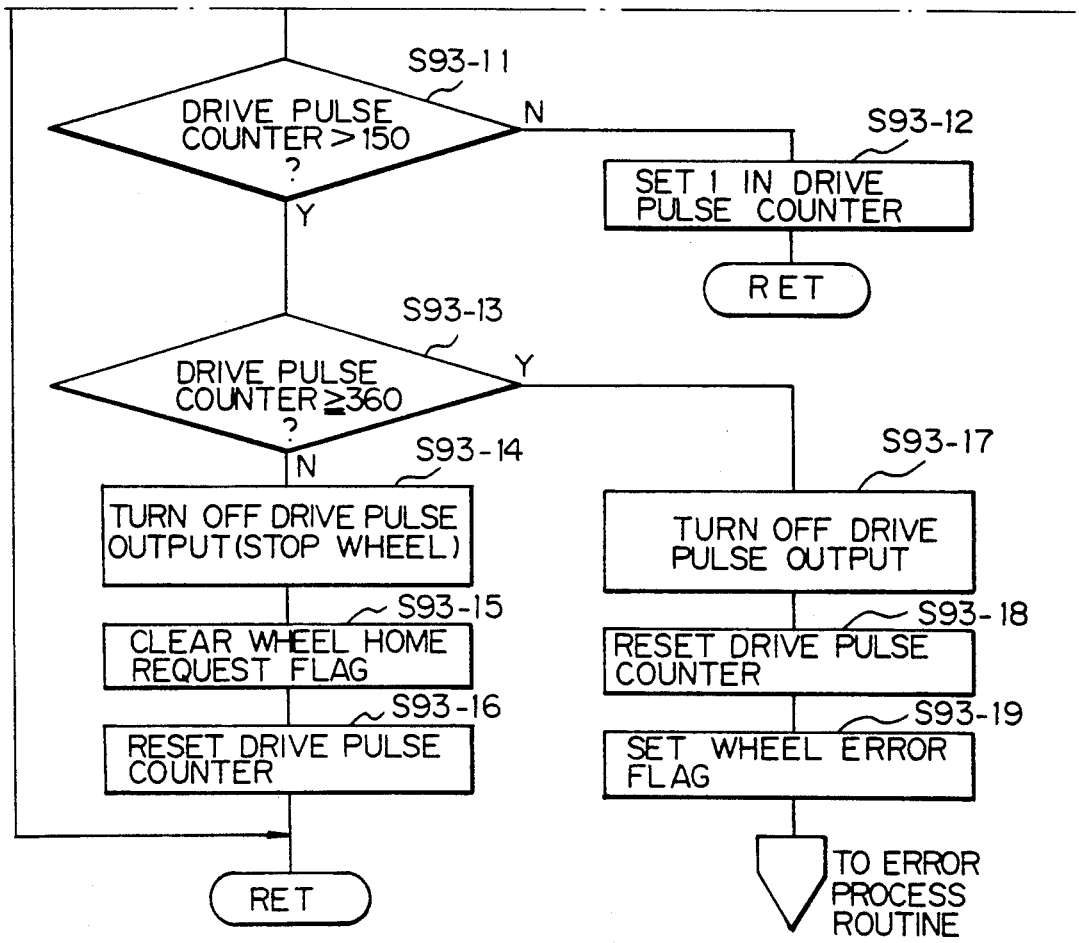

As shown in FIG. 93, whether or not a switching wheel home request flag is set is determined (S93-1). If the answer of the step S93-1 is NO, the program returns; if otherwise, whether or not the switching wheel 477 is rotating forward is determined (S93-2). If the answer of the step S93-2 is NO, the switching wheel 477 is rotated forward (S93-3), a drive pulse counter is reset (S93-4), and then the program returns. The drive pulse counter indicates the position of the switching wheel 477, count 0 being representative of the home position. The drive pulse counter is used in combination with a drive pulse memory in the event when the switching wheel 477 is driven. The drive pulse memory shows a position for driving the switching wheel 477 and is used in the same manner as the jogging counter and jogging memory.

If the switching wheel 477 is rotating forward as determined in the step S93-2, the drive pulse output is interrupted (S93-5), and whether or not the output of the home position sensor 545 has risen is determined (S93-6) If the answer of the step S93-6 is NO, whether or not the drive pulse counter is zero, i.e., whether it is reset is determined (S93-7). If the answer of the step S93-7 is YES, the program returns; if otherwise, the drive pulse counter is incremented by 1, and the program returns.

If the output of the home position sensor 545 has risen as determined in the step S93-6, whether or not the drive pulse counter is zero or reset is determined (S93-9). If the answer is YES, the drive pulse counter is incremented by 1(S93-10), and the program returns; if otherwise, whether or not the drive pulse counter is greater than 150 is determined (S93-11). If the answer of the step S93-11 is NO, the drive pulse counter is incremented by 1(S93-12), and then the program returns; if otherwise, whether or not the drive pulse counter is greater than 360 is determined (S93-13). If the answer of the step S93-13 is NO, the drive pulse output is interrupted to stop the rotation of the switching wheel 477 (S93-14), the wheel home request flag is cleared (S93-15), the drive pulse counter is reset (S93-16), and then the program returns.

If the drive pulse counter is greater than 360 as determined in the step S93-13, the drive pulse output is interrupted (S93-17), the drive pulse output is turned off (S93-17), the drive pulse counter is reset (S93-18), a wheel error flag is set (S93-19), and then the operation is transferred to an error process routine. The wheel error flag is normally ONE and changes to ZERO when the home position is not detected even after the switching wheel has been driven by more than a predetermined pulses.

8.4 Switching Wheel Drive

Figures 94, 94A, 94B, 94C:
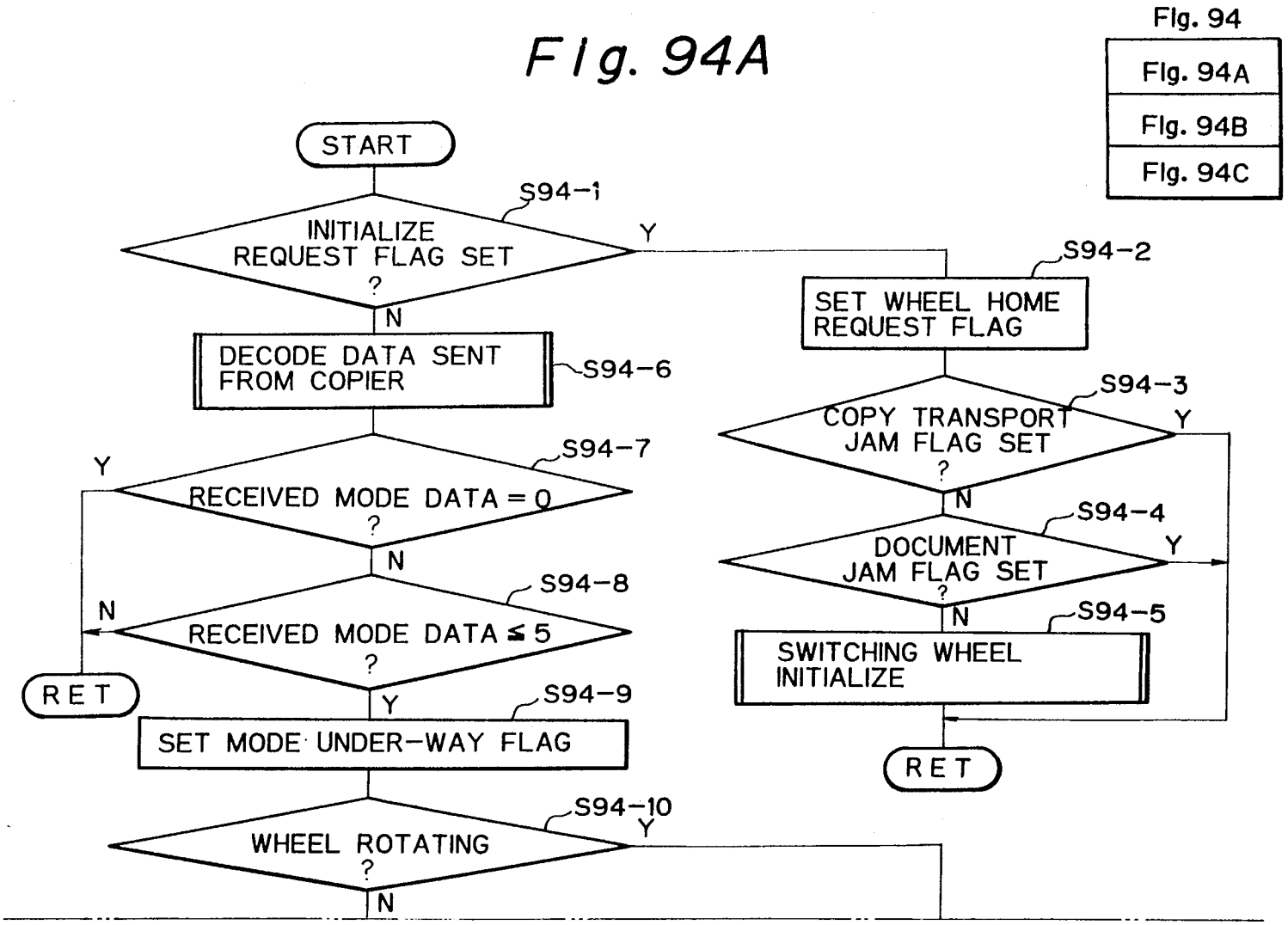
FIGS. 94A and 94B and 94C is a flowchart showing a switching wheel drive procedure.
Figure 94B:
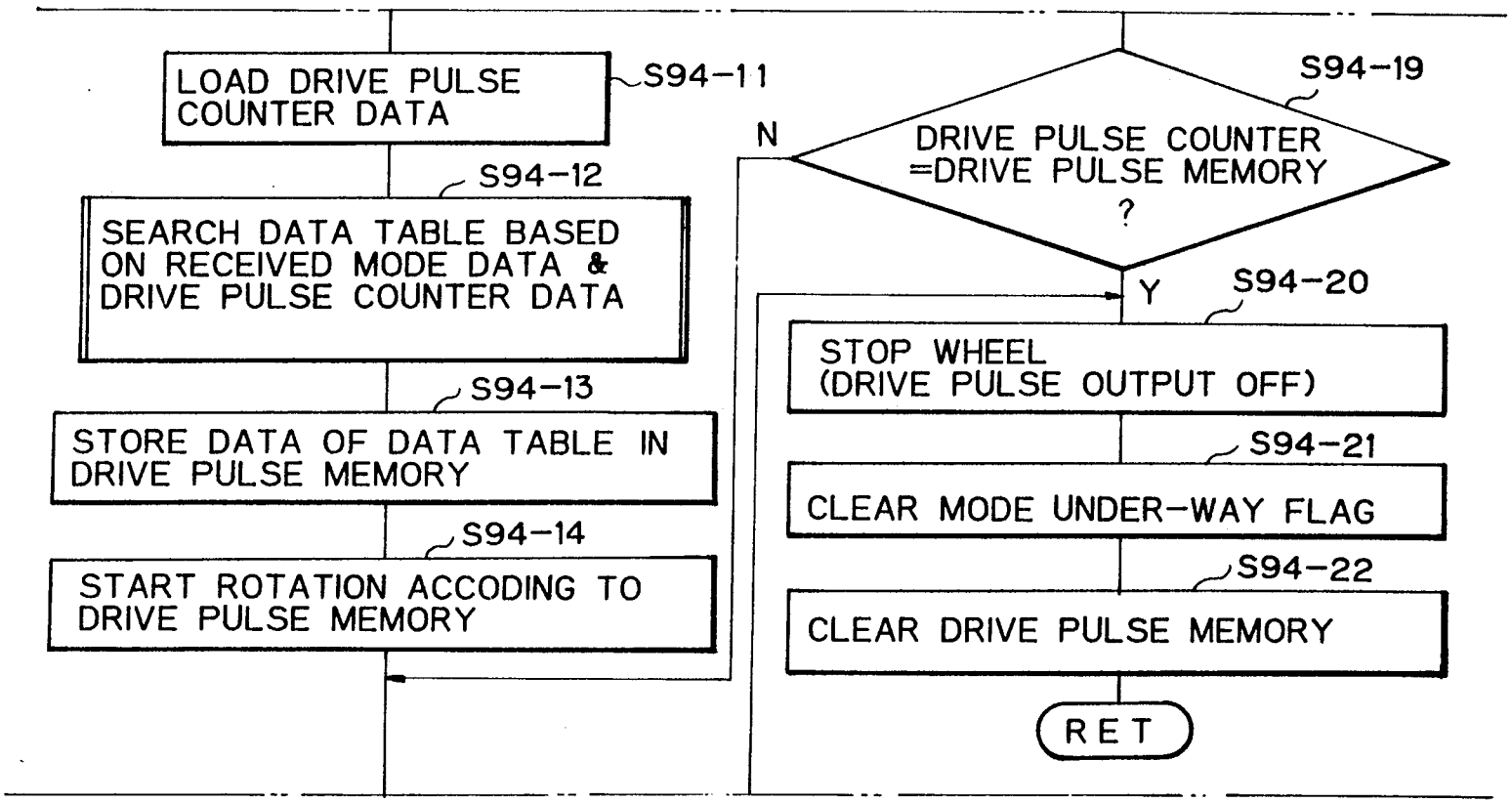
Figure 94C:
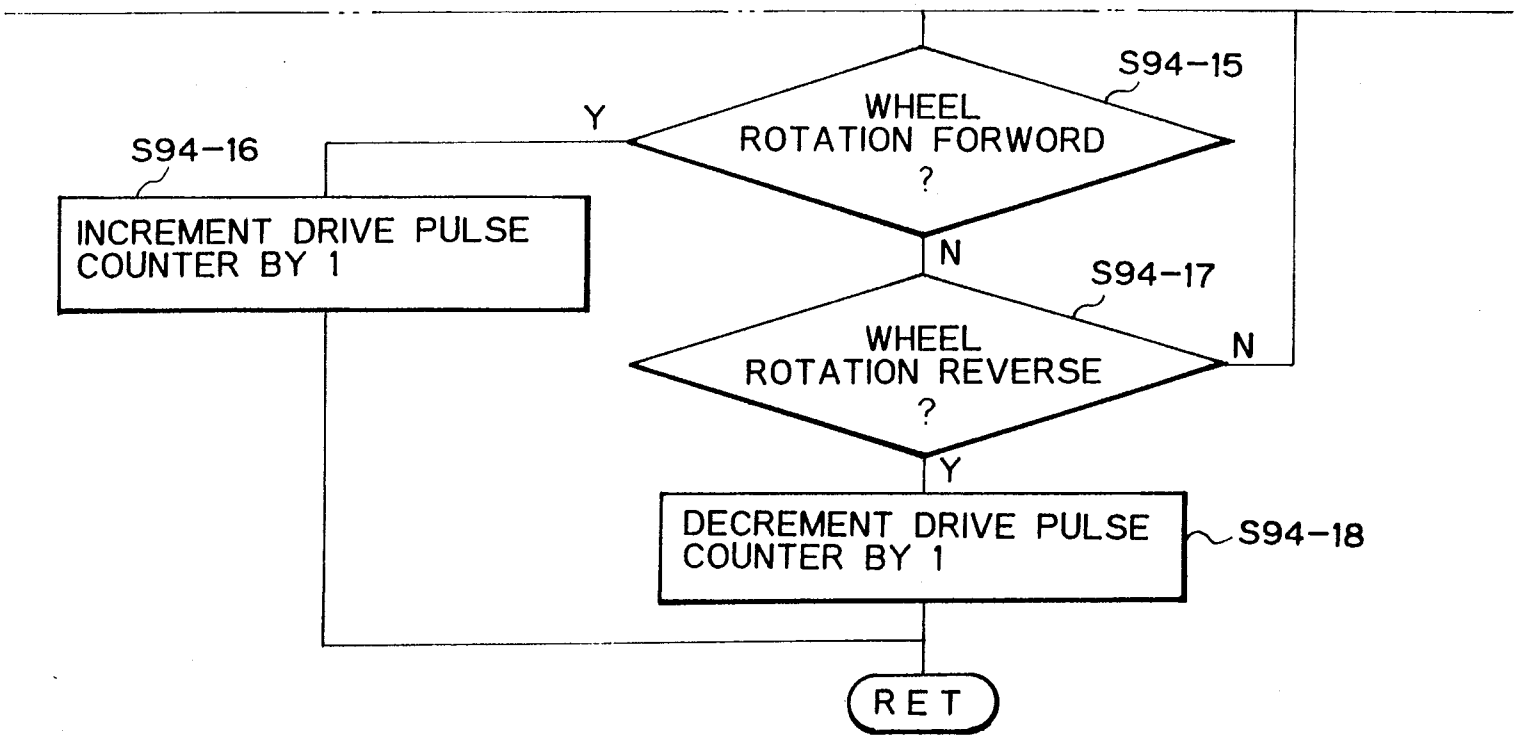

Once the switching wheel 477 is initialized as stated above, it is driven by a procedure which will be described with reference to FIG. 94. As shown in FIG. 94, whether or not an initial request flag is set is determined (S94-1) and, if it is set, a home request flag associated with the switching wheel 477 is set (S94-2). Then, whether or not a paper transport flag is set is determined (S94-3). If the answer of this step S94-3 is NO, meaning that the documents 69 have not jammed, the initialize processing shown in FIG. 93 is executed (S94-5), and the program returns. If the answer of the step S94-3 or 94-4 is YES, the program returns because either the paper sheets 37 or the documents 69 have jammed.

Figure 96A:
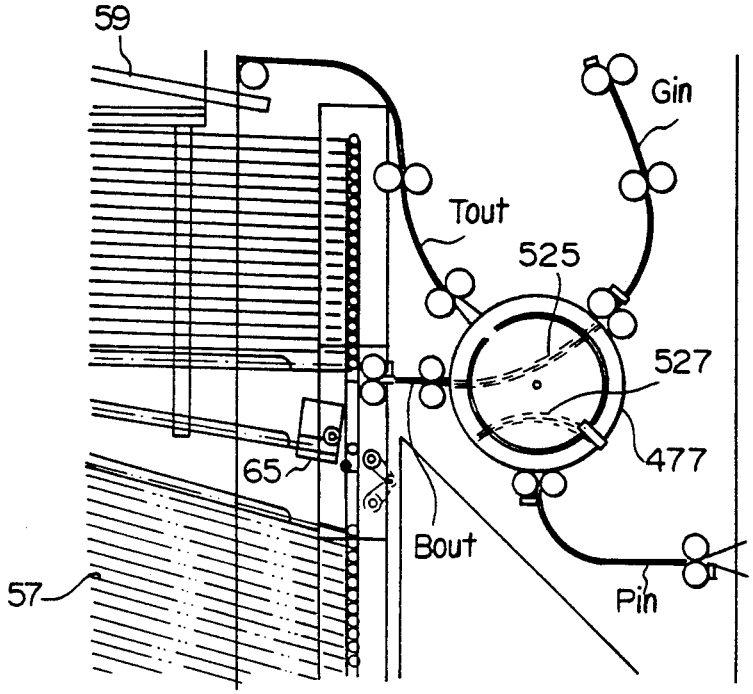
FIGS. 96A through 96D show a relation between the position of the switching wheel and the sheet transport path.
Figure 96B:
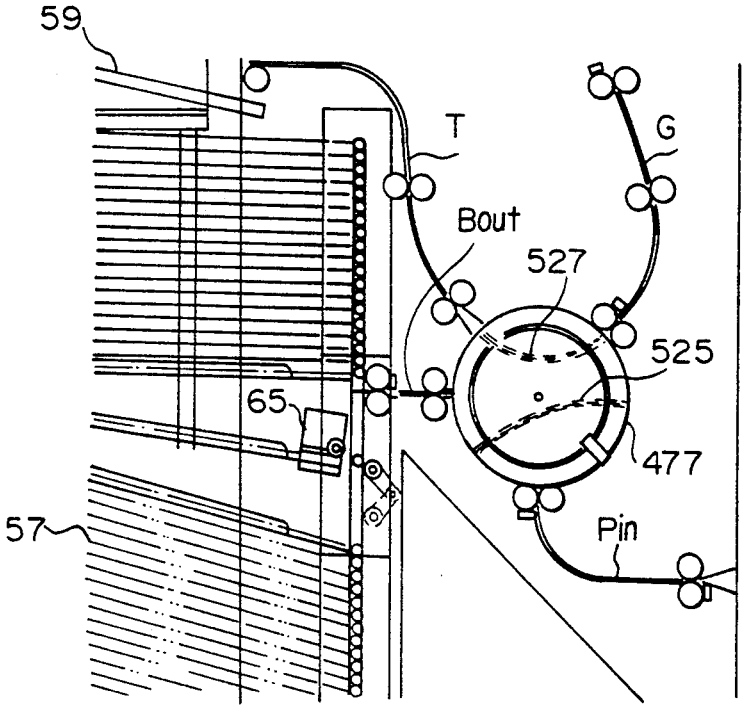
Figure 96C:
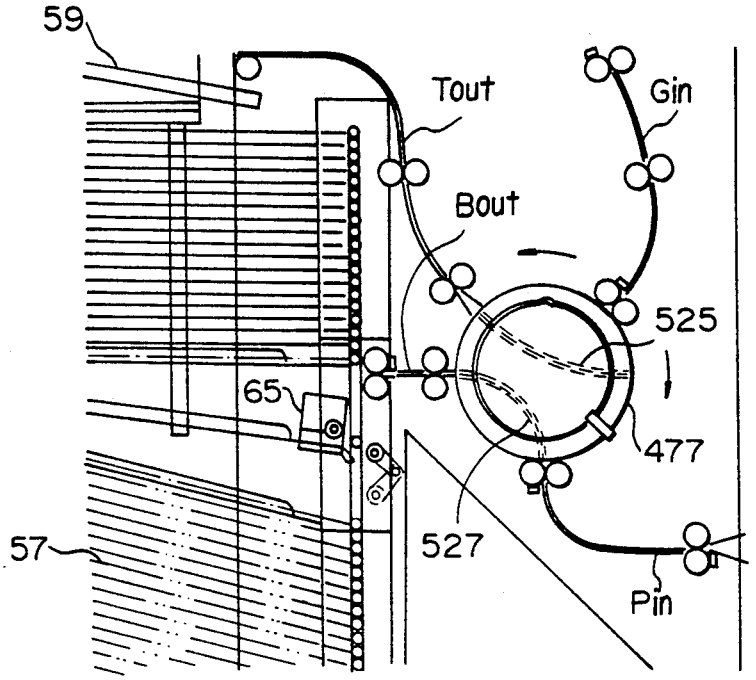
Figure 96D:
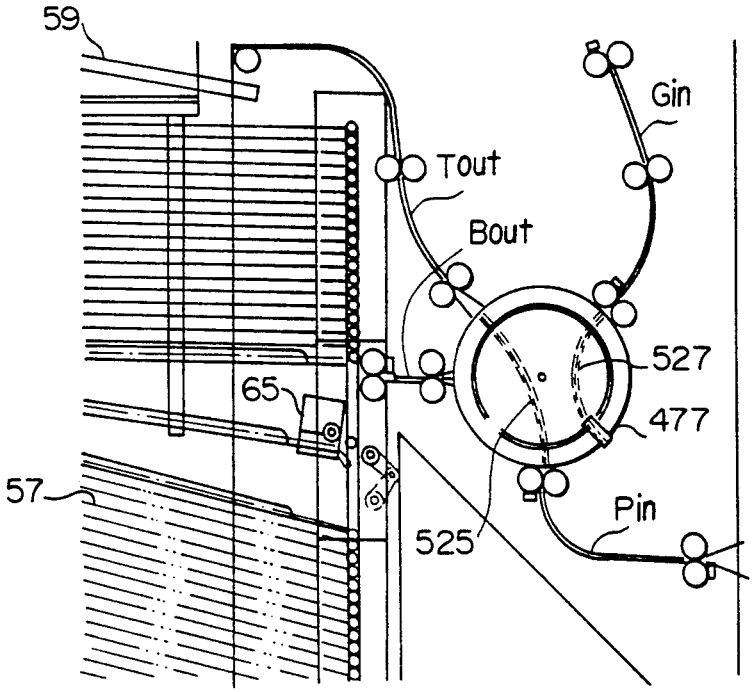

If the answer of the step S94-1 is NO, the CPU 651 of the finisher 11 decodes the data transmitted from the CPU 573 of the copier 1 (S94-6), and then whether or not the received mode data is 0 is determined. If the mode data is zero, the program returns; if otherwise, whether or not it is smaller than 5 is determined (S94-8). If the answer of the step S94-8 is NO, the program returns; if otherwise, a mode under-way flag is set (S94-9), and whether or not the switching wheel 477 is rotating is determined (S94-10). The mode under-way flag is ONE when, among processing which may be sent from the CPU 573 of the copier 1, processing which needs a relatively long period of time is under way. If the answer of the step S94-10 is NO. drive pulse counter data is loaded (S94-11). Then, a data table shown in FIG. 95 and associated with the drive pulse counter is searched on the basis of the received mode data and drive pulse counter data. In the data table shown in FIG. 95, the pulse data for rotating the switching wheel 477 are predetermined such that one pulse which drives the steeping motor causes the wheel 477 to rotate one degree. In FIG. 95, [a] to [d] are associated with particular positions of the switching wheel 477 shown in FIGS. 96A to 96D, respectively. In the position shown in FIG. 96A, the switching wheel 477 steers the documents 69 toward the bins 57. In FIG. 96B, the switching wheel 477 is so positioned as to transport the documents 69 to the proof tray 59. In FIG. 96C, the switching wheel 477 is so positioned as to deliver the paper sheets 37 undergone copying operations to the bins 57. Further, in FIG. 96D, the switching wheel 477 is so positioned as to deliver such paper sheets or copies 37 to the proof tray 59.

After the step S94-12, a step S94-13 is executed for writing the data read out of the data table in the drive pulse memory (S94-13). Then, the wheel drive motor 487 implemented as a stepping motor starts rotating according to the drive pulse memory (S94-14). Subsequently, whether or not the switching wheel 477 is rotating forward is determined (S94-15). If the answer of the step S94-15 is YES, the drive pulse counter is incremented by 1, and the program returns (S94-16); if otherwise, whether or not the wheel 477 is rotating reversely is determined (S94-17). If the answer of the step S94-17 is YES, the drive pulse counter is decremented by 1, and then the program returns.

If the switching wheel 477 is rotating as determined in the step S94-10, the contents of the drive pulse counter and drive pulse memory are compared (S94-19). If the two contents do not compare equal, the step S94-15 and successive steps are executed; if otherwise, the rotation of the wheel 477 is stopped (S94-20), i.e., the drive pulse output is interrupted. Thereupon, the mode under-way flag is cleared (S94-21), the drive pulse memory is cleared (S94-22), and then the program returns.

8.5 Sheet Bin Up/Down Check

The bins 57 for accommodating the paper sheets 37 or the documents 69 have to be moved up and down to receive such sheets therein, to staple the sheets, or to discharge the sheets to the stack tray 67. This is because the finisher 11 of the illustrative embodiment 11 does not finish sheets by fixing the bins 57 in position and, instead, it performs various kinds of sheet processing by moving the bins 57, as seen from the previously stated mechanical construction. Processing relating to the up-down movement of the bins 57 will be described hereinafter.

Figures 97A, 97B:
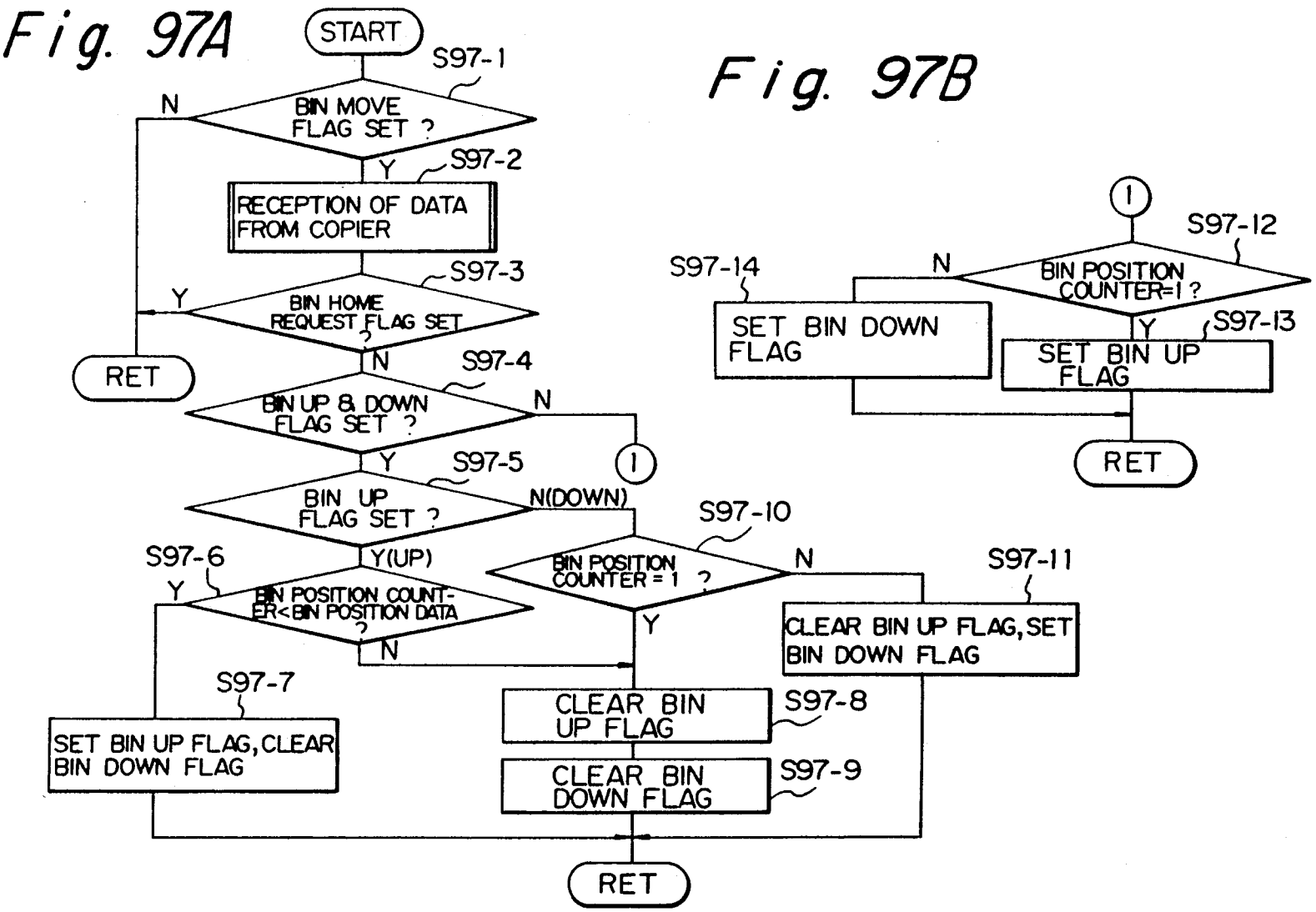
FIGS. 97A and 97B are flowcharts showing a procedure for checking the up-down movement of the sheet bins in response to a command from the copier body.

FIG. 97 is a flowchart demonstrating a check routine for determining whether the bins 57 should be raised or lowered in response to a command from the copier body. First, when the copier 1 sets a flag, whether or not a bin shift flag for matching a bin position counter to bin position data is set is determined (S97-1). If the answer of the step S97-1 is NO, the program returns; if otherwise, data relating to bin control and sent from the CPU 573 of the copier 1 is fed to the CPU 651 of the finisher 11 (S97-2). The bin position counter indicates the position of a bin currently set in the finisher 11. On receiving the data, the CPU 651 determines whether or not a bin home request indicative of the shift of the bins 57 to the home position is set (S97-3) and, if it is set, returns. If the answer of the step S97-3 is NO, whether or not a bin up-down flag is set is determined (S97-4). That the bin home request flag is set means that the bins 57 are returning to the home position.

If the answer of the step S97-4 is YES, whether or not a bin up flag for elevating the bins 57 by one bin is set is determined (S97-5). If the bin up flag is set, meaning that the bins 57 are moving upward, the content of the bin position counter representative of a bin currently set and the bin position data representative of a bin which should be set are compared (S97-6). If the content of the bin position counter is smaller than the bin position data, the bin up flag is set, a bin down flag for lowering the bins 57 by one bin is cleared (S97-7), and then the program returns. If the answer of the step S97-6 is NO, both the bin up flag and the bin down flag are cleared (S97-8 and S97-9), and the program returns.

If the bin up flag has been cleared as determined in the step S97-5, whether or not the bin position counter is 1 is determined (S97-10). If the answer of the step S97-10 is YES, the steps S97-8 and S97-9 are executed, and the program returns; if otherwise, the bin up flag is cleared, the bin down flag is set (S97-11), then the program returns.

If the bin up flag and bin down flag have been cleared as determined in the step S97-4, whether or not the content of the bin position counter is 1 is determined (S97-12). If the answer of the step S97-12 is YES, the bin up flag is set (S97-13), and the program returns; if otherwise, the bin down flag is cleared (S97-14), and the program returns.

8. 6 Sheet Bin Up-Down Control

Figures 1, 98, 98A, 98B:
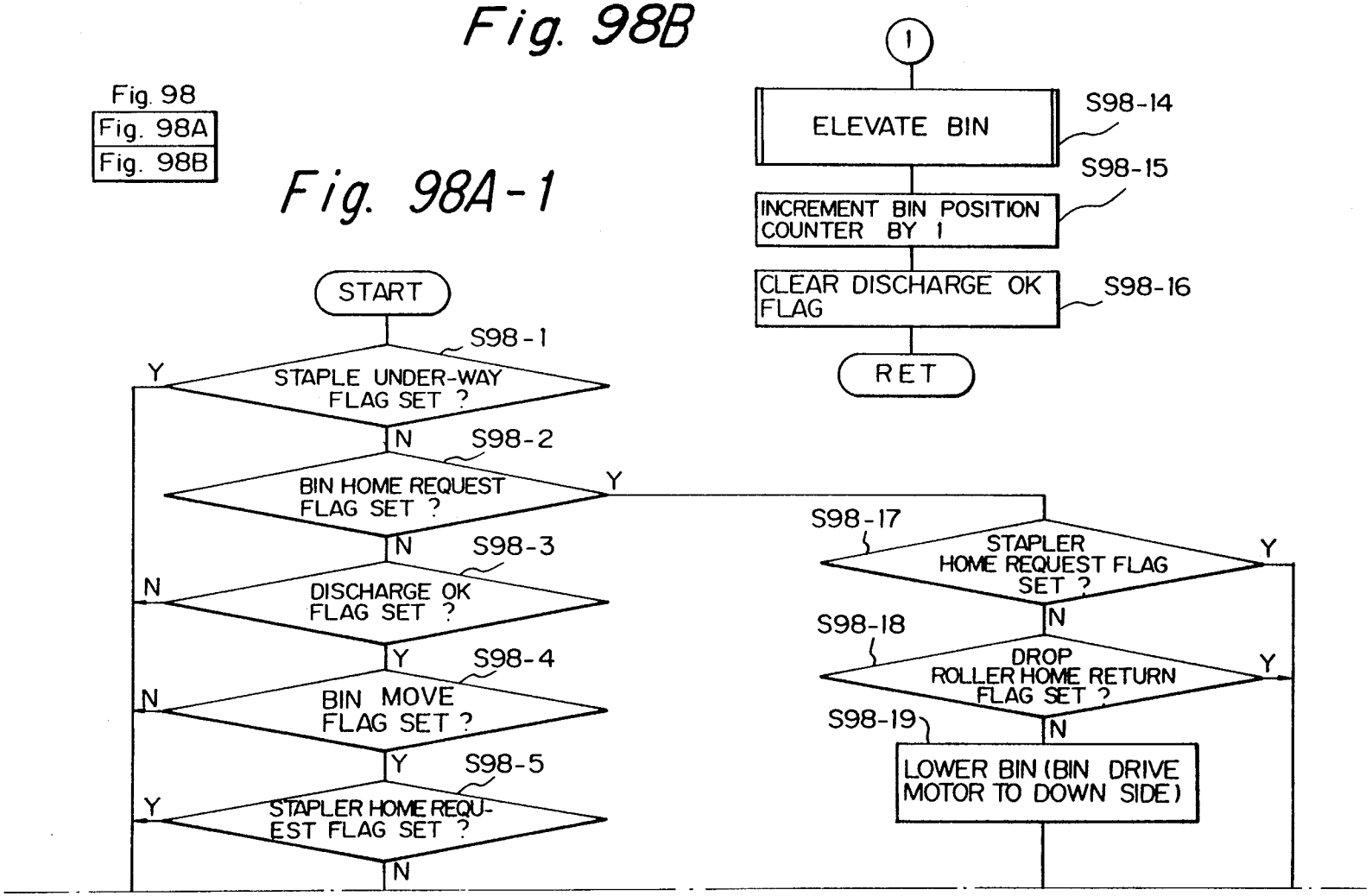
FIGS. 98A and 98B are flowcharts showing the up-down control over the sheet bins.
Figures 2, 98A:
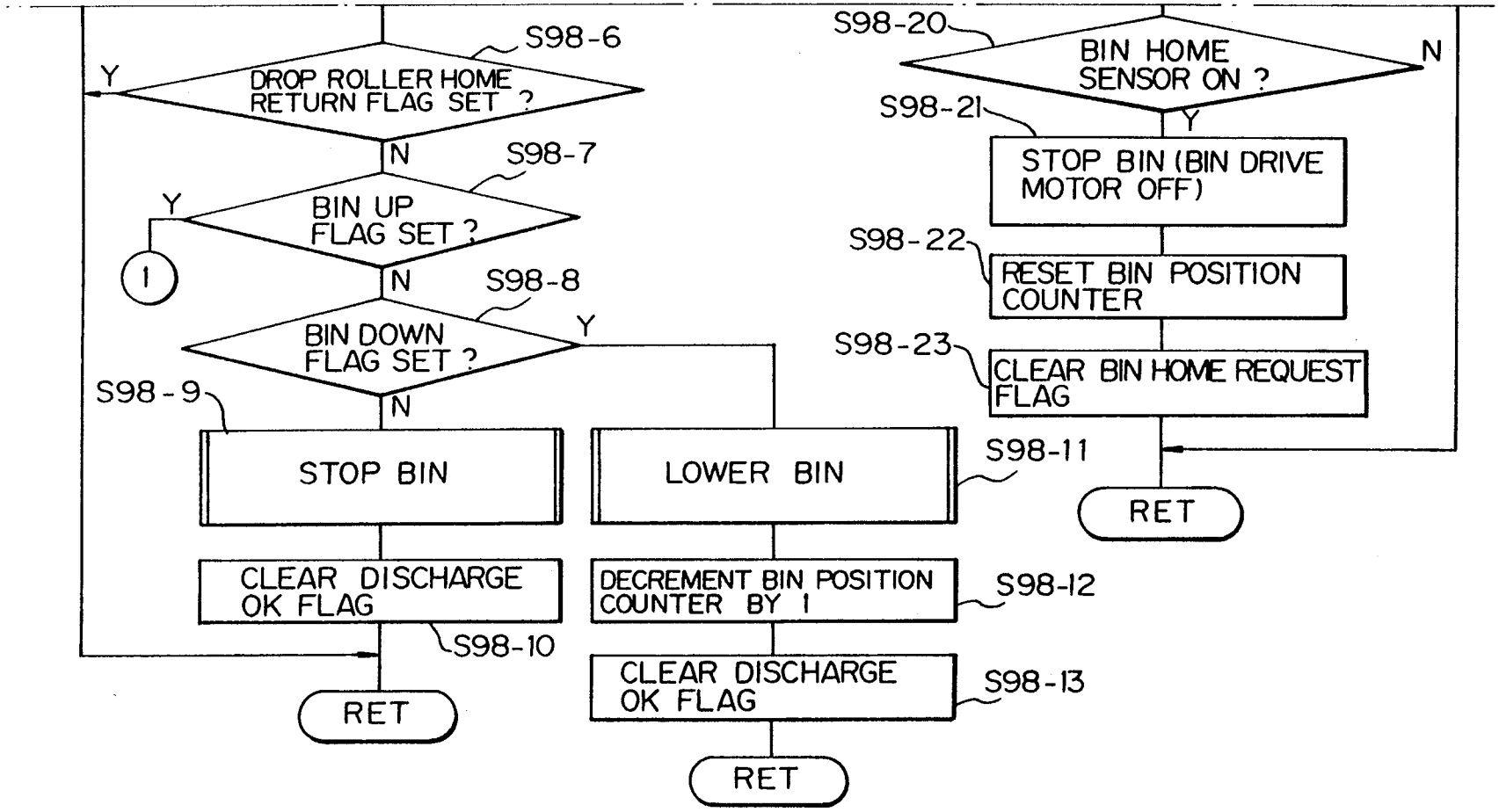

After the above-described check routine, the bins 57 are raised or lowered by a procedure which will be described with reference to FIG. 98. As shown in FIG. 98, whether or not a staple under-way flag which is ONE when a stapling operation inclusive of the movement of the stapler 65 is under way is set is determined (S98-1). If the answer of the step S98-1 is YES, the program returns immediately; if otherwise, the bin home request signal is set is determined (S98-2). If the answer of the step S98-2 is NO, whether a discharge OK flag is set is determined (S98-3). The discharge OK flag is ONE when a sheet transported from the copier 1 or the document transport unit is discharged via the release sensor 542 or ZERO when, for example, the bins 57 are shifted. If the answer of the step S98-3 is NO, the program returns; if otherwise, whether or not a bin shift flag is set is determined (S98-4). If the answer of the step S98-4 is NO, the program returns; if otherwise, whether or not a stapler home position request flag for returning the stapler 65 to the home position (ONE during the return) is set is determined (S98-5). If the answer of the step S98-5 is YES, the program returns; if otherwise, a drop roller home return flag for returning the drop rollers to the home position (ONE during the return) is set is determined (S98-6). If the answer of the step S98-6 is YES, the program returns; if otherwise, whether or not the bin up flag is set is determined (S98-7).

If the answer of the step S98-7 is NO, whether or not the bin down flag is set is determined (S98-8) and, if the answer if NO, the movement of the bins 57 is interrupted (S98-9), the discharge OK flag is cleared, and then the program returns (S98-10). If the answer of the step S98-8 is YES, the bins 57 are lowered by one bin (S98-11), the bin position counter is decremented by 1 (S98-12), the discharge OK flag is cleared (S98-13), and then the program returns.

If the bin up flag is set as determined in the step S98-7, the bins 57 are raised by one bin (S98-14), the bin position counter is incremented by 1 (S98-15), the discharge OK flag is cleared (S98-16), and then the program returns.

If the bin home request flag is set as determined in the step S98-2, whether or not the stapler home request flag is set is determined (S98-17) and, if the answer is YES, the program returns. If the answer of the step S98-17 is NO, whether or not the drop roller home return flag is set is determined (S98-18). If the answer of the step S98-18 is YES, the program returns; if otherwise, the bin motor 418 is rotated in the direction for lowering the bins 57 to thereby lower the bins 57 (S98-19).

While the bins 57 are lowered as stated above, whether or not the bin home position sensor 543 is in an ON state is determined (S98-20) and, if the answer is NO, the program returns. If the answer of the step S98-20 is YES, the bin motor 418 is deenergized to stop the movement of the bins 57 (S98-21), the bin position counter is reset (S98-22), the bin home request flag is cleared (S98-23), and then the program returns.

8.7 Stapler Shift

Figures 99A, 99B:
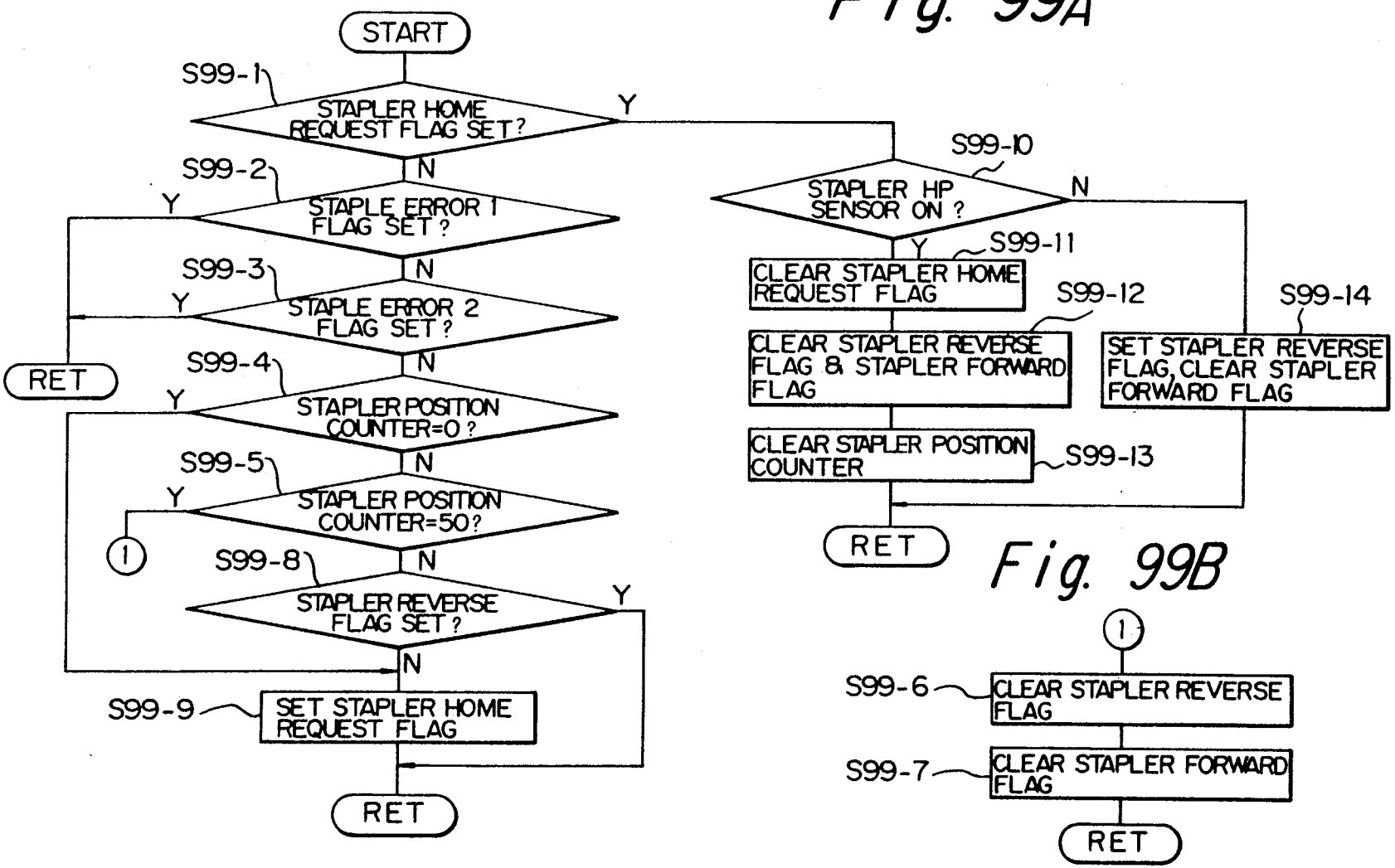
FIGS. 99A and 99B are flowcharts showing a procedure for moving the stapler.

While the stapling operation is effected as the bins 57 are moved, the stapler 65 has to be moved from the home position thereof to a staple position in order to perform the stapling operation. FIG. 99 shows a procedure for moving the stapler toward and away from the staple position. As shown, whether or not the stapler home request flag is set is determined (S99-1) and, it is not set, whether or not a staple error 1 flag which is normally ZERO and is ONE when the stapler 65 has run out of staples is set is determined (S99-2). If the answer of the step S99-2 is YES, the program returns; if otherwise, whether or not a staple error 2 flag representative of an error of a staple motor, not shown, is set is determined (S99-3). If the answer of the step S99-3 is YES, the program returns. If the answer of the step S99-3 is NO, meaning that the stapler 65 is free from errors, a stapler position counter indicative of the position of the stapler 65 by using the stapler home position as 0 is 0, i.e., whether or not the stapler 65 is in the home position is determined (S99-4). If the answer of the step S99-4 is NO, whether or not the stapler position counter has reached 50 is determined (S99-5). If it has reached 50, a stapler reverse flag for returning the stapler 65 to the home position (normally ZERO and changing to ONE during reverse movement) is cleared (S99-6). Further, a stapler forward flag for shifting the stapler 65 from the home position to the staple position (normally ZERO and changing to ONE during forward movement) is cleared (S99-7), and then the program returns.

If the answer of the step S99-5 is NO, whether or not the stapler reverse flag and stapler forward flag are set is determined (S99-8) and, if they are set, the program returns. If the answer of the step S99-8 is NO, the stapler home request flag is cleared (S99-9), and then the program returns. If the stapler position counter is 0 as determined in the step S99-4, the step S99-9 and successive steps are executed.

If the stapler home request flag is set as determined in the step S99-1, whether or not the stapler home position sensor 429 is in an ON state is determined (S99-10). If the answer of the step S99-10 is NO, the stapler reverse flag is set and the stapler forward flag is cleared (S99-14), and then the program returns. If the answer of the step S99-10 is YES, the stapler home request flag is cleared (S99-11), the stapler reverse flag and stapler forward flag are cleared (S99-12), the stapler position counter is reset (S99-13), and then the program returns.

8.8 Staple

Figure 100A:
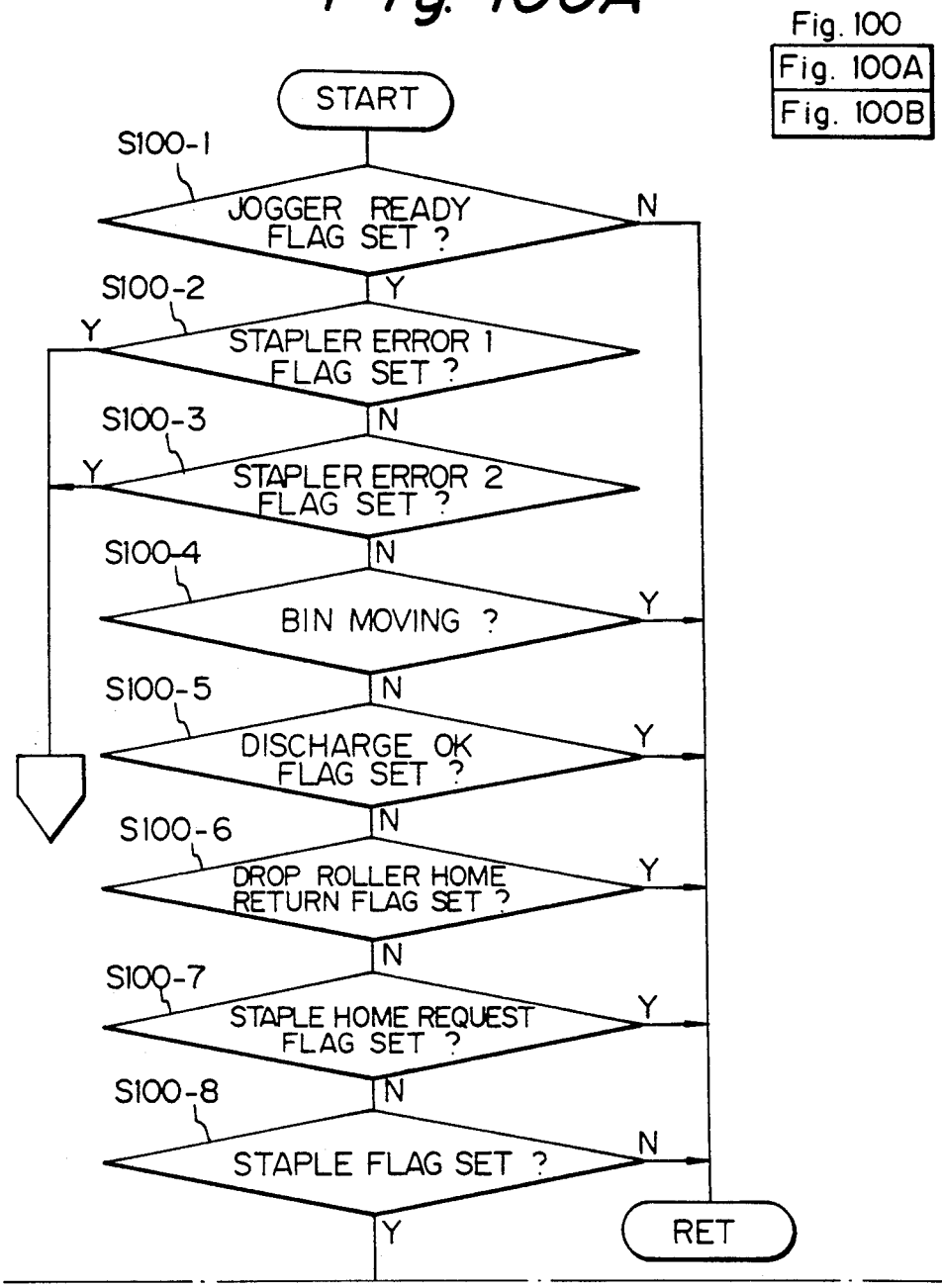
FIG. 100A and 100B is a flowchart showing a stapling procedure.
Figure 100B:
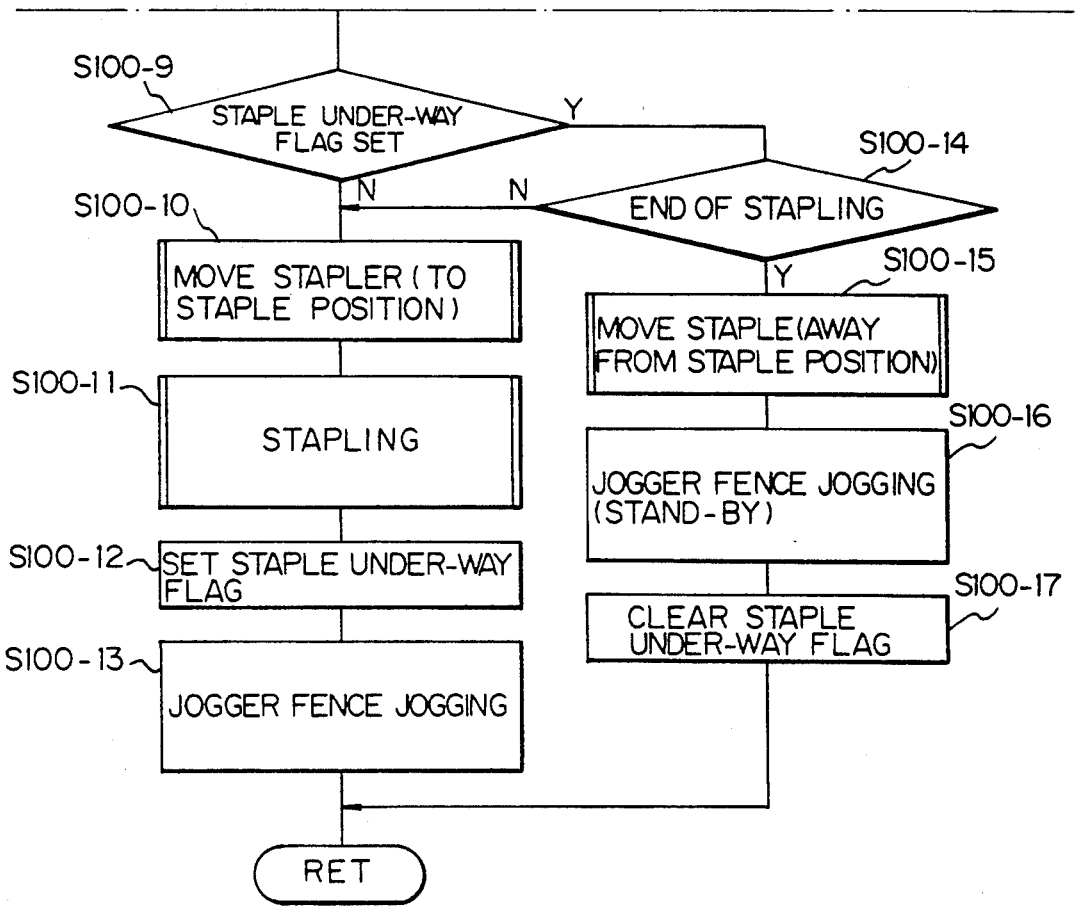

FIG. 100 shows a procedure for executing stapling in association with the movement of the stapler. As shown, whether or not the jogger ready flag indicating that the jogger 63 has been set in a particular jogging position is set is determined (S100-1). If the answer of the step S100-1 is NO, the program returns. If the answer of the step S100-1 is YES, the staple error 1 flag and staple error 2 flag are checked (S100-2 and S100-3). If the staple error 1 flag or the staple error 2 flag is set, the operation is transferred to the error process routine. If the two flags both are not set, whether or not the bins 57 are moving is determined (S100-4) and, if they are moving, the program returns. If the answer of the step S100-4 is NO, whether or not the discharge OK flag is set is determined (S100-5) and, if it is set, the program returns. If the answer of the step S100-5 is NO, whether or not the drop roller return flag is set is determined (S100-6) and, if it is set, the program returns. If the answer of the step S100-6 is NO, whether or not the stapler home request flag is set is determined (S100-7), and if it is set, the program returns. If the answer of the step S100-7 is NO, whether or not a staple flag is set is determined (S100-8). The staple flag causes a a stapling operation to occur in response to a ONE transmitted from the CPU 573 of copier 1. If the answer of the step S100-7 is YES, the program returns. If the answer of the step S100-8 is NO, whether or not a staple under-way flag which is ONE during stapling operation inclusive of the movement of the stapler 65 is set is determined (S100-9). If the answer of the step S100-9 is NO, meaning that a stapling operation is not effected, the stapler forward flag is set to move the stapler 65 to the staple position (S100-10) so as to staple a stack of sheets (S100-11). Then, the staple under-way flag is set (S100-12), the jogger fence 472 is caused to jog (S100-13), and then the program returns.

If a stapling operation is under way as determined in the step S100-9, whether or not the operation is completed is determined (S100-14) and, if it is not completed, the step S100-10 and successive steps are executed. If the answer of the step S100-14 is YES, the stapler reverse flag is set to move the stapler away from the staple position (S100-15), the jogger fence 472 is caused to jog (S100-16), the staple under-way flag is cleared (S100-17), and the program returns.

8.9 Sheet Drop

Figure 101:
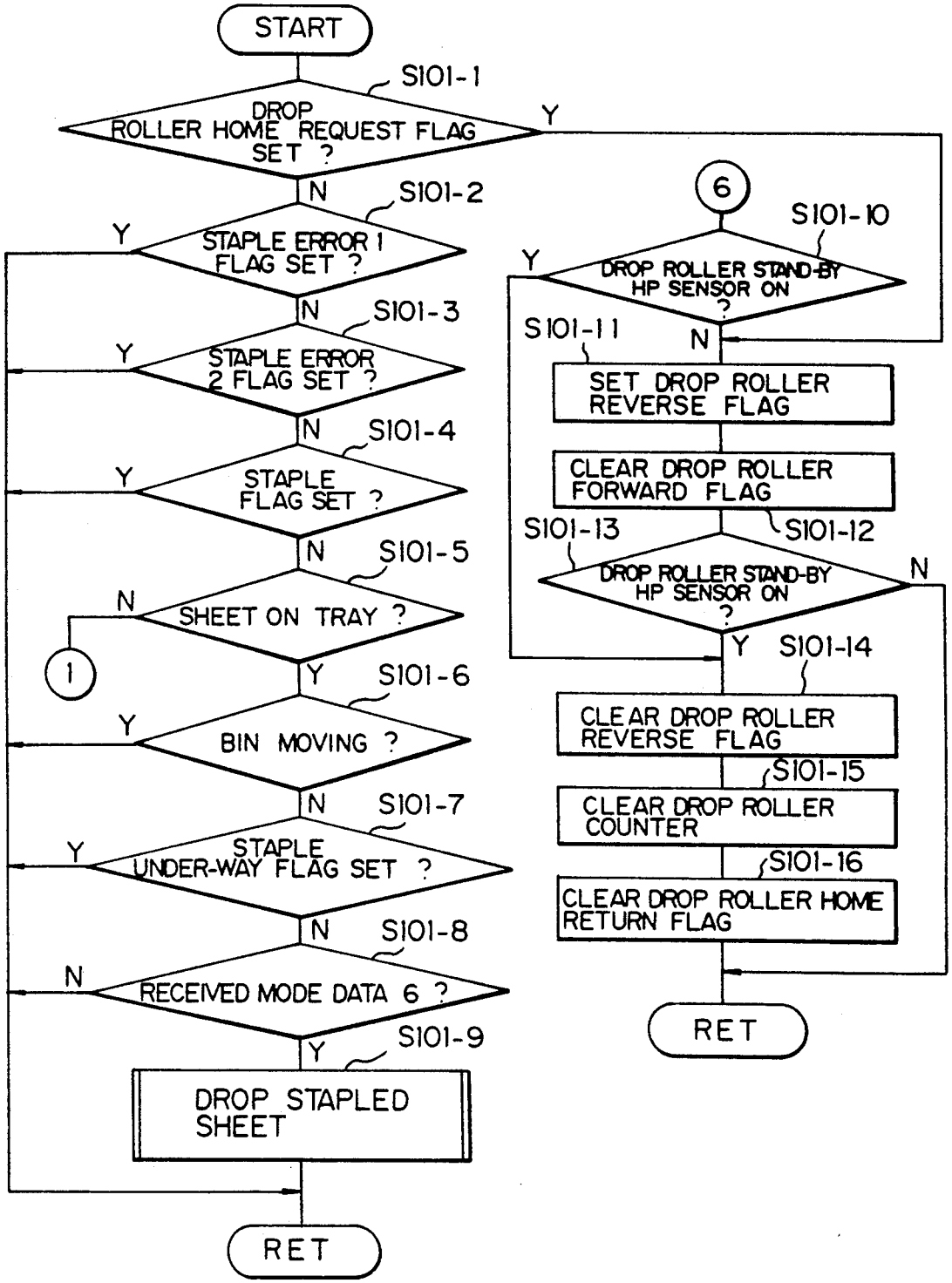
FIG. 101 is a flowchart showing a sheet dropping procedure.

The stapling procedure is followed by a sheet dropping procedure on the basis of a set mode. As shown FIG. 101, this procedure begins with a step S101-1 of determining whether or not the drop roller home return flag is set. If the answer of step S101-1 is NO, the statuses of the staple error 1 flag, staple error 2 flag and staple flag are determined (S101-2, S101-3 and S101-4). If any one of such flags is not set, the program returns. If all the flags are set, whether or not the bin 57 is loaded with sheets is determined (S101-5), and then whether or not the bin 57 is moving is determined (S101-6). If the answer of the step S101-6 is YES, the program returns; if otherwise, the status of the staple under-way flag is determined (S101-7). If the staple under-way flag is set, the program returns; if otherwise, whether or not the received mode data is 6 is determined (S101-8). If the mode data is 6, processing for dropping a stapled sheet onto the stack tray 67 is executed (S101-9), and the program returns.

If the answer of the step S101-1 is YES, a reverse flag indicative of a movement of drop rollers away from the bin 57 is set (S101-11), a forward flag indicative of a movement of the drop rollers toward the bin 57 is cleared (S101-12), and then whether or not the drop roller stand-by home position sensor 438 is in an ON state is determined (S101-13).

If the sensor 438 is not in an ON state as determined in the step S101-13, the program returns. If the sensor 438 is in an ON state, the drop roller reverse flag is cleared (S101-14), and a drop roller counter indicative of a position of the drop rollers (0 at the home position) is reset (S101-15). Subsequently, a drop roller home return flag (ONE during return) is cleared (S101-16), and then the program returns.

If the bin 57 is not loaded with sheets as determined in the step S101-5, the drop roller drive motor 441 is turned off (S103-4), and the 5-second timer is stopped and cleared (S103-5). Then, the drop roller forward flag and reverse flag are cleared (S103-6 and S103-7), and then the drop roller home return flag and mode end flag are set (S103-8 and S103-9). Thereafter, the 1-second timer is stopped and cleared (S103-10), and the output of the home position sensor 438 is determined (S101-10). If the home position sensor 438 is in an OFF state, the step S101-11 and successive steps are executed; if otherwise, the program executes teh step S101-14 skipping the steps S101-11 to S101-13.

Figure 102A:
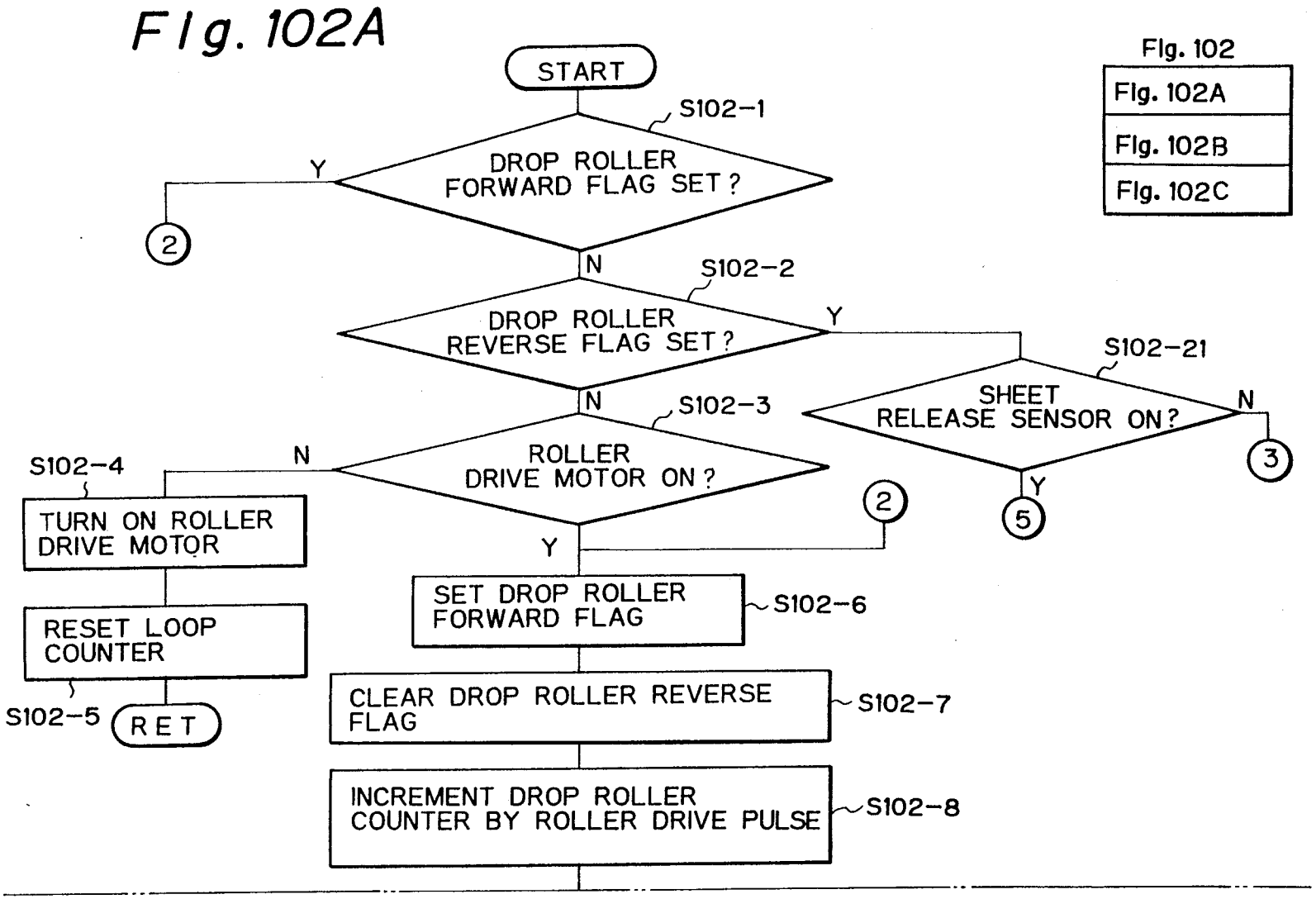
FIGS. 102A, 102B, 102C and 103 are flowcharts showing a procedure to be executed while stapled sheets are being dropped.
Figure 102B:
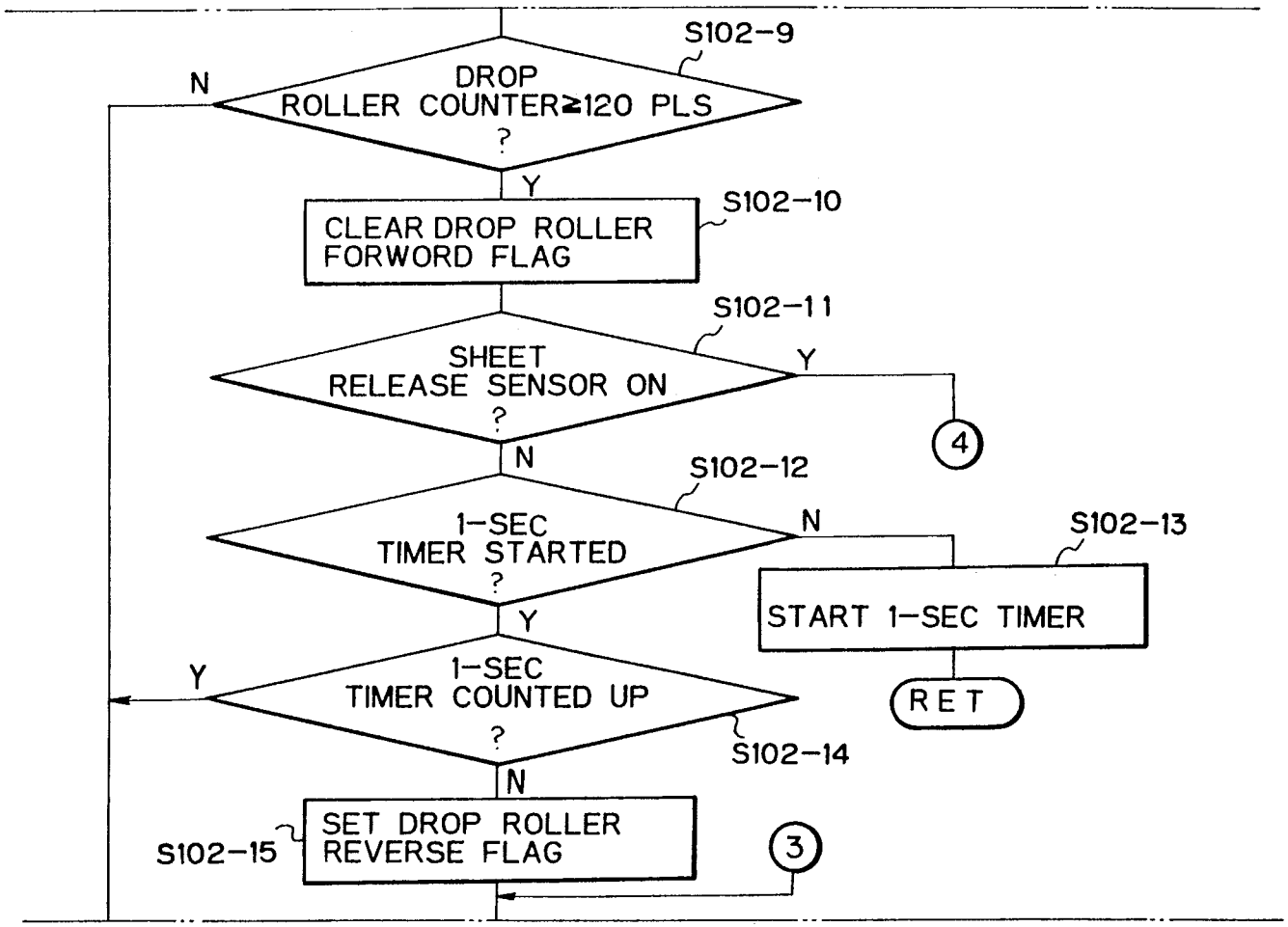
Figure 102C:
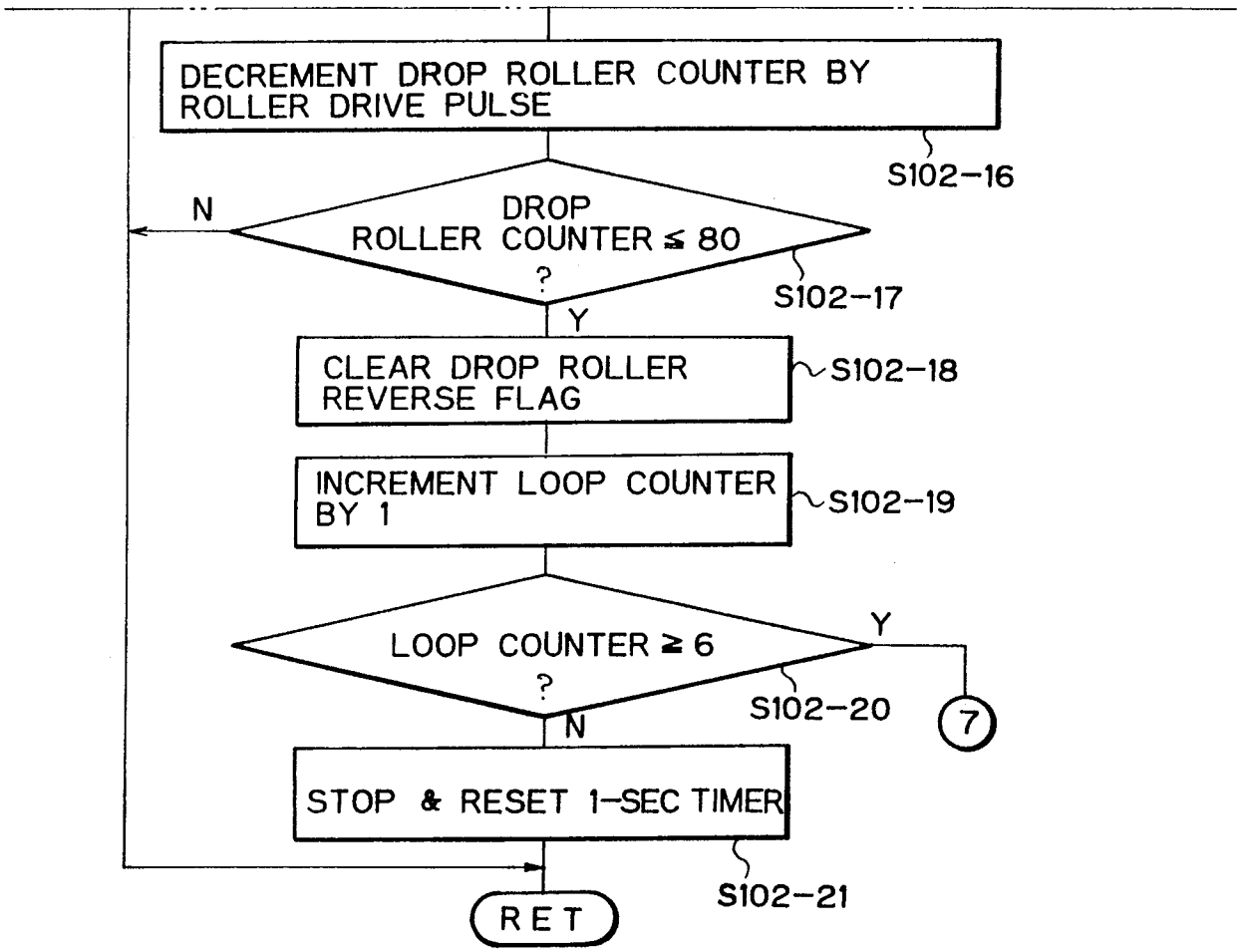

FIG. 102 demonstrates processing to be executed while a stapled sheet stack is dropped. Specifically, whether or not the drop roller forward flag is set is determined (S102-1) and, if it is not set, whether or not the drop roller reverse flag is set is determined (S102-2). If the answer of the step S102-2 is NO, the drop roller drive motor 441 is checked (S102-3). If the drive motor 441 is in an OFF state, the drive motor 441 is turned on (S102-4), a loop counter is reset (S102-5), and then the program returns. The loop counter counts the number of times that the drop rollers are moved back and forth and counts six times per sheet. Only when the sheets does not reach the sheet release sensor even after the loop counter has counted six times, it is determined that a jam has occurred. If the drive motor 441 is an ON state, the drop roller forward flag is set (S102-6), the drop roller reverse flag is cleared (S102-7), and then whether or not the drop roller counter has counted more than 120 pulses is determined (S102-9). If the answer of the step S102-9 is YES, the drop roller forward flag is cleared (S102-10), and then whether or not sheet release sensor 545 is in an ON state is determined (S102-11). If the answer of the step S102-11 is NO, whether or not the 1-second timer has started is determined (S102-12). If the answer of the step S102-12 is NO, the 1-second timer is caused to start (S102-13), and then the program returns.

On the other hand, if the 1-second timer has already started, whether or not the timer has counted up is determined (S102-14) and, if it has counted up, the program returns. If the answer of the step S102-14 is NO, the drop roller reverse flag is set (S102-15). Then, the drop roller counter is decremented by the drop roller drive pulses (S102-16), and whether or not the drop roller counter has become smaller than 80 is determined (S102-17). If the answer of the step S102-17 is NO, the program returns; if otherwise, the drop roller reverse flag is cleared (S102-18), and the loop counter is incremented by 1 (S102-19). Thereupon, whether or not the loop counter is greater than 6 is determined (S102-20) and, if the answer is NO, the 1-second timer is stopped and cleared (S102-21) and the program returns. If the answer of the step S102-20 is YES, the operation is transferred to a flow shown in FIG. 103 to clear the drop roller forward flag and drop roller reverse flag (S103-12 and S103-13). It is to be noted that "6" mentioned above means the sixth sheet dropping action effected with a single sheet. Thereafter, the drive motor 441 is deenergized (S103-14), the 5-second and 1-second timers are stopped and cleared (S103-15 and S103-16), a sheet release jam flag is set (S103-17), and then the operation is transferred to the error process routine. Here, the sheet release jam flag is ON when the stapled sheets has failed to drop onto the stack tray 67.

Figure 103:
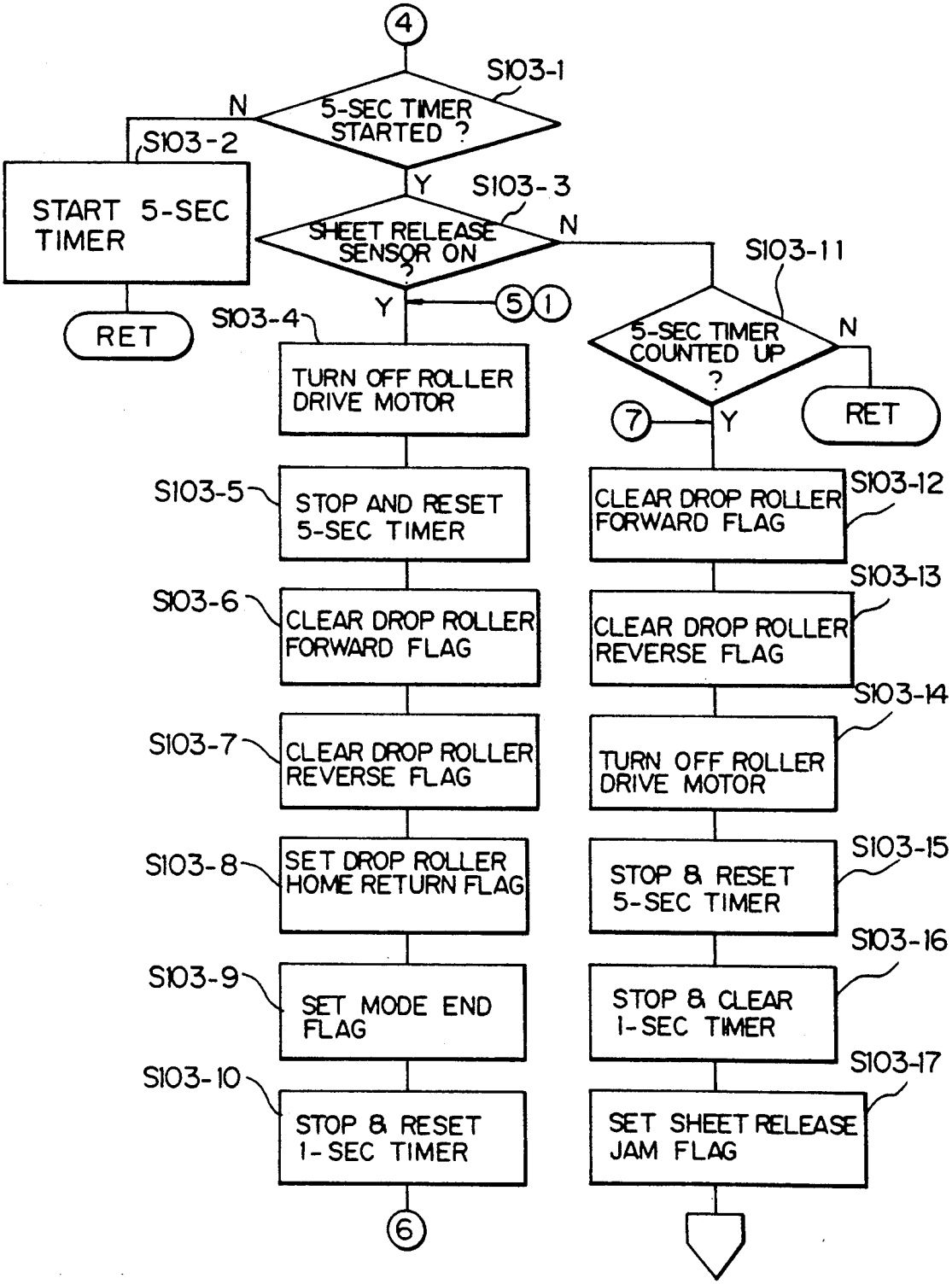

When the sheet release sensor is in an ON state as determined in the step S102-11, the operation is transferred to the flow of FIG. 103 to see if the 5-second timer has started (S103-1). If the answer of the step S103-1 is NO, the 5-second timer is started (S103-2), and the program returns. If the answer of the step S103-1 is YES, whether or not the output of the sheet release sensor has fallen is determined (S103-3). If the answer of the step S103-3 is YES, the step S103-4 and successive steps are executed; if otherwise, whether or not the 5-second timer has counted up is determined (S103-11). If the 5-second timer has not counted up, the program returns; if otherwise, the step S103-12 and successive steps are executed.

Further, when the drop roller reverse flag is set as determined in the step S102-2, whether or not the output of the sheet release sensor 545 has fallen is determined (S102-21). If the answer of the step S103-21 is YES, the step S103-4 and successive steps are executed; if otherwise, the step S102-16 and successive steps are executed. If the answer of the step S102-1 is YES, meaning that the drop roller forward flag is set, the step S102-6 and successive steps are executed.

9. Document Processing Control

Figure 104A:
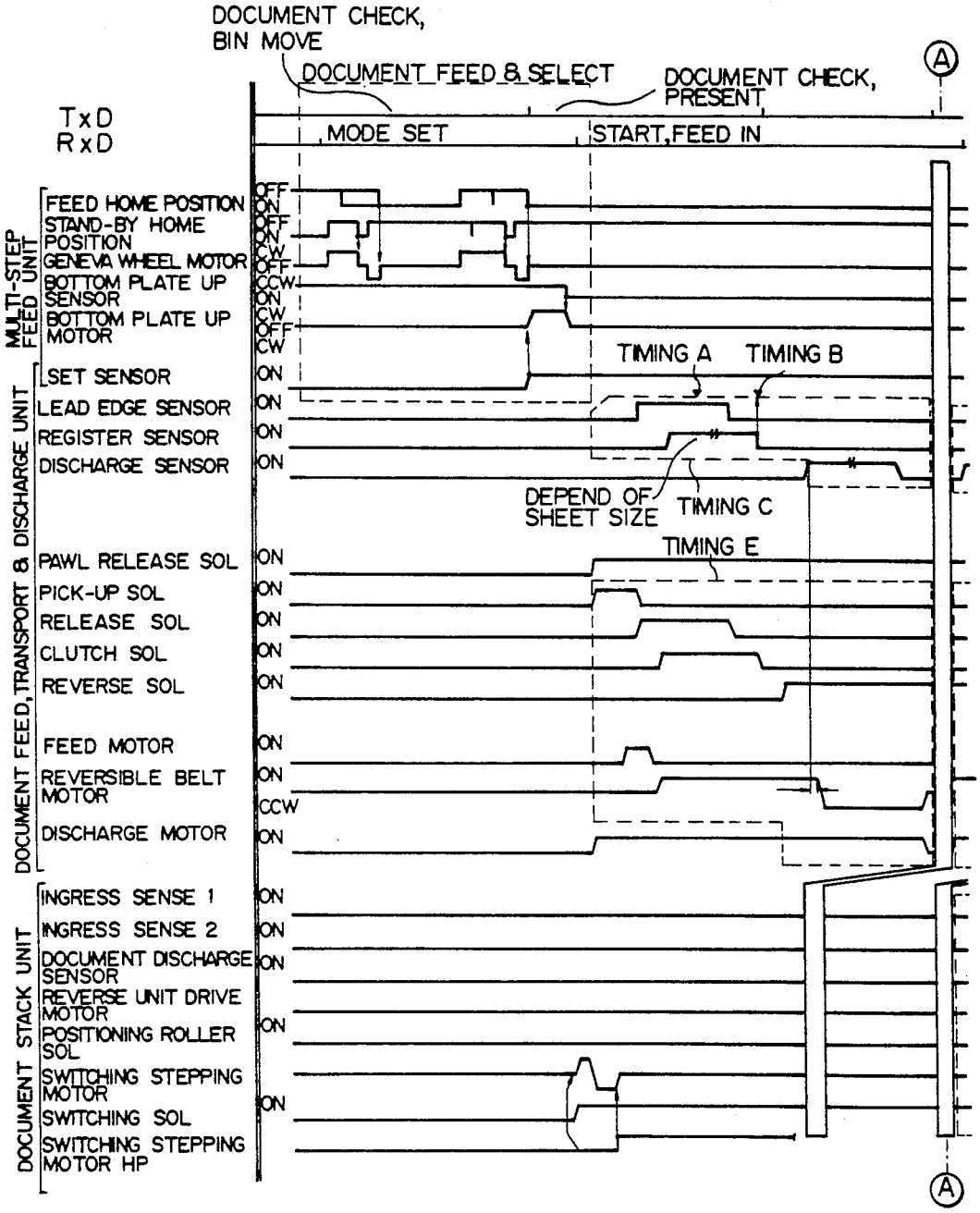
FIGS. 104A and 104B are timing charts indicative of the timings for setting, feeding and discharging documents.
Figure 104B:
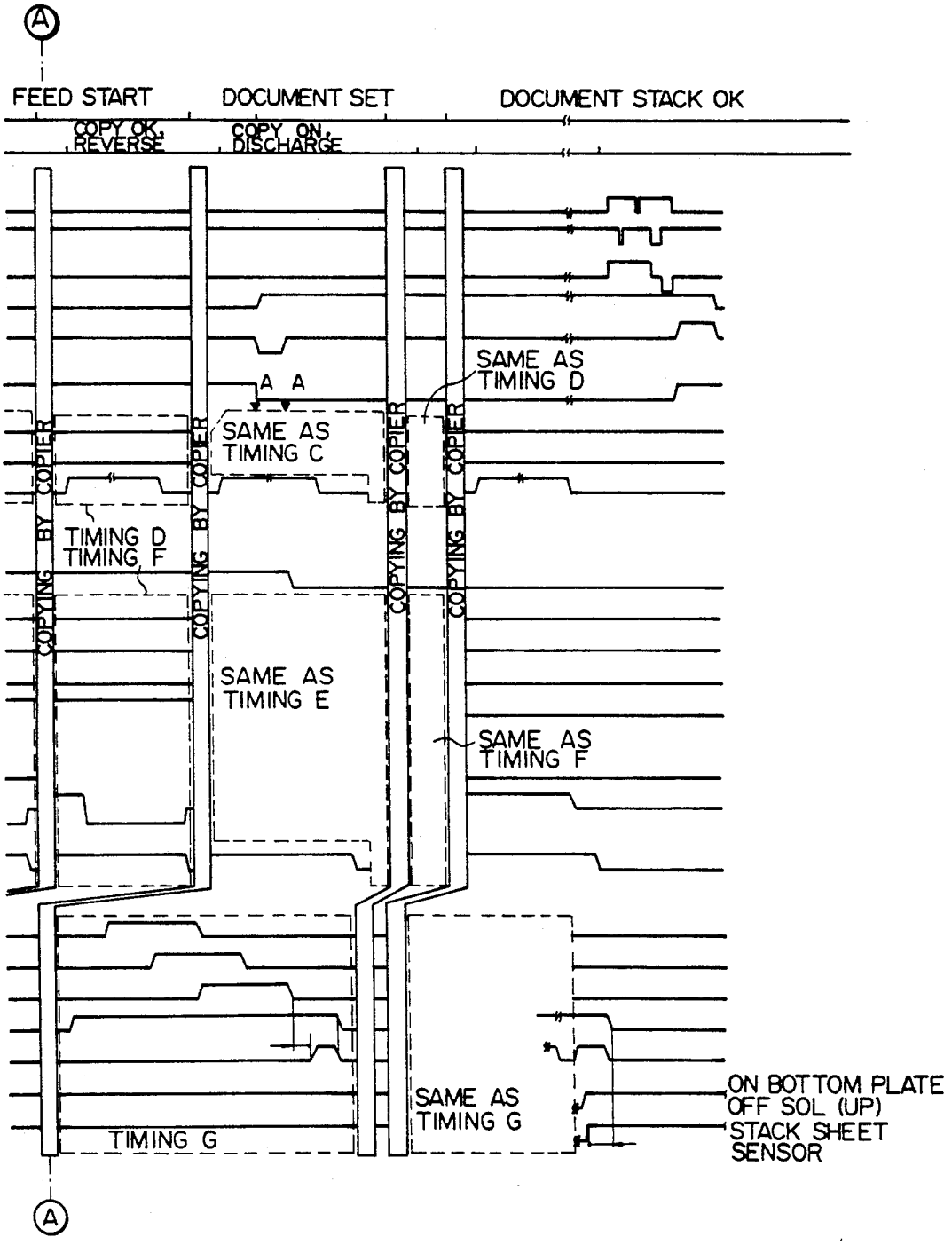

The control over processing for feeding and processing the documents 69 on the basis of a plurality of different modes will be described in detail. How the documents 69 are set, fed and discharged is shown in timing charts in FIGS. 104A and 104B.

9. Initialize

Initialize includes (1) door open checking associated with the document reverse unit, (2), optional unit connection checking associated with the document reverse unit, (3) bin home request processing associated with the multi-step unit, and (4) lift-up checking and intial jam checking associated with the transport section (cover plate) of the document transport unit, as will be described specifically.

Figure 105:
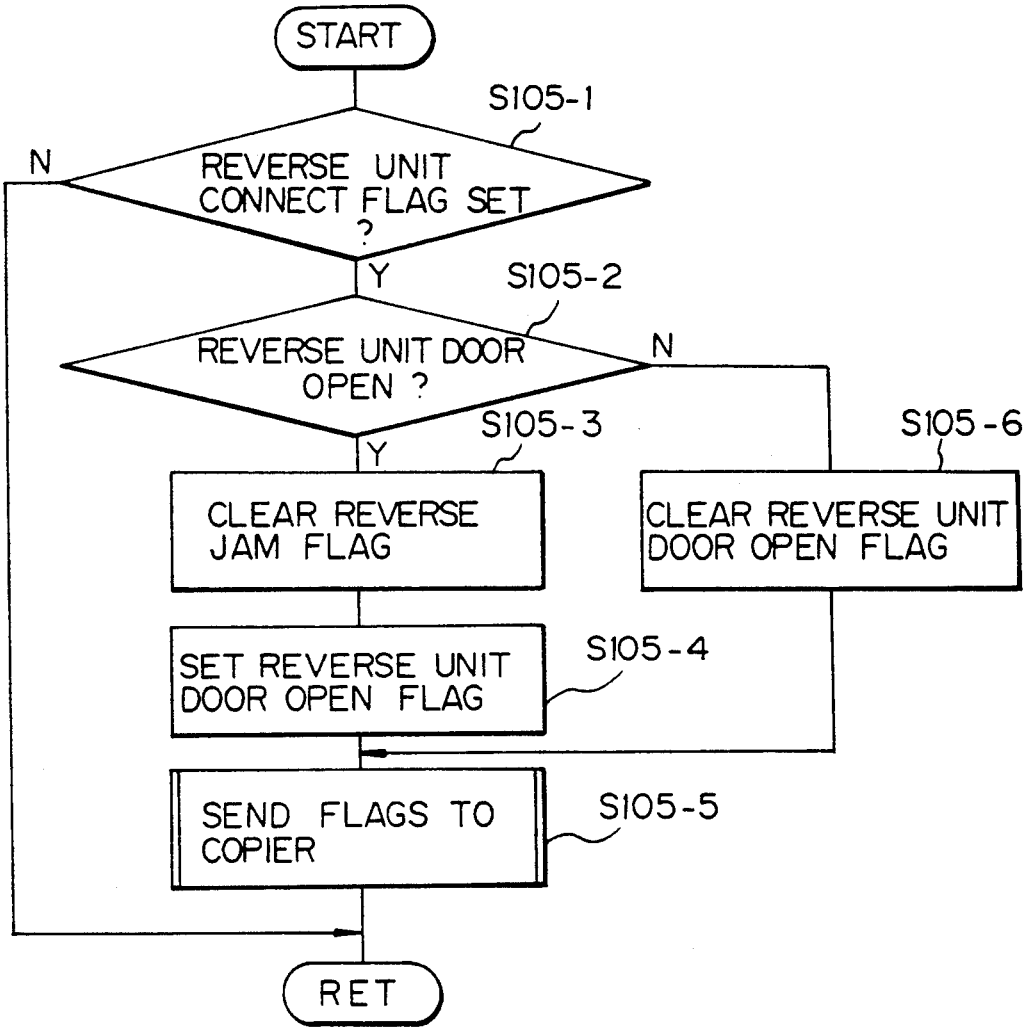
FIG. 105 is a flowchart showing door open check processing.

(1) Door open checking: In the illustrative embodiment, whether or not a door included in the document transport section 9 is open is determined, as shown in FIG. 105. First, the status of a reverse unit connect flag which shows whether or not the reverse unit 52 is connected to the transport unit 51 is determined (ONE if the unit 52 is connected or ZERO if otherwise) (S105-1). If the answer of the step S105-1 is NO, the program returns. If the answer of the step S105-1 is YES, whether or not the door of the reverse unit 51 is open is determined. If the door is open, a document reverse unit jam flag is cleared (S105-3), a document reverse unit door open flag is set (S105-4), these jam flag and door open flag are sent to the CPU 573 of the copier body as serial data, and then the program returns. If the door is closed as determined in the step S105-2, the door open flag is cleared (S105-6), this flag is sent to the CPU 573, and then the program returns.

The document reverse unit jam flag is associated with the first and second ingress sensors 370 and 368 of the document reverse unit 52. The document reverse unit door open flag is ONE when the door is open or ZERO when it is closed.

(2) Optional unit connect checking: In the illustrative embodiment, the document stack tray 353 and multi-step unit 50 are connectable to the document feed unit 51 as optional units. Whether or not such optional units are connected to the document transport unit 51 is determined by a procedure which will be described with reference to FIG. 106.

Figure 106:
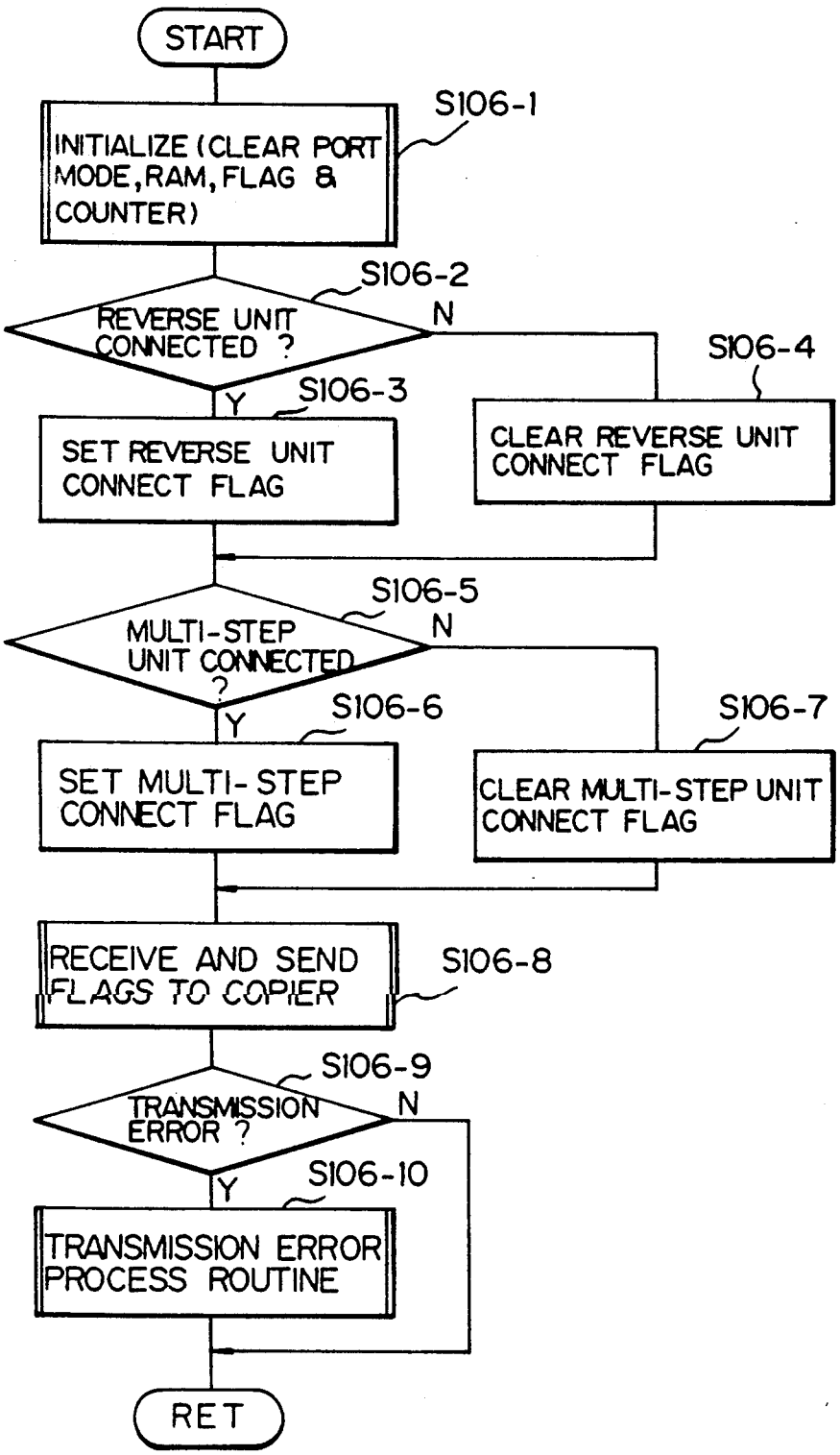
FIG. 106 is a flowchart showing a procedure for determining whether or not an optional unit is connected to the document transport unit.

As shown in FIG. 106, an initialize subroutine is executed to clear the port mode and RAM, to reset flags and counters, etc. (S106-1). Then, whether or not the document reverse unit 52 is connected to the document feed unit 51 is determined (S106-2). This decision is made on the basis of the level of the input port of the gate array 605. Specifically, the level of the input port is "L" if the document reverse unit 52 is connected to the document feed unit 51 or "H" if otherwise. If the answer of the step S106-2 is YES, a document reverse unit connect flag is set (S106-3); if otherwise, this flag is cleared (S106-4). Subsequently, whether or not the multi-step unit 50 is connected is determined in the same manner as with the document reverse unit 52 (S106-5).

If the multi-step unit 50 is connected as determined in the step S106-5, a multi-step unit connect flag is set (S106-6). If the answer of the step S106-5 is NO, the multi-step unit connect flag is cleared (S106-7), and then the reverse unit connect flag and multi-step unit connect flag are transmitted to the CPU 573 of the copier body as serial data (S106-8). The multi-step unit connect flag is ONE when the multi-step unit 50 is connected to the document transport unit 51 or ZERO if otherwise. Of course, the multi-step SDF 49 is made up of the multi-step unit 50 and document transport unit 51 in the illustrative embodiment.

After the step S106-8, a step S106-9 is executed to see if a transmission error has occurred. If the answer of the step S106-9 is NO, the program returns; if otherwise, a transmission error process routine is executed (S106-10), and then the program returns.

Figure 107A:
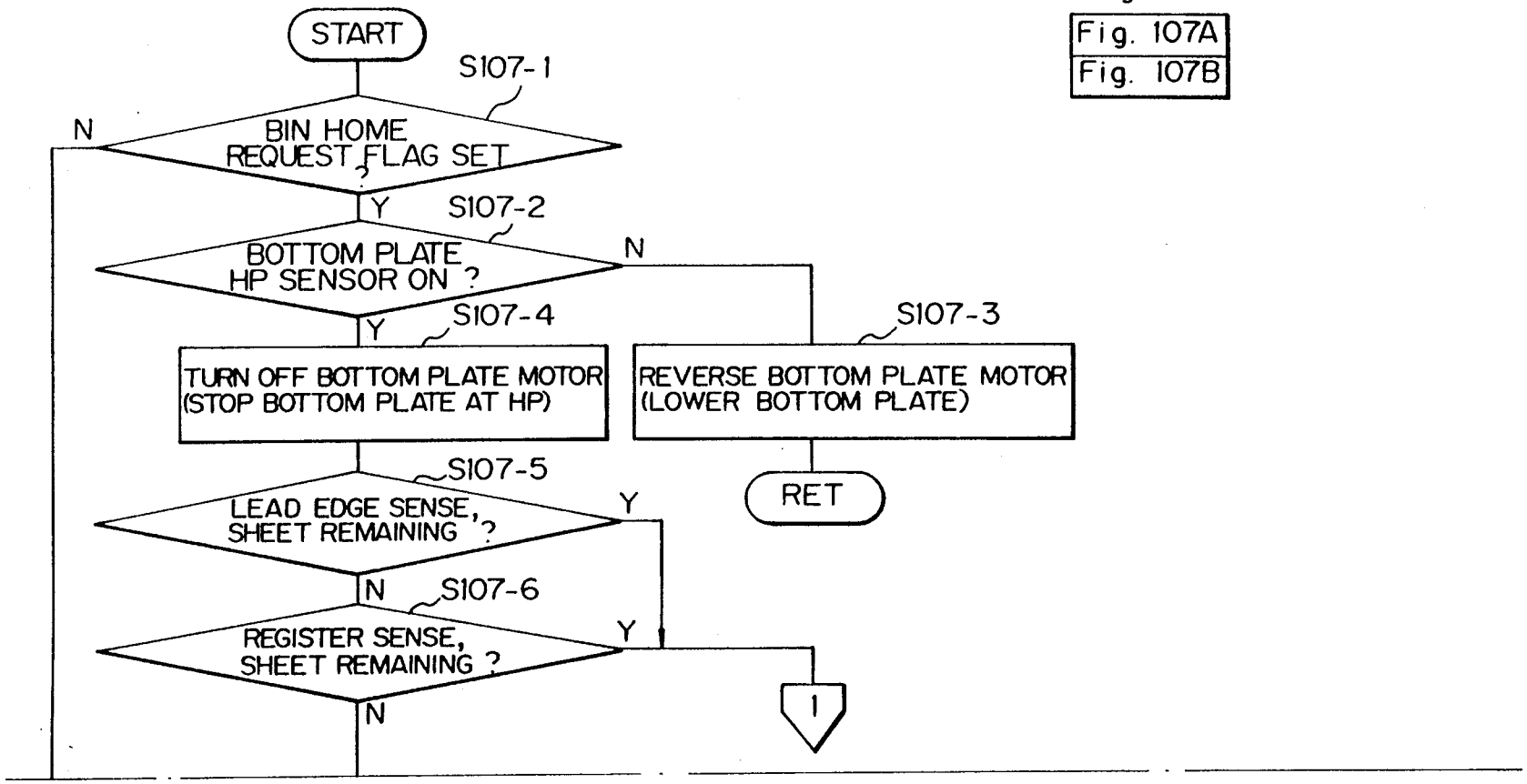
FIG. 107A and 107B is a flowchart showing document bin home request processing.
Figure 107B:
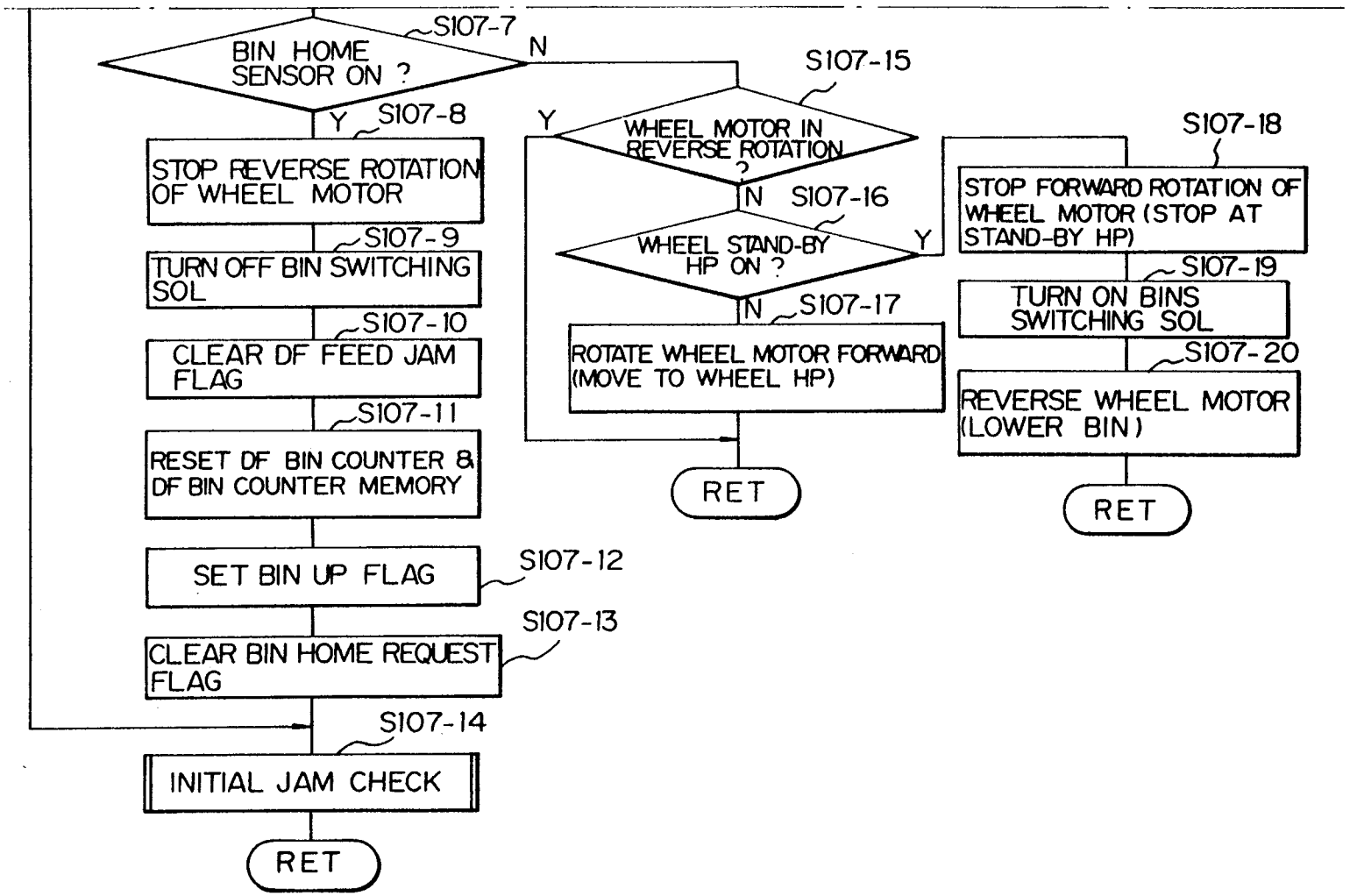
Figure 108:
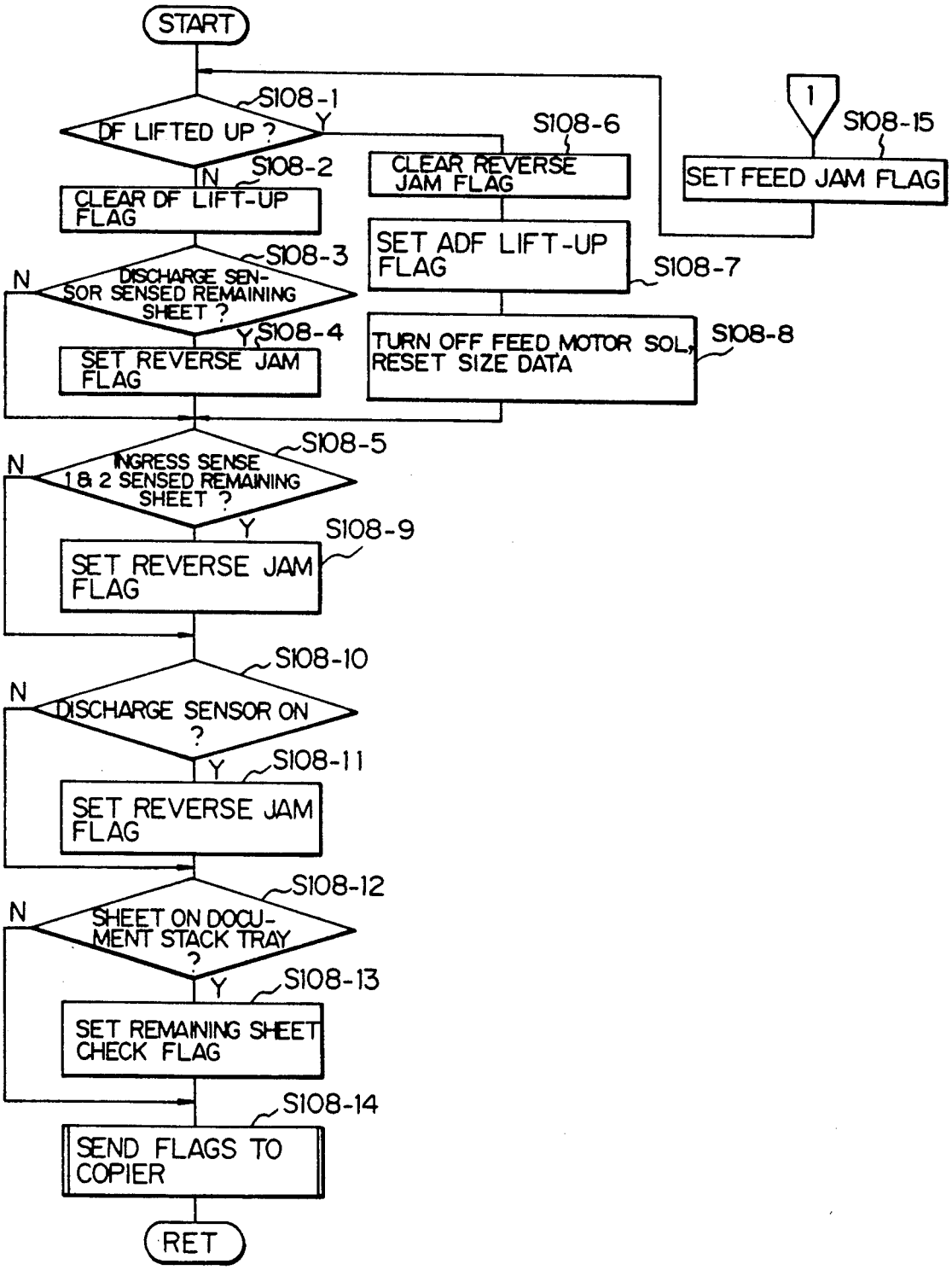
FIG. 108 is a flowchart showing lift-up check and initial jam check processing associated with the document transport unit.

(3) Bin home request processing: This processing is executed to return the document bins 201 to their initial position or home position. Specifically, as shown in FIG. 107, the status of a bin home request flag is determined (S107-1). When the bin home request flag of the copier body is ONE, the CPU 601 of the document transport unit 51 receiving such a flag changes the above-mentioned bin home request flag from ZERO to ONE and thereby moves the bins 201 to the home position. As the bins 201 reach the home position, the bin home request flag is cleared and transmitted to the CPU 573 of the copier body. If the bin home request flag is set as determined in the step S107-1, the status of the bottom plate home position sensor 251 is determined (S107-2). If the output of the home position sensor 251 is in an OFF state, the bottom plate motor 241 is reversed to lower the bottom plate 211. (S107-3), and then the program returns. If the output of the home position sensor 251 is in an ON state, meaning that the bottom plate 211 has reached thehome position, the motor 241 is deenergized to stop the bottom plate 211 at the home position (S107-4). Subsequently, whether or not sheets are left on the bins 201 is determined by the leading edge sensor 243 (S107-5) and, if the answer is YES, a procedure shown in FIG. 108 is executed to set a feed flag (S108-15). If the answer of the step S107-5 is NO, whether or not sheets are left is determined again by the register sensor 245 (S107-6). If the answer of the step S107-6 is YES, a step S108-15 and successive steps shown in FIG. 108 are executed; if it is NO, the status of the bin home sensor 222 is determined (S107-7). If the bin home sensor 222 is in an ON state, the reverse rotation of the wheel motor 231 is stopped to cause the bins 201 to wait at the home position (S107-8). Then, the bin switching solenoid 240 is turned off (S107-9), and the feed jam flag of the document transport unit 51 is cleared (S107-10). The feed jam flag is normally ZERO and is ONE when a jam occurs as determined by the sensors 243 and 245.

After the feed jam flag has been cleared in the step S107-10, a bin counter (DF bin counter) and a bin counter memory (DF bin counter memory) are reset (S107-11). The DF bin counter is indicative of the position of each bin 201 of the multi-step unit 50 having five bins in total, and the counts thereof have the following meaning:

0: all of the five bins have been lowered to the home position;

1: job processing and shift processing with the first or uppermost bin;

2: job processing and shift processing with the second bin;

3: job processing and shift processing with the third bin;

4: job processing and shift processing with the fourth bin;

5: job processing and shift processing with the fifth bin.

The DF bin counter memory is associated with the DF bin counter and implementats interrupt processing and reverse mode processing.

After the step S107-11, the bin raise flag is set (S107-12), the bin home requests flag is cleared (S107-13), the initial jam check suroutine is executed (S107-14), and the the program returns.

On the other hand, if the bin home sensor 222 is in an OFF stated as determined in the step S107-7, the rotation of the wheel motor 231 is checked (S107-15). If the wheel motor 231 is in reverse rotation, the program returns; if otherwise, the status of the wheel stand-by home position sensor 253 is checked (S107-16). If the sensor 253 is in an OFF state, the wheel motor 231 is rotated forward to bring the Geneva wheel 107 to the wheel stand-by home position (S107-17), and then the program returns. If the sensor 253 is in an ON state, the forward rotation of the wheel motor 231 is stopped to bring the Geneva wheel 207 to a stop at the home position thereof (S107-18). Subsequently, the bin solenoid is energized (S107-19), the wheel motor 231 is reversed to lower the bins 201, and then the program returns.

(4) Lift-up check and initial jam check: FIG. 108 shows a lift-up check and initial jam check procedure associated with the transport section of the document transport unit. As shown, whether or not the document transport unit or DF has the transport section thereof lifted up, i.e., whether or not the cover plate 288 has been opened is determined (S108-1). If the answer of the step S108-1 is NO, a DF lift-up flag is cleared (S108-2), and whether or not a document 69 is present is determined by the discharge sensors 321 and 322 (S108-3). If a document 69 is left in the sensor position, a jam flag associated with the discharge sensors 321 and 322 is set (normally ZERO and changing to ONE in the event of a jam) (S108-4); if otherwise, whether or not a document 69 is left is determined on the basis of the outputs of the first and second ingress sensors 370 and 368 (S108-5). If the answer of the step S108-1 is YES, a reverse jam flag is cleared (S108-6) while an ADF lift-up flag (ONE when the DF cover plate is raised or ZERO when it is lowered) is set (S108-7). Further, the document transport motor 323 and reverse solenoid 316 are turned off, and the size data and counter are cleared (S108-8). This is followed by the step S108-5.

If a document 69 is left at the position where the sensor 370 or 368 is located as determined in the step S108-5, the document reverse jam flag is set (S108-9). If the answer of the step S108-5 is NO, whether or not a document 69 has been discharged is determined by the document discharge sensors 321 and 322. If the sensors 321 and 322 are in an ON state, meaning that a document 69 is left in the discharge section, the document reverse jam flag is set (S108-11). If the sensors 321 and 322 are in an OFF state, whether or not a document 69 is present on the stack tray 382 is determined (S108-12). If a document 69 exists on the stack tray 382, the stack tray paper-end sensor 376 senses it. Then, a sheet check flag is set (ONE if a document 69 exists on the stack tray 382 or ZERO if otherwise) (S108-13). If no documents 69 exist on the stack tray 382, the above-stated flags are transmitted to the CPU 573 of the copier body (S108-14), and then the program returns.

When the operation is transferred from the step S107-5 or S107-6 shown in FIG. 107 as the initial jam check routine, the feed jam flag is set (S108-15), and then the step S108-1 and successive steps are executed.

9.2 Movement of Document Bin

The five document bins 201 are selected and moved on the basis of jobs selected by the copier body. Processing relating to the selection and movement of the bins 201 include (1) inputting data representative of the number of bins, (2) moving the bins in response to data sent from the copier body, (3) elevating the bins, and (4) lowering the bins, as described specifically hereinafter.

Figure 109:
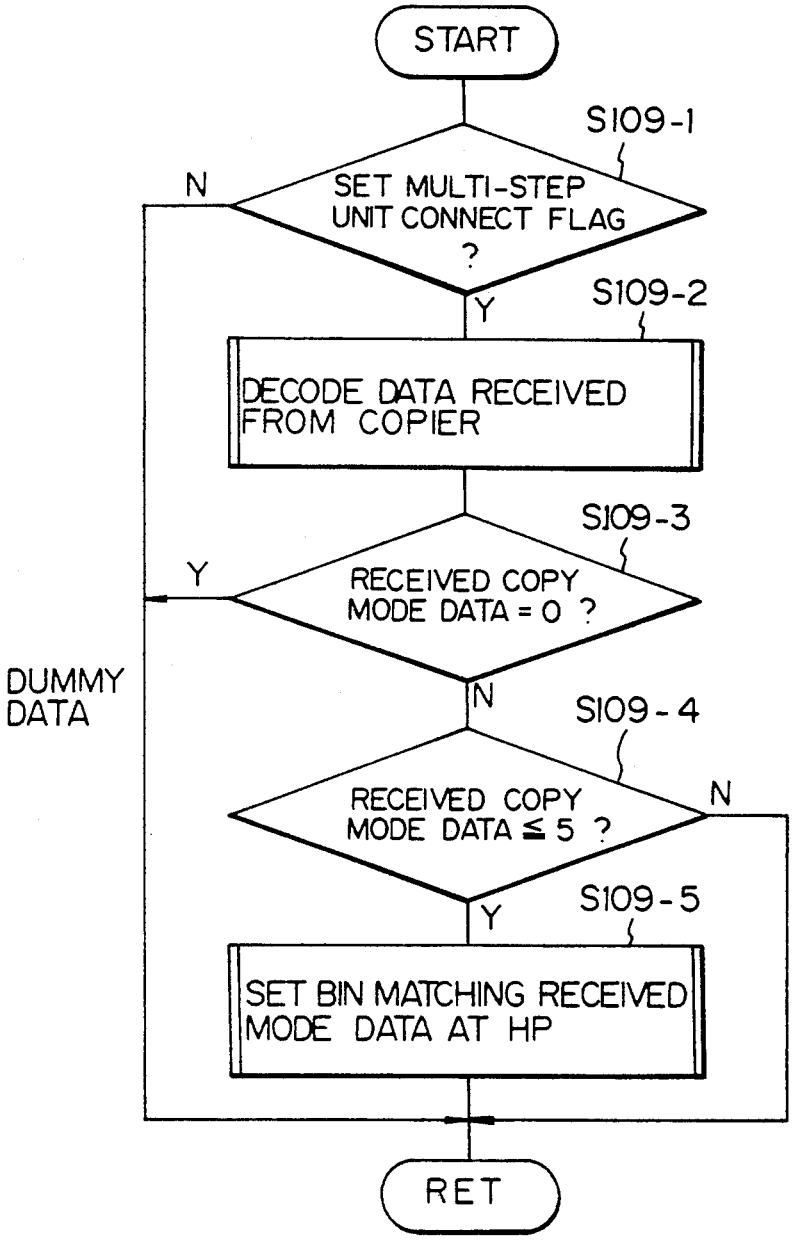
FIG. 109 is a flowchart showing a procedure relating to the entry of the number of bins of the multi-step unit.

(1) Data input: FIG. 109 shows a procedure relating to the input of data representative of the number of bins. First, to confirm the connection of the multi-step unit 50, the state of the multi-step unit connect flag is determined (S109-1) and, if it is not set, dummy data is outputted, and then the program returns. If the multi-step unit connect flag is set, data sent from the CPU 573 of the copier body is decoded (S109-2), and then whether or not the received copy mode data is 0 is determined (S109-3). If the received copy mode data is 0, the program returns immediately. If the received copy mode data it not 0, whether or not the data is smaller than 5 is determined (S109-4). If the data is greater than 5, the program returns; if otherwise, one of the bins 201 which matches the received mode data is set at the feed home position (S109-5), and the program returns. It is to be noted that "5" of the received copy mode data stems from the fact that the multi-step unit 50 has five steps and will, of course, change depending on the number of steps of the multi-step ADF 49.

Figure 110:
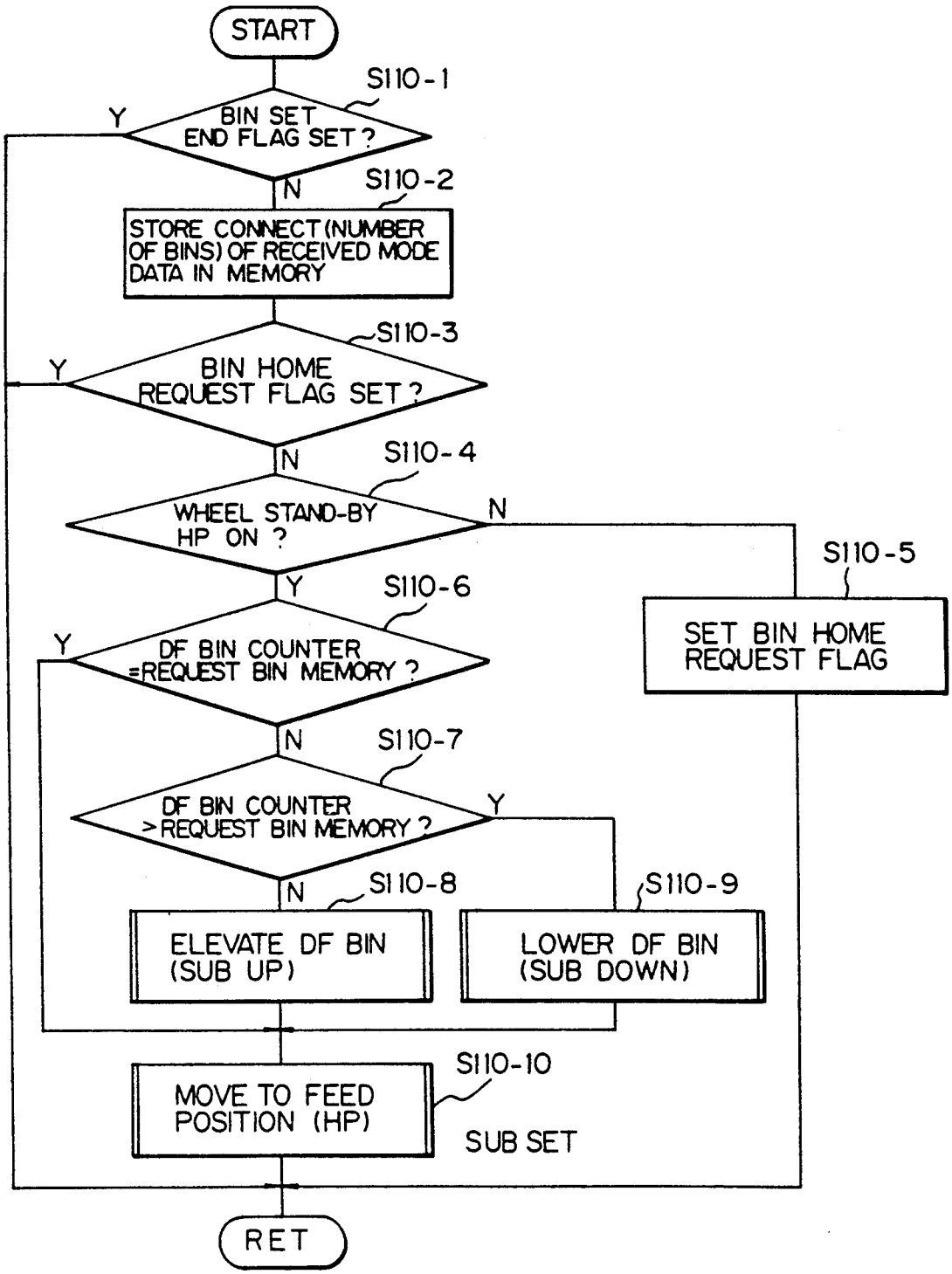
FIG. 110 is a flowchart showing a bin moving procedure based on data received from the copier body.

(2) Movement of bins: FIG. 110 shows a procedure for moving the bins 201 in response to data sent from the copier body. As shown, the status of a bin set end flag is determined (S110-1). The bin set end flag is ONE if a bin 201 has been brought from the stand-by home position to the feed home position or ZERO if otherwise. If the bin set end flag is set, meaning that a bin 201 is located at the feed home position, the program returns. If this flag is not set, the content of received mode data, i.e., the number of bins is written to a request bin memory (S110-2), and then the status of a bin home request flag is determined (S110-3). If the bin home request flag is set, the program returns; if otherwise, the status of the wheel stand-by home position sensor 257 is determined (S110-4). Regarding the bin home request flag, when the bin home request flag of the copier body changes to ONE, the DF receives it and changes the bin home request flag thereof to ONE to return the bin 201 to the home position.

If the Geneva wheel is not located at the stand-by home position as determined in the step S110-4, the bin home request flag is cleared (S110-5), and the program returns. Otherwise, whether or not the DF bin counter and request bin memory compare equal is determined (S110-6). If the answer of the step S110-6 is YES, a subroutine for moving the bin 201 to the feed home position is executed (S110-10), and then the program returns. If the answer of the step S110-6 is NO, whether or not the DF bin counter is greater than the request bin memory is determined (S110-7). If the answer of the step S110-7 is NO, a DF bin raise subroutine is executed to elevate the bins 201 (S110-8); if otherwise, a DF bin lower subroutine which will be described is executed to lower the bins 201 (S110-9), and then the program returns after executing the step S110-10.

Figure 111:
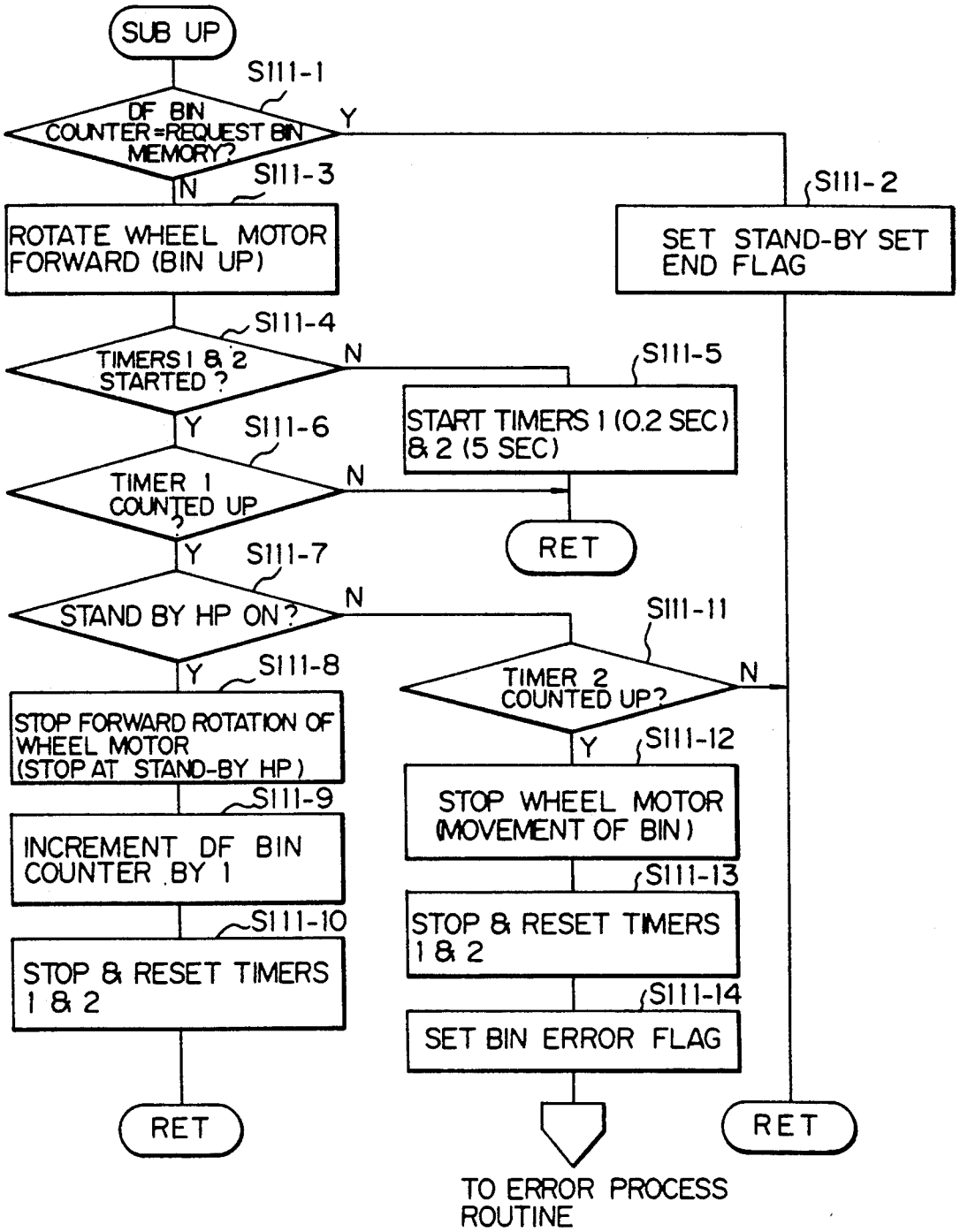
FIG. 111 is a flowchart showing a document bin up procedure.

(3) Elevation of bins: FIG. 111 shows the bin raise subroutine, step S110-8, in detail. As shown, whether or not the DF bin counter and the request bin memory compare equal is determined (S111-1). If they compare equal, a stand-by set end flag is set, and the program returns (S111-2). The stand-by set end flag changes to ONE when the bins 201 are fully moved by the number of bins transmitted from the CPU 573 of the copier body and a designated bin 201 is sensed by the stand-by home position sensor 257. If the DF bin counter and request bin memory do not compare equal as determined in the step S111-1, the wheel motor 231 is rotated forward to elevate the bins 201 (S111-3), and then whether or not the timers 1 and 2 have started is determined (S111-4). If the answer of the step S111-4 is NO, they are started (S111-5), and then the program returns. If the timers 1 and 2 have started, whether or not the timer 1 has counted up is determined (S111-6). If the timer 1 has not counted up, the program returns; if it has counted up, the status of the stand-by home position sensor 257 is determined (S111-7). If the stand-by home position sensor 257 is in an ON state, the forward rotation of the wheel motor 231 is stopped at a position corresponding to the stand-by home position (S111-8), the DF bin counter is incremented by 1 (S111-9), the timers 1 and 2 are stopped and cleared (S111-10), and then the program returns.

If the stand-by home position sensor 257 is in an OFF state as determined in the step S111-7, whether or not the timer 2 has counted up is determined (S111-11). If the answer of the step S111-11 is NO, the program returns; if otherwise, the rotation of the wheel motor 231 and, therefore, the movement of the bins 201 is stopped (S111-12). Thereafter, the timers 1 and 2 are stopped and cleared (S111-13), a bin error flag is set (S111-14), and then the operation is transferred an error process subroutine. The above-mentioned bin error flag is ONE if an error has occurred in the movement of the bins 201 or ZERO if otherwise.

Figure 112:
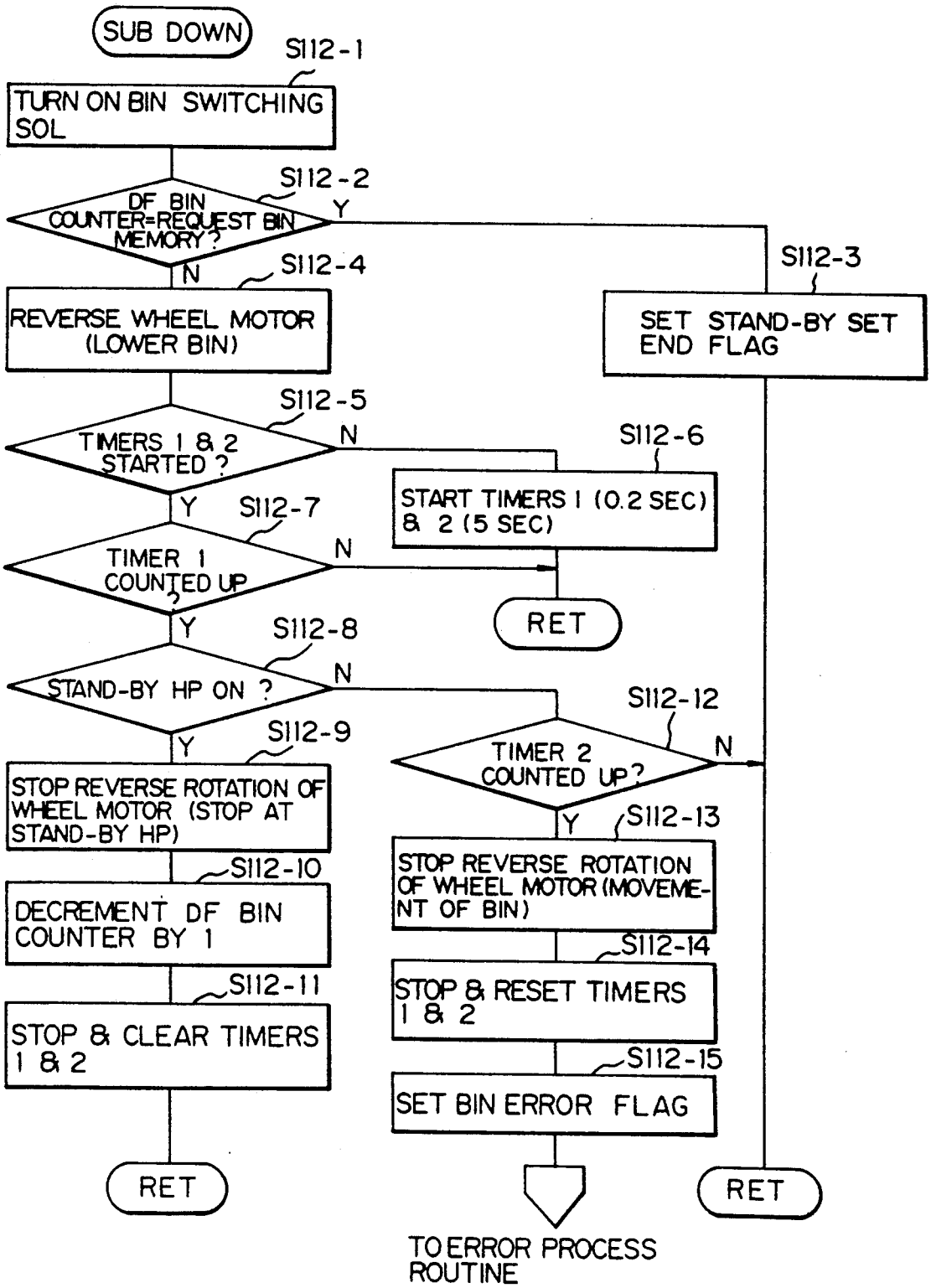
FIG. 112 is a flowchart showing a document bin down procedure.

(4) Lowering of bins: FIG. 112 shows the DF bin lower processing, step S110-9, in detail. First, the bin switching solenoid 240 is energized (S112-1), and then whether or not the DF bin counter and request bin memory compare equal is determined (S112-2). If the answer of the step S112-2 is YES, the stand-by set end flag is set (S112-3), and then the program returns. If the answer of the step S112-2 is NO, the wheel motor 231 is reversed to lower the bins 201 (S112-4). Subsequently, whether or not the timers 1 and 2 have started is determined (S112-5) and, if not, the timers 1 and 2 are started (S112-6). If the timers 1 and 2 have started, whether or not the timer 1 has counted up is determined (S112-7) and, if not, the program returns. If the timer 1 has counted up, the status of the stand-by home position sensor 257 is determined (S112-8). If the stand-by home position sensor 257 is in an ON state as determined in the step S112-8, the reverse rotation of the wheel motor 231 is stopped to stop the movement of the bin 201 at the stand-by home position (S112-9). Then, the DF bin counter is decremented by 1 (S112-10), the timers 1 and 2 are stopped and cleared (S112-11), and then the program returns.

If the stand-by home position sensor 257 is in an OFF state as determined in the step S112-8, whether or not the timer 2 has counted up is determined (S112-12). If the timer 2 has not counted up, the program returns. If the timer 2 has counted up, the reverse rotation of the wheel motor 231 and, therefore, the movement of the bins 201 is stopped (S112-13). Thereupon, the timers 1 and 2 are stopped and cleared (S112-14), the bin error flag is set, and then the operation is transferred to the error process routine.

9.3 Setting of Document Bin at Feed Position

A reference will be made to FIGS. 113 and 114 for describing specific procedures for moving a bin 201 loaded with documents to be processed in an entered mode to the document feed position.

Figure 113:
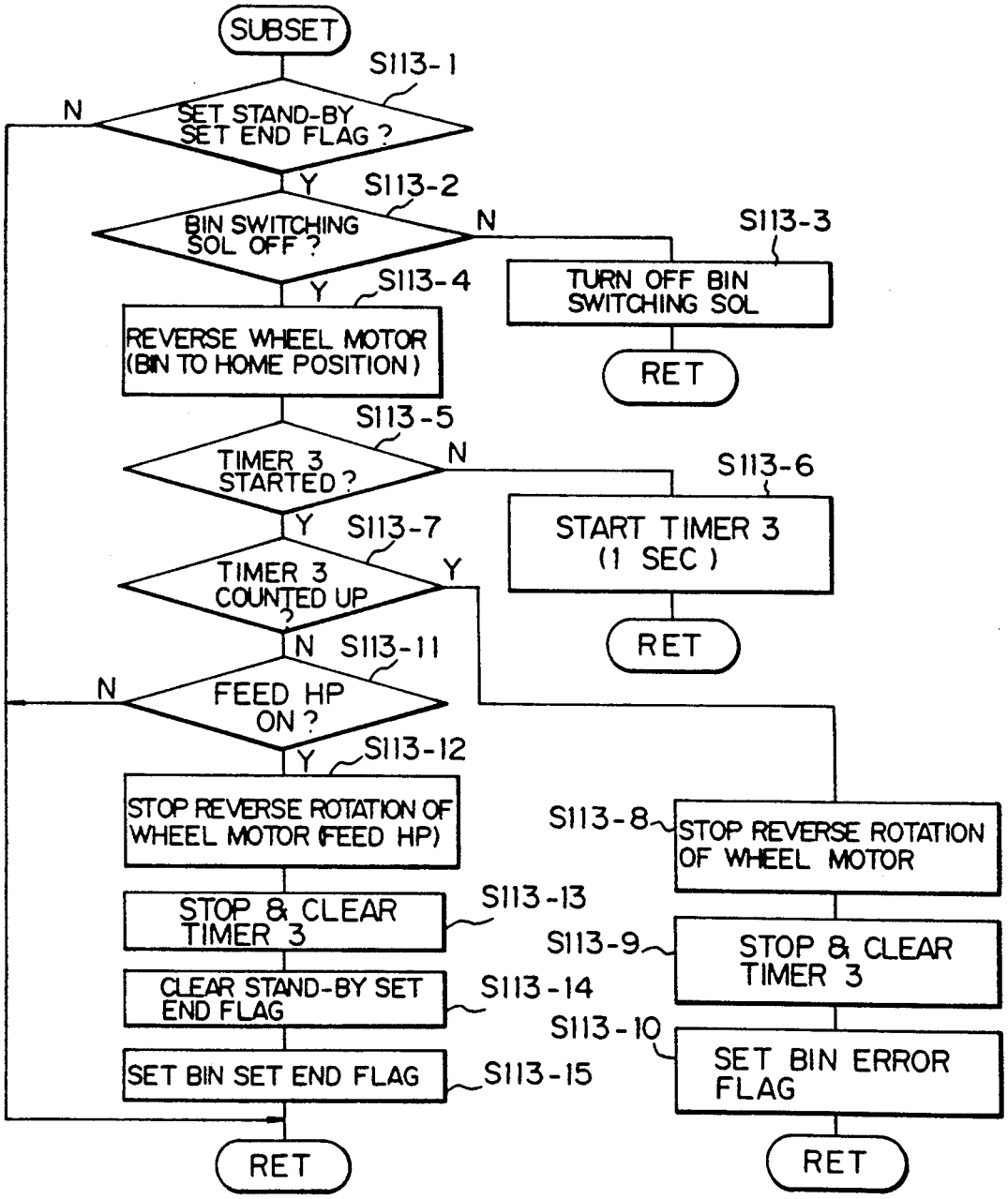
FIGS. 113 and 114 are flowcharts each showing a specific procedure for setting the document bin at the feed position.

As shown in FIG. 113, whether or not the stand-by set end flag is set is determined (S113-1) and, if it is not set, the program returns. If the flag of interest is set, the state of the bin switching solenoid 240 is determined (S113-2). If the solenoid 240 is in an ON state, it is caused into an OFF state (S113-3), and the program returns. If the solenoid 240 has already been deenergized, the wheel motor 231 is reversed to move the bin 201 to the feed position (S113-4), and then whether or not the timer 3 has started is determined (S113-5). If the answer of the step S113-5 is NO, the timer 3 is started (S113-6), and the program returns. If the answer of the step S113-5 is YES, whether or not the timer 3 has counted up is determined (S113-7). If the answer of the step S113-7 is YES, the reverse rotation of the wheel motor 231 is stopped (S113-8), the timer 3 is stopped and cleared (S113-9), the bin error flag is set (S113-10), and then the program returns.

If the timer 3 has not counted up as determined in the step S113-7, the status of the feed home position sensor 259 is determined (S113-11). If the feed home position sensor 259 is in an OFF state, the program returns. If the sensor 259 is in an ON state, the reverse rotation of the wheel motor 231 is stopped to bring the bin 201 to a stop at the feed home position (S113-12). Thereafter, the timer 3 is stopped and cleared (S113-13), the stand-by set end flag is cleared (S113-14), the bin set end flag is set (S113-15), and then the program returns.

Figure 114:
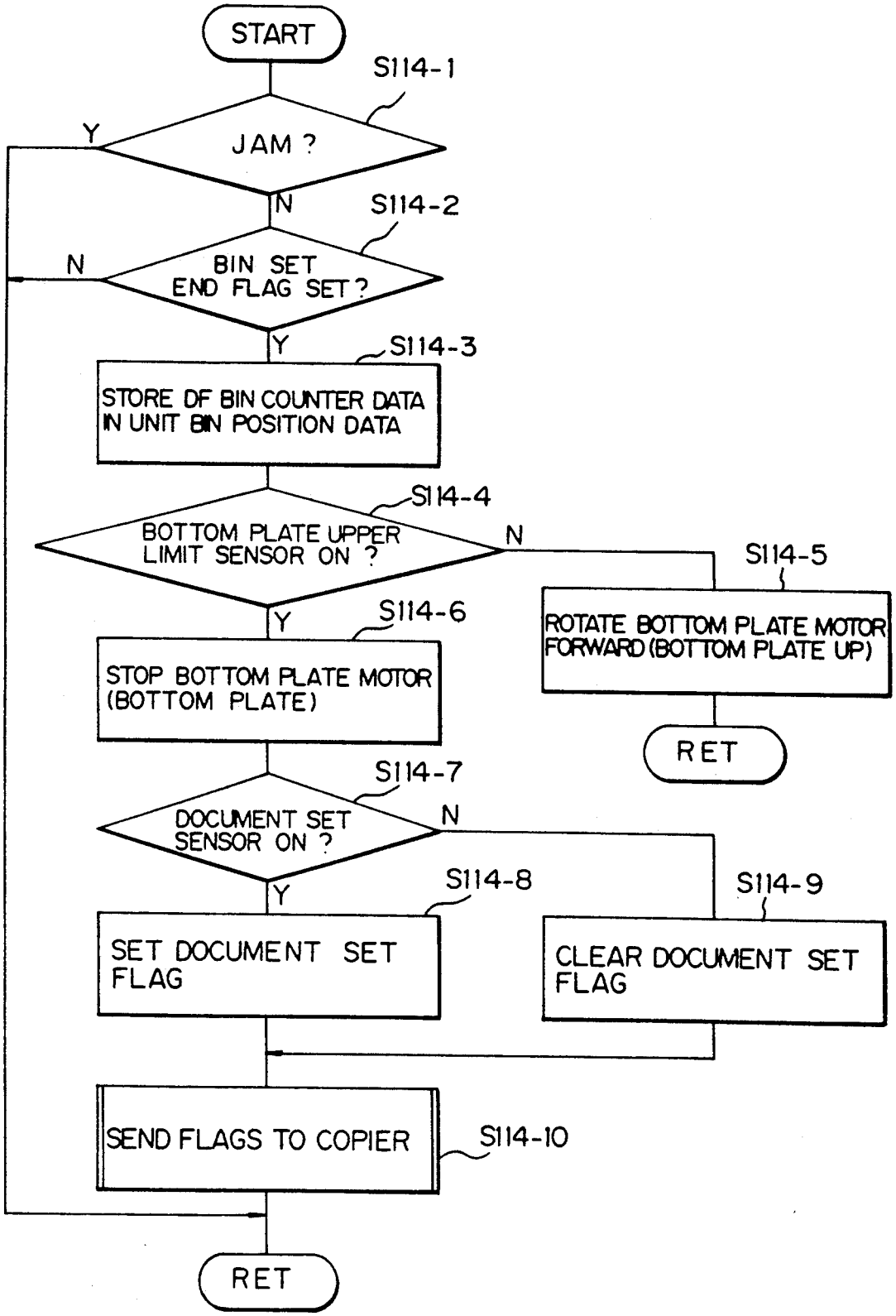

The procedure shown in FIG. 114 begins with a step of determining whether or not a document 69 has jammed (S114-1). If a document 69 has jammed, the program returns. If a jam has not occurred, the status of the bin set end flag is determined (S114-2). If the bin set end flag is not set, the program returns; if otherwise, the data of the DF bin counter is written to the bin position memory (S114-3). Then, the state of the bottom plate upper limit (elevation) sensor 263 is determined (S114-4). If the sensor 263 is in an OFF state, the bottom plate motor 241 is rotated forward to raise the bottom plate 211 (S114-5), and then the program returns. If the sensor 263 is in an ON state, the motor 241 and, therefore, the bottom plate 211 is stopped (S114-6). Subsequently, the status of the document set sensor 249 is determined (S114-7). If documents 69 are sensed, the document set flag is set (S114-8); if otherwise, the document set flag is cleared (S114-9), the flags are sent to the CPU 573 of the copier body (S114-10), and then the program returns.

9.4 Feed-In

Feed-in processing is executed to begin transporting a document 69 toward the document transport unit 51 in response to a document feed signal fed from the CPU 573 of the copier body.

Figure 115:
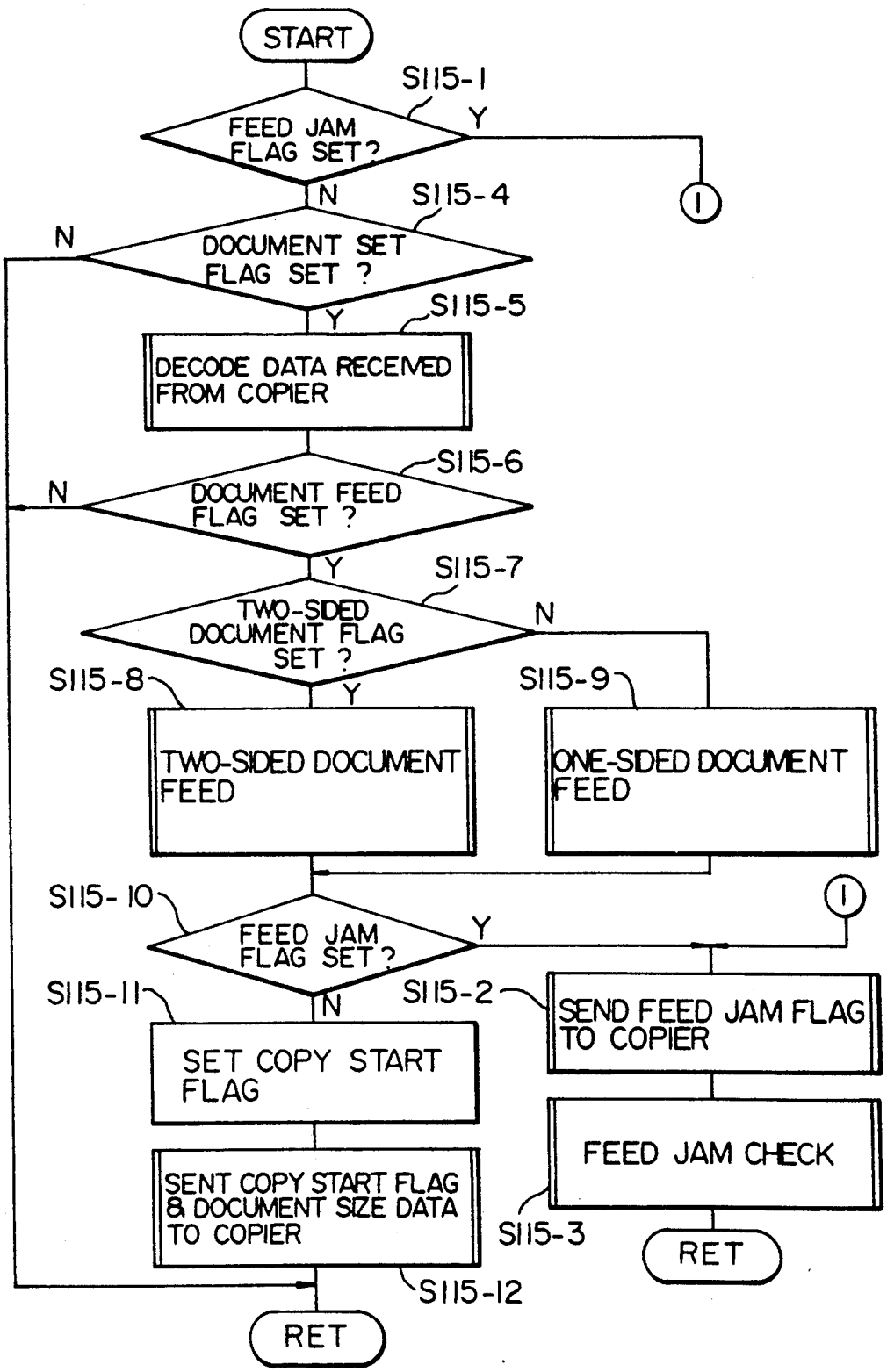
FIG. 115 is a flowchart showing a feed-in procedure for starting feeding a document from the multi-step unit to the document transport unit.
Figures 116A, 116B, 116C, 116D:
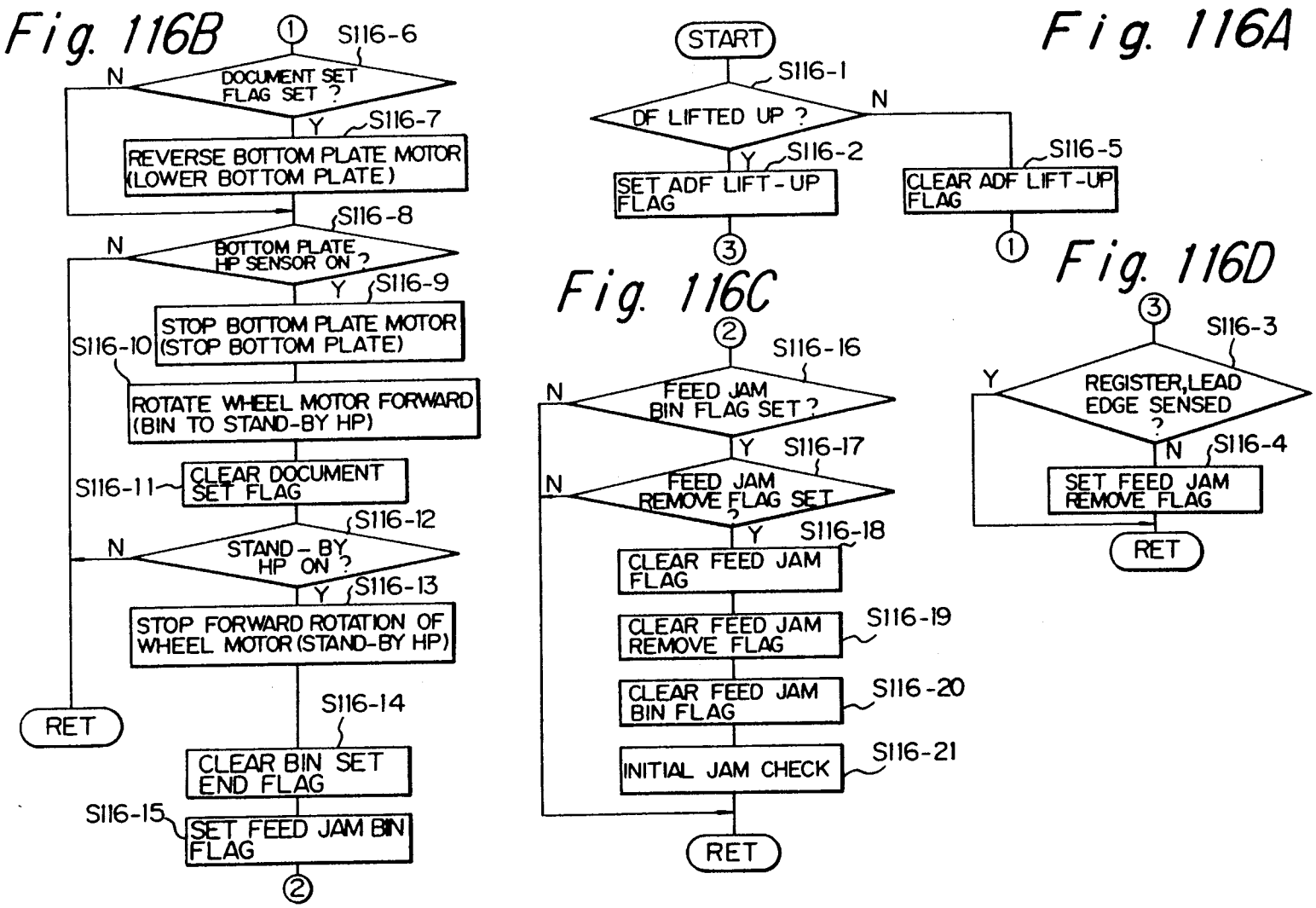
FIGS. 116A through 116D are flowcharts showing a feed jam check procedure.

Specifically, as shown in FIG. 115, the status of the feed jam flag is determined (S115-1). If this flag is set, meaning that a document 69 has jammed the multi-step unit 50, the flag is sent to the CPU 573 of the copier body (S115-2), a feed jam check subroutine which will be described with reference to FIG. 116 is executed (S115-3), and then the program returns. On the other hand, if the feed jam flag is not set, the status of a document set flag is determined (S115-4). The document set flag is ONE if the bin 201 is loaded with documents 69 or ZERO if otherwise. If the document set flag is not set, the program returns; if otherwise, data sent from the CPU 573 of the copier body is decoded (S115-5). Then, whether or not the document feed flag is set in response to a document feed flag fed from the CPU 573 is determined (S115-6). If the answer of the step S115-6 is NO, the program returns; if otherwise, the status of a two-sided document flag is determined (S115-6) is determined. If the two-sided document flag is set, meaning that the documents are two-sided documents, a two-sided document feed subroutine is executed (S115-8). If this flag is not set, meaning that the documents are one-sided documents, a one-sided document feed subroutine is executed (S115-9). After the two-sided or one-sided document feed subroutine, the status of the feed jam flag is determined (S115-10). If the feed jam flag is not set, a copy start flag is set (S115-11), the copy start flag and document size data are sent to the CPU 573 of the copier body (S115-12), and then the program returns. If the feed jam flag is set as determined in the step S115-10, the steps S115-2 and 115-3 are executed, and then the program returns.

9.5 Feed Jam Check

FIG. 116 shows a specific procedure for causing the bins 201 to retract in the event of a jam which may occur during feed-in of the documents 69 in order to facilitate the removal of the jamming document.

As shown in FIG. 116, whether or not the document transport unit 51 has been lifted up is determined (S116-1). If the answer of the step S116-1 is YES, an ADF lift-up flag is set (S116-2), and then whether or not a document 69 is located at the register sensor 245 and leading edge sensor 243 is determined (S116-3). If the answer of the step S116-3 is YES, the program returns; if otherwise, a feed jam remove flag is set (S116-4), and then the program returns. If the answer of the step S116-1 is NO, the ADF lift-up flag is cleared (S116-5), and then the status of the document set flag is determined (S116-6). If the document set flag is set, the bottom plate motor 241 is reversed to lower the bottom plate (S116-7). If the document set flag is not set, the status of the bottom plate home position sensor 251 is determined (S116-8). If the sensor 251 is in an ON state, the motor 241 and, therefore, the bottom plate 211 is stopped (S116-9), and the wheel motor 231 is rotated forward (S116-10). As a result, the bins 201 is lowered to the stand-by home position. Subsequently, the document set flag is cleared (S116-11). As soon as the sensor 253 turns from OFF to ON, the forward rotation of the wheel motor 231 is stopped to stop the bins 201 at the stand-by home position (S116-12).

Thereafter, the bin set end flag is cleared (S116-14), and then a feed jam bin flag is set (S116-15). The feed jam bin flag is normally ZERO and changes to ONE when the movement of the bins 201 effected in the event of a jam to facilitate the removal of a jamming document is completed. After the feed jam bin flag has been set in the step S116-15, whether or not the feed jam bin flag is set is determined (S116-16). If the answer of the step S116-16 is YES, the status of the feed jam remove flag is determined (S116-17). If the answer of the step S116-17 is YES, the feed jam flag, feed jam remove flag and feed jam bin flag are sequentially cleared in this order (S116-18, S116-19 and S116-20), the initial jam check is executed (S116-21), and then the program returns.

9.6 Feed-Out

A document 69 undergone a copying operation is driven out to one of the discharge tray 285, document stack tray 382, proof tray 59, and bins 57. Processing associated with this part of the operation includes (1) document discharge I, (2) document discharge II, (3) initialization, and (4) motor drive. Flowcharts shown in FIGS. 117 and 118 each selects the destination (discharging method) of documents 69 in response to code data sent from the copier body. Document discharge I selects one of four different discharging methods shown in FIGS. 129A to 129D, while document discharge II selects one of three different positions shown in FIG. 22.

Figure 117:
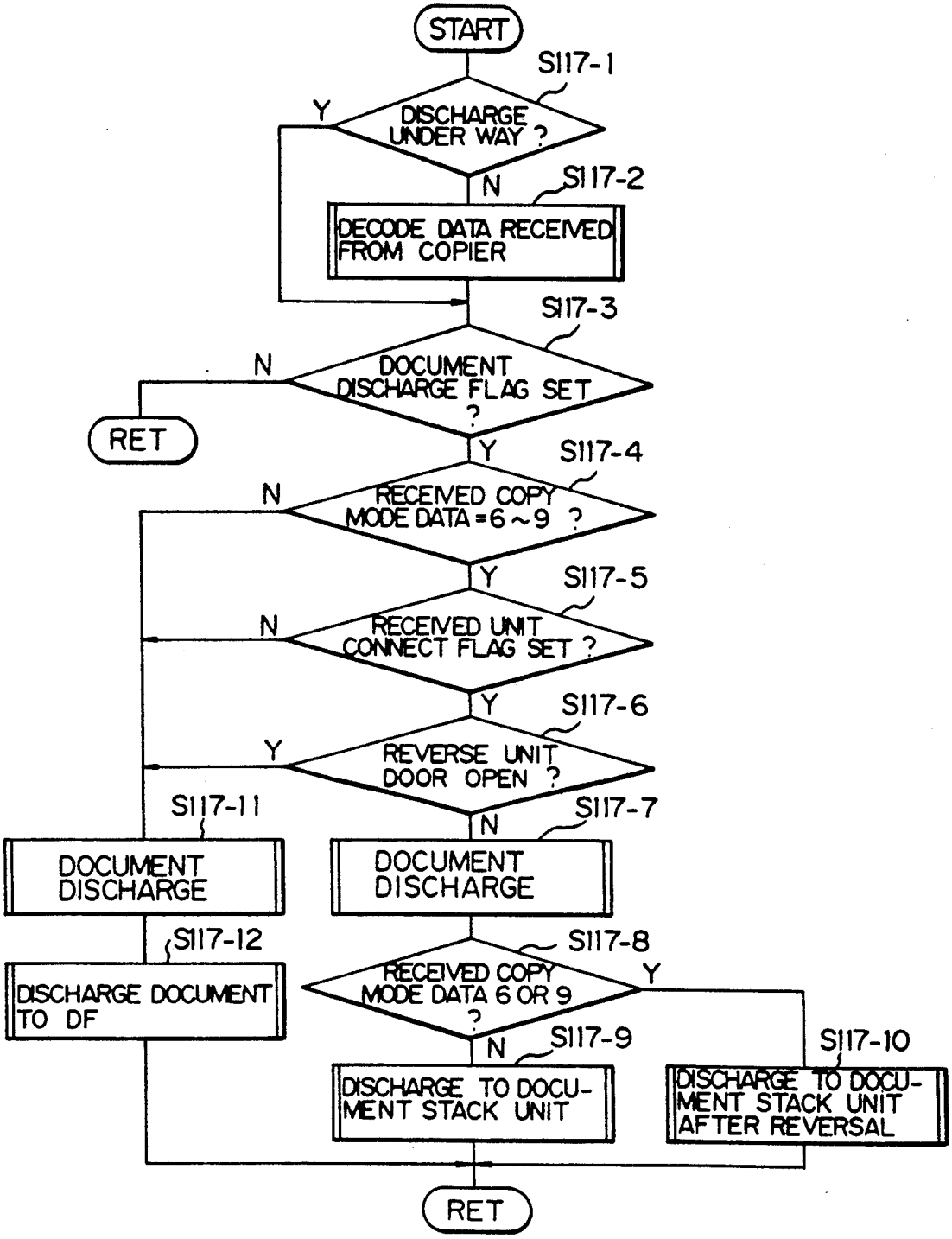
FIG. 117 is a flowchart showing a document discharge I procedure.

(1) Document discharge I: As shown in FIG. 117, whether or not a document 69 is being discharged is determined (S117-1). If the answer of the step S117-1 is NO, data sent from the CPU 573 of the copier body is decoded (S117-2); if it is YES, whether or not a document discharge flag is set is determined (S117-3). If the document discharge flag is not set, the program returns; if it is set, whether or not the received copy mode data lies in the range of 6 to 9 is determined (S117-4). The received data dealt with in the step S117-4 is used to determine whether or not the discharge mode is meant for the document stack tray 382. If the answer of the step S117-4 is YES, whether or not the document reverse unit connect flag is set is determined (S117-5). If this flag is set, i.e., if the document reverse unit 52 is connected, whether or not the door of the unit 52 is open is determined (S117-6). If the door is closed, a document discharge subroutine is executed (S117-7). Then, whether or not the received copy mode data is 6 or 9 is determined (S117-8). If the copy mode data is neither 6 nor 9, a subroutine for discharging the documents 69 to the document stack tray 382 is executed (S117-9). If the copy mode data is 6 or 9, a subroutine for discharging the documents 69 to the document stack ray 382 after turning them over is executed (S117-10).

If the received copy mode data does not lie in the range of 6 to 9 as determined in the step S117-4, if the document reverse unit connect flag is not set as determined in the step S117-5, and if the door of the document reverse unit 52 is open, a document discharge subroutine shown in a step S117-11 is executed, the documents are driven out to the discharge tray 285 (S117-12), and then the program returns.

The subroutines shown in the steps S117-7 and S117-11 are based on the flowcharts shown in FIGS. 61 through 65. The subroutine shown in the step S117-9 is based on the flowchart of FIG. 105. The subroutine shown in the step 117-10 is based on the flowchart of FIG. 106. Further, the subroutine shown in the step S117-12 is based on the flowchart of FIG. 108.

Figure 118:
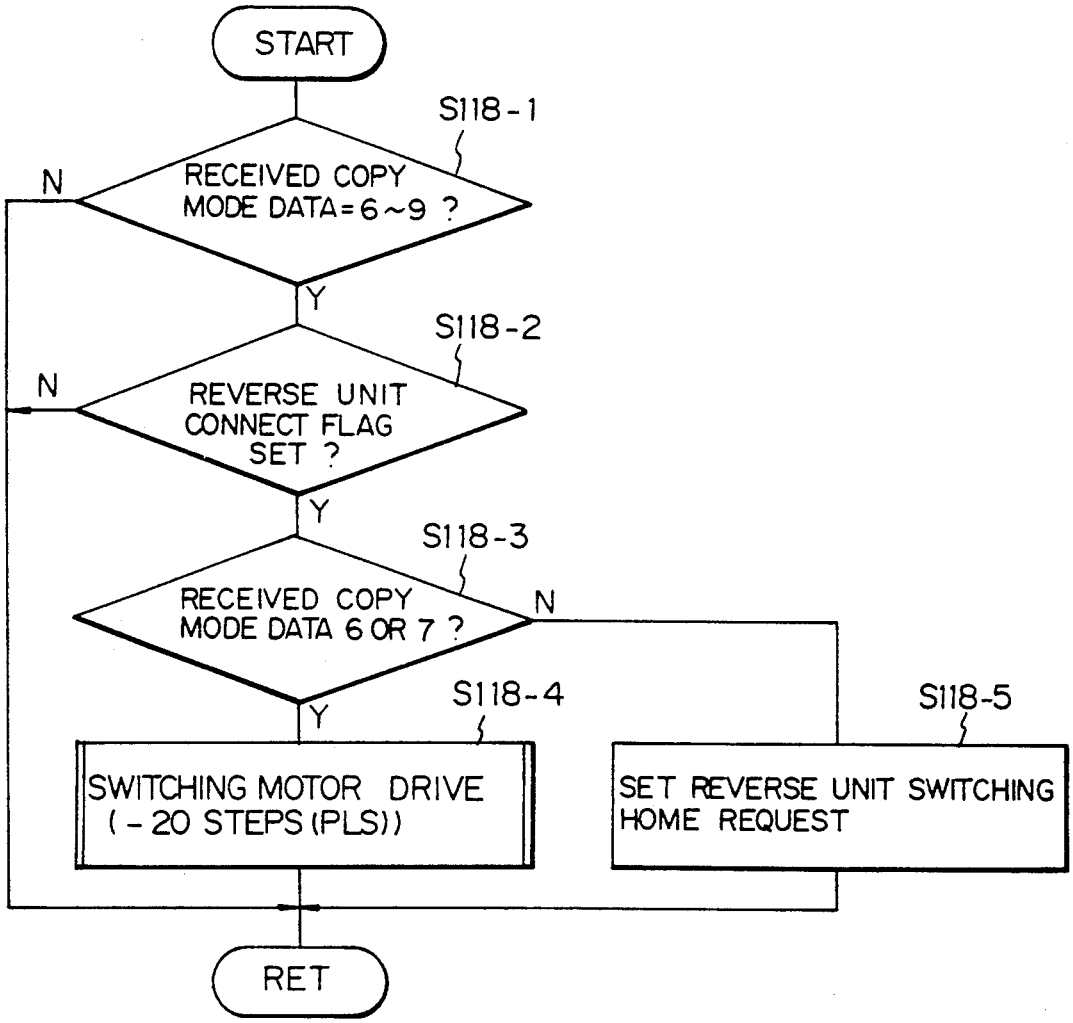
FIG. 118 is a flowchart showing a document discharge II procedure

(2) Document discharge II: As shown in FIG. 118, in this processing, whether or not received copy mode data is any one of 6 to 9 is determined (S118-1) and, if the answer is NO, the program returns. If the answer of the step S118-1 is YES, whether or not the document stack unit connect flag is set is determined (S118-2). If this flag is set, meaning that the document stack unit 52 is connected, whether or not the received copy mode data is 6 or 7 is determined (S118-3). If the answer of the step S118-3 is YES, a switching motor drive subroutine is executed (S118-4), and the program returns. In the switching motor drive subroutine, a switching motor backward flag is set, 20 is written to a step angle memory, and then the stepping motor 377 is driven by −20 steps. If the answer of the step S118-3 is NO, a reverse unit switch home request flag is set to execute processing shown in FIG. 119 (S118-5), and the program returns.

(3) Initialize: The document reverse unit 351 is switched over by a stepping motor. Specifically, the unit 351 is switched over in any one of three different patterns on the assumption that the position where the switch home position sensor turns on is the home position, as follows:

(a) no movement (FIG. 22)

(b) 20 steps backward (FIG. 23)

(c) 20 steps forward (FIG. 24)

The document transfer section 351 included in the document reverse unit 52 is reversible:

(a) forward rotation: linear speed equivalent to that of DF belt 53;

(b) reverse rotation: linear speed equivalent to sheet discharge speed of copier 1 and that of finisher 11.

The forward rotation mentioned above transports a document from the DF discharge side toward the document stack tray 382, while the reverse rotation transports it from the tray 382 side toward the finisher 11 via the reverse unit switching mechanism.

Figure 119A:
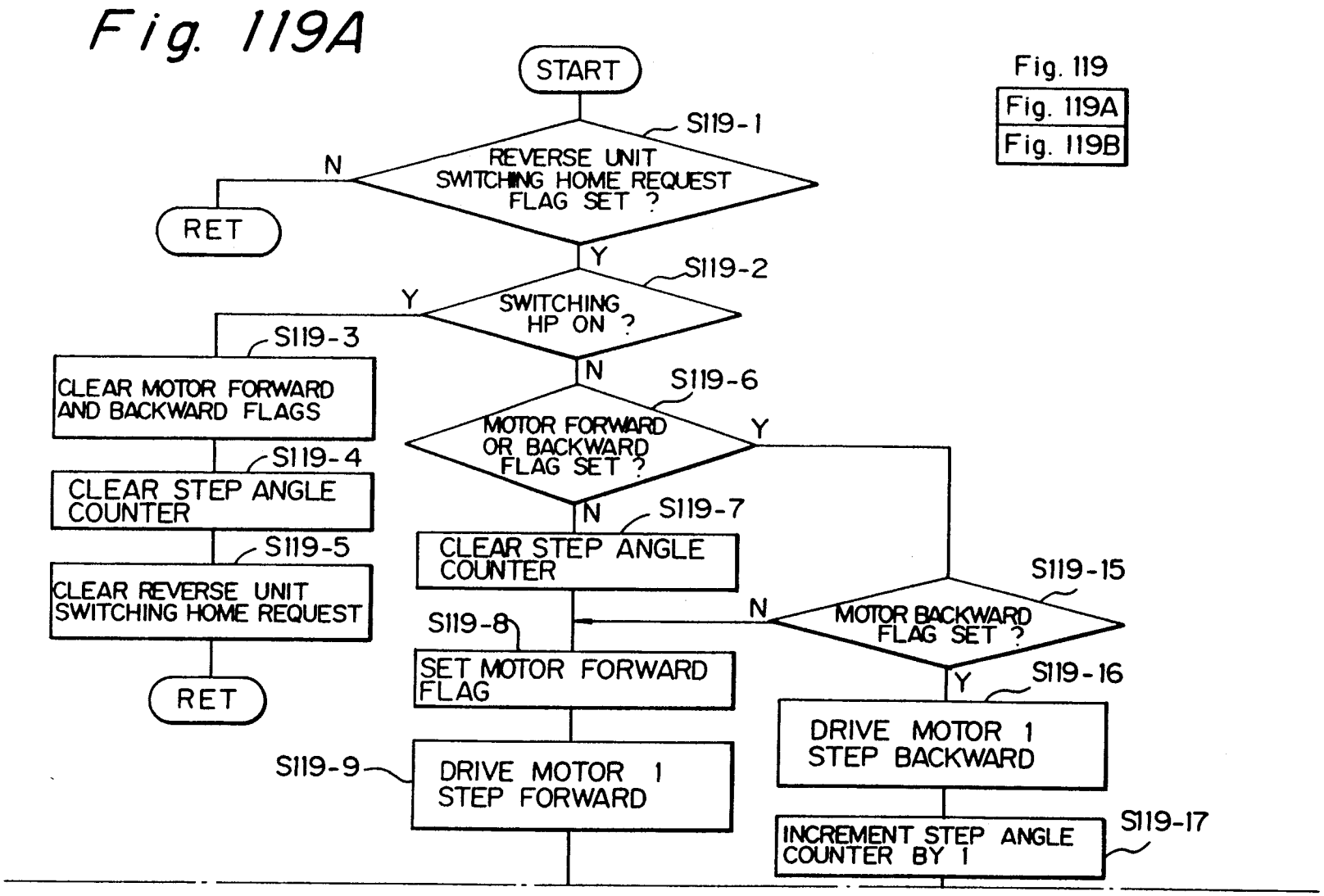
FIGS. 119A and 119B is a flowchart showing initialize processing for setting the reverse unit switching mechanism at a home position.
Figure 119B:
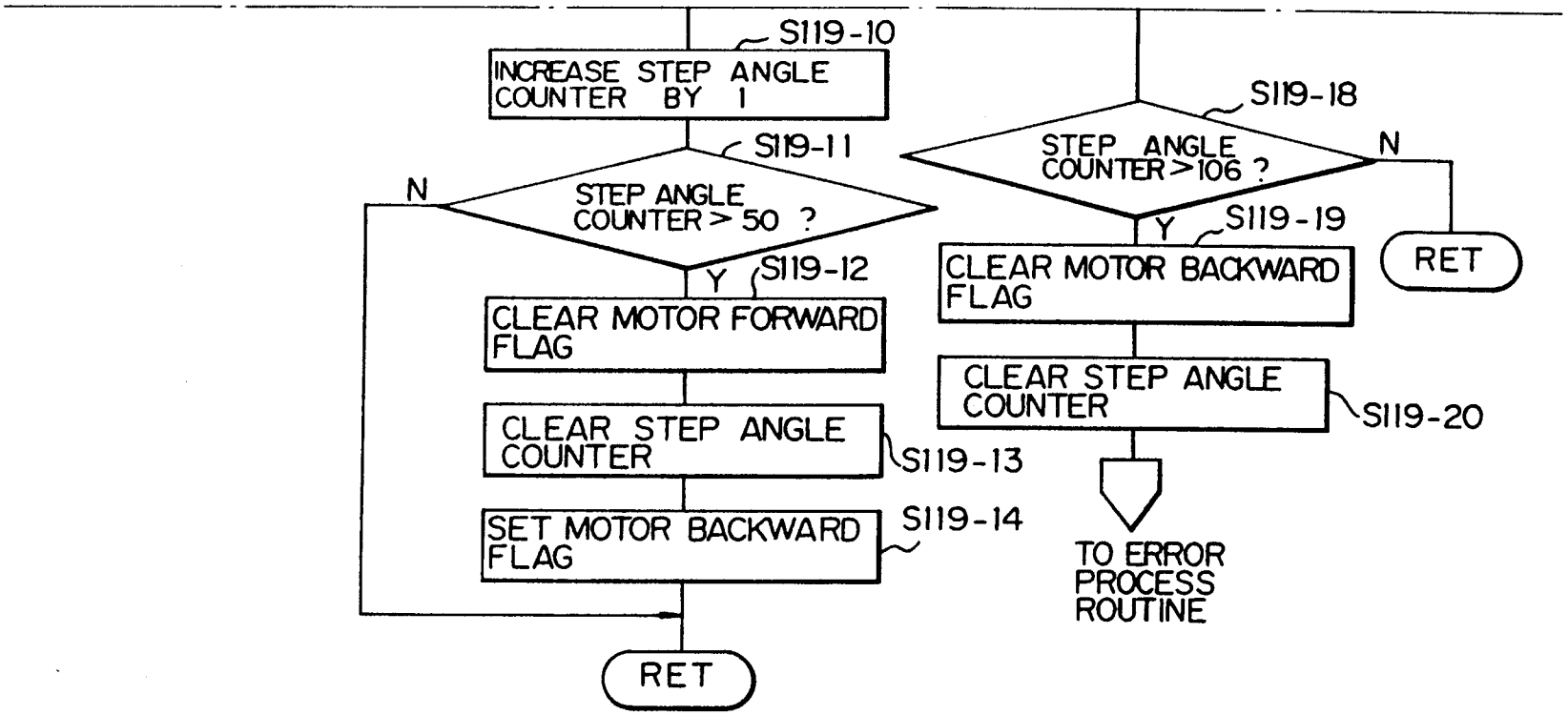

The initialization is such that the switching mechanism is brought to the home position to reduce the displacement of the document transfer section 351 to zero. Specifically, as shown in FIG. 119, whether or not the reverse unit switch home request flag is set is determined (S119-1) and, if the answer is NO, the program returns. If the answer of the step S119-1 is YES, whether or not the switch home position sensor 378 is in an ON state is determined (S119-2). If the answer of the step S119-2 is YES, the switching motor forward flag and backward flag are cleared (S119-3), the step angle counter is reset (S119-4), the reverse unit switch home request flag is cleared (S119-5), and then the program returns. If the answer of the step S119-2 is NO, whether or not the switching motor forward flag or backward flag is set is determined (S119-6). If neither the forward flag nor the backward flag is set, the step angle counter is reset (S119-7), the forward flag is set (S119-8), and the switching motor (stepping motor) is driven 1 step forward (S119-9). Thereafter, the step angle counter is incremented by 1 (S119-10). When the resulting count of the step angle counter is greater than 50 (S119-11), forward flag is cleared (S119-12), the step angle counter is reset (S119-13), the backward flag is set (S119-14), and then the program returns.

If either one of the forward flag and backward flag is set as determined in the step S119-6, the status of the backward flag is determined (S119-15). If the backward flag is not set, the step S119-8 and successive steps are executed; if it is set, the stepping motor 377 is driven one step backward (reverse) (S119-16). Then, the step angle counter is incremented by 1 (S119-17). As the step angle counter exceeds 106 (S119-18), the backward flag is cleared (S119-19), the step angle counter is reset (S119-20), and then the operation is transferred to an error process routine.

Figure 120:
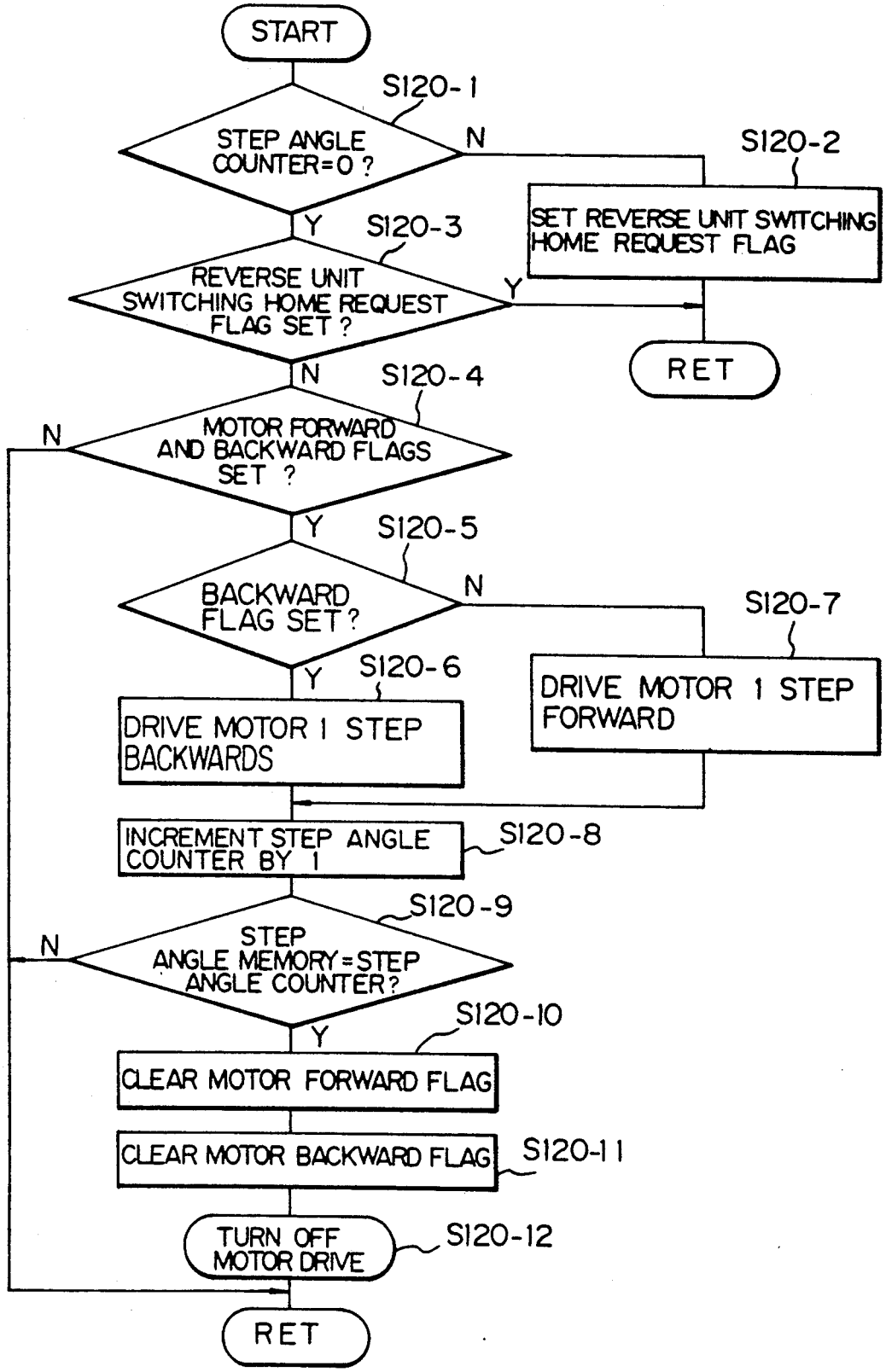
FIG. 120 is a flowchart showing a switching motor drive procedure.

(4) Switching motor drive: FIG. 120 shows a procedure for driving the switching motor, i.e., stepping motor 377 of the document reverse unit 351. As shown, whether or not the step angle counter is reset is determined (S120-1) and, if the answer is NO, the reverse unit switch home request flag is set (S120-2), and the program returns. If the answer of the step S120-1 is YES, whether or not the reverse unit switch home request flag is set is determined (S120-3). If this flag is set, the program returns; if otherwise, the switching motor forward flag and backward flag are set is determined (S120-4). If these flags are set, whether or not the backward flag is set is determined again (S120-5). If the answer of the step S120-5 is YES, the stepping motor 377 is driven one step backward (S120-6); if otherwise, the motor 377 is driven one step forward (S120-7), and then the step angle counter is incremented by 1 (S120-8). Subsequently, whether or not the step angle memory and the step angle counter compare equal is determined (S120-9) and, if they compare equal, the forward flag and backward flag are cleared (S120-10 and S120-11), the stepping motor 377 is turned of (S120-12), and then the program returns. If both of the forward and backward flags are not set as determined in the step S120-4 or if the step angle memory and the step angle counter do not compare equal as determined in the sep S120-9, the program returns.

9.7 Document Stack Section

Figures 1, 121, 121A, 121B:
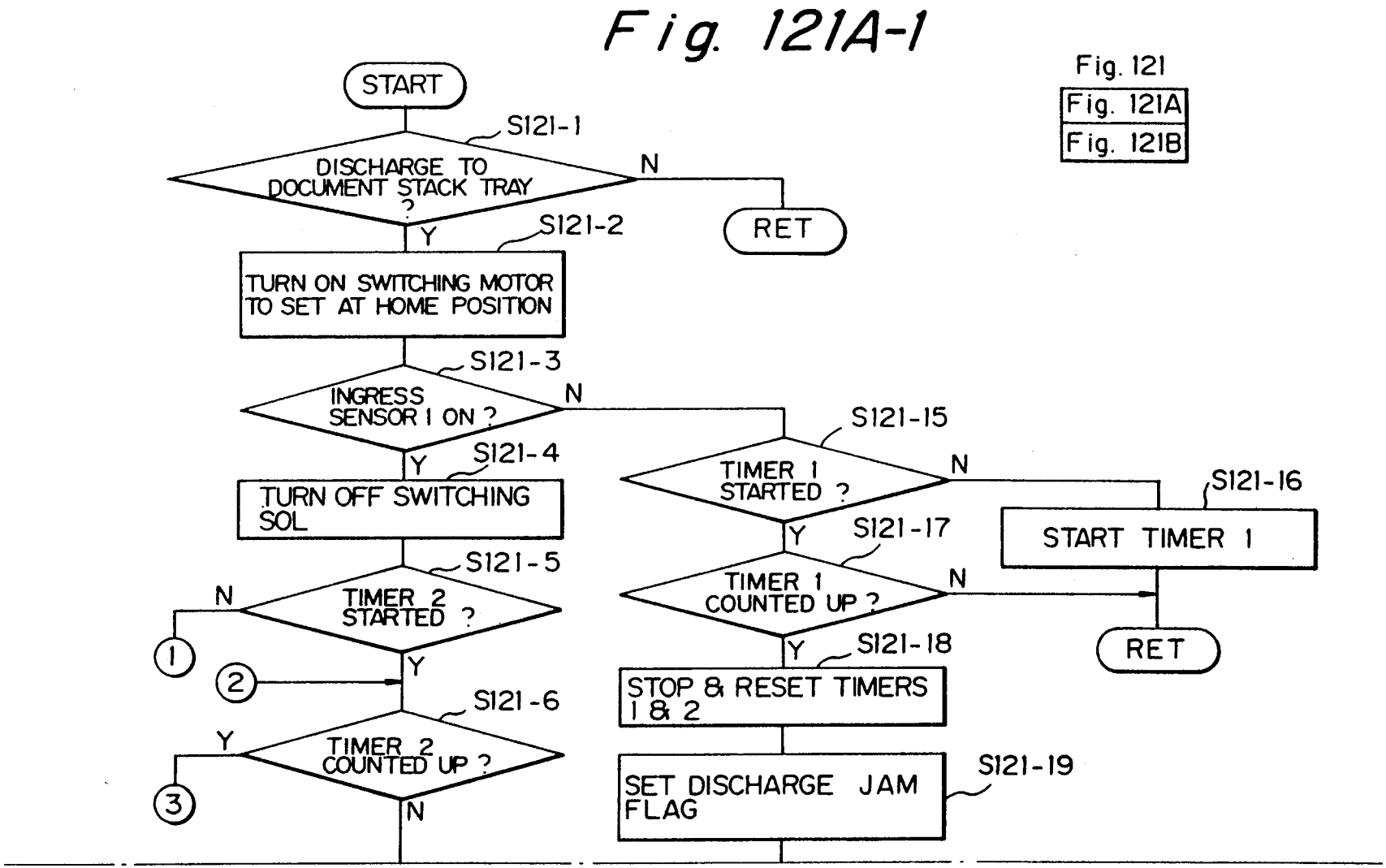
FIGS. 121A–C and 122A–C are flowcharts each showing a specific procedure associated with a document stack section.
Figures 2, 121A, 121B, 121C:
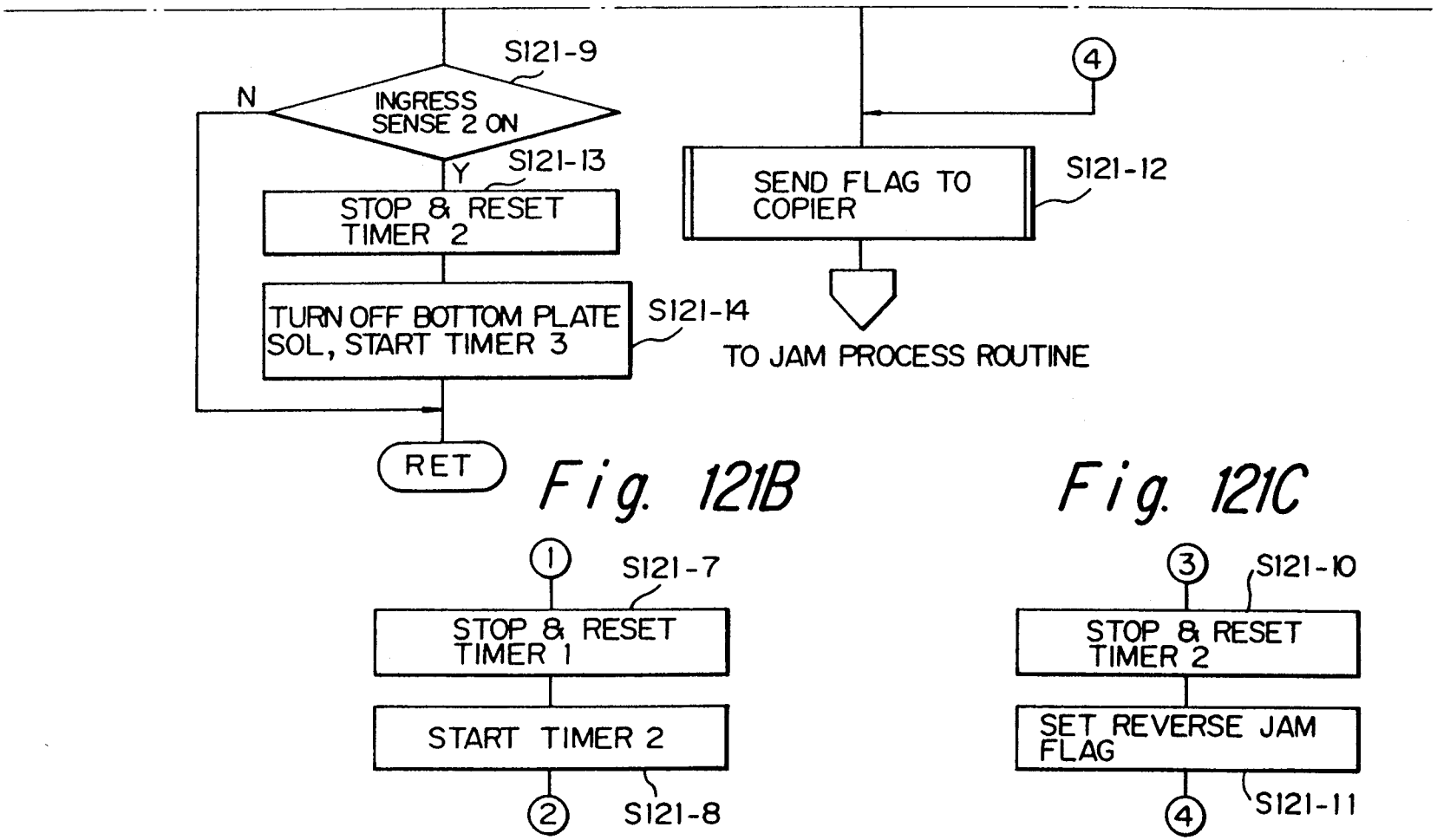
Figures 1, 122A, 122B:
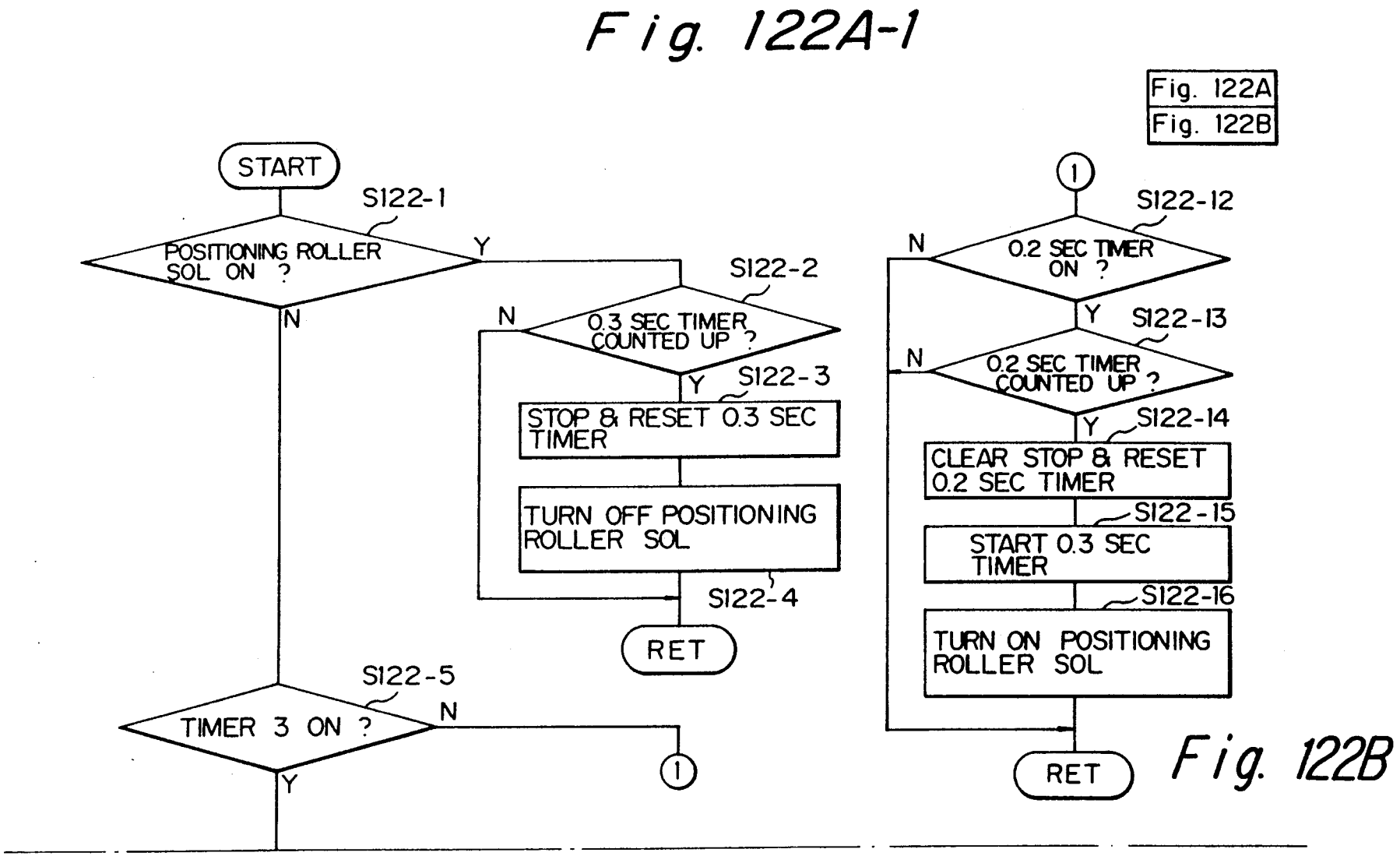
Figures 2, 122A, 122C:
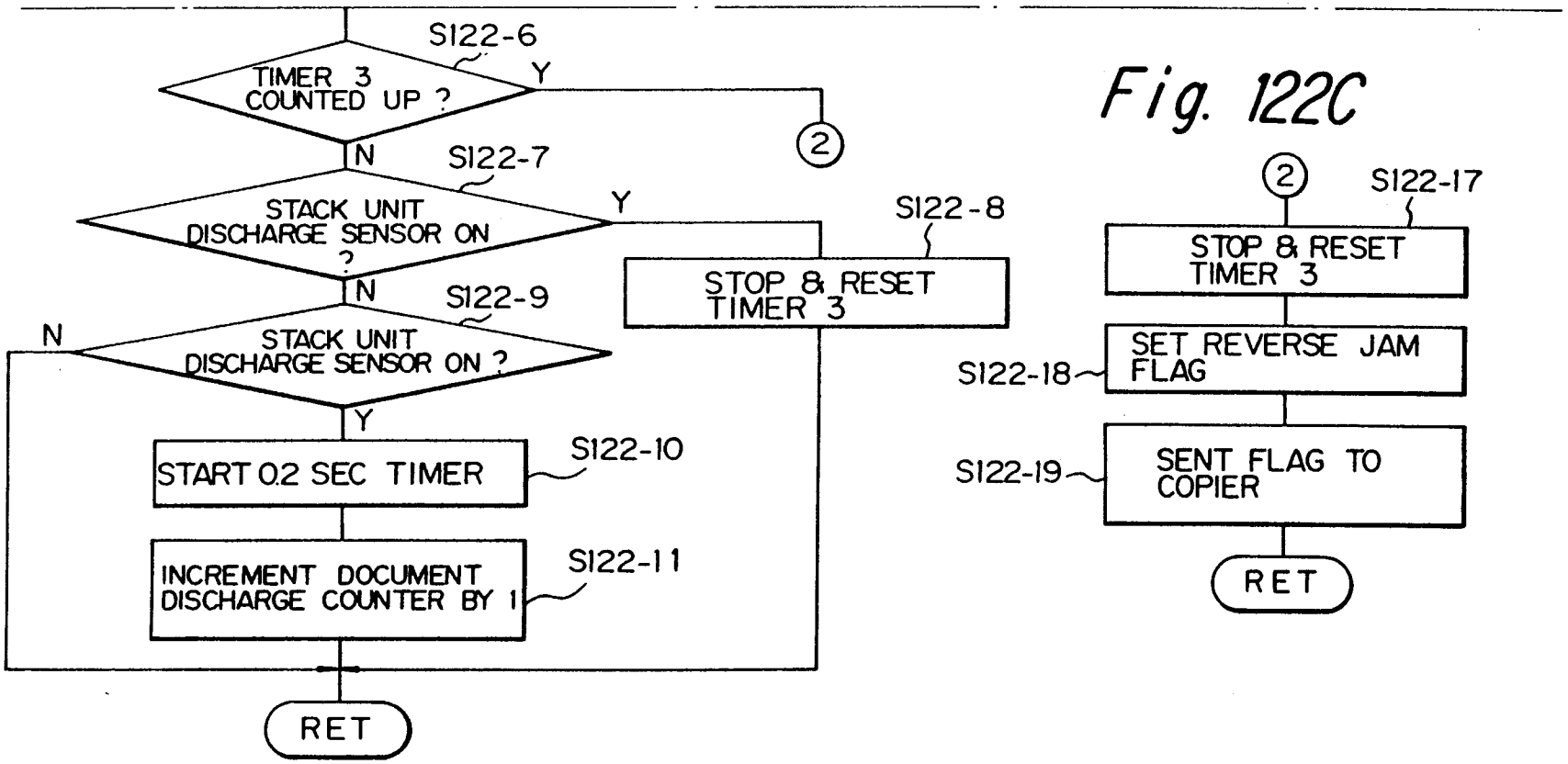

Processing associated with the document stack section transports the documents 69 to the document stack tray 382 and causes the positioning roller 381 to position the documents 69 on the document stack tray 382, as shown in FIGS. 121 and 122. As shown in FIG. 121, this processing begins with a step S121-1 of determining whether or not a document 69 has been driven out onto the document stack tray 382. If the answer of the step S121-1 is YES, the stepping motor 377 is energized to set the switching member 365 at the home position (S121-2), as shown in FIG. 22. Subsequently, the state of the first ingress sensor 370 is determined (S121-3). If the sensor 370 is in an ON state, meaning that the document 69 has been transported from the glass platen 17 to the sensor 370, the switching solenoid 380 is deenergized (S121-4). Then, if this sensor 370 and the timer 2 which is a jam check timer associated with the second ingress sensor 368 have started (YES, S121-5), the program waits until the timer 2 counts up (S121-6). If the timer 2 has not started, the timer 1 which is a jam check timer responsive to a jam between the DF discharge sensors 321 and 322 and the sensor 370 is cleared (S121-7), the timer 2 is started (S121-8), and then the program waits until the timer 2 counts up (S121-6). As the timer 2 counts up, it is stopped and cleared (S121-10), the document reverse jam flag is step (S121-11), this flag is sent to the CPU 573 of the copier body (S121-12), and then the operation is transferred to a jam process routine. If the timer 2 has not counted up, the state of the second ingress sensor 368 is determined (S121-9). If the sensor 368 is in an OFF state, the program returns; if otherwise, the timer 2 is stopped and cleared (S121-13). Subsequently, the pick-up solenoid 386 is deenergized, the timer 3 which is also a jam check timer is started (S121-14), and then the program returns.

On the other hand, if the first ingress sensor 370 is in an OFF state as determined in the step S121-3, whether or not the timer 1 has started is determined (S121-15). If the answer of the step S121-15 is NO, it is started (S121-16), and then the program returns. If the answer of the step S121-15 is YES, the program waits until the timer 1 counts up (S121-17), the timers 1 and 2 are stopped and cleared on the count-up of the timer 1 (S121-18), the document discharge flag is set (S121-19), this flag is sent to the CPU 573 of the copier body (S121-12), and then the operation is transferred to the jam process routine.

If the answer of the step S121-3 is NO, meaning that the first ingress sensor 370 is in an OFF state, whether or not the timer 1 has started is determined (S121-15). If the answer o the step S121-15 is NO, it is started (S121-16), and the program returns; if otherwise, the program waits until the timer 1 counts up (S121-17). Thereafter, as soon as the timer 1 counts up, the timers 1 and 2 are stopped and cleared (S121-18), the document discharge jam flag is set (S121-19), this flag is sent to the CPU 573 of the copier body (S121-12), and then the operation is transferred to the jam process routine.

Further, in the processing shown in FIG. 122, the condition of the drive solenoid 383 is determined (S122-1). If it has been energized, whether or not a 0.3 second timer for counting the time in which the document 69 is expected to be positioned (FIG. 135) has counted up is determined (S122-2). If the answer of the step S122-2 is YES, the 0.3 second timer is stopped and cleared (S122-3), the drive solenoid 383 is deenergized (S122-4), and then the program returns.

Figure 135:
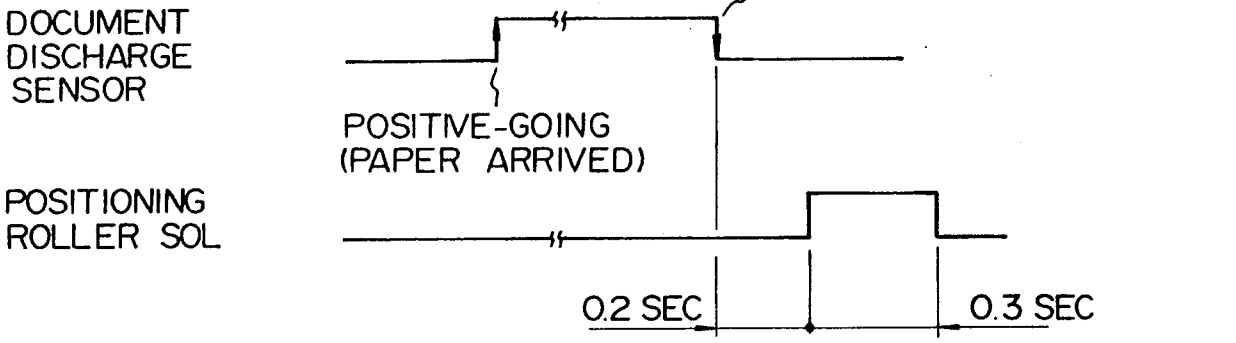
FIG. 135 is a timing chart showing the output of a document discharge sensor an the operation timing of a positioning roller.

If the drive solenoid 383 has been deenergized, the state of the timer 3 is determined (S122-5) and, if it is in an ON state, whether it has counted up is determined (S122-6). If the answer of the step S122-6 is NO, whether or not the output of the document discharge sensor 379 of the document stack unit has risen as shown in FIG. 135 is determined (S122-7). If the answer of the step S122-7 is YES, the timer 3 is stopped and cleared (S122-8), and then the program returns; if otherwise, whether or not the output of the document discharge sensor 379 of the stack tray section 677 has fallen is determined (S122-9). If the answer of the step 122-9 is NO, the program returns. If the answer of this step is YES, a 0.2 second timer which is a delay timer responsive to the drop of the document 69 onto the stack tray 382 (FIG. 135) is started (S122-10), a discharged document counter is incremented by 1 (S122-11), and then the program returns.

If the answer of the step S122-6 is YES, the timer 3 is stopped and cleared (S122-17), a document reverse jam flag is set (S122-18), this flag is sent to the CPU 573 of the copier body (S122-19), and then the program returns. If the answer of the sep S122-5 is NO, the program waits until the 0.2 second timer counts up (S122-13). As soon as this timer counts up, it is stopped and cleared (S122-14), then the 0.3 second timer is started (S122-15). Then, the drive solenoid 383 is energized, and the program returns. Of course, the positioning roller 381 may be driven by the solenoid 383 such that it acts on a single document a plurality of times.

9.8 Refeed

Figure 123A:
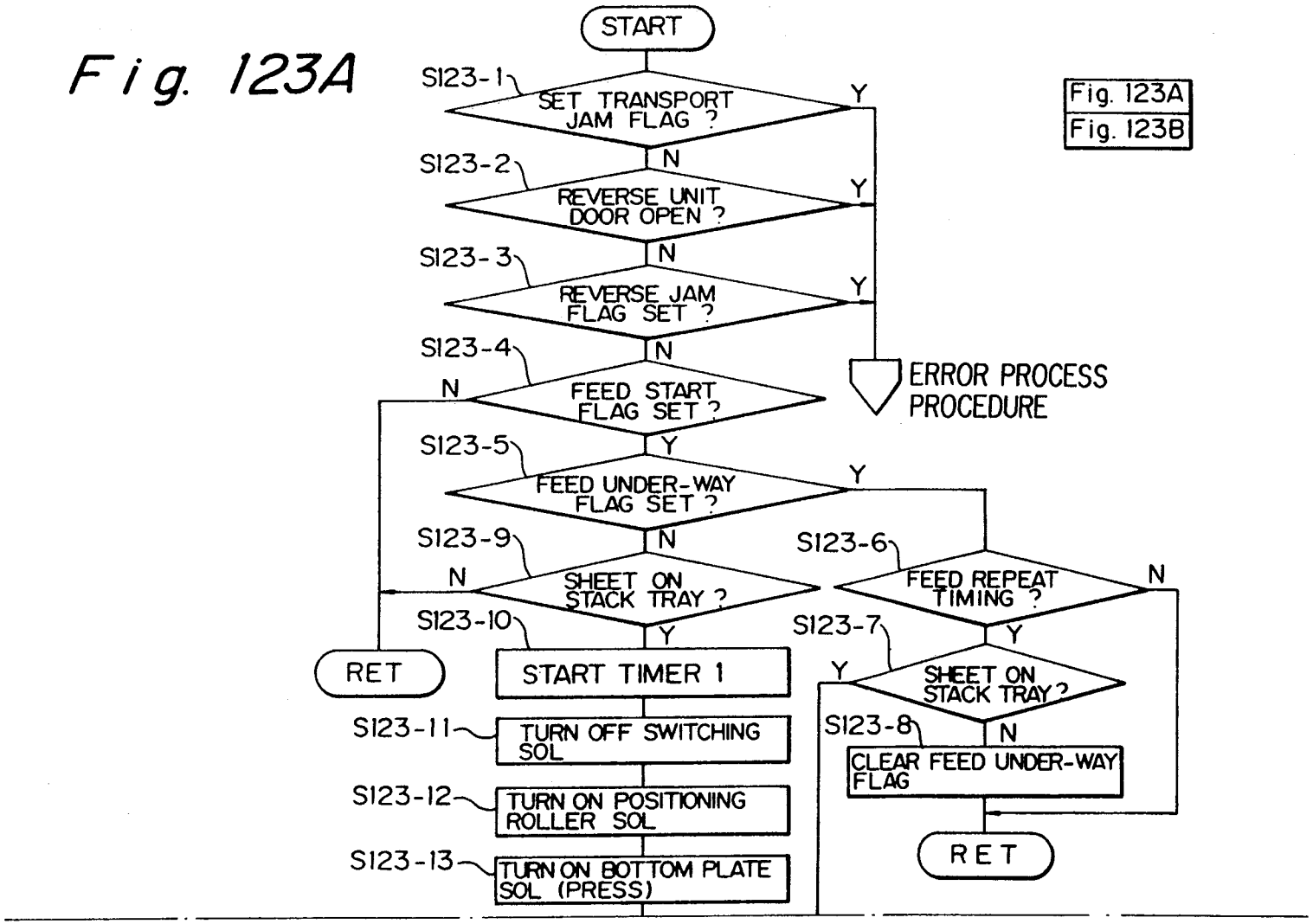
FIGS. 123A and 123B is a flowchart showing a paper refeed procedure.
Figure 123B:
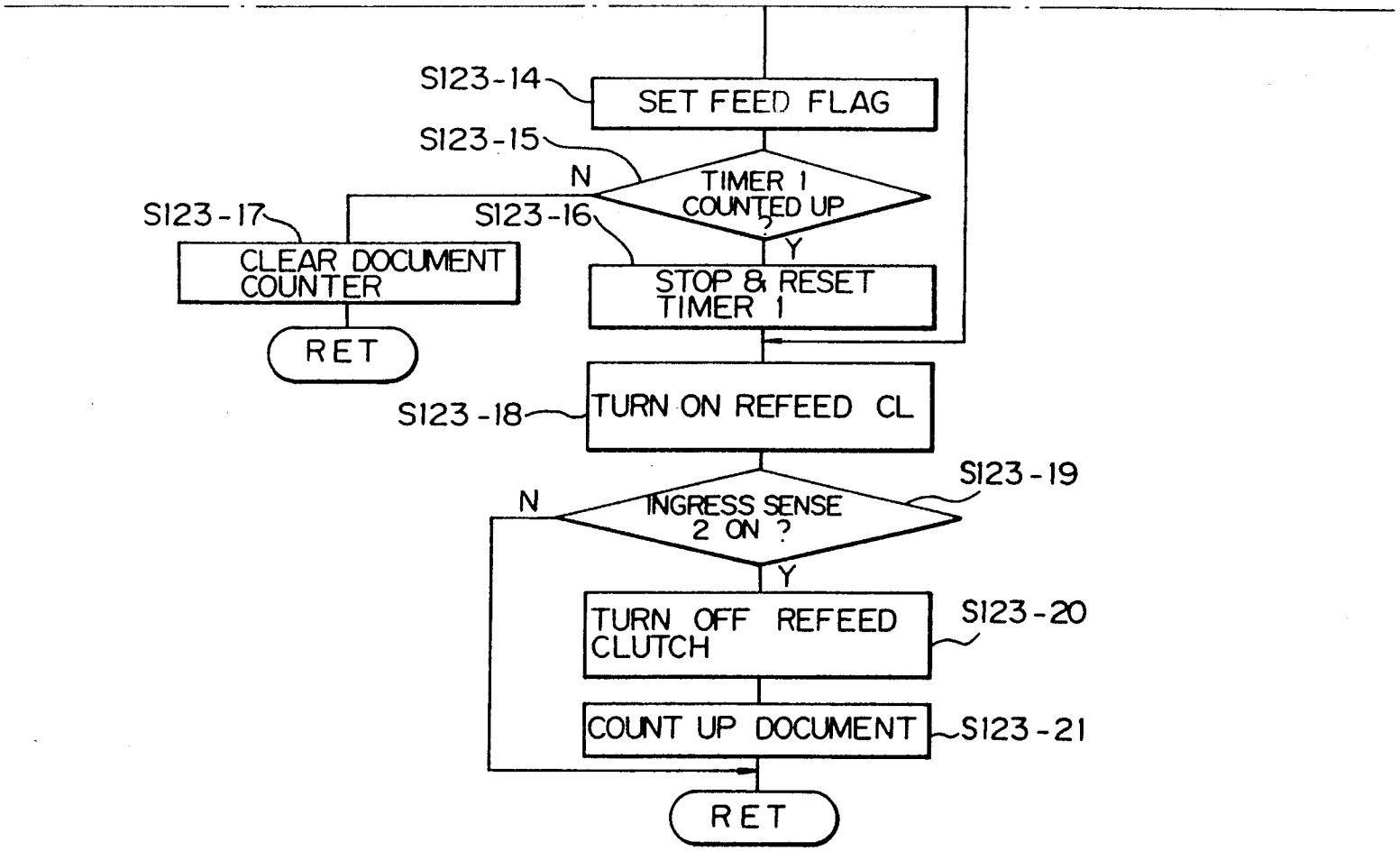

This processing steers the documents 69 to the finisher 11. The documents 69 reached the finisher 11 will be dealt with in the same manner as the paper sheets 37. Specifically, as shown in FIG. 123, the status of a transport jam flag is determined to see if a document 69 has jammed (S123-1). If the transport jam flag is set, the operation is transferred to an error process routine; if otherwise, whether or not the door of the document reverse unit 52 is open is determined (S123-2). If the answer of the step S123-2 is YES, the operation is transferred to the error process routine; if otherwise, whether or not the document reverse jam flag is set is determined (S123-3). If the answer of the step S123-3 is YES, the operation is transferred to the error process routine; if otherwise, the status of a document feed start flag is determined (S123-4). If the answer of the step S123-4 is NO, meaning that the feed of a document 69 has not started, the program returns. If the answer of this step S123-4 is YES, the status of feed under-way flag is determined (S123-5). If the the feed under-way flag is set, meaning that a document 69 is being fed, whether or not the time for repeating the feed has reached is determined (S123-6). If the answer of the step S123-6 is YES, whether or not a document 69 exists on the document stack tray 382 is determined (S123-7). If the answer of the step S123-7 is NO, the feed under-way flag is cleared, and then the program returns. If the answer of the step S123-7 is YES, a refeed clutch located coaxially with and at the rear of the separation roller 390, FIG. 21, is coupled (S123-18), and then the state of the second ingress sensor 368 is determined (S123-19). If the sensor 368 is in an ON state, the refeed clutch is uncoupled (S123-20), the count of documents is incremented by 1 (S123-21), and then the program returns.

On the other hand, if the document under-way flag is not set as determined in the step S123-5, whether or not a document 69 is present in the stack tray 382 is determined (S123-9). If no documents are present on the stack tray 382, the program returns; if otherwise, the timer 1 is started (S123-10). Thereafter, the switching solenoid is deenergized (S123-11), the positioning roller drive solenoid 383 is energized (S123-12), the pick-up solenoid 386 is energized (S123-13), the feed under-way flag is cleared (S123-14), and the timer 1 is stopped and cleared if it has counted up (S123-16), or the document number counter is cleared and the program returns if the timer 1 has not counted up (S123-17). After the step S123-16, the refeed clutch is coupled (S123-18), and the state of the second ingress sensor 368 is determined (S123-19). If the sensor 368 is in an ON state, the refeed clutch is uncoupled (S123-20), the count of documents is incremented by 1, and then the program returns.

9.9 Jam Check Timing

Figure 125:
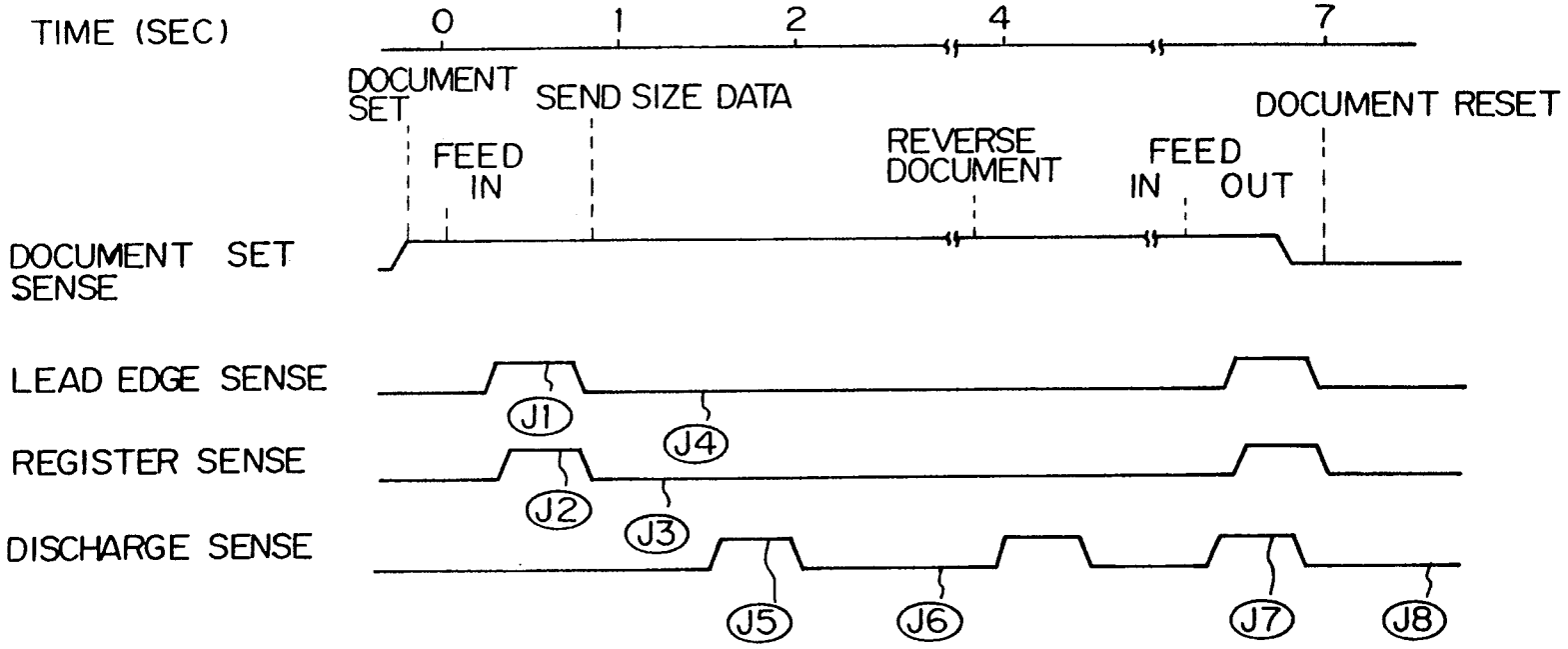
FIG. 125 is a timing chart showing a jam check procedure in a two-side mode.

FIGS. 124 and 125 indicate jam check timings in a one-sided copy mode and a two-sided copy mode, respectively. In FIG. 124, a timing J1 is indicative of jam checking which uses the leading edge sensor 243, i.e., leading edge jam checking is effected for 475 ms after the energization of the feed motor 233. If 475 ms expires before the turn-on of the sensor 243, it is determined that a jam has occurred. A timing J2 indicates jam checking associated with the register sensor 245. Specifically, register jam checking is effected for 375 ms after the turn-on of the leading edge sensor 243. If 375 ms expires before the turn-on of the register sensor 245, it is determined that a jam has occurred. A timing J3 shows jam checking which is also associated with the register sensor 245. Specifically, register OFF checking is effected while 1,844 pulses appear after the turn-on of the register sensor 245. If the register sensor 245 does not turn off even after 1,844 pulses have appeared, it is determined that a jam has occurred. A timing J4 is indicative of jam checking using the discharge sensors 321 and 322; discharge jam checking is effected for 675 ms after the turn-on of the discharge motor 330. If 675 ms expires before the turn on of the sensors 321 and 322, it is determined that a jam has occurred. A timing J5 is also indicative of jam checking using the discharge sensors 321 and 322; discharge OFF checking is effected for 1,250 ms after the turn-on of the discharge sensors 321 and 322. If 1,250 ms expires before the turn-off of the sensors 321 and 322, it is determined that a jam has occurred.

In FIG. 125, a timing J1 is indicative of jam checking using the leading edge sensor 243. Specifically, leading edge jam checking is effected for 475 ms after the turn-on of the feed motor 233. If 475 ms expires before the turn-on of the leading edge sensor 243, it is determined that a jam has occurred. A timing J2 shows register jam checking effected by the register sensor 245 for 350 ms after the turn-off of the feed motor 233. If 350 ms expires before the turn-on of the register sensor 245, it is determined that a jam has occurred. A timing J3 shows register OFF checking effected by the register sensor 245 for 175 ms after the turn-off of the leading edge sensor 243. If 175 ms expires before the turn-off of the register sensor 245, it is determined that a jam has occurred. A timing J4 shows leading edge OFF checking effected by the leading edge sensor 243 for 1,250 ms turn-on of the register sensor 245. If 1,250 ms expires before the turn-off of the leading edge sensor 243, it is determined that a jam has occurred. A timing J5 is indicative of discharge sensor ON checking effected by the discharge sensors 321 and 322 for 1,250 ms after the turn-on of the reverse solenoid 316. If 1,250 ms expires before the turn-on of the sensors 321 and 322, it is determined that a jam has occurred. A timing J6 represents discharge sensor OFF checking effected by the discharge sensors 321 and 322 for 1,250 ms after the reversal of the transport motor 323. If 1,250 ms expires before the turn-off of the sensors 321 and 322, it is determined that a jam has occurred. A timing J7 shows discharge sensor ON checking effected by the discharge sensors 321 and 322 for 675 ms after the turn-on of the discharge motor 330. If 675 ms expires before the turn-on of the discharge sensors 321 and 322, it is determined that a jam has occurred. Further, a timing J8 shows discharge sensor OFF checking effected by the discharge sensors 321 and 322 for 1,250 ms after the turn-on of the 321 and 322. If 1,250 ms expires before the turn-on of the sensors 321 and 322, it is determined that a jam has occurred.

9.10 Document Transport Timing

Figure 126A:
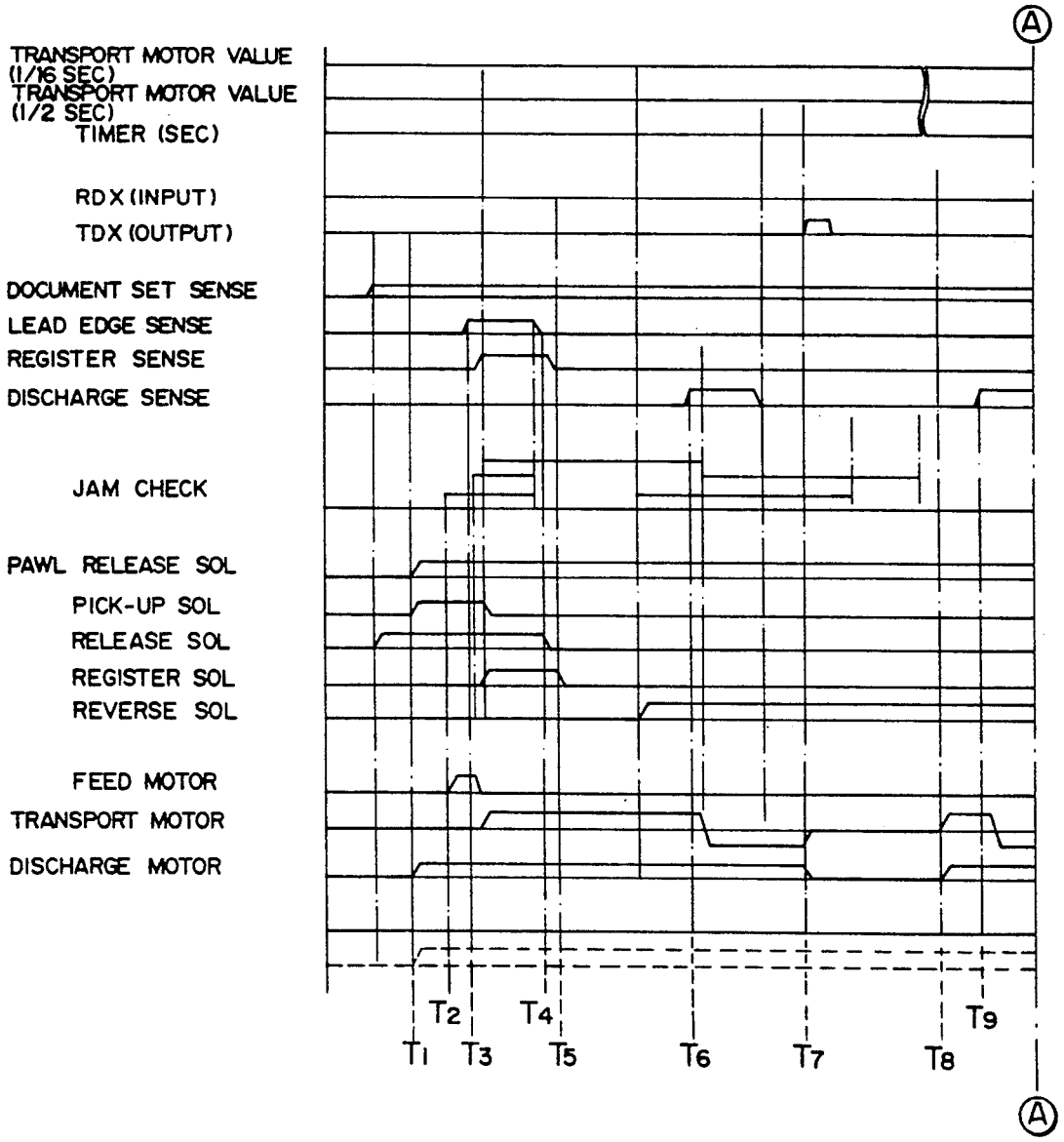
FIGS. 126A and 126B are timing charts showing a document transport operation.
Figure 126B:
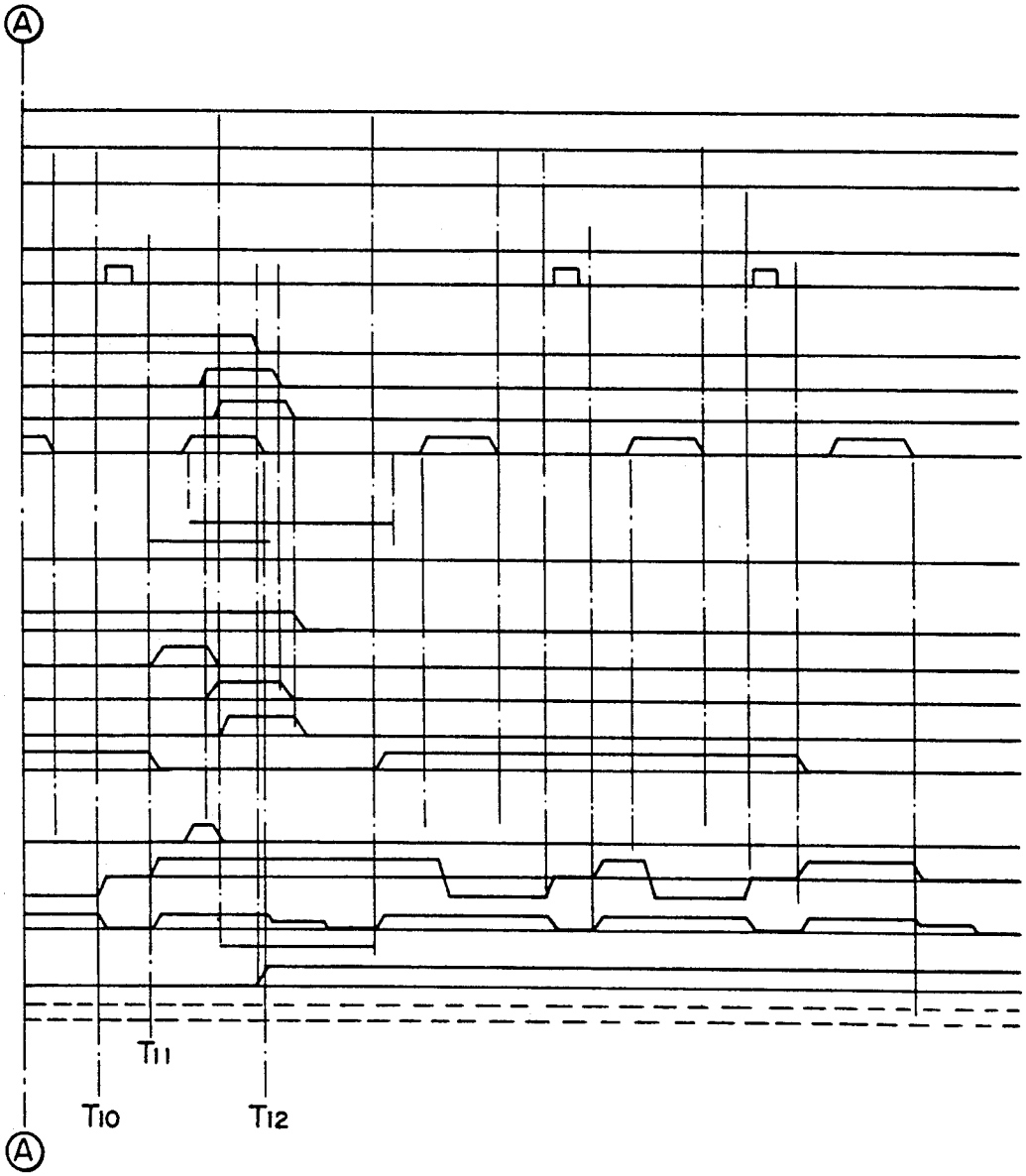

Referring to FIGS. 126A and 126B, timings for transporting a document are shown. As shown, at a time T1, the pick-up solenoid 267 and discharge motor 330 are turned on to effect the feed-in of the document 69. At a time T2 which is 200 ms later than the time T1, the feed motor 233 is turned on. At a time T3, the leading edge sensor 243 is turned on, the pick-up solenoid 267 is turned off, and then the transport motor 323 is driven forward on the lapse of 55 ms. At a time T4, the leading edge sensor 243 is turned off, and the separation roller release solenoid 285 is turned off. At a time T5, the register sensor 245 is turned off, the clutch 237 is turned off, and the interchange of size data with the CPU 573 of the copier body is effected. At at time T6, the transport motor 323 is reversed on the lapse of 75 ms after the turn-on of the discharge sensors 321 and 322. At a time T7, the transport motor 323 and discharge motor 332 are turned off in response to 532 pulses having appeared after the turn-off of the sensors 321 and 322. At the same time, a feed start signal is sent to the CPU 573 of the copier body. At a time T8, a reverse signal is received from the CPU 573 of the copier body after the completion of rear-surface copying, so that the transport motor 323 is driven forward and the discharge motor 330 is turned on. At a time T9, after the turn-on of the discharge sensors 321 and 322, the transport motor 323 is reversed on the lapse of 75 ms. At a time T10, when 532 pulses have appeared after the turn-off of the discharge sensors 321 and 322, the transport motor 323 and discharge motor 330 are turned off. At a time T11, a copy end signal is received from the CPU 573 of the copier body with the result that the transport motor 323 is driven forward and the discharge motor 330 is turned on. At a time T12, the discharge motor 330 is turned off on the lapse of 325 ms after the turn-off of the discharge sensors 321 and 322.

9.11 Flow and Timing of Document

FIGS. 127A to 127D are timing charts each demonstrating a particular flow of documents 69 and particular operation timings of the turn roller, transport belt, discharge sensors, and reverse solenoid, which are determined by the transport pattern. The patterns shown in FIGS. 127A to 127D correspond to FIGS. 129A to 129D, respectively.

First, a reference will be made to FIG. 128, which is a fragmentary view associated with FIG. 2, for describing the constructions of various sections including the above-mentioned turn-roller. As shown, the driven roller 315 is located on the finisher 11 side of the glass platen 17, i.e., at the left-hand side as viewed in the figure for driving the transport belt 53. The turn-roller 315 is located at the left of the driven roller 305. The first and second driven rollers 324 and 326 are rollably held in contact with the turn-roller 315. The first and second discharge sensors 321 and 322 are associated with the driven rollers 324 and 326, respectively, and located at the finisher 11 side. Pawls 318*a*, 318*b* and 318*c* for selecting a path are sequentially arranged along the path surrounding the turn roller 315 in the clockwise direction. The pawls 318*a* to 318*c* are driven by the reverse solenoid 316 to switch over the path for transporting the documents 69. The documents 69 are transported in any one of four different directions which will be described. The switchover of the path is effected on the basis of the turn-on and turn-off of the discharge sensors 321 and 322.

Figure 127A:
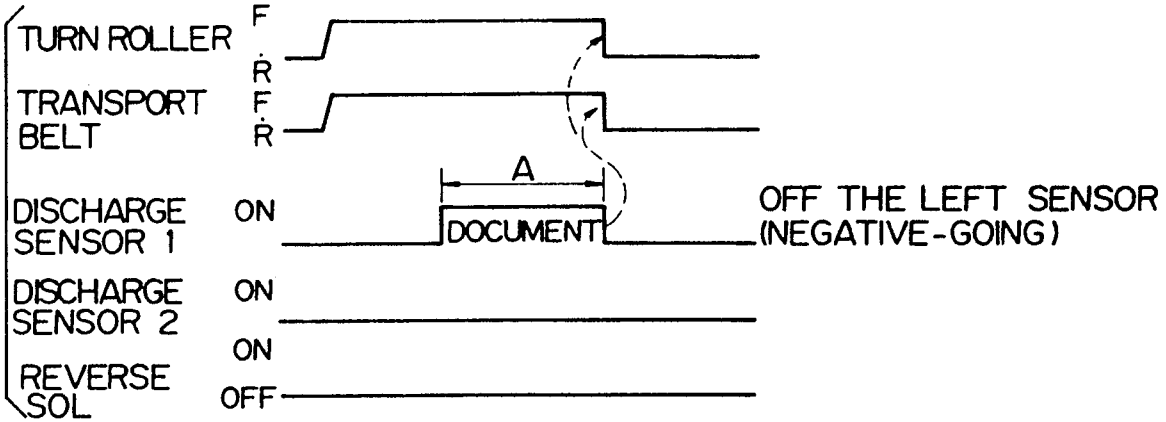
FIGS. 127A through 127D are timing charts showing the flow of a document and the operations of various sections contributing thereto.

Specifically, FIG. 127A shows timings for transporting the documents 69 to the document stack tray 382. In this case, the turn roller 315 and transport belt 53 start rotating forward (F) at the same timing as each other. The reverse solenoid 316 is deenergized to maintain the pawl 318*a* in a position indicated by a dash-and-dot line. When the discharge sensor 321 turns on by sensing the document 69 and then turns off as the document 69 moves away from the sensor 321, the turn roller 315 and transport belt 53 are brought to a stop at the same time. as a result, the document 69 is transported to the document stack tray 382 via the turn roller 315 as indicated by an arrow in FIG. 129A. The document 69 moves away from the discharge sensor 321 in a period of time A shown in FIG. 127A and which of course depends on the size of the document 69.

Figure 127B:
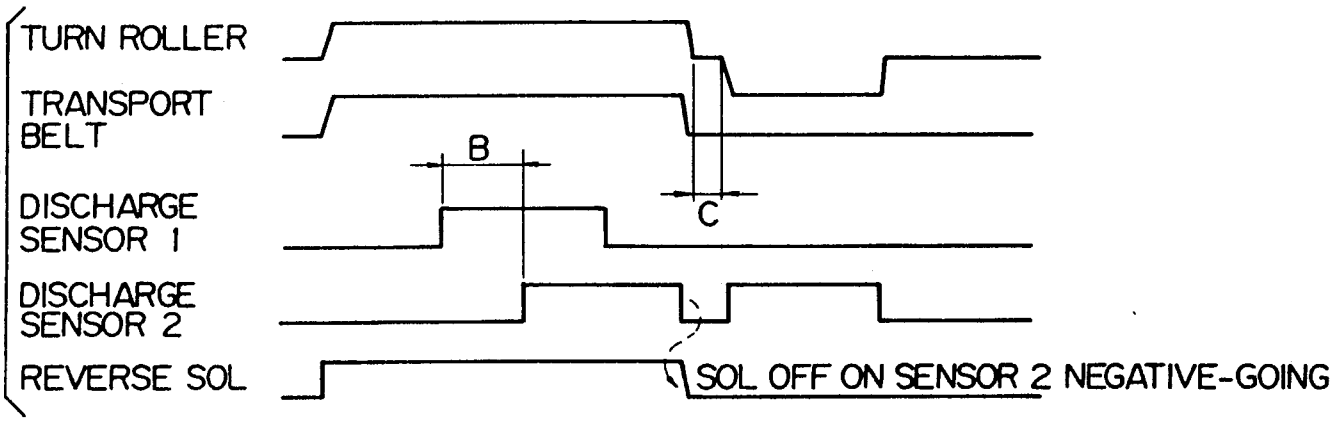

FIGS. 127B indicates timings for transporting the document 69 to the document stack tray 382 after turning it over. In this case, the turn roller 315 and transport 53 are driven forward (F) at the same timing, and the reverse solenoid 316 is energized at the same time. As a result, the pawls 318*a* to 318*c* are brought to positions indicated by solid lines. As the document 69 is transported, the discharge sensor 321 turns on, then the discharge sensor 322 turns on on the lapse of a time B, then the sensor 321 turns off, and then the sensor 322 turns off. At this time, the trailing edge of the document 69 has moved away from the discharge sensor 322. Therefore, the turn roller 315, belt 53 and reverse solenoid 316 are turned off. This moves the pawls 318*a* to 318*c* to the dash-and-dot line positions. On the lapse of a time C selected in consideration of the delay of the relay solenoid 316, the turn roller 315 is reversed (R) with the result that the document 69 is driven out onto the document stack tray 382 in a reversed position, travelling over the pawl 318*b*. Such a flow of the document 69 is indicated by an arrow in FIG. 129B. It is to be noted that a time B is representative of a difference in timing ascribable to the difference in position between the discharge sensors 321 and 322 on the transport path.

Figure 127C:
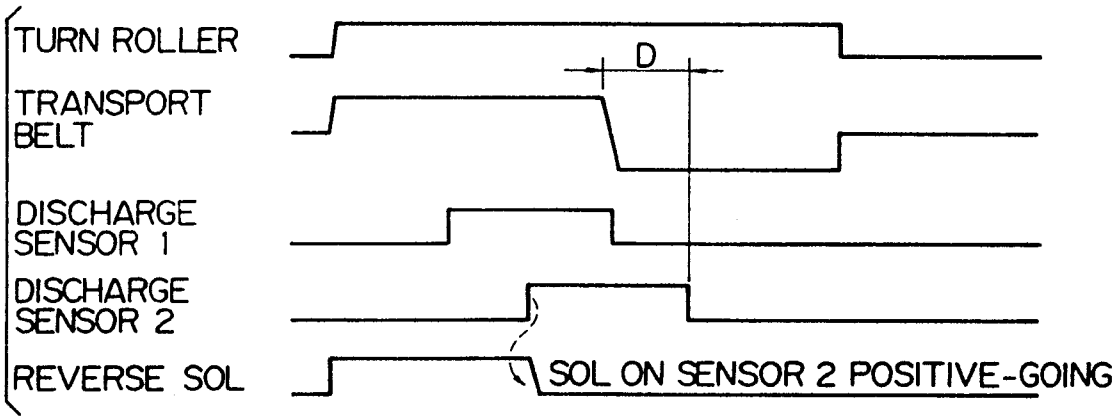

FIG. 127C shows timings for transporting the document 69 to the glass platen 17 after turning it over. As shown, the turn roller 315 and transport belt 53 begin rotating forward (F) at the same timing, and the reverse solenoid 316 is energized at the same time. As a result, the pawls 318*a* to 318*c* are brought to the solid line positions. As the discharge sensor 321 turns on in response to the document 69 and the discharge sensor 322 turns on the time B later, the reverse solenoid 316 is turned off. Consequently, the pawl 18*c* assumes the dash-and-dot line position. Substantially simultaneously with the turn-on of the discharge sensor 321, the belt 53 is reversed. When the leading edge of the document 69 reaches the belt 53, the belt 53 having been reversed pulls the document 69 toward the glass platen 17. After the document 69 has been fully transported to the glass platen 17, the turn roller 315 and belt 53 are brought to a stop. Such a flow of the document 69 is indicated by an arrow in FIG. 129C. It is to be noted that a time D is representative of the time when the document 69 turned over by the turn roller 315 arrives at the belt 53.

Figure 127D:
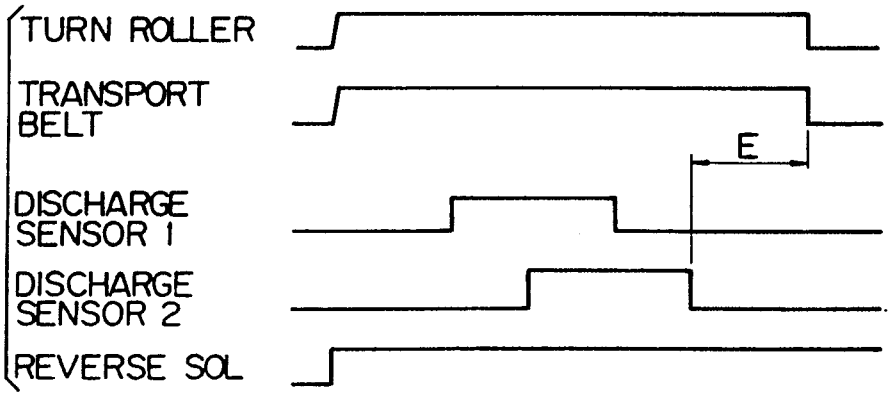

FIG. 127D shows timings for discharging the document 69 to the discharge tray 285 of the document transport unit 10. As shown, the turn roller 315 and belt 53 begin rotating forward (F) at the same time, and the reverse solenoid 316 is turned on at the same time. This moves the pawls 318*a* to 318*c* to the solid line positions. The discharge sensor 321 turns on in response to the document 69, and the discharge sensor 322 turns on the time B later. After the document 69 has moved away from the discharge sensor 322 and, therefore, the sensor 322 has turned off, the turn roller 315 and belt 53 are brought to a stop on the lapse of a time E in which the document 69 will have been released from the discharge roller 319. Consequently, the document 69 is driven out onto the tray 285 of the document transport unit 51. Such a flow of the document 69 is indicated by an arrow in FIG. 129D.

10. General Flow of Job Execution

Figures 1, 130A:
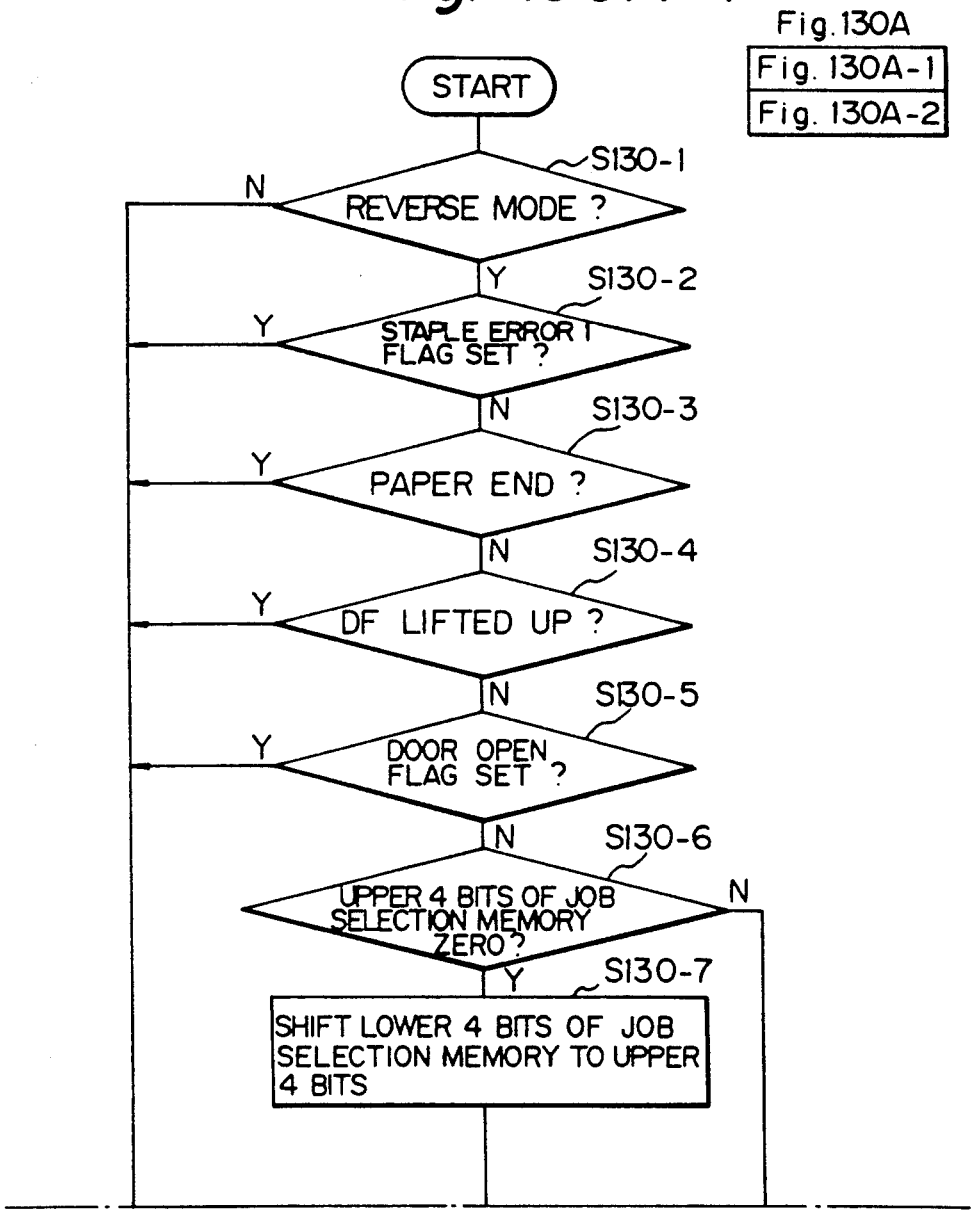
FIGS. 130A, 130B and 131 are flowcharts showing procedures for executing jobs.
Figures 2, 130A:
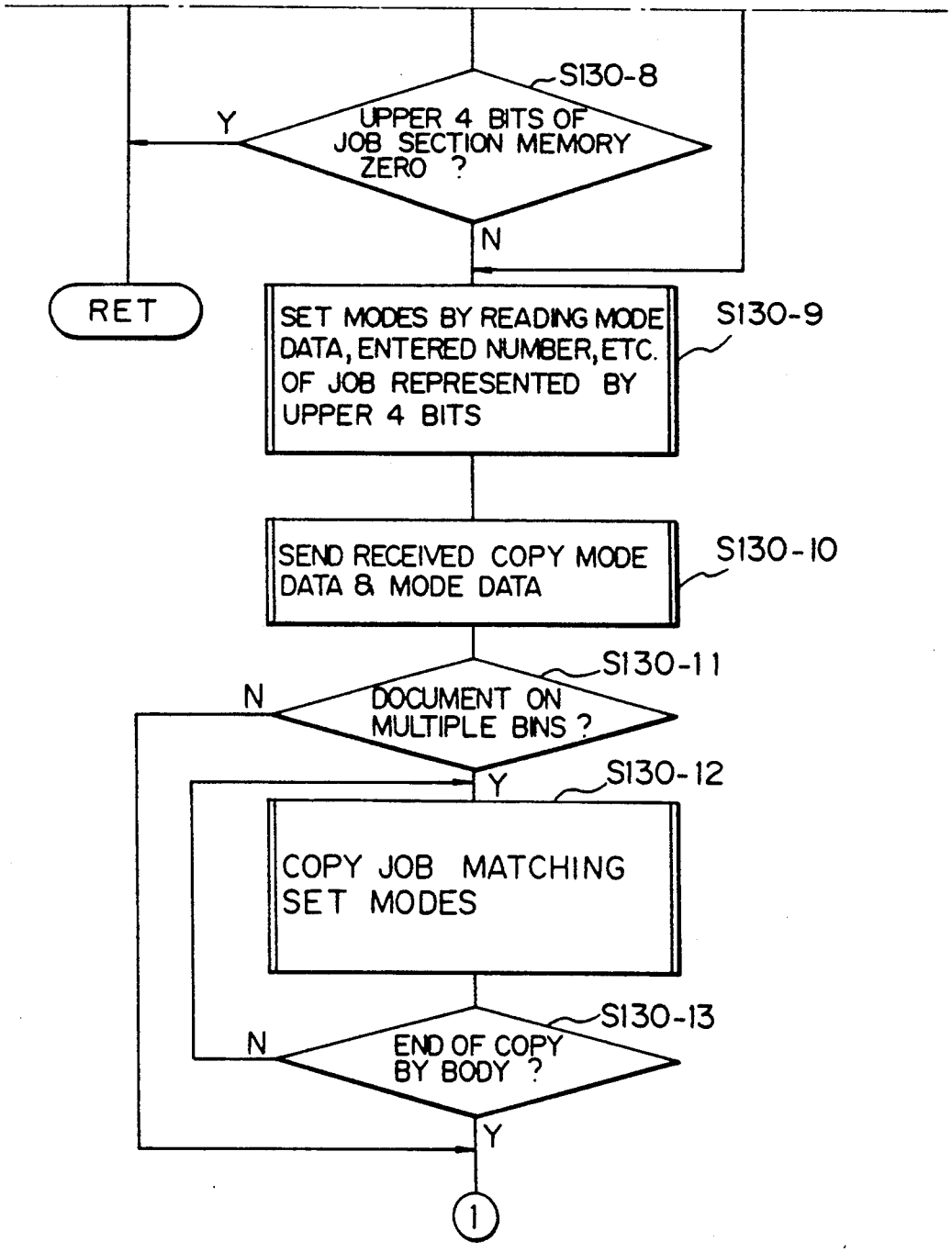
Figure 130B:
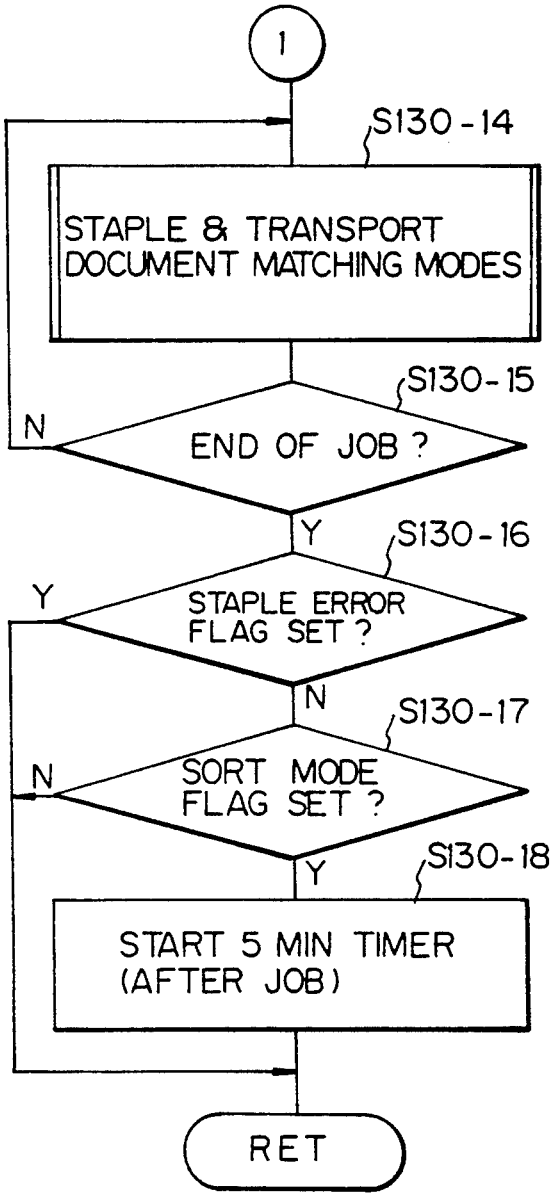

The general procedure for executing individual jobs will be described with reference to FIGS. 130A and 130B. As shown, the reserve mode (S130-1), staple error 1 flag (S130-2), paper end (S130-3), DF lift-up (S130-4), and door open flags (S130-5) are checked. A copying operation is allowed only when the reserve mode is selected, the staple error 1 flag is cleared, paper sheets for copying are left, the cover plate 288 of the document transport unit 51 are positioned on the glass platen 17, and various doors are closed. Then, whether or not the upper four bits of the job select memory are ZERO is determined (S130-6) and, if the answer is YES, the lower bits of the memory are shifted to the upper four bits (S130-7). Then, if the resultant upper four bits of the memory are ZERO is determined (S130-8). If the answer of this step S130-8 is NO, the job mode data, numerical values, and other data represented by the upper four bits are read out of the memory to set a mode (S130-9). After the step S130-9, copy mode data and mode data are transmitted (S130-100, and then whether or not the document bins 201 of the multi-step unit 50 are loaded with documents 69 is determined (S130-11). If the answer of the step S130-11 is YES, a copying operation matching the set mode is repeated until the mode completes (S130-12 and S130-13). In the step S130-12, the CPU 651 of the finisher 11 and the CPU 601 of the document transport unit 10 interchange various data with the CPU 573 of the copier body.

The data to be interchanged as mentioned above are as follows:

(1) From copier CPU 573 to finisher CPU 651:
- (a) motor ON flag
- (b) copy size data (five bits)
- (c) copy transport flag
- (d) staple flag
- (e) bin move flag
- (f) release flag
- (g) received mode data (three bits)

(2) From finisher CPU 651 to copier CPU 573
- (a) mode end flag
- (b) staple under-way flag
- (c) bin position data (five bits)
- (d) copy transport jam flag (in the event of jam)
- (e) discharge OK flag
- (f) release jam flag (in the event of jam)
- (g) discharge jam flag (in the event of jam)

(3) From copier CPU 573 to document transport unit CPU 601
- (a) received copy mode flag (four bits)
- (b) two-sided document flag
- (c) document feed flag
- (d) document reverse flag
- (e) document discharge flag
- (f) document feed start flag
- (g) returned number data (in the event of jam)

(4) From document transport unit CPU 601 to copier CPU 573
- (a) return mode under-way flag
- (b) document set flag
- (c) copy start flag
- (d) document size data (five bits)
- (e) document reverse jam flag
- (f) reverse jam flag
- (g) transport jam flag
- (h) feed jam flag When the copy job is completed as determined in the step S130-13, the stapling operation and the transport of a document matching the set modes are repeated until the job completes (S130-14 and S130-15). After the step S130-15, the states of the staple error flag and sort mode flag are determined (S130-16 and S130-17). If the staple error flag is not set and the sort mode flag is set, the 5-second timer is started on the completion of the job (S130-18), and then the program returns. If the staple error flag is set or if the sort mode flag is not set, the program returns immediately.

On the other hand, the finisher 11 determines whether or not the bins 57 thereof have any remaining sheets thereon (S131-1). If the answer of the step S131-1 is NO, the 5-minute timer is stopped and cleared (S131-8), and the program returns; if otherwise, whether or not the job is under way (S131-2), whether or not the staple error flag is set (S131-3), whether or not The door open flags are set (S131-4), and whether or not the 5-minute timer has counted up (S131-5) are determined. If the job is under way, if the staple error flag is set, if any of the door open flags is set, or if the 5-minute timer has not counted up, the program returns; if otherwise, all the sheets remaining on the bins are stapled (S131-6 and S131-7), the 5-minute timer is cleared (S131-8), and then the program returns.

In summary, a document feeder in accordance with the present invention sequentially moves document supports from the initial position to a document feed position and further to a stand-by position simply by causing drive means to switch over the direction for moving document support moving means. This allows a particular document feeding operation to be effected with each of the document supports. Hence, the document feeder achieves unprecedented productivity and reliability despite the simple and miniature configuration thereof.

Further, a sheet finishing device in accordance with the present invention staples sheets and removes stapled sheets automatically to thereby eliminate the need for manual work and enhance productivity. The stapled sheets removed from sheet accommodating means are collected in sheet receiving means and are, therefore, easy to manage.

Various modifications will become possible for those skilled in the art after receiving the teachings of the present invention without departing from the scope thereof.

What is claimed is:

1. A device for feeding a document to a predetermined position automatically, comprising:
- a plurality of document supports;
- feeding means for feeding the document;
- document support moving means for moving said plurality of document supports sequentially and intermittently;
- drive means for driving said document support moving means; and
- moving means for causing said drive means to drive said document support moving means in one direction to thereby move said document supports from an initial position to a predetermined position, then to drive said document support moving means in the other direction to move said document supports to a document feed position, and to drive, after said feeding means has fed documents, said document support means in said one direction to move said document supports to a stand-by position.

2. A device as claimed in claim 1, wherein said document support moving means comprises a rotatable body.

3. A device for feeding documents to a predetermined position automatically, comprising:
- a plurality of document supports;
- feeding means for feeding the documents;
- document support moving means for moving said plurality of document supports;
- drive means for driving said document support moving means;
- guide means for guiding in predetermined directions said document supports being moved by said document support moving means;
- switching means for switching said predetermined directions from each other, wherein said predetermined directions comprise an upward and downward direction and a direction in which said document supports are moved to a document feed position;

pressing means for pressing the documents, said pressing means being movable between a first position in which the documents are pressed by said pressing means and a second position in which said pressing means is released from the documents; and sensor means for sensing said document supports positioned at said document feed position, said pressing means being selectively moved to one of said first position and said second position in response to an output of said sensor means.

4. A sheet finishing device comprising:

a plurality of sheet accommodating means arranged one above another, each accommodating a plurality of sheets;

sorting means for sorting sheets to said plurality of sheet accommodating means;

stapling means for stapling sheets accommodated in said plurality of sheet accommodating means; and sheet removing means for removing sheets stapled by said stapling means in said plurality of sheet accommodating means, both an upper sheet accommodating means and a lower sheet accommodating means being moved away from a sheet accommodating means disposed between said upper and lower sheet accommodating means which accommodates sheets to be stapled by said stapling means.

5. A sheet finishing device as claimed in claim 4, further comprising sheet receiving means for collecting sheets removed from said plurality of sheet accommodating means.

6. A sheet finishing device as claimed in claim 5, wherein said sheet removing means comprises a mechanism for dropping said stapled sheets onto said sheet receiving means.

* * * * *